US012693093B2

(12) United States Patent
Swensen et al.

(10) Patent No.: US 12,693,093 B2
(45) Date of Patent: Jul. 28, 2026

(54) HUNTING AND CARRYING DEVICES, ASSEMBLIES, SYSTEMS, AND RELATED METHODS

(71) Applicant: HUKR LLC, Cedar Hills, UT (US)

(72) Inventors: Michael Swensen, Cedar Hills, UT (US); Kendall Hal Seymour, Pleasant Grove, UT (US); Devin Miller, Eagle Mountain, UT (US); Joshua Reinholdt Bladh, Provo, UT (US); Gavin Wallin, Eagle Mountain, UT (US)

(73) Assignee: HUKR LLC, Cedar Hills, UT (US)

( * ) Notice: Subject to any disclaimer, the term of this patent is extended or adjusted under 35 U.S.C. 154(b) by 32 days.

(21) Appl. No.: 18/639,050

(22) Filed: Apr. 18, 2024

(65) Prior Publication Data

US 2024/0353198 A1 Oct. 24, 2024

Related U.S. Application Data

(60) Provisional application No. 63/496,888, filed on Apr. 18, 2023.

(51) Int. Cl.
*F41C 33/00* (2006.01)
*A45F 3/04* (2006.01)
*A45F 3/00* (2006.01)

(52) U.S. Cl.
CPC ..... *F41C 33/007* (2013.01); *A45F 3/04* (2013.01); *A45F 2003/003* (2013.01)

(58) Field of Classification Search
CPC ..... F41C 33/002; F41C 33/007; A45F 5/021
USPC ..... 224/149–150, 913; 211/64
See application file for complete search history.

(56) References Cited

U.S. PATENT DOCUMENTS 1,163,307 A * 12/1915 Arnold ..... B68C 1/20 224/913
2,423,531 A 7/1947 Theis
2,919,058 A * 12/1959 William ..... B60R 7/14 224/570
3,127,075 A * 3/1964 Yavello ..... F41C 33/003 224/913
3,653,564 A * 4/1972 Carter ..... F41C 33/001 224/150
5,265,781 A * 11/1993 Nichols ..... F41C 33/0227 224/198
5,927,574 A * 7/1999 Ruesink ..... F41C 33/003 224/907

(Continued)

OTHER PUBLICATIONS

Trademark specimen filed by applicant on Jun. 9, 2023 in conjunction with U.S. TM Appl. No. 97424616, available online at https://tsdr.uspto.gov/ #caseNumber=97424616&caseSearchType=US_APPLICATION&caseType=DEFAULT&searchType=statusSearch (select Documents tab then the Specimen link dated Jun. 9, 2023), last accessed Apr. 16, 2024.

(Continued)

*Primary Examiner* — Scott T Mcnurlen
(74) *Attorney, Agent, or Firm* — Law Office of Paul B. Johnson; Paul B. Johnson

(57) ABSTRACT

A device may include a back plate comprising one or more clip receivers and a plurality of slots. A plurality of straps may be included and may be configured to pass through the slots to releasably secure the back plate to a backpack. The one or more clip receivers may be configured to receive a clip to releasably secure a firearm to the back plate.

3 Claims, 85 Drawing Sheets

(56) References Cited

U.S. PATENT DOCUMENTS

| | | | | |
|---|---|---|---|---|
| 6,957,648 | B1 | 10/2005 | Adcock | |
| 6,988,755 | B2 * | 1/2006 | Lukas | F41A 35/00 294/82.11 |
| 7,185,796 | B2 * | 3/2007 | Parsons | A45F 5/02 248/113 |
| 7,434,773 | B1 | 10/2008 | Minjares | |
| 7,526,842 | B2 | 5/2009 | Wemmer | |
| 7,828,180 | B2 | 11/2010 | Slesar | |
| 9,194,655 | B1 | 11/2015 | Cha | |
| 9,714,810 | B1 * | 7/2017 | Nowlin | F41C 33/0236 |
| 10,072,906 | B2 | 9/2018 | Eberle | |
| 10,085,544 | B2 | 10/2018 | Schessel | |
| 10,231,533 | B2 | 3/2019 | Vaughan | |
| 10,544,897 | B2 | 1/2020 | Nesin et al. | |
| 11,060,657 | B1 | 7/2021 | Frye et al. | |
| 11,357,312 | B2 | 6/2022 | Hasewaga | |
| 11,585,634 | B2 | 2/2023 | Wessels et al. | |
| 11,614,304 | B2 * | 3/2023 | Shirlen | F41C 33/007 224/150 |
| 11,639,839 | B1 | 5/2023 | Swensen | |
| 2007/0145092 | A1 | 6/2007 | Eberle | |
| 2010/0012691 | A1 * | 1/2010 | Hyle | F41C 33/005 224/149 |
| 2012/0073556 | A1 | 3/2012 | Knowles | |
| 2012/0174382 | A1 | 7/2012 | Dering | |
| 2013/0233292 | A1 | 9/2013 | Gardner | |
| 2014/0361143 | A1 | 12/2014 | May | |
| 2015/0305478 | A1 | 10/2015 | Krol | |
| 2017/0102207 | A1 | 4/2017 | Janzen | |
| 2017/0153086 | A1 | 6/2017 | Eberle | |
| 2018/0092455 | A1 | 4/2018 | Kim et al. | |
| 2019/0011076 | A1 | 1/2019 | Nesin et al. | |
| 2020/0124378 | A1 | 4/2020 | Baskins | |
| 2020/0278174 | A1 | 9/2020 | Gill et al. | |
| 2021/0270561 | A1 | 9/2021 | Ochs | |
| 2021/0285740 | A1 * | 9/2021 | Wessels | F41C 33/007 |
| 2022/0082350 | A1 | 3/2022 | Padilla et al. | |
| 2022/0390202 | A1 * | 12/2022 | Ray | F41C 33/007 |
| 2022/0403862 | A1 | 12/2022 | Justice et al. | |
| 2023/0139525 | A1 | 5/2023 | Stocks | |
| 2023/0280126 | A1 | 9/2023 | Swensen | |
| 2023/0280128 | A1 | 9/2023 | Swensen | |
| 2023/0296346 | A1 | 9/2023 | Stallings | |
| 2024/0044608 | A1 | 2/2024 | Nelson | |
| 2024/0418473 | A1 | 12/2024 | Swensen | |

OTHER PUBLICATIONS

Condor MOPC Gen II Modular Operator Plate Carrier, on sale by GALLS in the U.S. at least as early as Jul. 24, 2023, available online at https://www.galls.com/condor-mopc-modular-operator-plate-carrier, retrieved and last visited Nov. 29, 2024.

RSA QD Rail Sling Attachment QD, on sale in the U.S. by MAGPUL at least as early as 2023, available online at https://magpul.com/rsa-qd-rail-sling-attachment.html?mp_global_color=118, retrieved and last visited Nov. 29, 2024.

MS1 Padded Sling, on sale in the U.S. by MAGPUL at least as early as 2023, available online at https://magpul.com/ms1-padded-sling.html?mp_global_color=118, retrieved and last visited Nov. 29, 2024.

BCM KeyMod Quick Detachable Sling Mount, on sale in the U.S. by Bravo Company USA at least as early as 2018, available online at https://bravocompanyusa.com/bcm-keymod-quick-detachable-sling-mount/, retrieved and last visited Nov. 29, 2024.

BCM Quick Detach Sling Swivel (Heavy Duty Design), on sale in the U.S. by Bravo Company USA at least as early as 2019, available online at https://bravocompanyusa.com/bcm-quick-detach-sling-swivel-heavy-duty-design/, retrieved and last visited Nov. 29, 2024.

Elements that are believed to be prior art coupler receiver and threaded insert elements provided by an overseas manufacturer, believed to be on sale or disclosed prior to Nov. 29, 2024.

"Parts of a Compound Bow," published online by mikeoutdoors.com at least as early as Jan. 27, 2019, available online at http://mikeoutdoors.com/parts-of-a-compound-bow, retrieved and last accessed Aug. 28, 2024.

Trademark specimen filed by applicant on May 23, 2022 in conjunction with U.S. Trademark Application No. 97424631, available online at https://tsdr.uspto.gov/#caseNumber=97424631+&caseSearchType=US_APPLICATION&caseType=DEFAULT&searchType=statusSearch (select Documents tab then the Specimen link dated May 23, 2022), last accessed Apr. 16, 2024.

Trademark specimen filed by applicant on Jun. 9, 2023 in conjunction with U.S. Trademark Application No. 97424631, available online at https://tsdr.uspto.gov/#caseNumber=97424631+&caseSearchType=US_APPLICATION&caseType=DEFAULT&searchType=statusSearch (select Documents tab then the Specimen link dated Jun. 9, 2023), last accessed Apr. 16, 2024.

"Bow Anatomy 101: Parts of a Compound Bow," published online by n1outdoors.com at least as early as Aug. 21, 2021, available online at https://n1outdoors.com/parts-of-a-compound-bow/, retrieved and last accessed Aug. 28, 2024.

* cited by examiner

HUNTING AND CARRYING DEVICES, ASSEMBLIES, SYSTEMS, AND RELATED METHODS

CROSS REFERENCE TO RELATED APPLICATIONS

This document claims the benefit of the filing date of U.S. Provisional Patent Application No. 63/496,888, entitled "Hunting and Carrying Devices, Assemblies, Systems, and Related Methods," naming as first inventor Michael Swensen, which was filed on Apr. 18, 2023, the disclosure of which is hereby incorporated entirely herein by reference.

BACKGROUND

1. Technical Field

Aspects of this document relate generally to hunting and carrying devices, assemblies, systems, and related methods, such as devices and methods used in conjunction with hunting and/or outdoor adventures and/or for carrying a variety of items.

2. Background Art

Rifles, bows, and other weapons exist for hunting and/or for military purposes. Backpacks, including hiking backpacks and hunting backpacks, exist in the art, and some elements exist in the art for using a backpack and/or other elements to assist in carrying a rifle, bow, or other weapon. Hiking/trekking poles exist in the art. Hunting blinds exist in the art for covering/obscuring a hunter. Water bottles exist in the art.

SUMMARY

In implementations, the techniques described herein relate to a carrying assembly, including: a back plate including: one or more clip receivers, and; a plurality of slots; and a plurality of straps, each strap configured to pass through one of the slots and configured to secure the back plate to a backpack; wherein the one or more clip receivers are configured to receive a clip to secure a firearm to the back plate.

In implementations, the techniques described herein relate to a carrying assembly, wherein each clip receiver includes an opening facing toward a top of the back plate.

In implementations, the techniques described herein relate to a carrying assembly, further including a hook coupled with one of the straps and configured to secure a top of the back plate to a carrying handle of the backpack.

In implementations, the techniques described herein relate to a carrying assembly, further including a firearm strap assembly including the clip and further including a strap, the strap configured to secure the clip to the firearm.

In implementations, the techniques described herein relate to a carrying assembly, wherein the strap includes hook-and-loop fasteners to secure the strap to the firearm.

In implementations, the techniques described herein relate to a carrying assembly, wherein the firearm strap assembly further includes a through-hole configured to receive a protrusion of the firearm.

In implementations, the techniques described herein relate to a carrying assembly, further including a second carrying assembly including the clip and further including at least one hang bar, the at least one hang bar configured to hang the firearm thereon.

In implementations, the techniques described herein relate to a carrying assembly, wherein the at least one hang bar includes a plurality of hang bars coupled with the clip, and wherein the plurality of hang bars are rotatable relative to the clip.

In implementations, the techniques described herein relate to a carrying assembly, wherein the back plate is substantially flat.

In implementations, the techniques described herein relate to a carrying assembly, wherein the back plate is formed of a rigid polymer.

In implementations, the techniques described herein relate to a carrying assembly, wherein the one or more clip receivers are positioned at different heights between a top and a bottom of the back plate.

In implementations, the techniques described herein relate to a carrying assembly, wherein the plurality of slots includes at least one slot proximate a top of the back plate and at least one slot proximate a bottom of the back plate.

In implementations, the techniques described herein relate to a carrying assembly, further including a cradle assembly including a cradle and at least one cradle strap configured to releasably secure the cradle to the back plate or at least one of the plurality of straps, wherein the cradle is configured to receive a butt of a gun and is further configured to receive a bottom portion of a hunting bow.

In implementations, the techniques described herein relate to a carrying assembly, wherein the cradle includes an upper edge and a side flap which, when alternated from a first position to a second position, exposes a lower edge, and wherein the exposed lower edge is configured to allow the bottom portion of the hunting bow to partially extend out of a side of the cradle instead of only out of a top of the cradle.

In implementations, the techniques described herein relate to a carrying assembly, wherein the cradle assembly includes one or more couplers configured to releasably secure the flap alternately between the first position and the second position.

In implementations, the techniques described herein relate to a carrying assembly, including: a rigid back plate including one or more clip receivers configured to receive a clip to secure a firearm to the back plate, each clip receiver including an opening facing a top of the back plate; and the clip.

In implementations, the techniques described herein relate to a carrying assembly, wherein the back plate includes a plurality of slots, the carrying assembly further includes a plurality of straps, and the straps are configured to secure the back plate to a backpack.

In implementations, the techniques described herein relate to a carrying assembly, further including a backpack, wherein the rigid back plate is integrally formed with the backpack or is permanently affixed thereto.

In implementations, the techniques described herein relate to a method of use of a carrying assembly, including: providing a back plate including: one or more clip receivers, and; a plurality of slots; securing a plurality of straps to the back plate by passing each strap through one of the slots; using the straps, securing the back plate to a backpack; securing a clip into one of the one or more clip receivers; and securing a firearm to the back plate using the clip.

In implementations, the techniques described herein relate to a method, further including coupling a cradle assembly with the back plate or at least one of the plurality of straps, the cradle assembly including a cradle, and inserting a butt of a gun or a bottom portion of a hunting bow into the cradle.

General details of the above-described implementations, and other implementations, are given below in the DESCRIPTION, the DRAWINGS, the CLAIMS and the ABSTRACT.

BRIEF DESCRIPTION OF THE DRAWINGS

Implementations will be discussed hereafter using reference to the included drawings, briefly described below, wherein like designations refer to like elements. The drawings are not necessarily drawn to scale.

FIG. 118 is a front, right side, top view of elements of a clip receiver assembly of the pole clip system of FIG. 125;

FIG. 119 is a rear, top, left side view of the elements of FIG. 118;

FIG. 120 is an exploded top, right side, rear view of clip receiver assembly elements of the pole clip system of FIG. 125;

FIG. 121 is an assembled top, right side, front view of clip receiver assembly elements of the pole clip system of FIG. 125;

FIG. 122 is a front, top, right side view of clip assembly elements of the pole clip system of FIG. 125;

FIG. 123 is a rear, top, left side view of the clip assembly elements of FIG. 122;

Figure 11B:
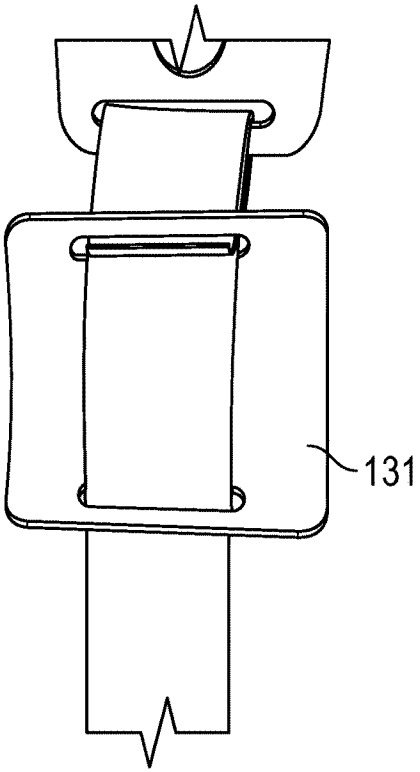
FIG. 11B is a rear view of a portion of the firearm strap assembly of FIG. 11A.
Figure 11A:
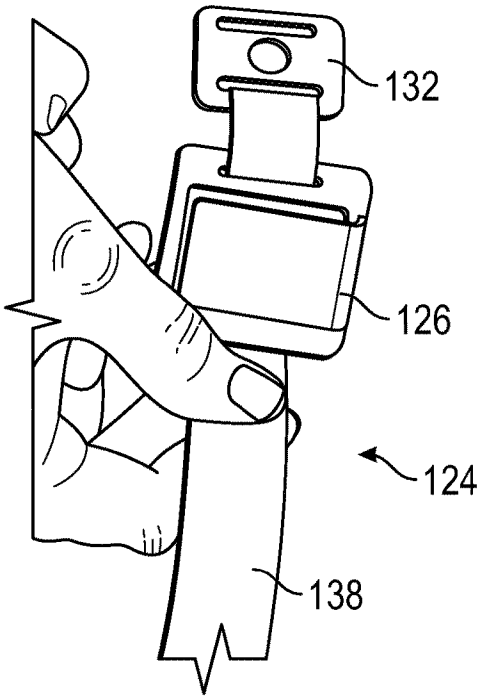
FIG. 11A is a front view of a portion of a firearm strap assembly being held by a user.
Figure 125:
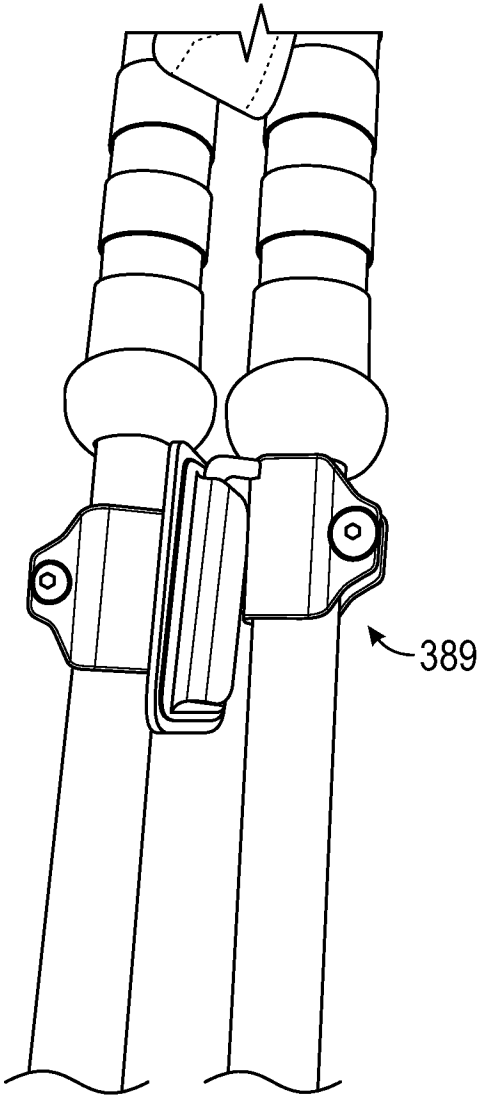
Figure 124:
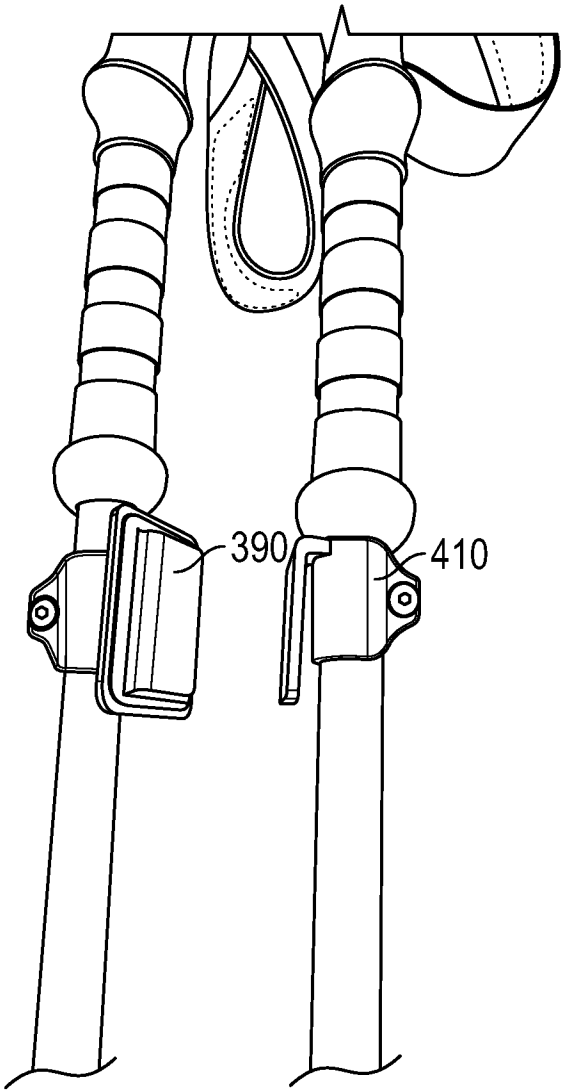
Figure 127:
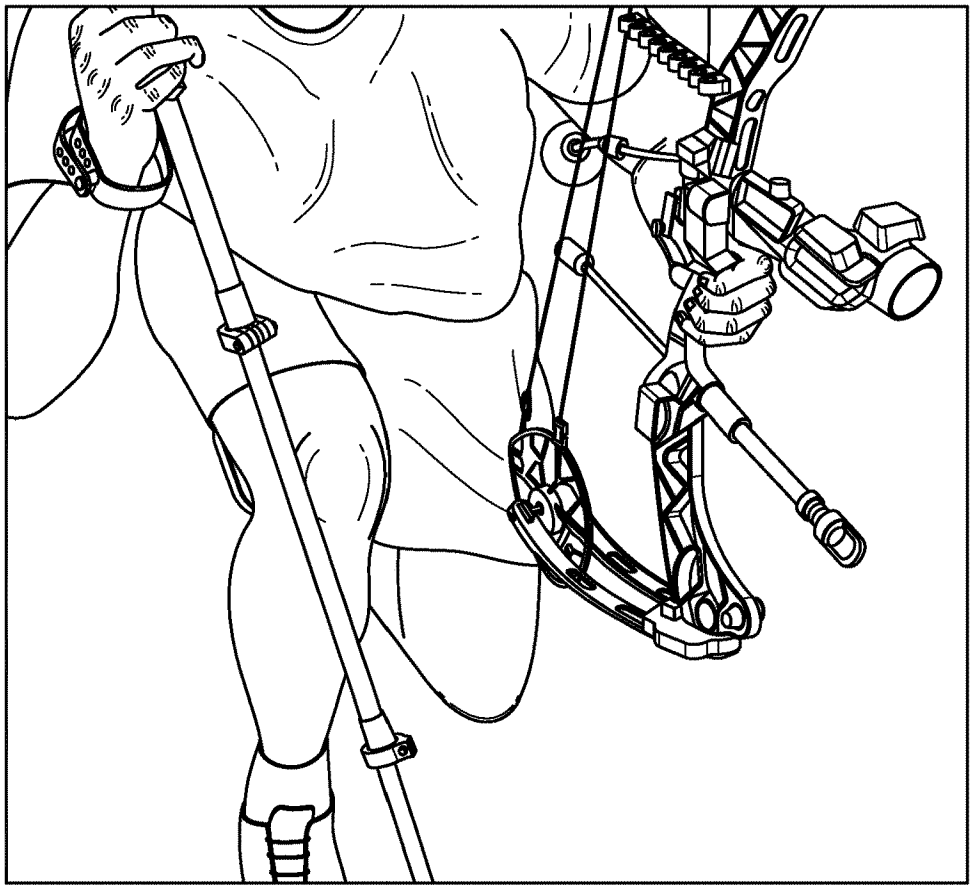
Figure 126:
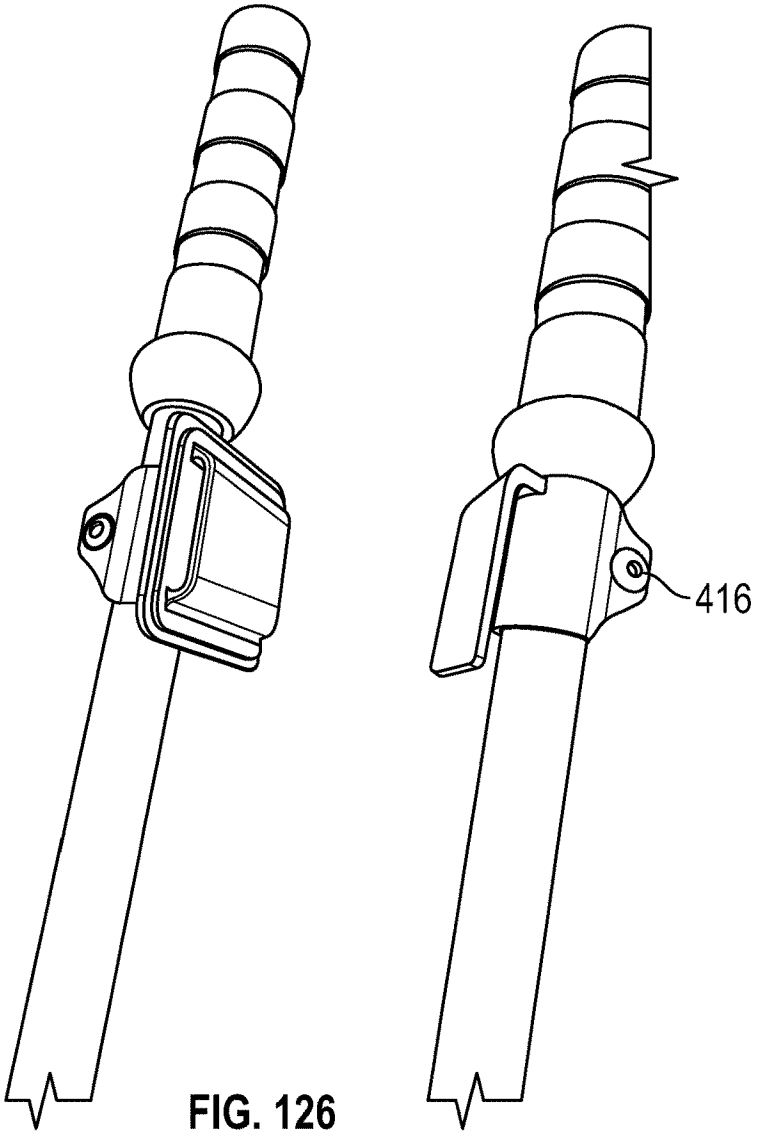
Figure 128:
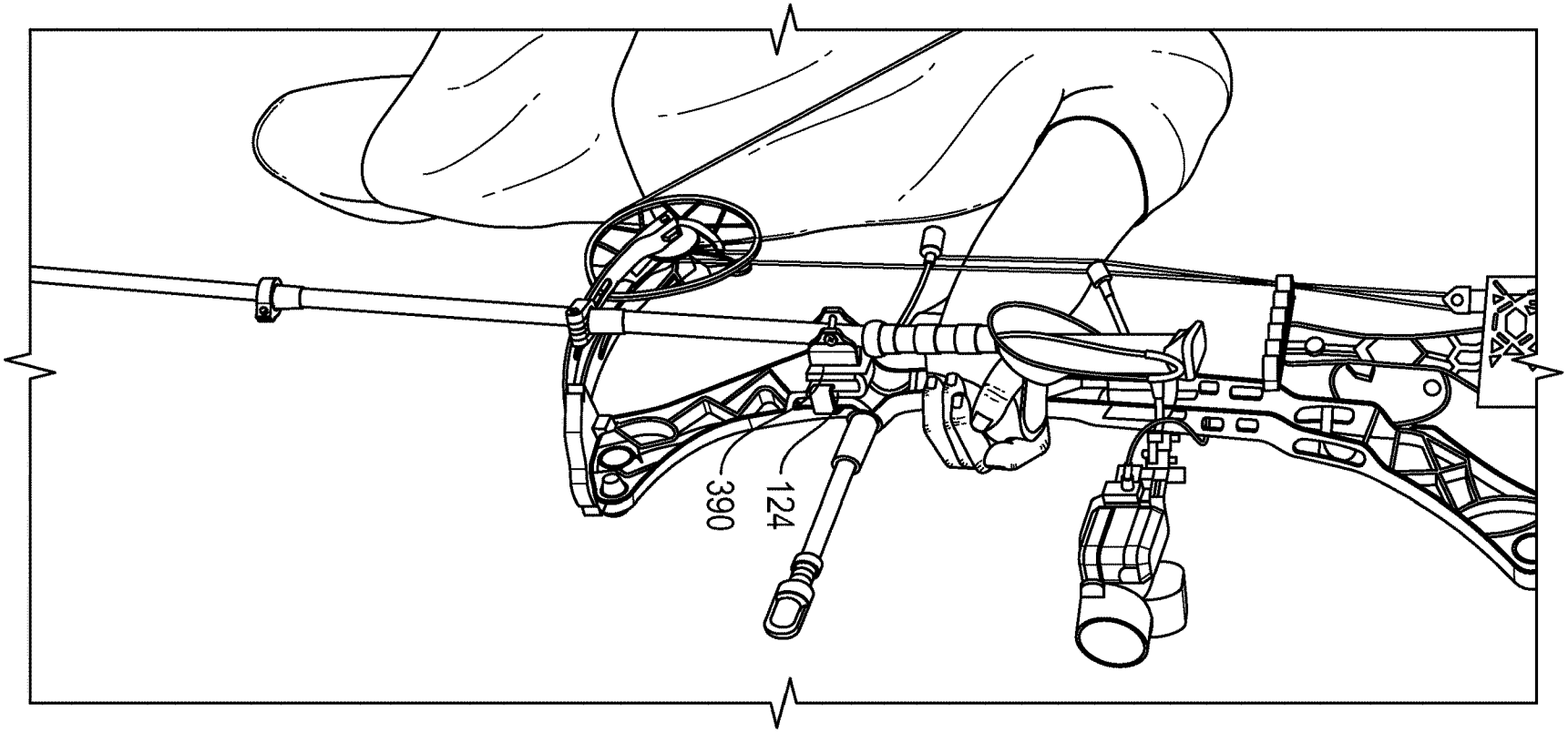
Figure 129:
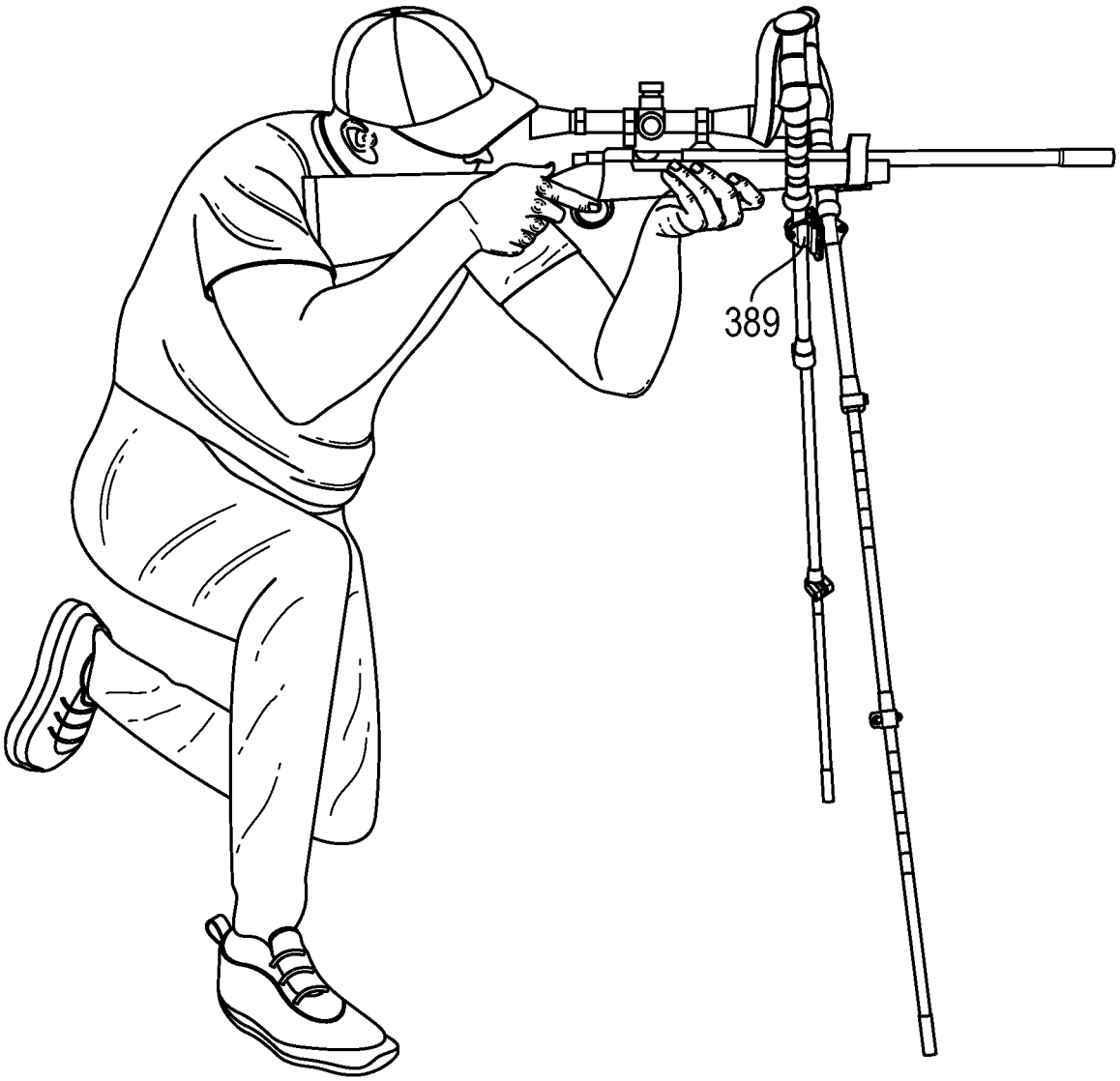
Figure 130:
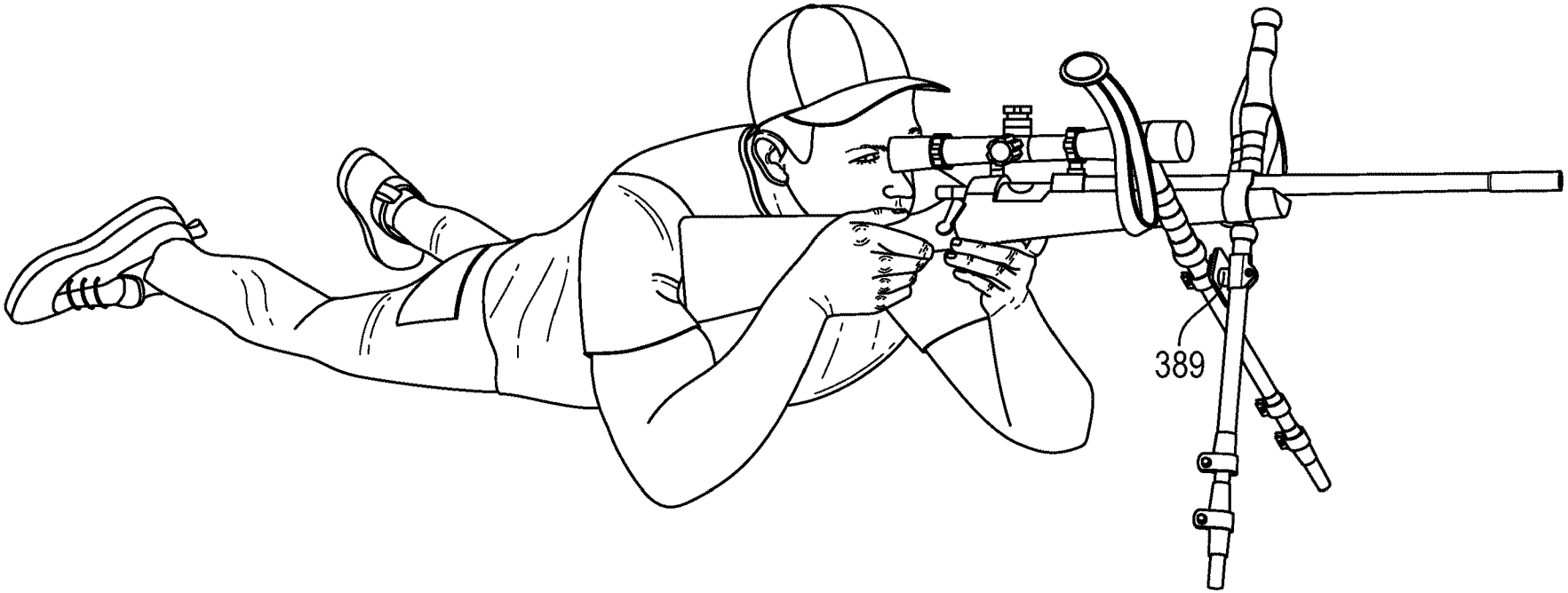
Figure 131:
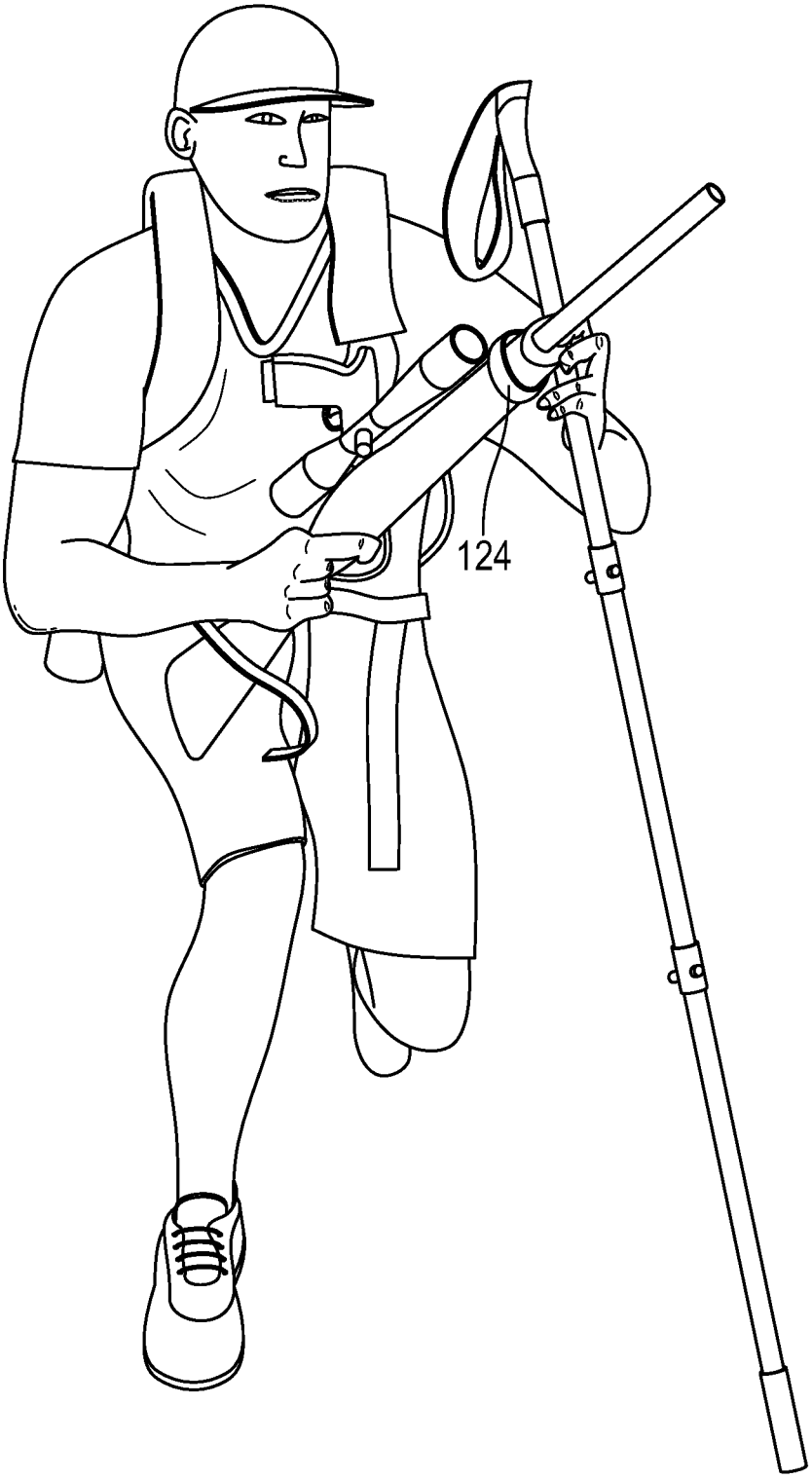
Figure 132:
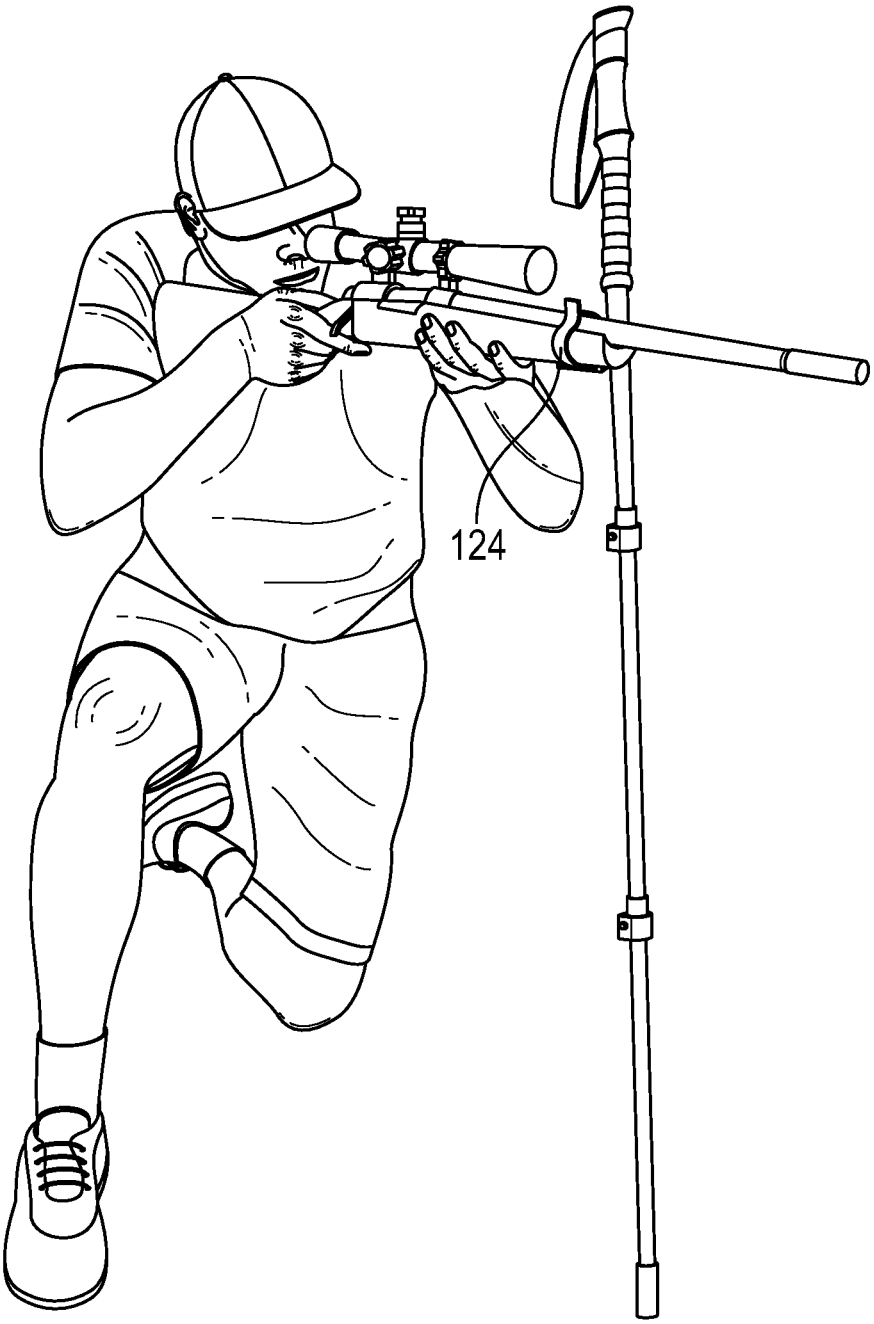
Figure 133:
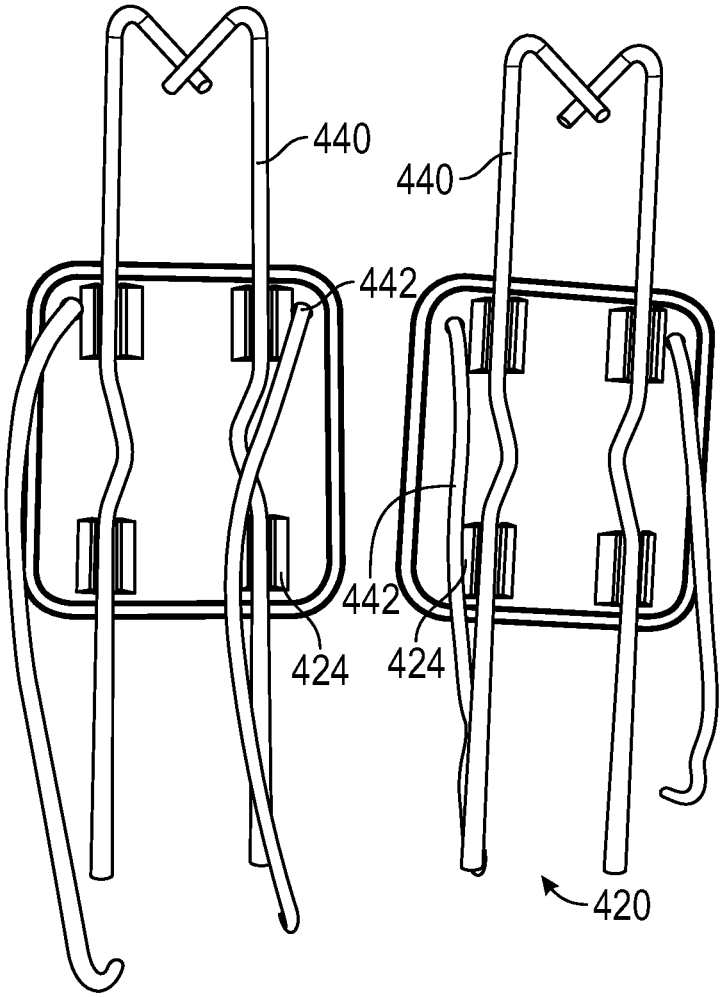
Figure 135:
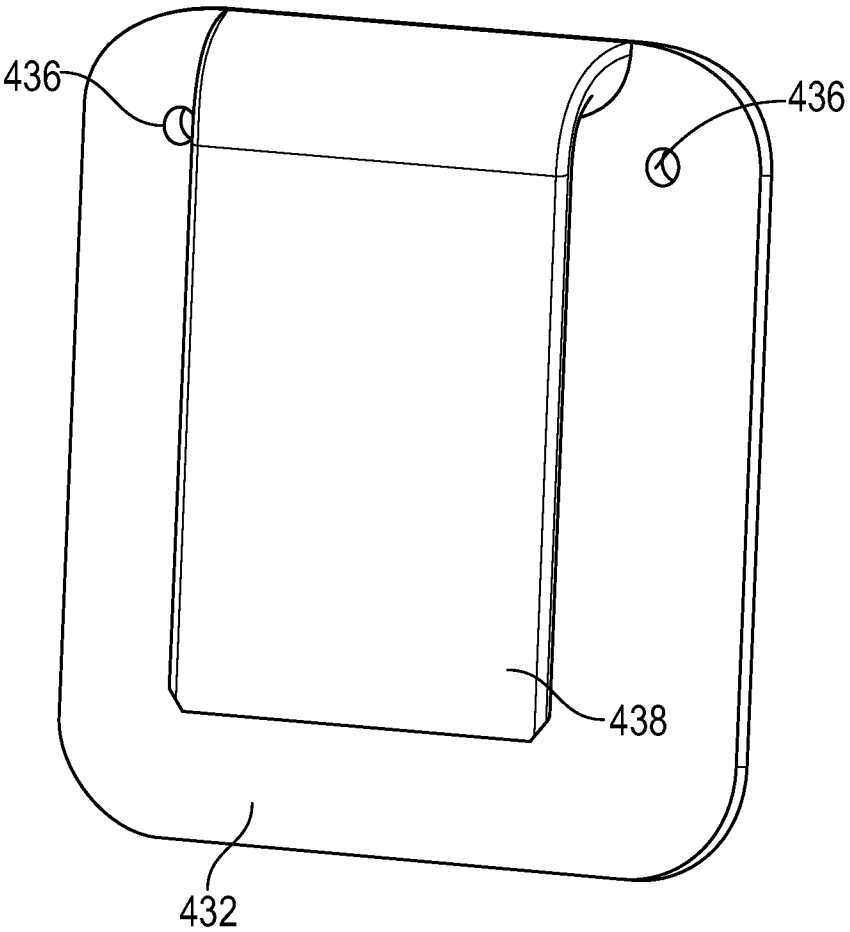
Figure 134:
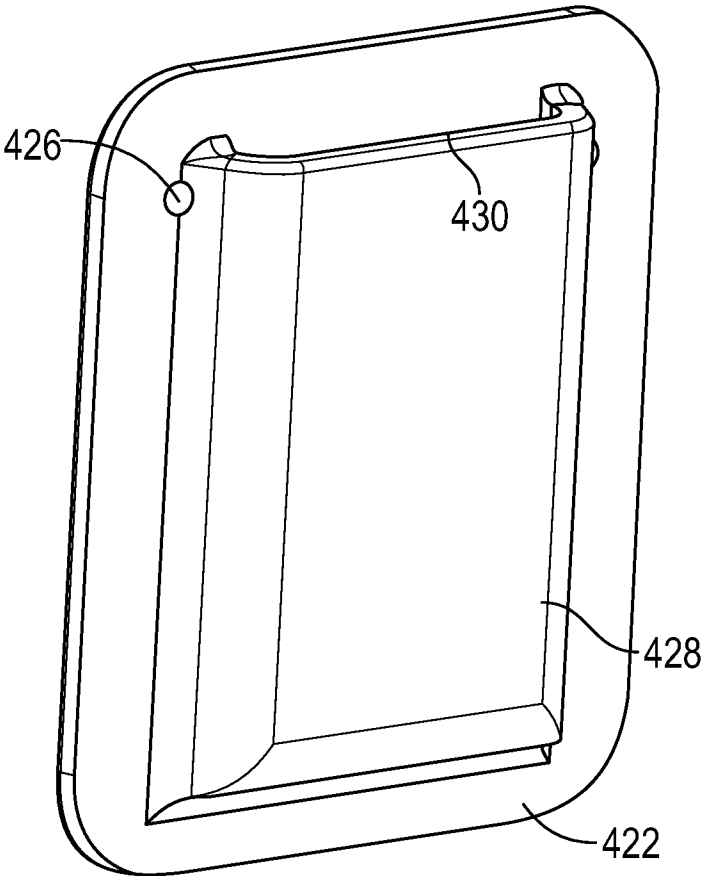
Figure 136:
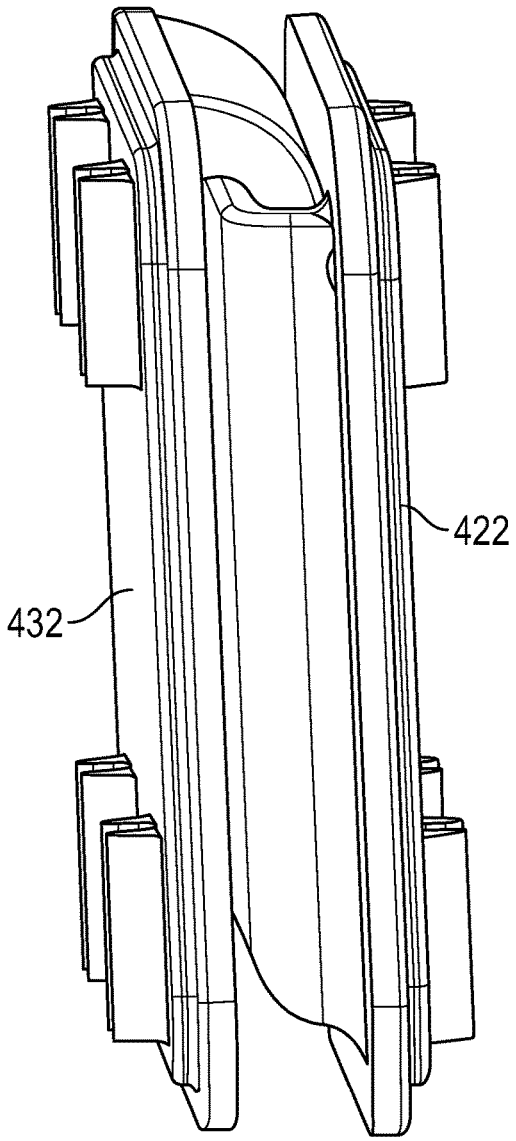
Figure 137:
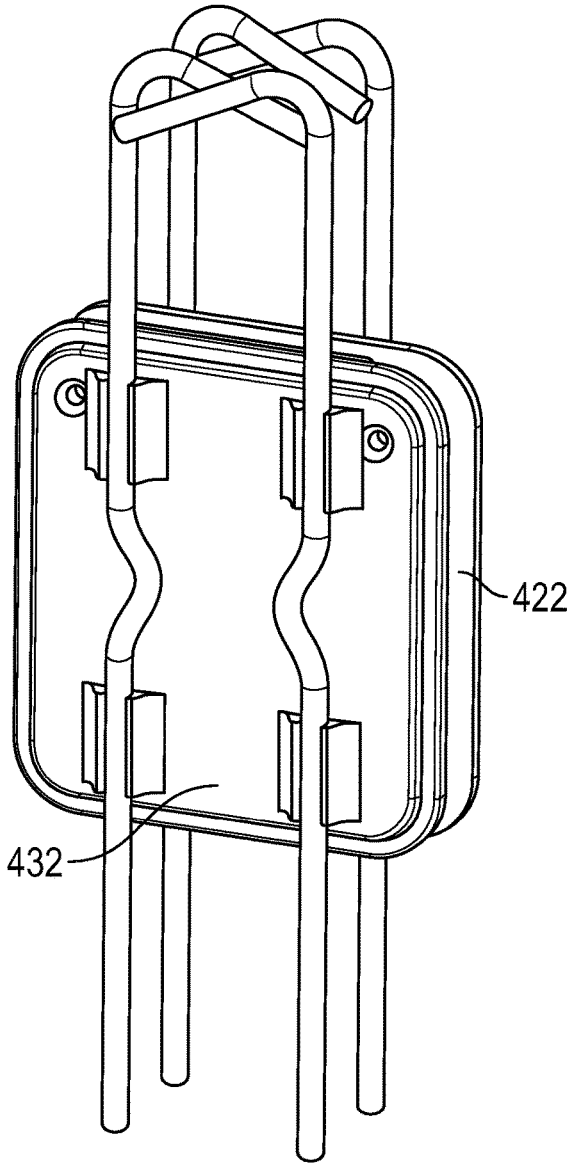
Figure 139:
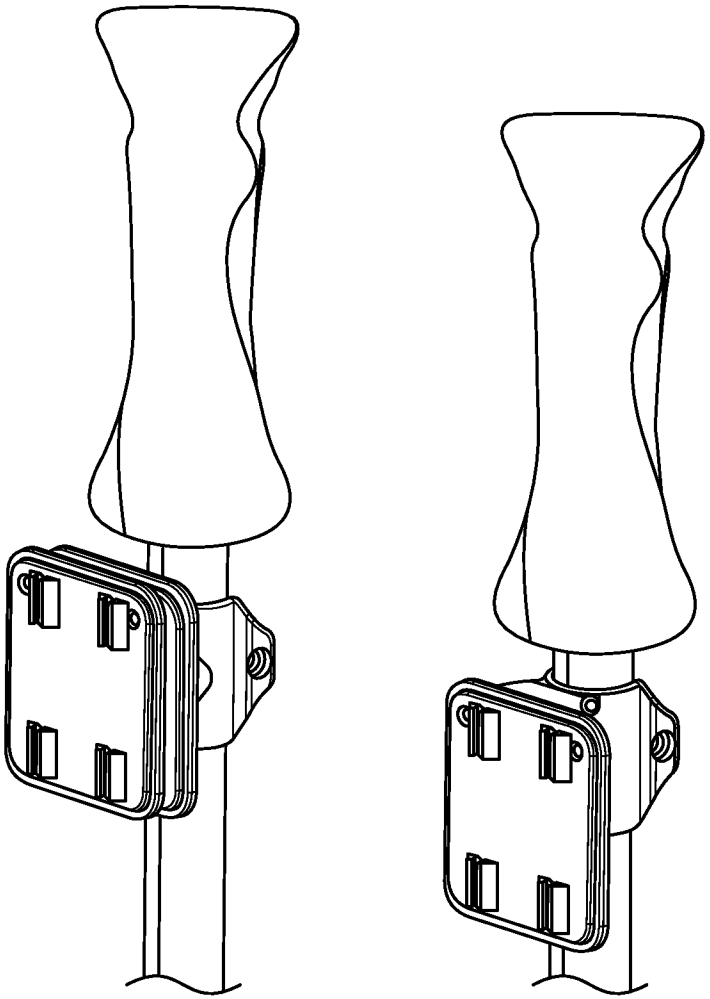
Figure 138:
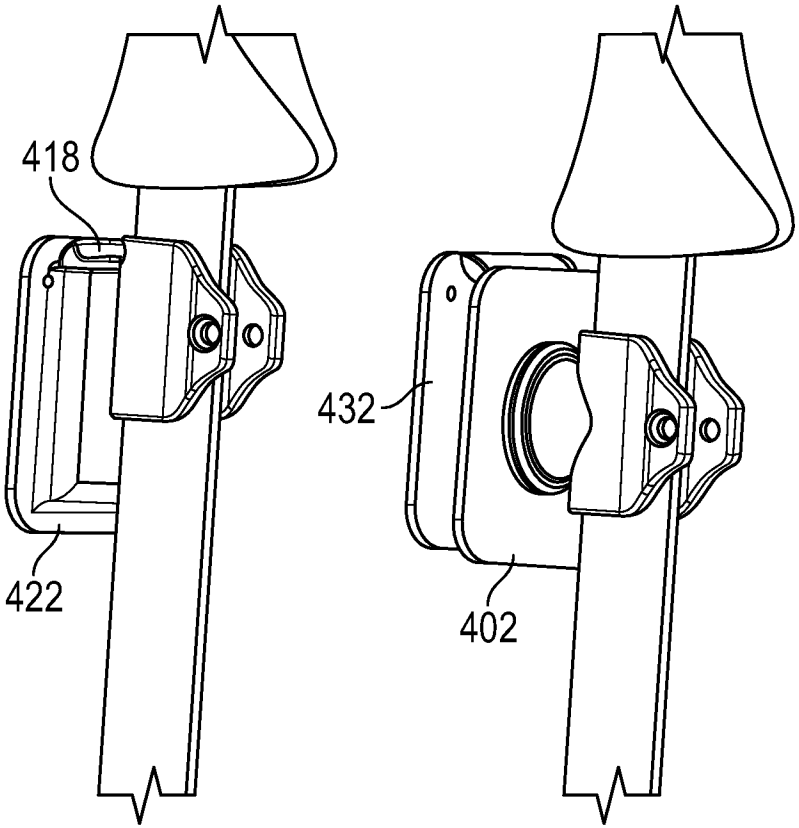
Figure 140:
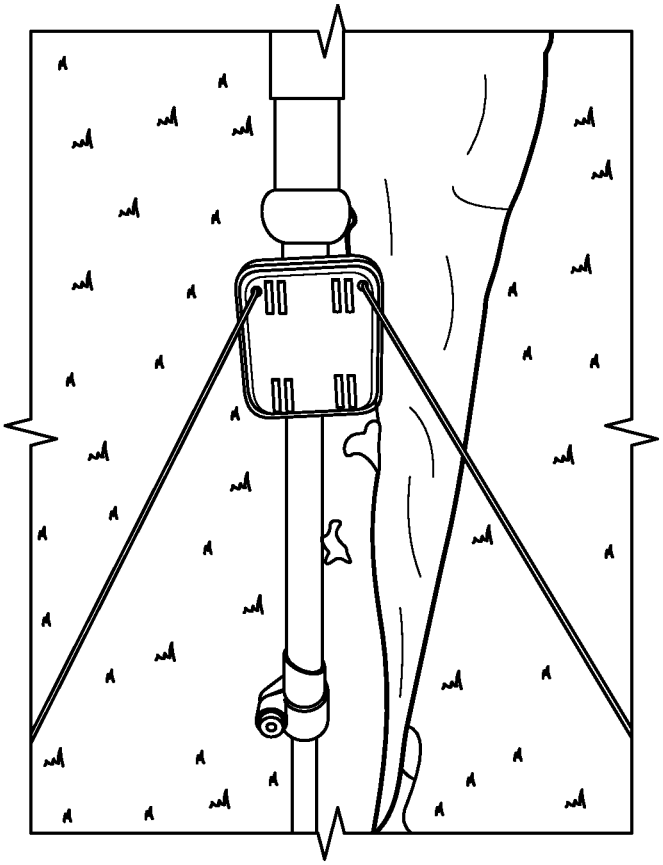
Figure 141:
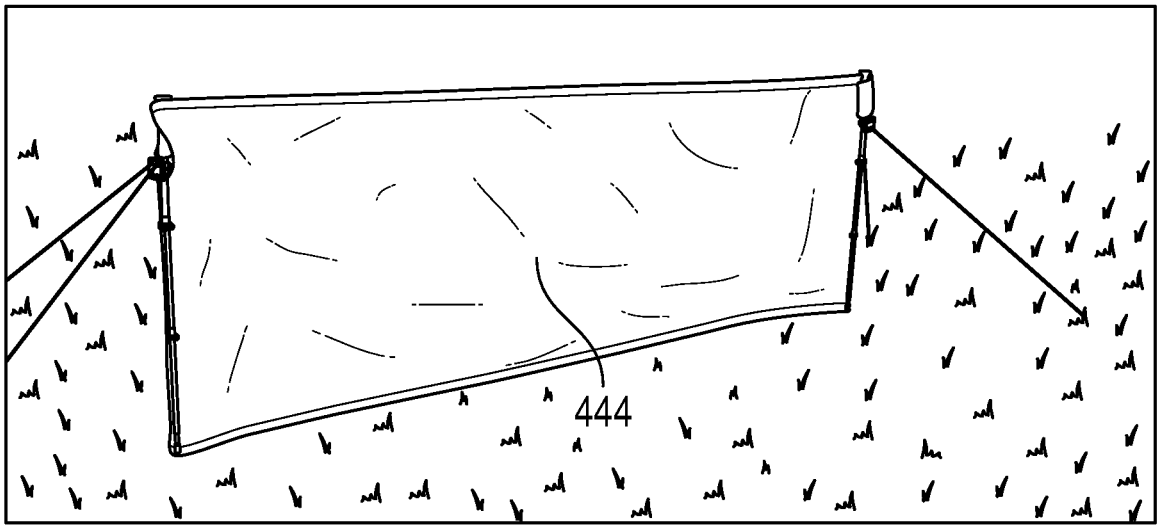
Figure 142:
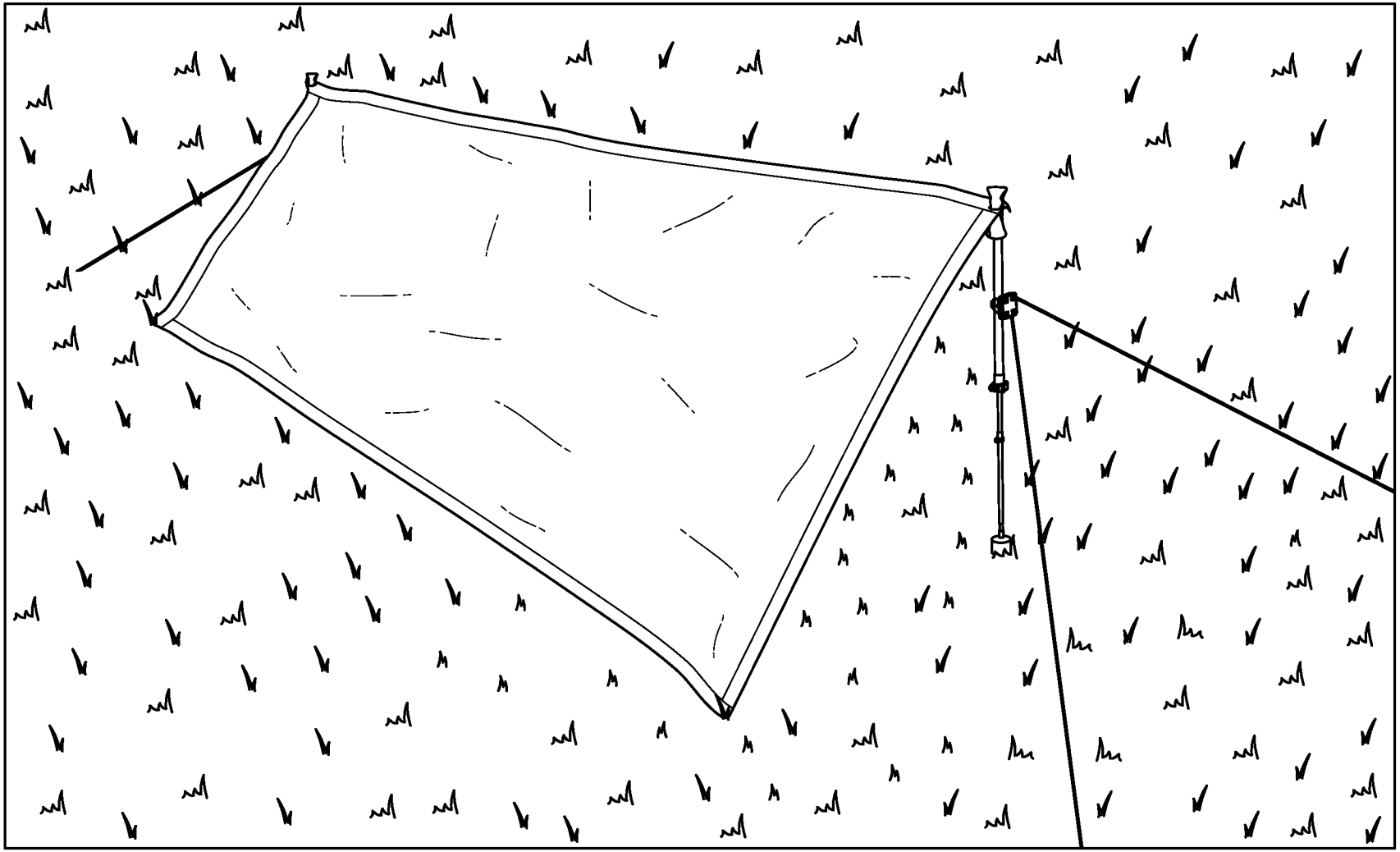
Figure 143:
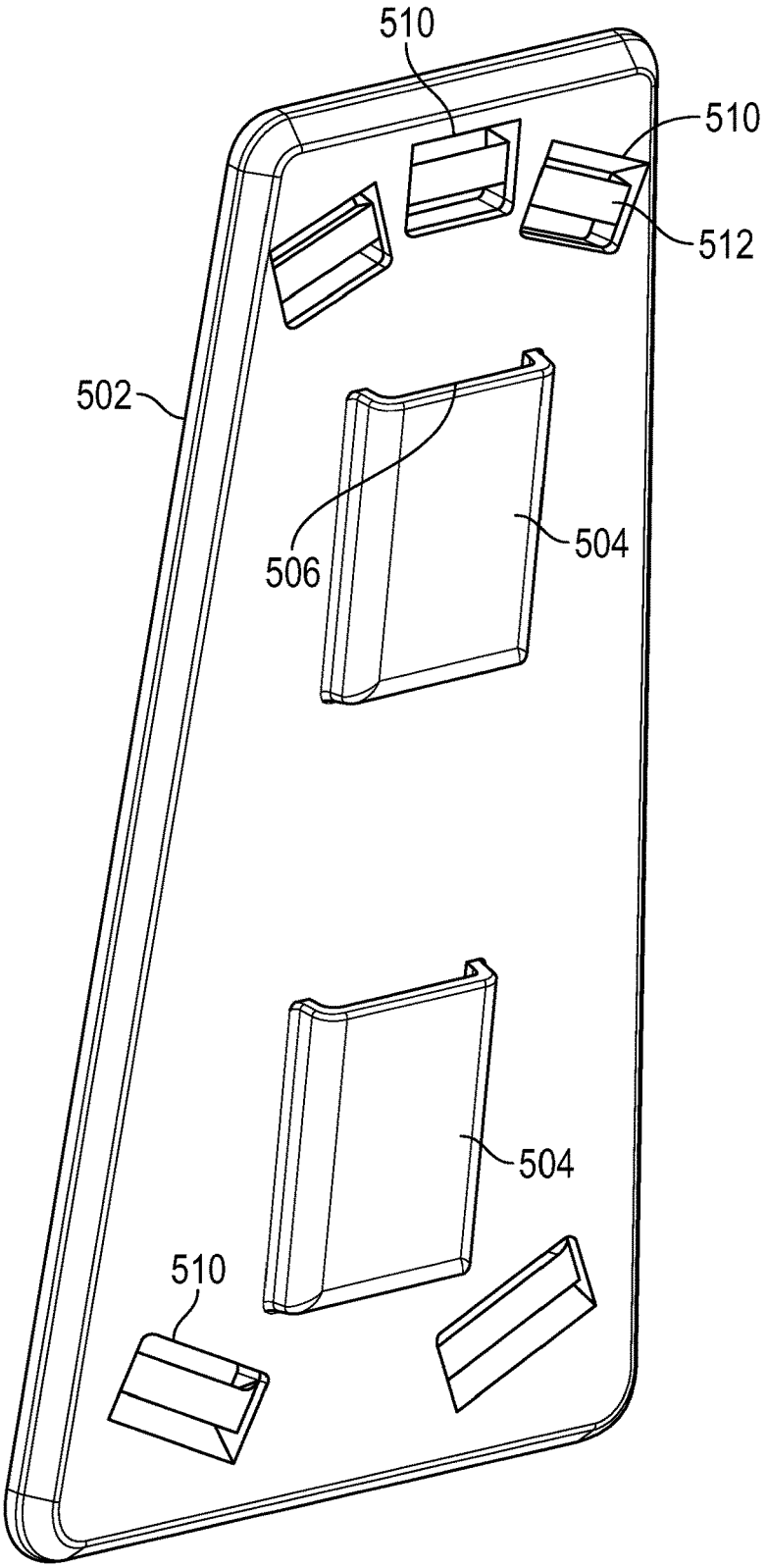
Figure 144:
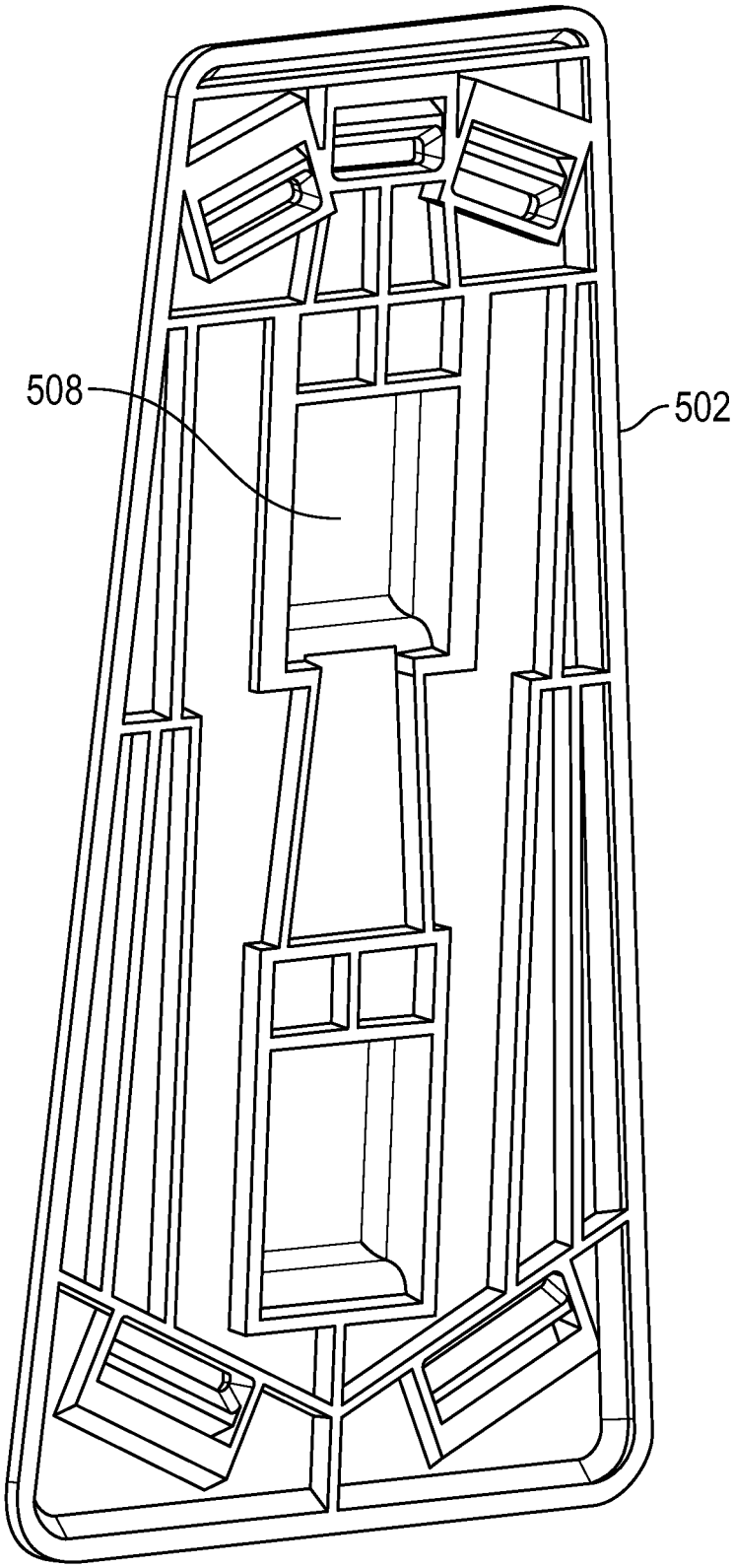
Figure 145:
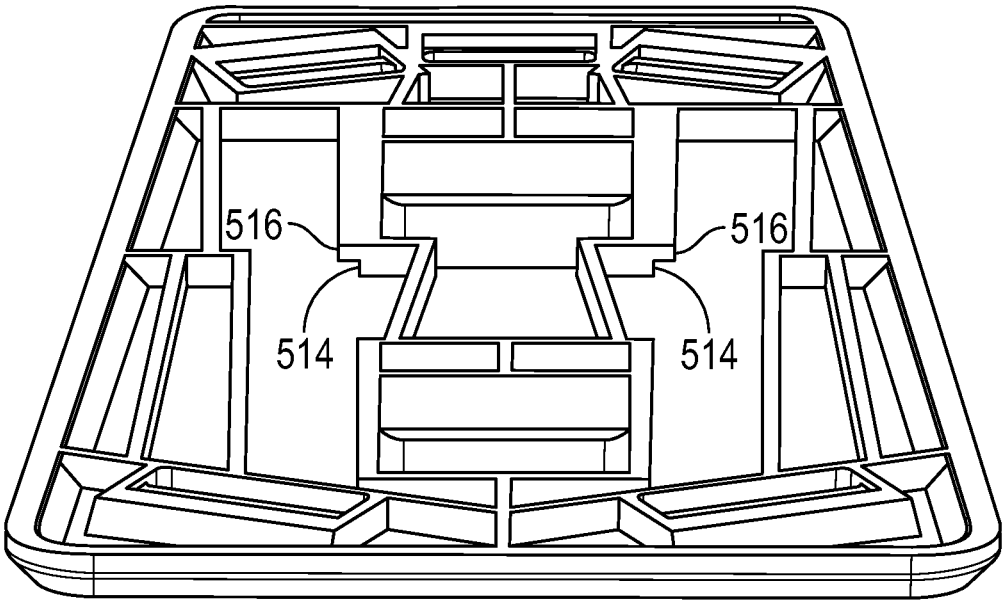
Figure 146:
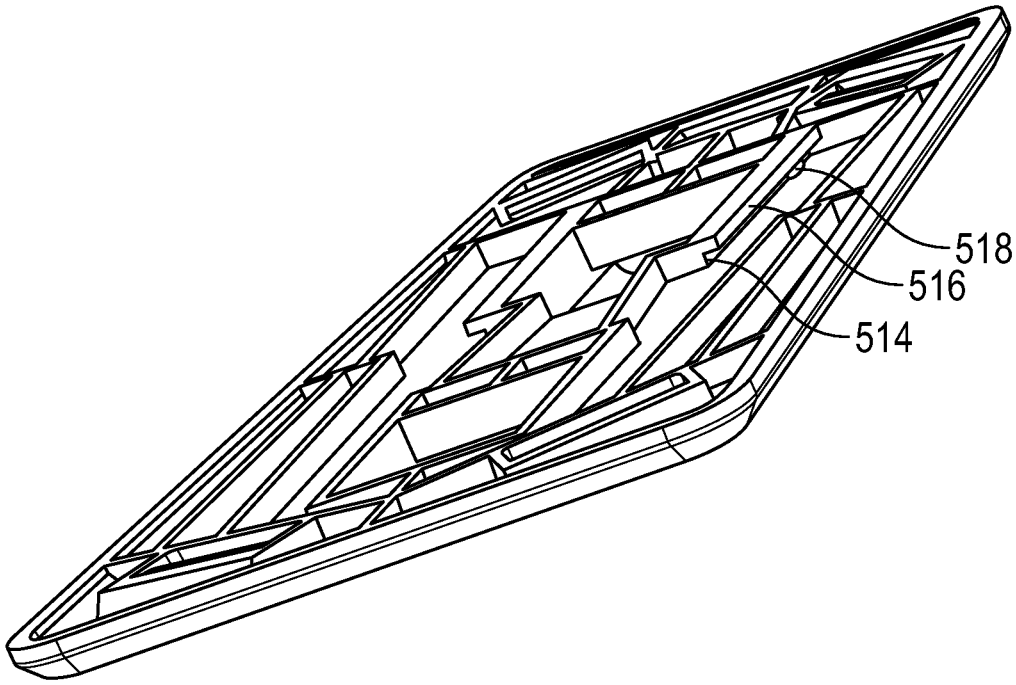
Figure 147:
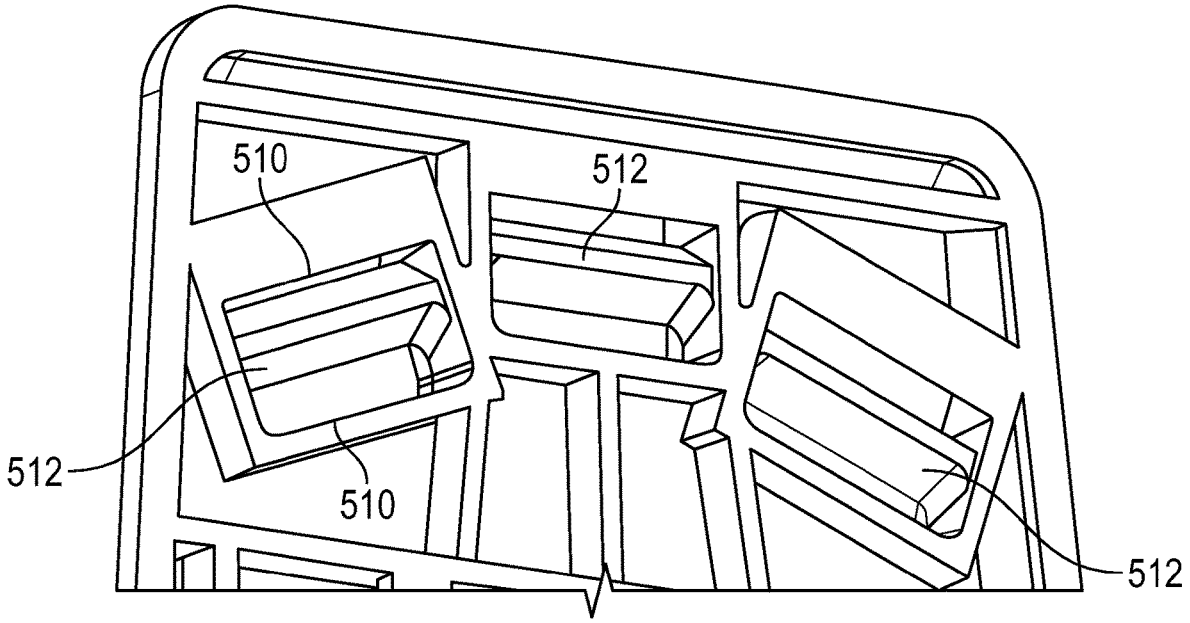
Figure 148:
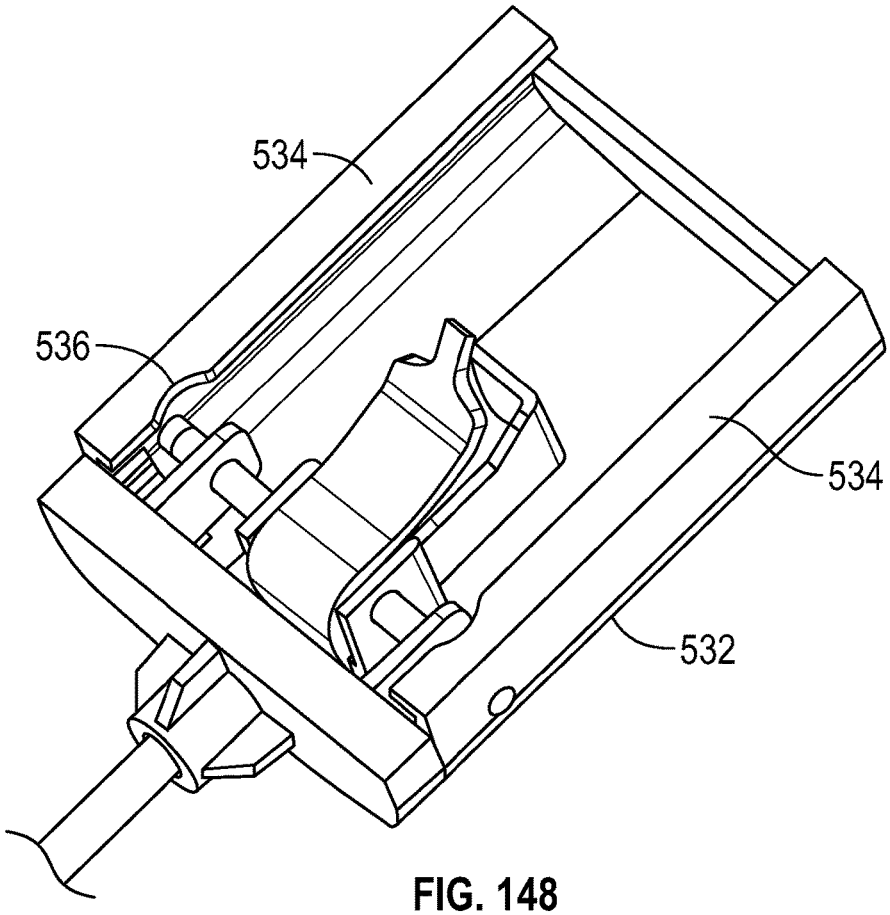
Figure 149:
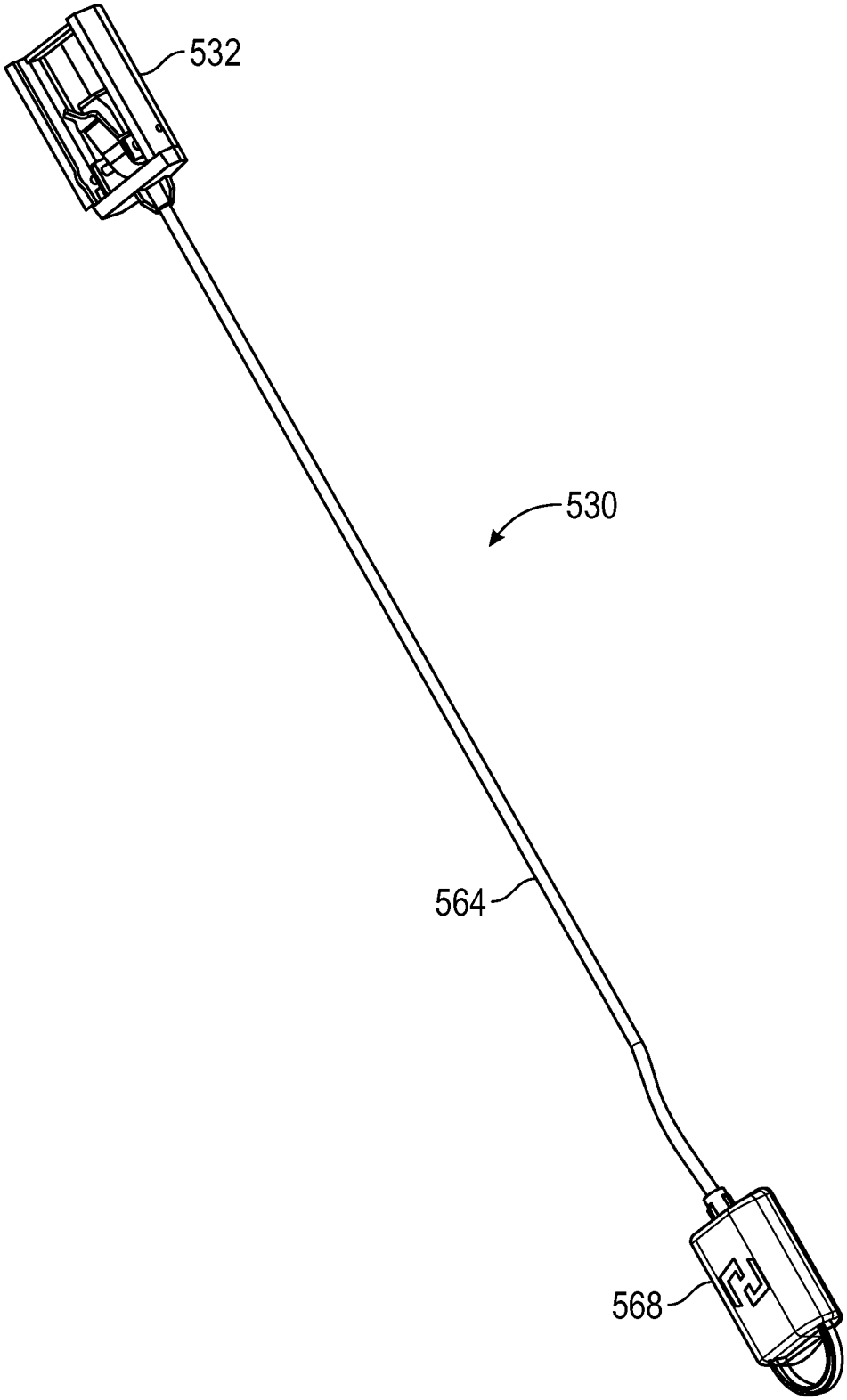
Figure 150:
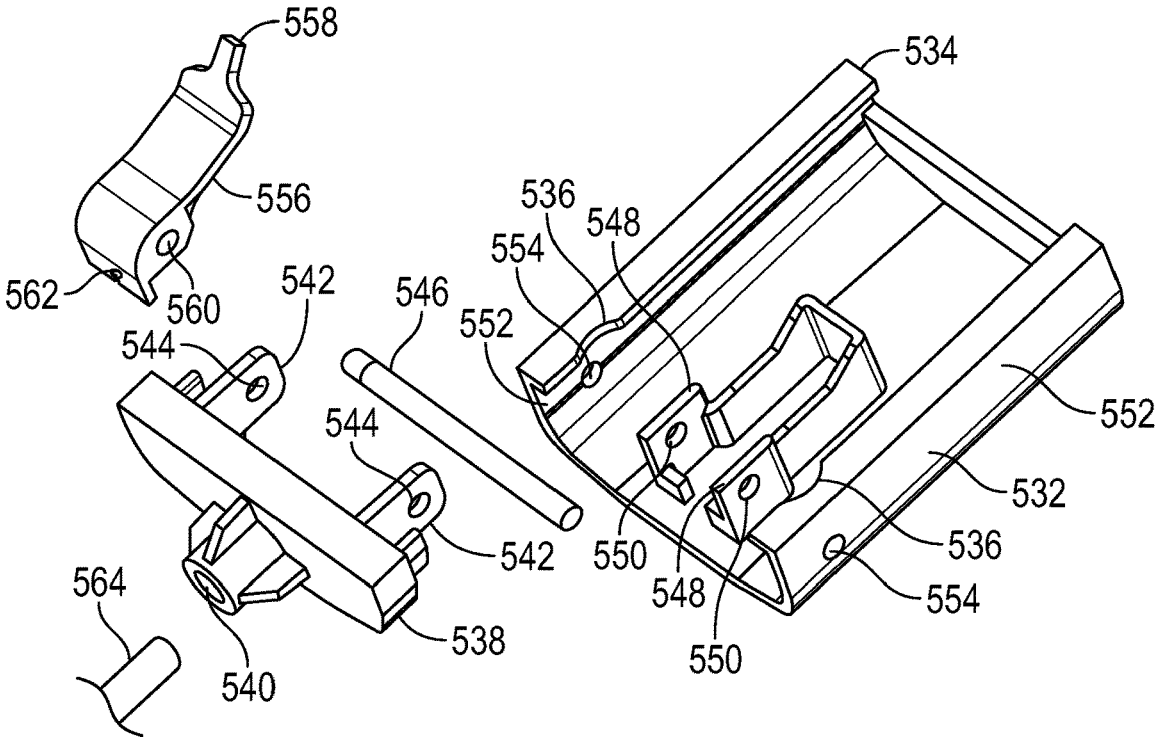
Figure 151:
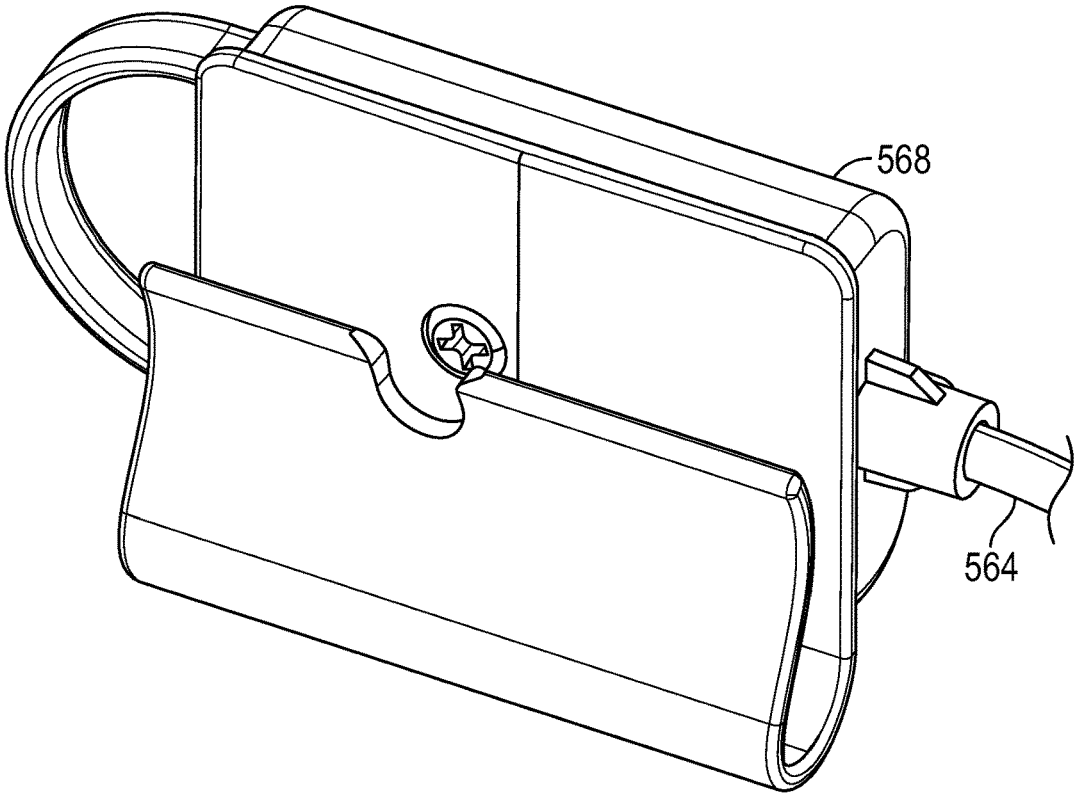
Figure 152:
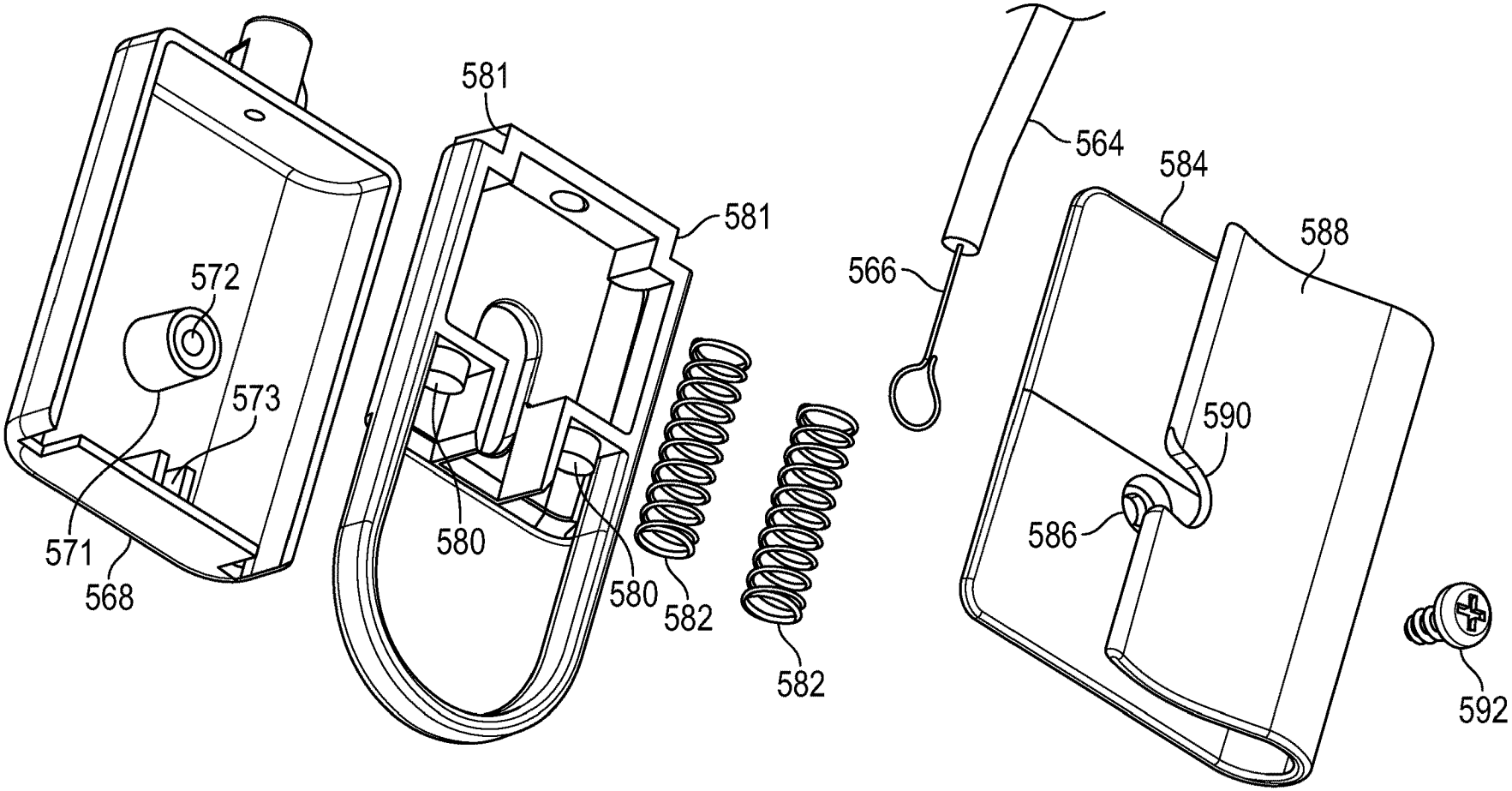
Figure 153:
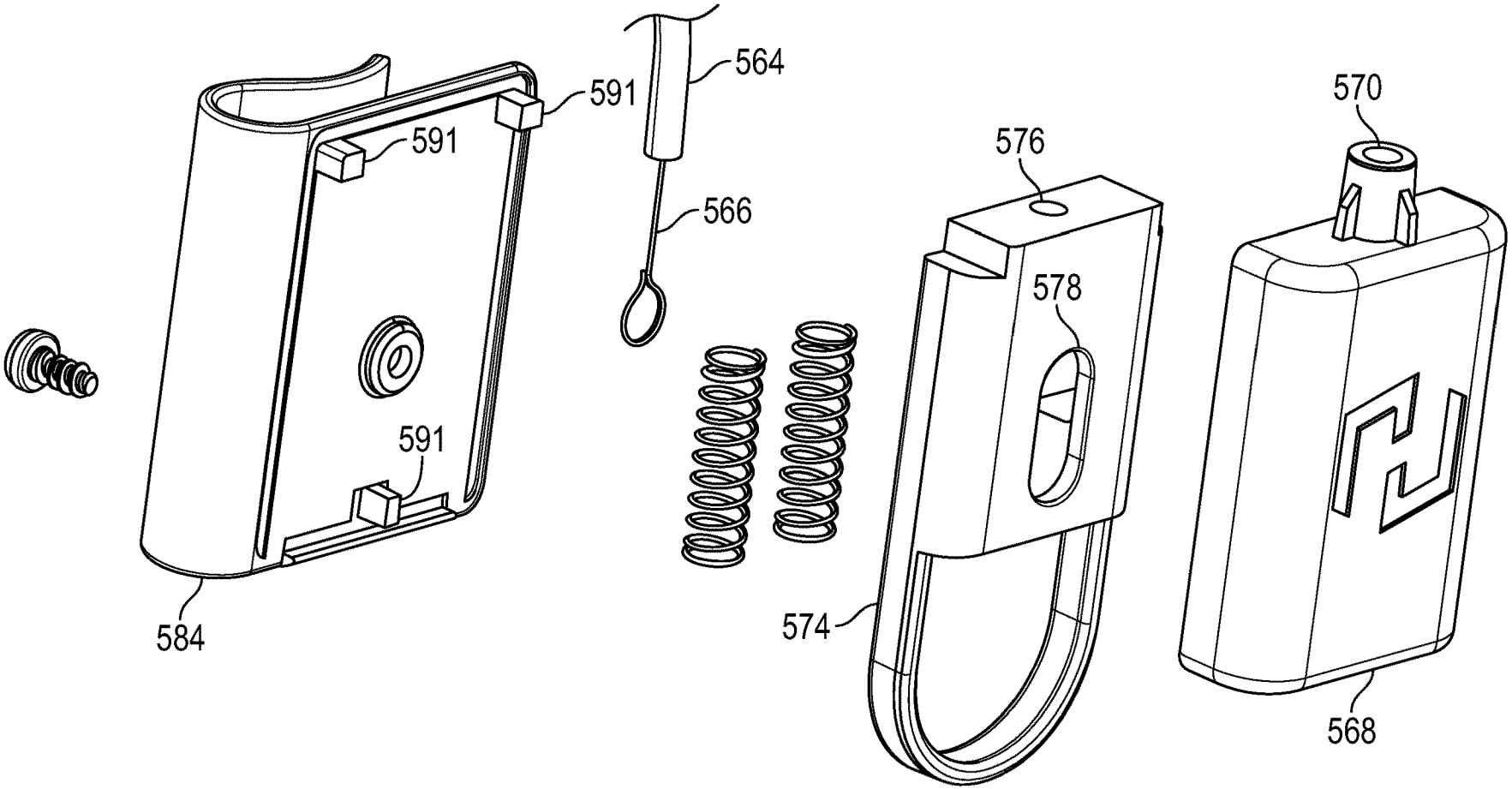
Figure 154:
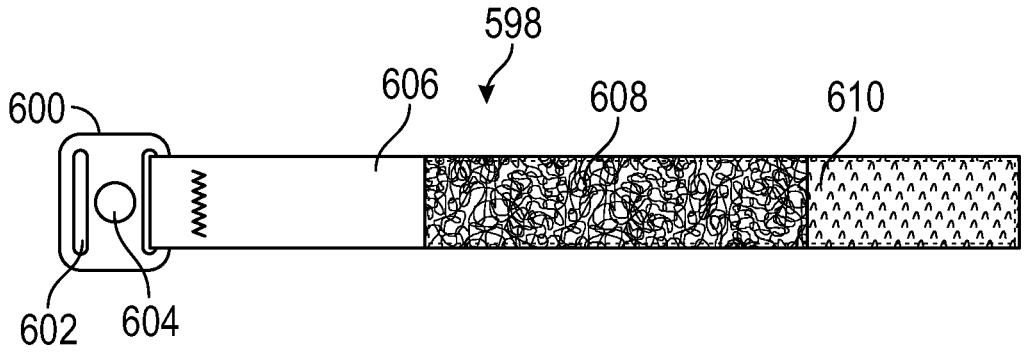
Figure 155:
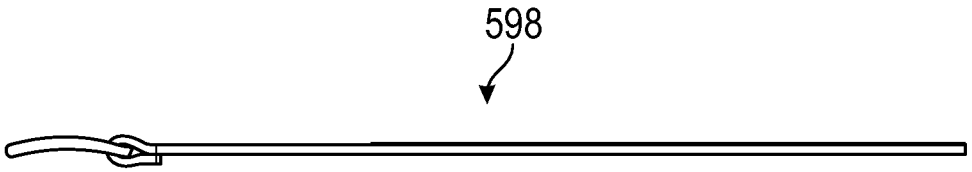

FIG. 124 representatively illustrates the pole clip system of FIG. 125 in a non-clipped configuration;

FIG. 125 representatively illustrates a pole clip system in a clipped configuration;

FIG. 126 representatively illustrates the pole clip system of FIG. 124 with a clip receiver of the clip receiver assembly rotated ninety degrees;

FIG. 127 representatively illustrates a user holding a bow in one hand having a firearm strap assembly of FIG. 11A secured thereto, and a hiking pole in the other hand having a clip receiver assembly of the pole clip system of FIG. 125 secured thereto, the user preparing to secure the bow to the pole;

FIG. 128 representatively illustrates the user of FIG. 127 having secured the bow to the pole by clipping the firearm strap assembly into the clip receiver assembly, the user using the pole to steady the bow while aiming;

FIG. 129 representatively illustrates the pole clip system of FIG. 125 securing extended poles in an X-configuration for resting a rifle while aiming;

FIG. 130 representatively illustrates the pole clip system of FIG. 125 securing contracted poles in an X-configuration for resting a rifle while aiming;

FIG. 131 representatively illustrates a user holding a rifle in one hand having a firearm strap assembly of FIG. 11A secured thereto, and a hiking pole in the other hand having a clip receiver assembly of the pole clip system of FIG. 125 secured thereto, the user preparing to secure the rifle to the pole;

FIG. 132 representatively illustrates the user of FIG. 131 having secured the rifle to the pole by clipping the firearm strap assembly into the clip receiver assembly, the user using the pole to steady the rifle while aiming;

FIG. 133 is a front view of a blind system;

FIG. 134 is a rear, top, left side view of a receiver member of the blind system of FIG. 133;

FIG. 135 is a rear, top, right side view of a clip member of the blind system of FIG. 133;

FIG. 136 representatively illustrates the receiver member of FIG. 134 and clip member of FIG. 135 in a clipped configuration;

FIG. 137 representatively illustrates the receiver member of FIG. 134 and clip member of FIG. 135 in a clipped configuration with stakes secured thereto;

FIG. 138 is a rear, right side, top view of the pole clip system of FIG. 125 having the clip member of FIG. 135 and the receiver member of FIG. 134 each in a clipped configuration relative to the pole clip system;

FIG. 139 is a front, right side, top view of the pole clip system of FIG. 125 having the clip member of FIG. 135 and the receiver member of FIG. 134 each in a clipped configuration relative to the pole clip system;

FIG. 140 representatively illustrates a right side view of a blind being secured using elements of the blind system of FIG. 133;

FIG. 141 representatively illustrates a front, right side view of the blind of FIG. 140 being secured using the blind system of FIG. 133;

FIG. 142 representatively illustrates a front, left side view of the blind of FIG. 140 being secured using the blind system of FIG. 133;

FIG. 143 is a front, top, left side view of an implementation of a back plate of a carrying assembly;

FIG. 144 is a rear, top, right side view of the back plate of FIG. 143;

FIG. 145 is a rear, bottom view of the back plate of FIG. 143;

FIG. 146 is a rear, bottom, left side view of the back plate of FIG. 143;

FIG. 147 is a close-up rear, right side view of a top portion of the back plate of FIG. 143;

FIG. 148 is a close-up rear, bottom, right side view of a portion of the lock assembly of FIG. 149;

FIG. 149 is a rear, bottom, right side view of a lock assembly;

FIG. 150 is an exploded close-up rear, bottom, right side view of the elements of FIG. 148;

FIG. 151 is a front, top, right side view of a portion of the lock assembly of FIG. 149;

FIG. 152 is an exploded front, bottom, right side view of the elements of FIG. 151;

FIG. 153 is an exploded rear, top, left side view of the elements of FIG. 151;

FIG. 154 is a front view of a partial assembly that forms part of a firearm strap assembly;

FIG. 155 is a left side view of the partial assembly of FIG. 154; and

Figure 156:
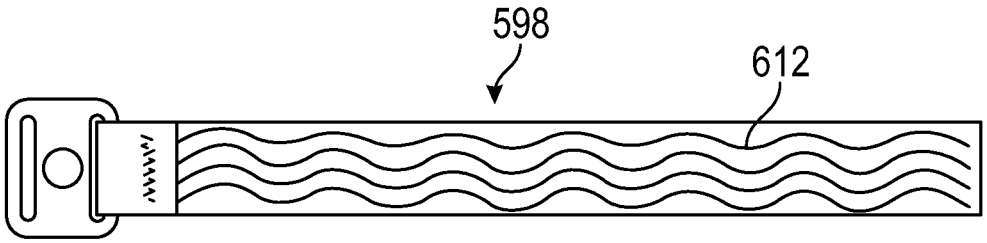

FIG. 156 is a rear view of the partial assembly of FIG. 154.

DESCRIPTION

Implementations/embodiments disclosed herein (including those not expressly discussed in detail) are not limited to the particular components or procedures described herein. Additional or alternative components, assembly procedures, and/or methods of use consistent with the intended hunting and carrying devices, assemblies, systems, and related methods may be utilized in any implementation. This may include any materials, components, sub-components, methods, sub-methods, steps, and so forth.

Implementations of hunting and carrying devices, assemblies, systems, and related methods relate to devices and methods used in conjunction with hunting and/or outdoor adventures and/or for carrying a variety of items.

Hunting and carrying devices, assemblies, systems, and related methods may include a single device disclosed herein or any combination of devices disclosed herein.

Referring now to FIGS. 1-8 and 18-23, an example carrying assembly 100 is shown. Assembly 100 includes a back plate 102 which includes a pair of clip receivers 103.

Figure 2:
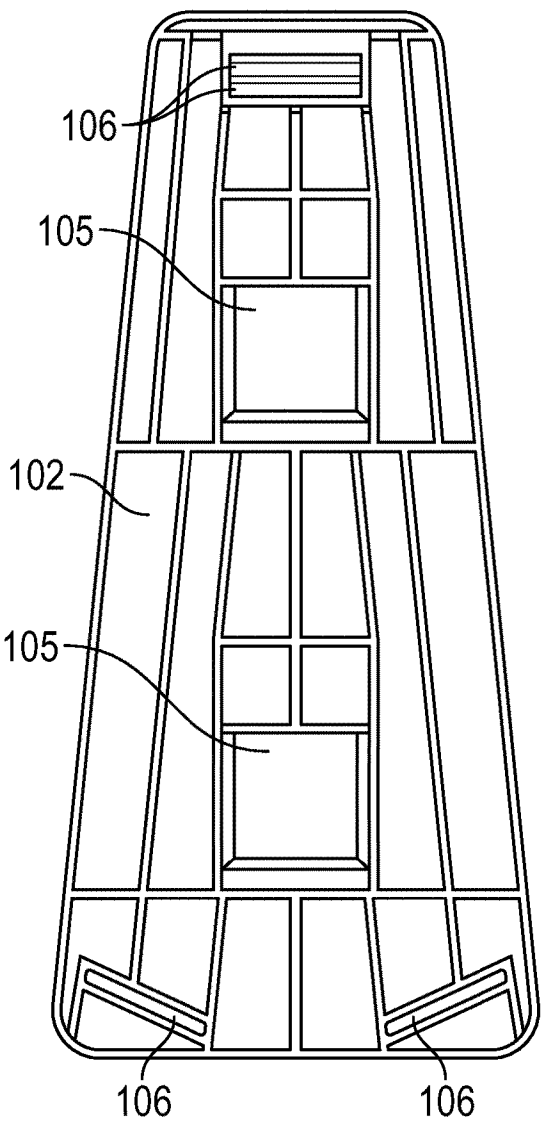
FIG. 2 is a back view of the back plate of FIG. 1.
Figure 1:
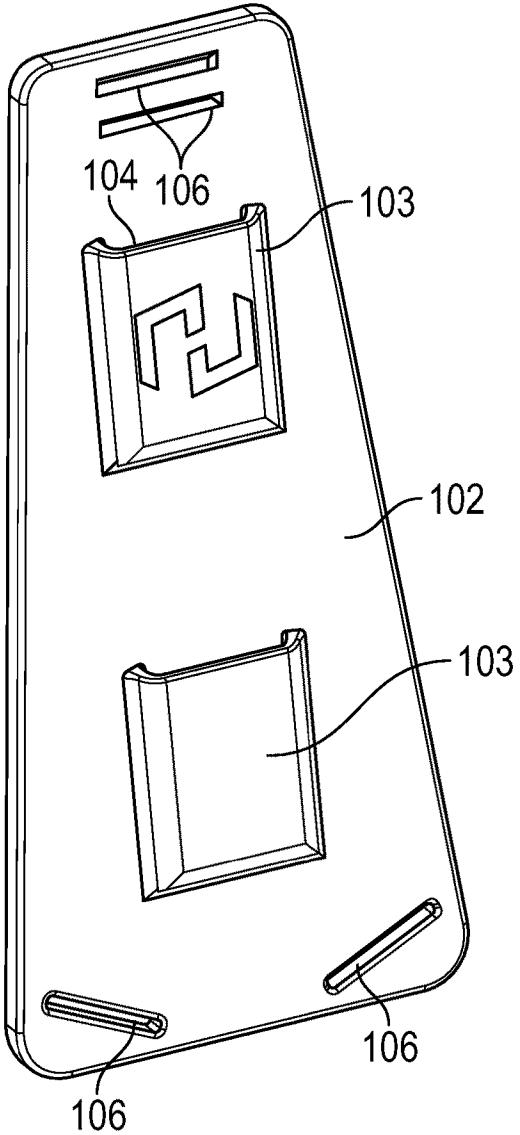
FIG. 1 is a front, top, left side view of an implementation of a back plate of the carrying assembly of FIG. 4.

Each clip receiver 103 includes an opening 104 providing access to a cavity 105. A plurality of slots 106 are present proximate the top of the back plate and proximate bottom corners thereof. FIG. 1 shows a front perspective view of the back plate while FIG. 2 shows a rear view thereof. The assembly further includes a hook 108 (shown in FIG. 3) which includes a slot 110. A strap 112 couples with the hook (using slot 110) and further couples with the back plate using the top slots 106. A pair of straps 113 couple with the bottom corner slots 106 and are coupled with couplers 114. Each coupler 114 may be part of a side release buckle pair and each may include one or more slots for receiving a strap 113. Any of the slots of this implementation (as with other implementations) may be paired such as to allow self-locking functionality for a strap.

Figure 4:
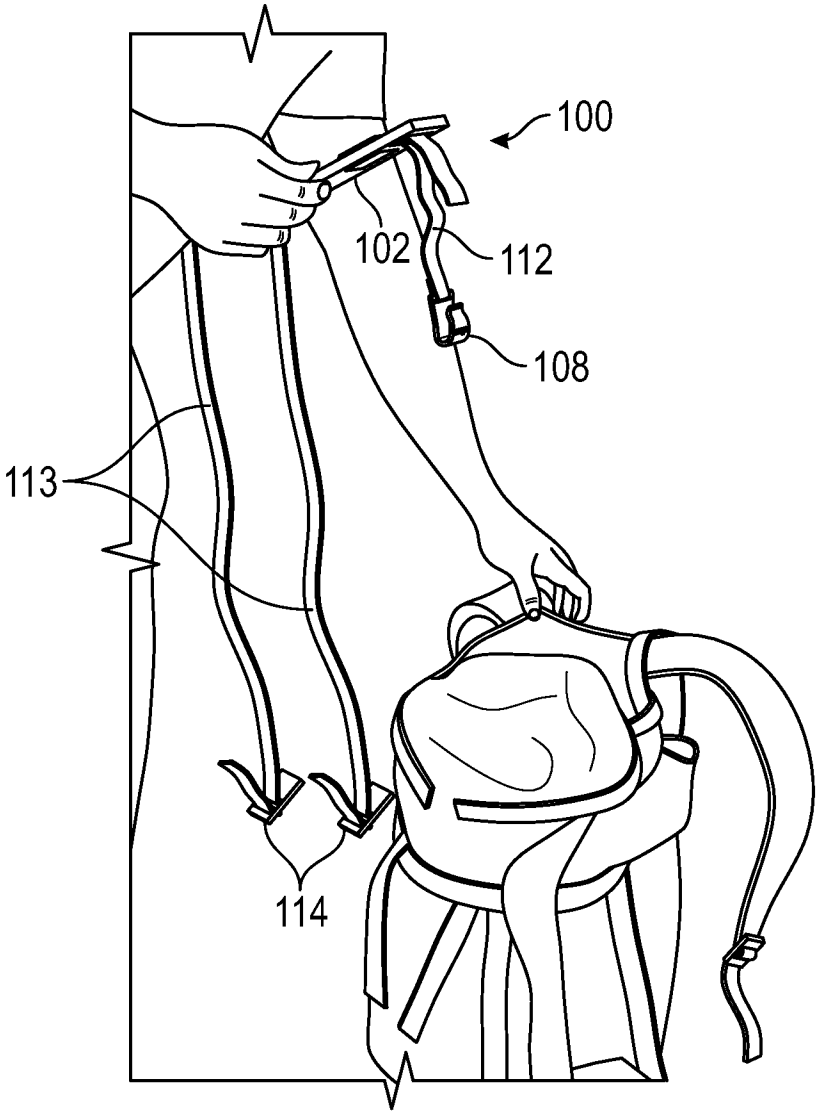
FIG. 4 representatively illustrates a user preparing to secure a carrying assembly to a backpack.
Figure 3:
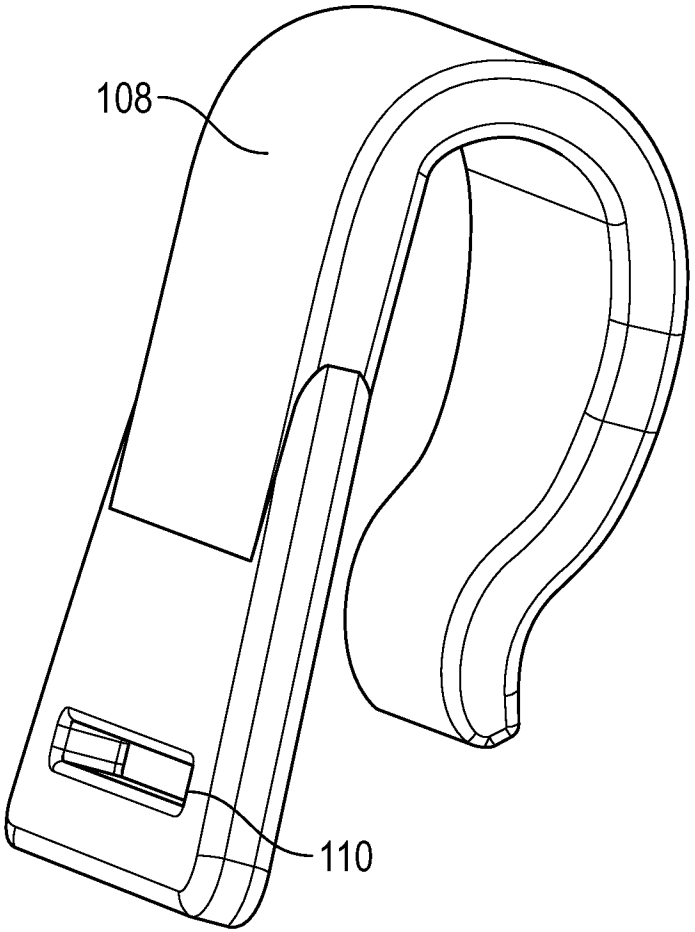
FIG. 3 is a front, top, right side view of a hook of the carrying assembly of FIG. 4.
Figure 6:
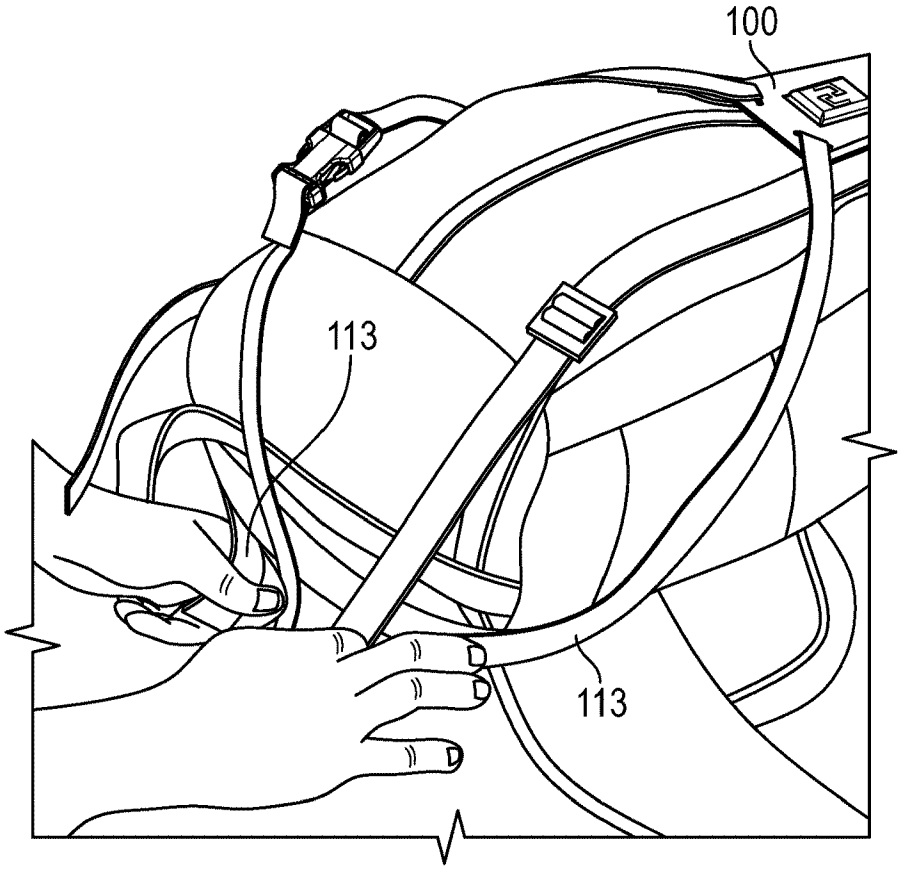
FIG. 6 representatively illustrates a step of securing the carrying assembly of FIG. 4 to a backpack.
Figure 5:
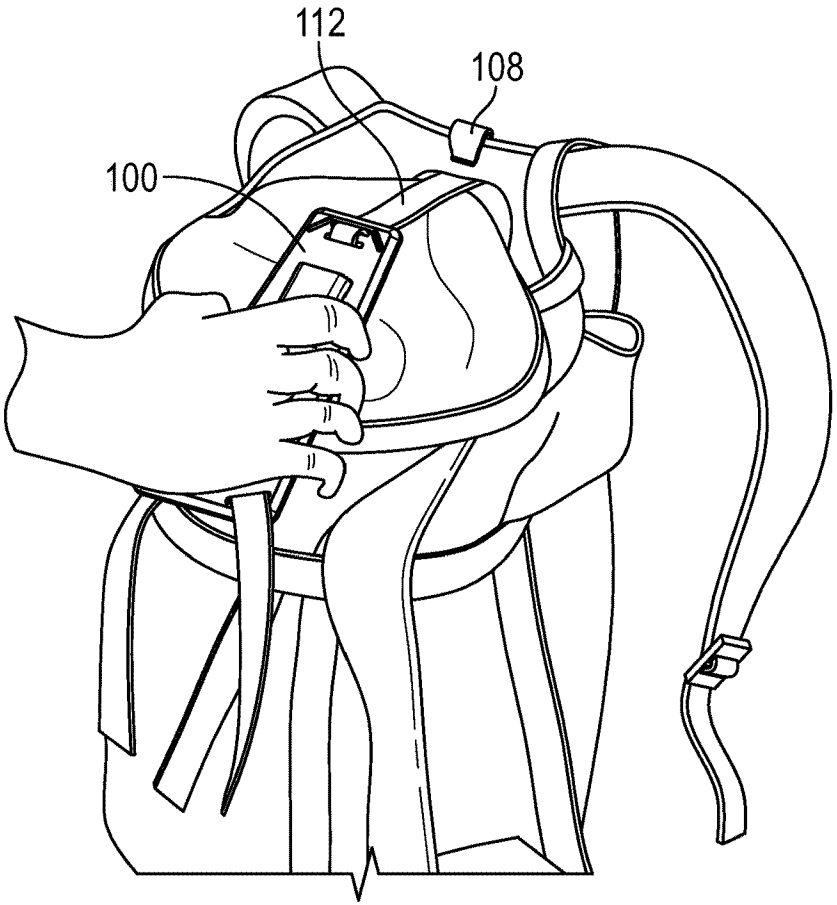
FIG. 5 representatively illustrates a step of securing the carrying assembly of FIG. 4 to a backpack.
Figure 7:
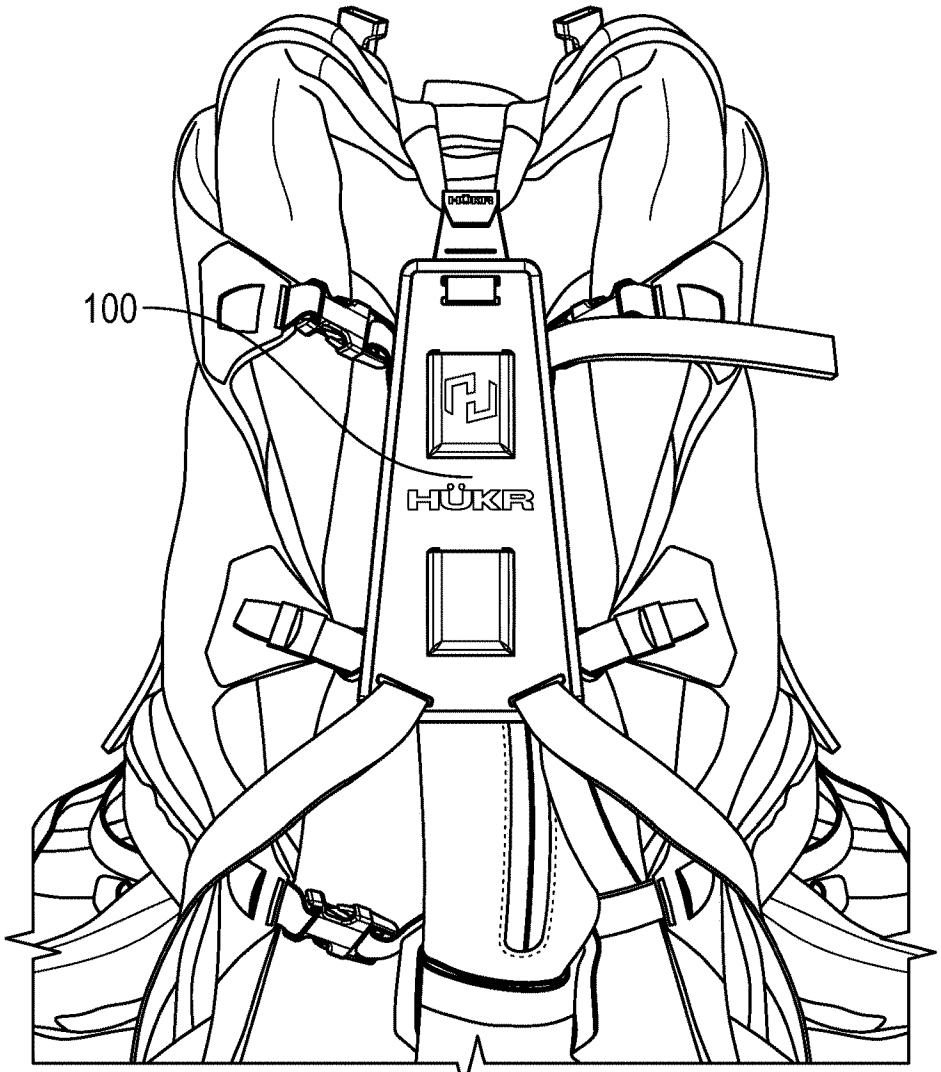
FIG. 7 is a front view of the carrying assembly of FIG. 4 secured to a backpack.

FIG. 4 shows a user preparing to couple assembly 100 with a backpack, which could be a hunting backpack. In FIG. 5 the user has coupled the hook 108 with a grab bar of the backpack (the hook may also be coupled with a carrying strap or handle of a backpack if a grab bar is not present). After doing this the user may adjust and/or lock/tighten strap 112, such as adjusting a distance between the hook and back plate, to achieve desired positioning. In FIG. 6 the user wraps straps 113 below a bottom of the backpack and then they are clipped together. FIG. 7 shows the backpack fully attached to a different backpack (which backpack includes a carrying handle instead of a rigid grab bar).

Figure 8:
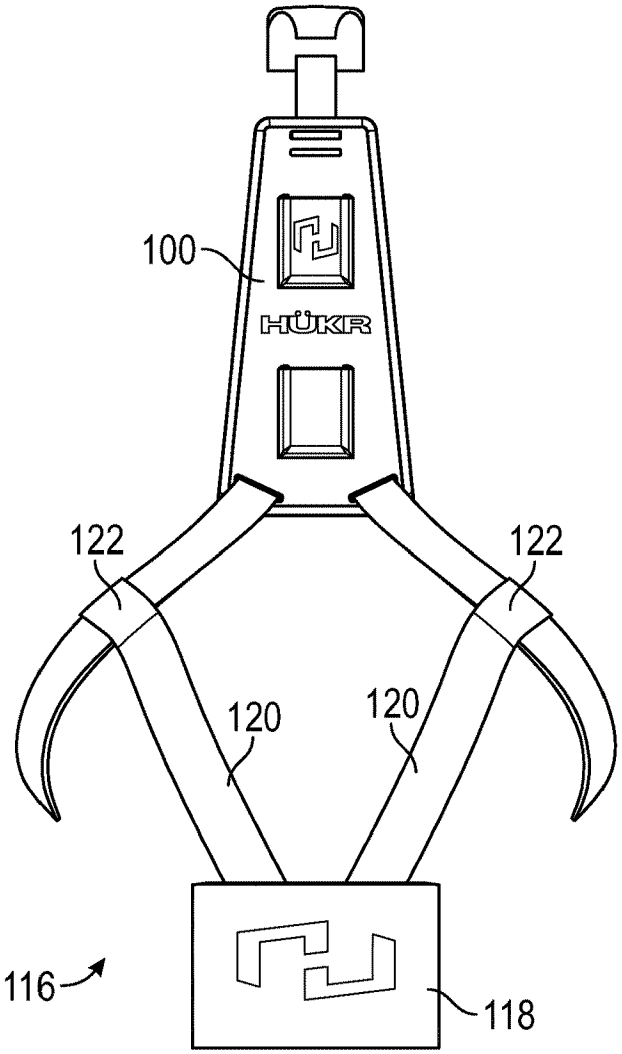
FIG. 8 is a front view of portions of the carrying assembly of FIG. 4 with a cradle assembly releasably secured thereto.

In FIG. 8 it is seen that a cradle assembly 116 may optionally be included, which may include a cradle 118 for receiving a butt of a gun, a bottom of a bow, or another item. Straps 120 couple with the cradle. Couplers 122, which may be clips or clasps or another coupling element, couple the straps 120 with straps 113. The cradle assembly may provide extra support for carrying a gun or bow or other item, and may be useful while the user is riding a bike or vehicle or otherwise moving, or in any other scenario in which the user desires extra carrying support for a weapon or other item. Nevertheless, the cradle assembly may be excluded/removed if a user does not desire to use it.

Figure 10:
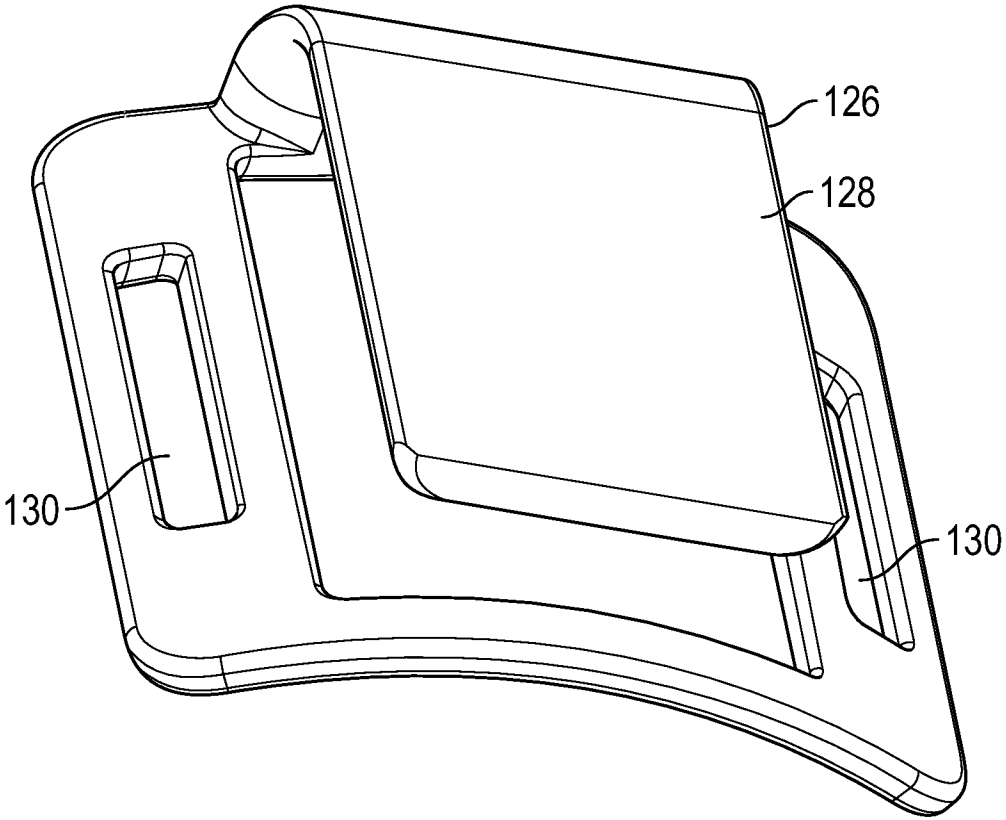
FIG. 10 is a front, bottom, left side view of a first member of the firearm strap assembly of FIG. 11A.
Figure 9:
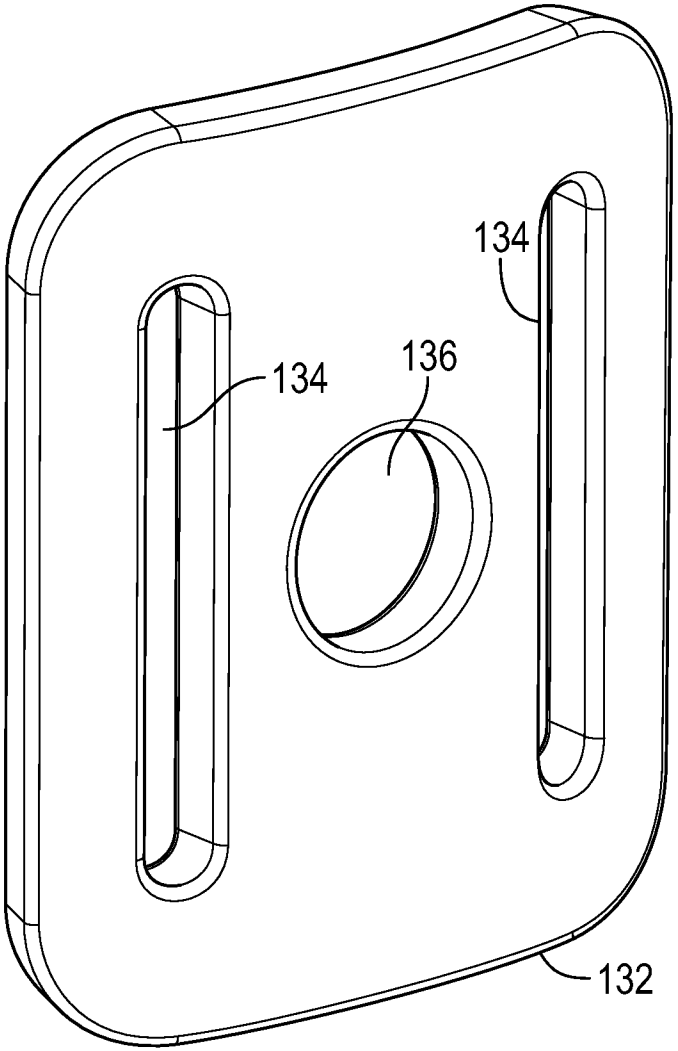
FIG. 9 is a front, top, left side view of a second member of the firearm strap assembly of FIG. 11A.
Figure 12:
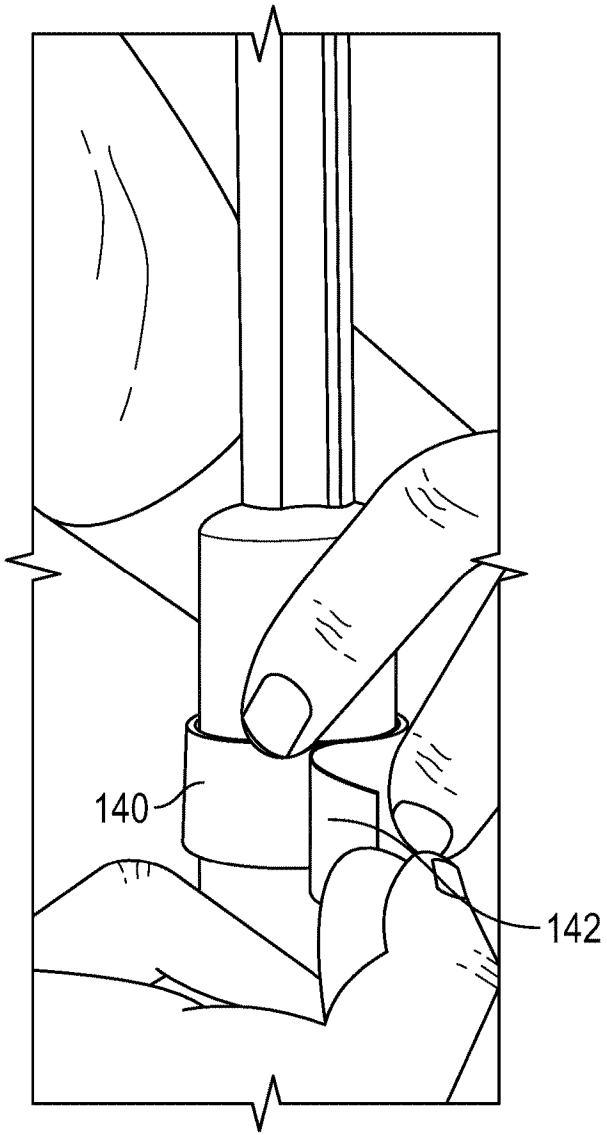
FIG. 12 representatively illustrates a user securing the firearm strap assembly of FIG. 11A to a rifle stock.
Figure 14:
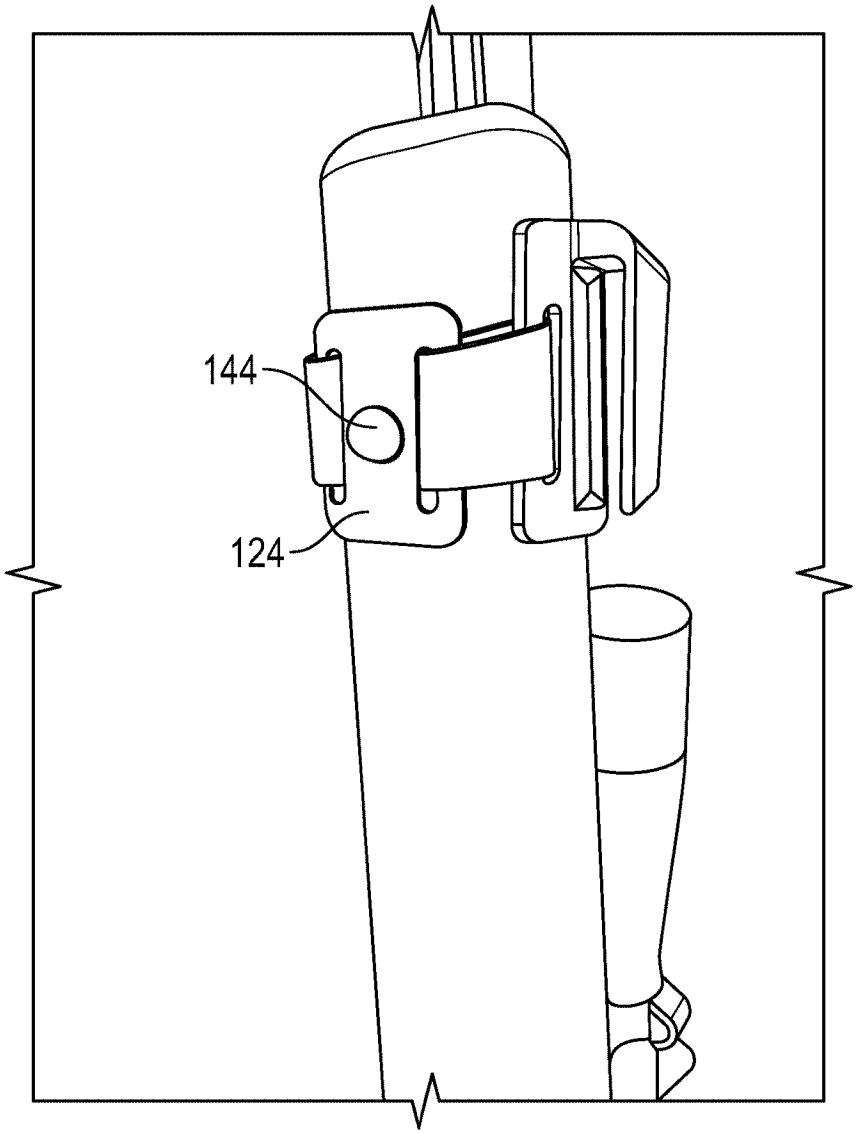
FIG. 14 representatively illustrates the firearm strap assembly of FIG. 11A secured to a rifle stock.
Figure 13:
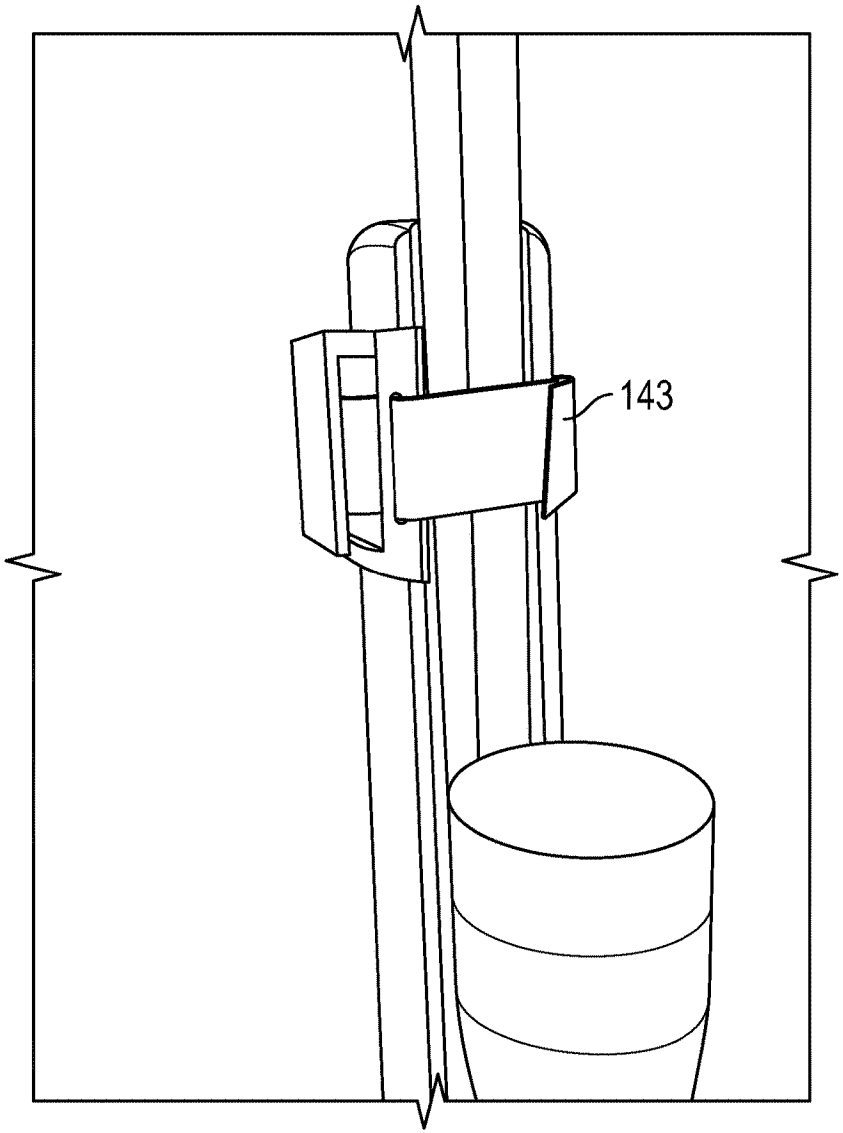
FIG. 13 representatively illustrates another firearm strap assembly secured to a rifle stock.

FIGS. 9-12, 14, and 18-23 show various views of a firearm strap assembly 124 and implementing components. FIG. 10 shows a first member 126 which includes a clip 128 and a pair of slots 130. FIG. 9 shows a second member 132 which includes a pair of slots 134 and a through-hole 136. FIG. 11A shows that a strap 138 is looped through one of the slots 134 and through both slots 130. FIG. 11B shows that a backing, which may be formed of a rubber or other high-friction element, may be coupled with a surface of the first member. In FIG. 12 the assembly has been wrapped around a rifle stock and barrel, the end of the strap has been looped through the remaining slot 134, and the strap has been pulled tight and is being secured using complementary hook-and-loop fasteners on a first portion 140 and second portion 142 of the strap. It is pointed out that, throughout this document, disclosed hook-and-loop fasteners are not shown in the drawings (both with respect to the FIG. 14 elements and with respect to elements of various other figures, though FIG. 23 does show one portion of the hook-and-loop fasteners) but hook-and-loop fasteners are generally well known and accordingly, wherever hook-and-loop fasteners are discussed/disclosed with respect to any element, the practitioner of ordinary skill in the art will understand how to configure the elements with complementary hook-and-loop elements without having them illustrated in the drawings. Thus, in this example, the practitioner will understand how to configure first portion 140 and second portion 142 with complementary hook-and-loop fasteners without their being shown in the drawings. In FIG. 13 a firearm strap assembly 143 (similar to assembly 124 except having a slightly different clip shape) is fully secured to the rifle. In FIG. 14 assembly 124 is fully secured to the rifle. During the securing process, through-hole 136 was aligned with a protrusion 144 of the rifle stock. The mating of the through-hole with the protrusion helps to couple the assembly securely with the rifle. In implementations the protrusion may be (or may be a portion of) a rifle sling mount (such as a swivel mount for a sling). However, in implementations in which a rifle or firearm does not have such a projection (such as a shotgun with no sling mount, or a bow or crossbow), the backing 131 may provide sufficient friction that by tightening the firearm strap assembly the gun or bow or other item may still be secured in a desired configuration using the clip notwithstanding there being no additional securing using the through-hole 136. The through-hole may be especially useful for gun stocks that are inherently low friction, such as some hunting rifle stocks with very smooth surfaces.

Figure 18:
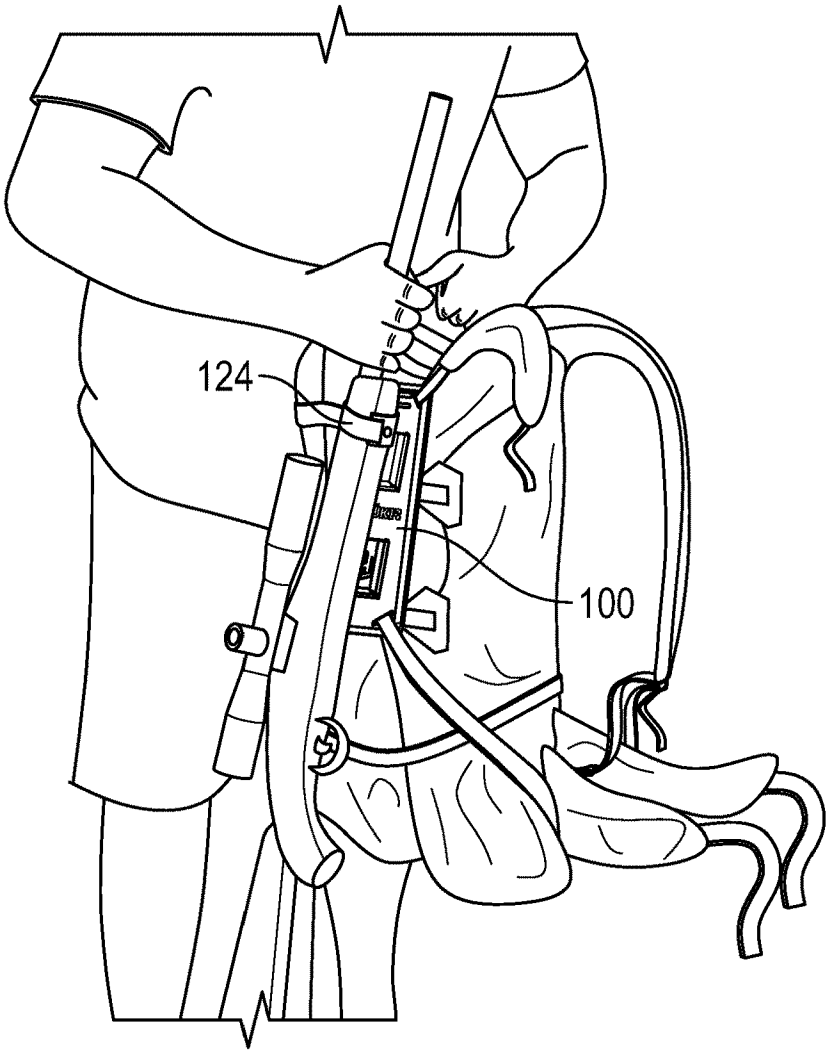
FIG. 18 representatively illustrates a user securing a rifle to the carrying assembly of FIG. 4 which is in turn secured to a backpack.
Figure 20:
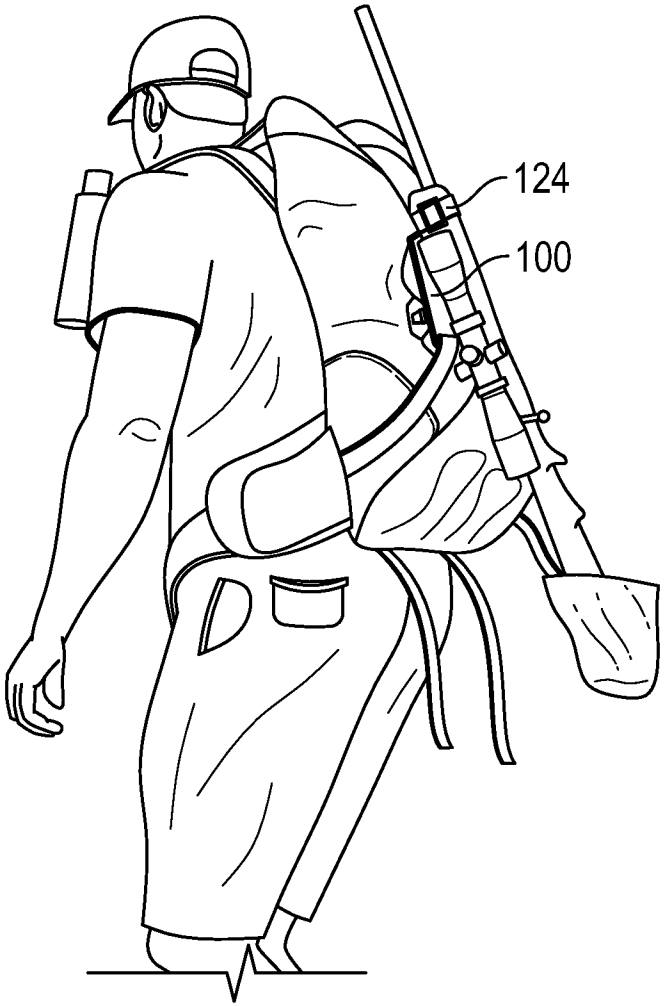
FIG. 20 representatively illustrates the user of FIG. 19 in a walking or running motion.
Figure 19:
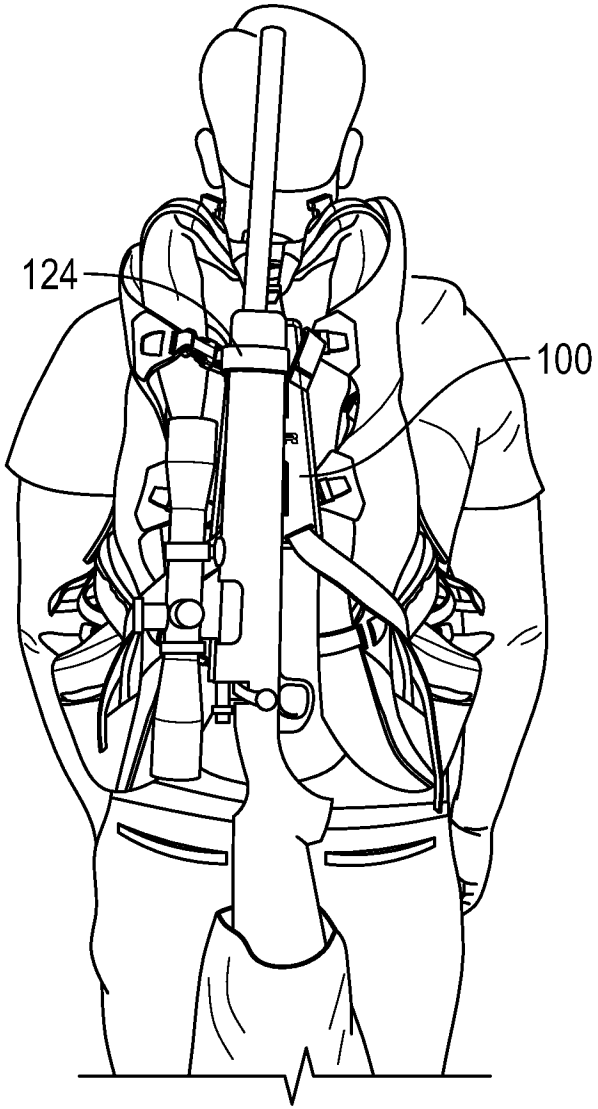
FIG. 19 representatively illustrates a user wearing a backpack with the carrying assembly of FIG. 4 secured thereto and with a rifle secured to the carrying assembly.
Figure 22:
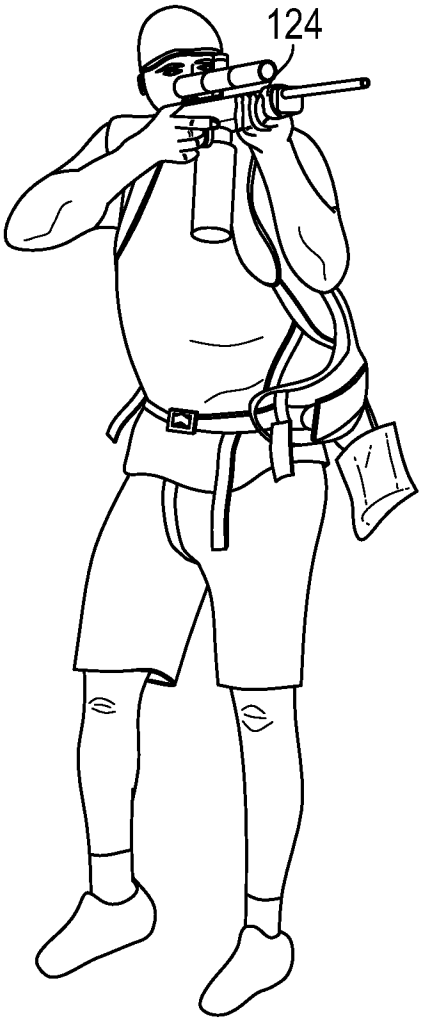
FIG. 22 representatively illustrates the user of FIG. 19 in an aiming motion aiming the rifle.
Figure 21:
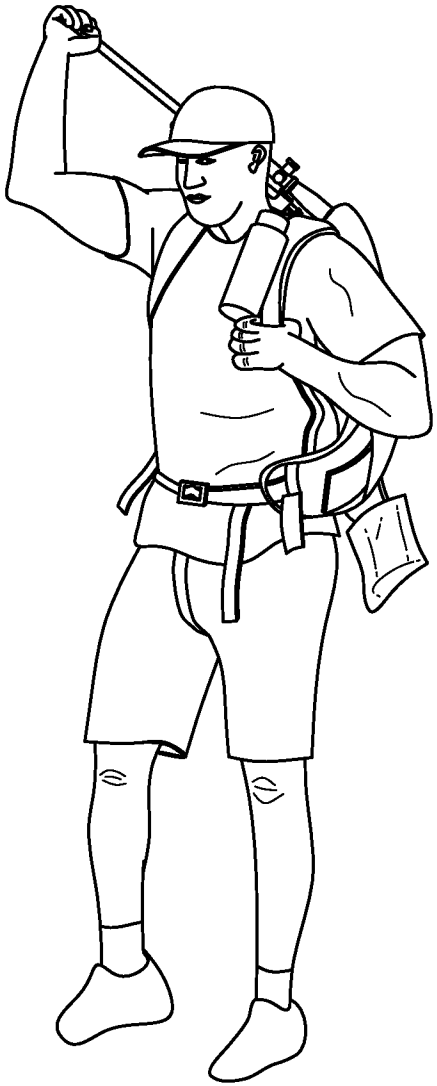
FIG. 21 representatively illustrates the user of FIG. 19 in a drawing motion removing the rifle from its secured configuration.
Figure 24:
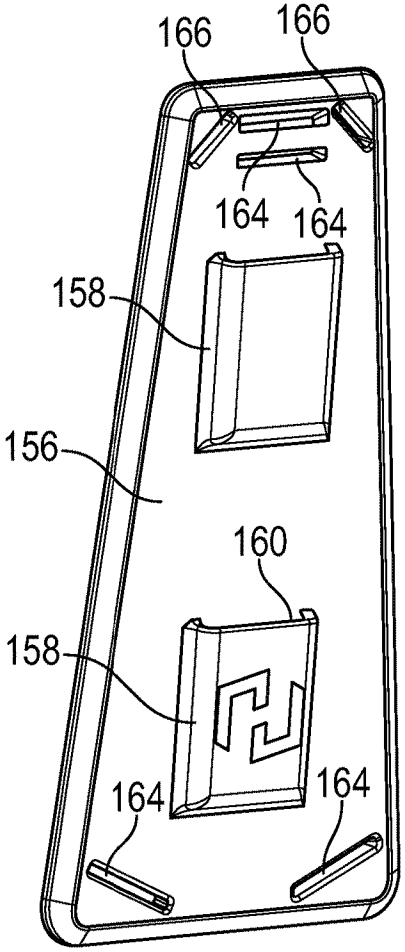
FIG. 24 is a front, top, left side view of a back plate of the carrying assembly of FIG. 26.
Figure 23:
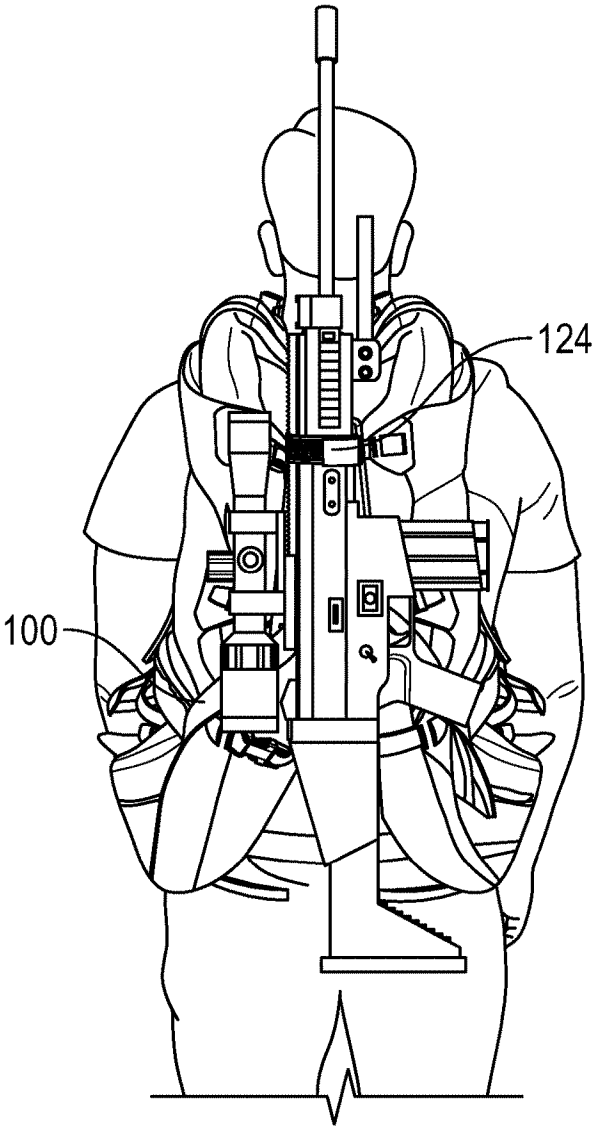
FIG. 23 representatively illustrates the user, backpack, and carrying assembly of FIG. 19, but with a different rifle secured to the carrying assembly.

In FIG. 18 the user has already secured assembly 124 to a rifle and clips the clip 128 into a clip receiver of assembly 100 to secure the rifle thereto. In FIG. 19 the user has fully secured the rifle to the backpack using assembly 124 and the butt of the gun is further secured within a prior art cradle (which is coupled with the backpack). In FIG. 20 the user is jogging with the backpack and rifle, and the above-described securing mechanisms keep the rifle secure so that it does not fall or jostle loose or hinder the user's movement. When the user desires to use the rifle (such as upon seeing an animal being hunted) the user can quickly reach back to grab the rifle (such as by grabbing the barrel) and with an upwards motion may easily pull the rifle free (without any removal of the backpack and/or untying of straps/cords, which may be needed for prior art systems), releasing the clip 128 from the clip receiver 103, as in FIG. 21, and then may position the gun for a shot, as in FIG. 22 (similar easy-release mechanisms may be used with a bow or any other weapon or other secured element). FIG. 23 shows a different rifle type secured to assembly 100 using assembly 124, revealing that various rifle and firearm types may be secured to the backpack in this manner.

Figure 15:
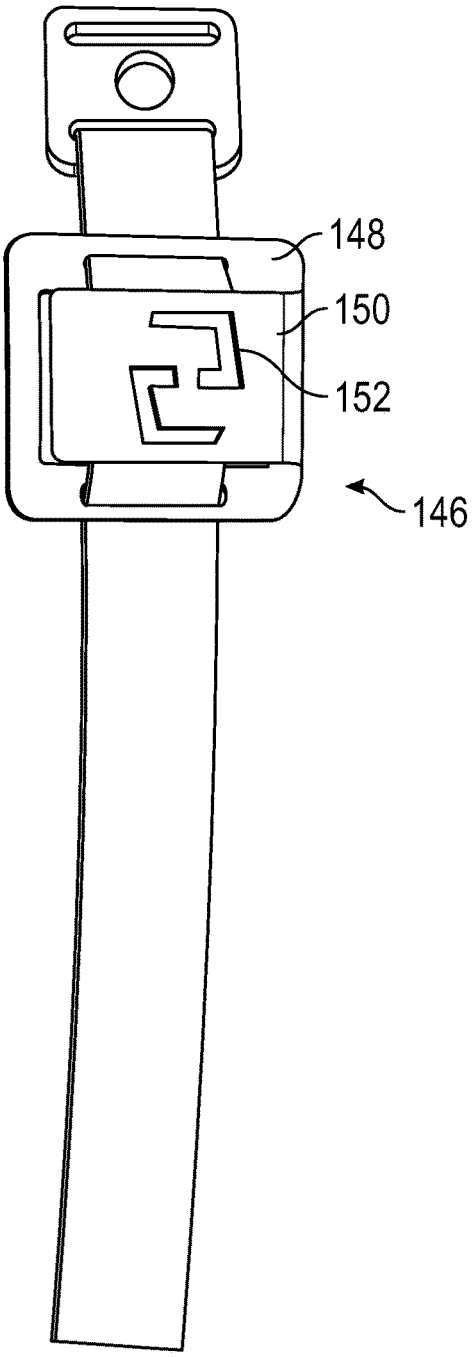
FIG. 15 is a front view of another firearm strap assembly.
Figure 16:
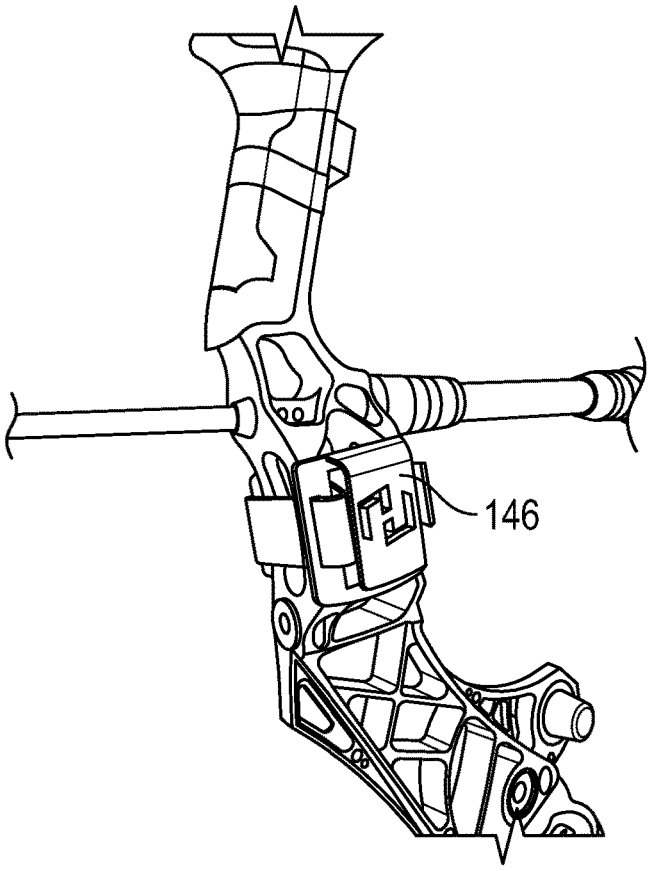
FIG. 16 representatively illustrates the firearm strap assembly of FIG. 15 secured to a hunting bow.
Figure 17:
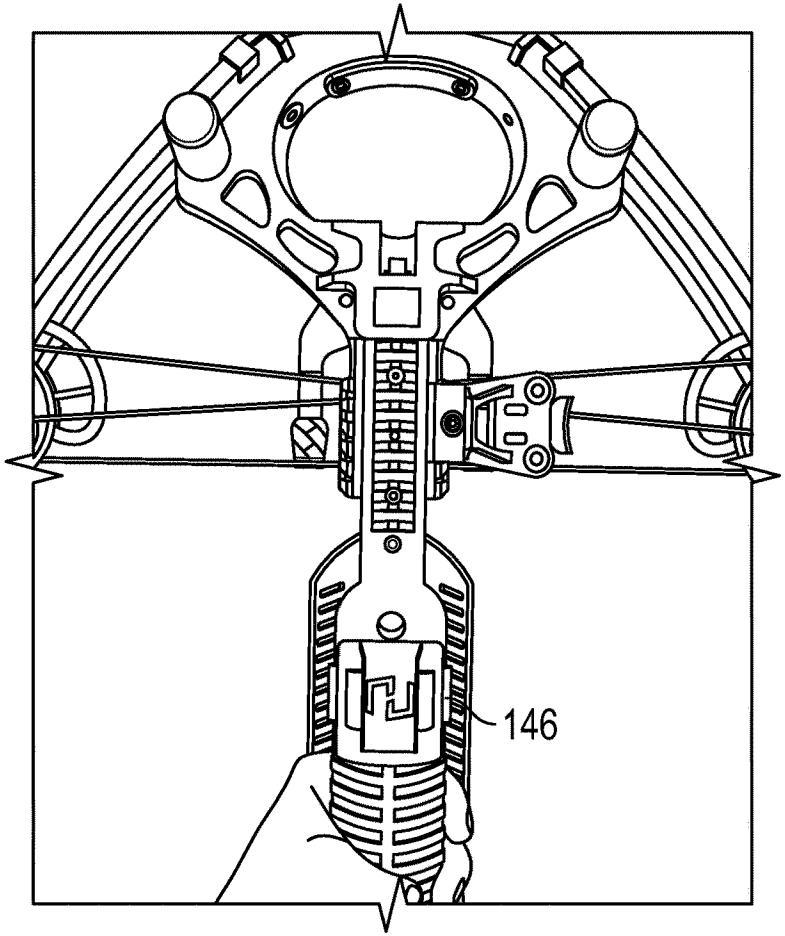
FIG. 17 representatively illustrates the firearm strap assembly of FIG. 15 secured to a crossbow.

FIGS. 15-17 show an example firearm strap assembly 146 which is similar to assembly 124 except that the clip 150 of the first member 148 includes one or more openings 152. Such openings, and openings on any other clips described herein, may be used for a locking mechanism/functionality, described later with respect to FIGS. 98-106. In FIG. 16 firearm strap assembly 146 is secured to a bow, and in FIG. 17 firearm strap assembly 146 is coupled with a crossbow. The firearm strap assemblies may accordingly be used to couple bows, crossbows, and other items, to a backpack, in addition to rifles and other guns.

Figure 25:
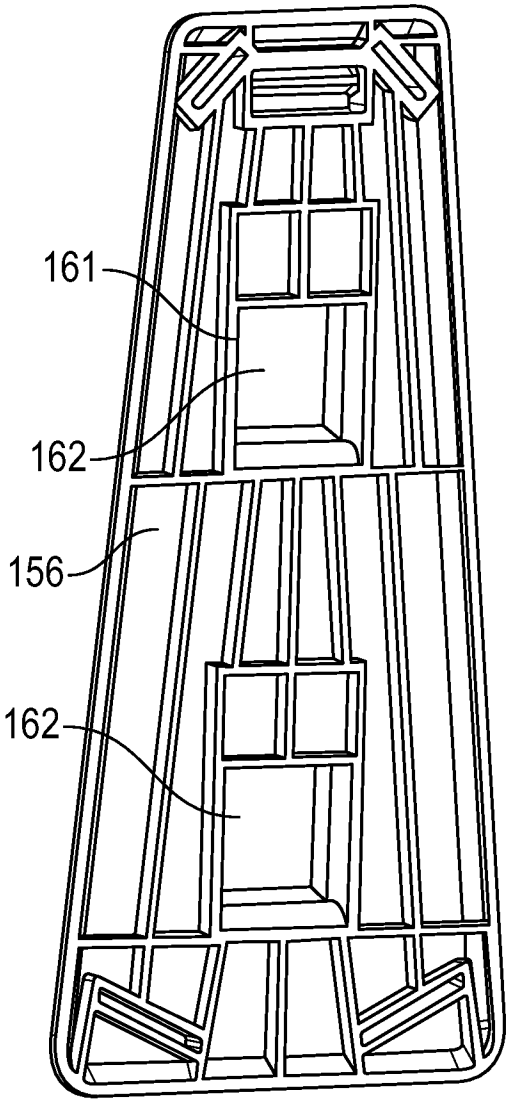
FIG. 25 is a rear, right side view of the back plate of FIG. 24.

FIGS. 24-37 show a carrying assembly 154 which is in some ways similar to assembly 100, including a back plate 156, clip receivers 158 having openings 160 that provide access to cavities 162, and slots 164. Assembly 154 also includes additional slots 166. The uppermost slots 164 may be used for coupling strap 112 and a corresponding hook 108 thereto, for securing the hook with a grab bar or carrying handle of a backpack. For backpacks which do not include a grab bar or carrying handle the strap 112 and hook may be excluded and additional slots 166 may be used to couple the top of the back plate to the backpack in a different manner, which will be described further below. The rear view of FIG. 25 reveals that openings 161 provide access to the cavities 162 at the rear of the back plate (back plate 102 has a similar configuration). This is useful for allowing openings of a clip, clipped into the cavity, to be used for a locking mechanism, in a way that will be described later with respect to FIGS. 98-106.

Figure 28:
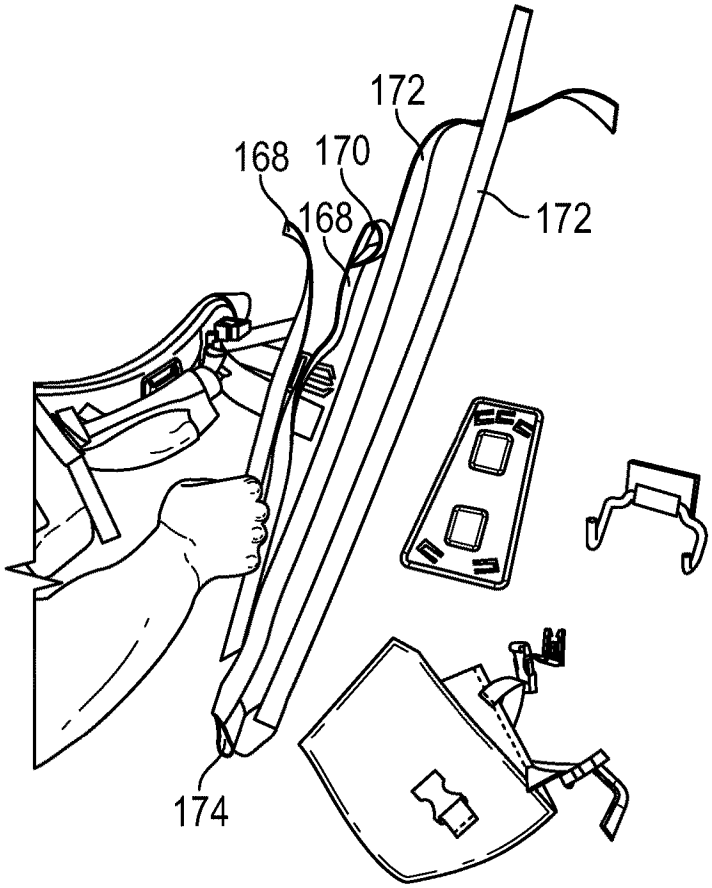
FIG. 28 representatively illustrates a step of securing the carrying assembly of FIG. 26 to a backpack.
Figure 27:
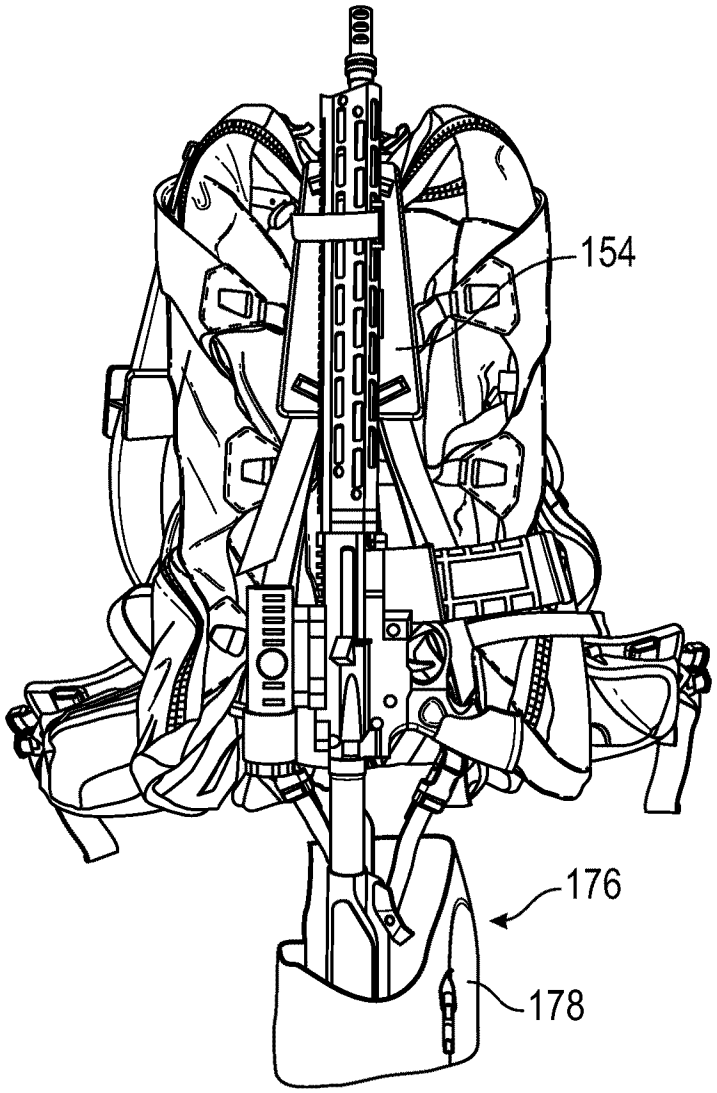
FIG. 27 representatively illustrates the carrying assembly of FIG. 26 secured to a backpack and carrying a rifle.
Figure 30:
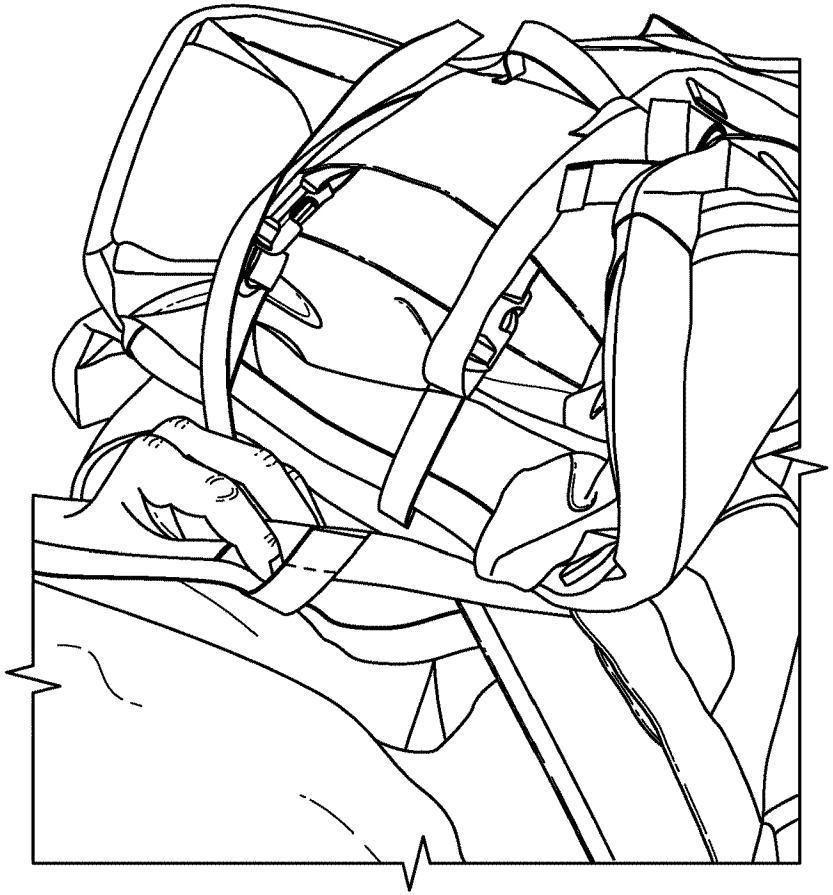
FIG. 30 representatively illustrates a step of securing the carrying assembly of FIG. 26 to a backpack.
Figure 29:
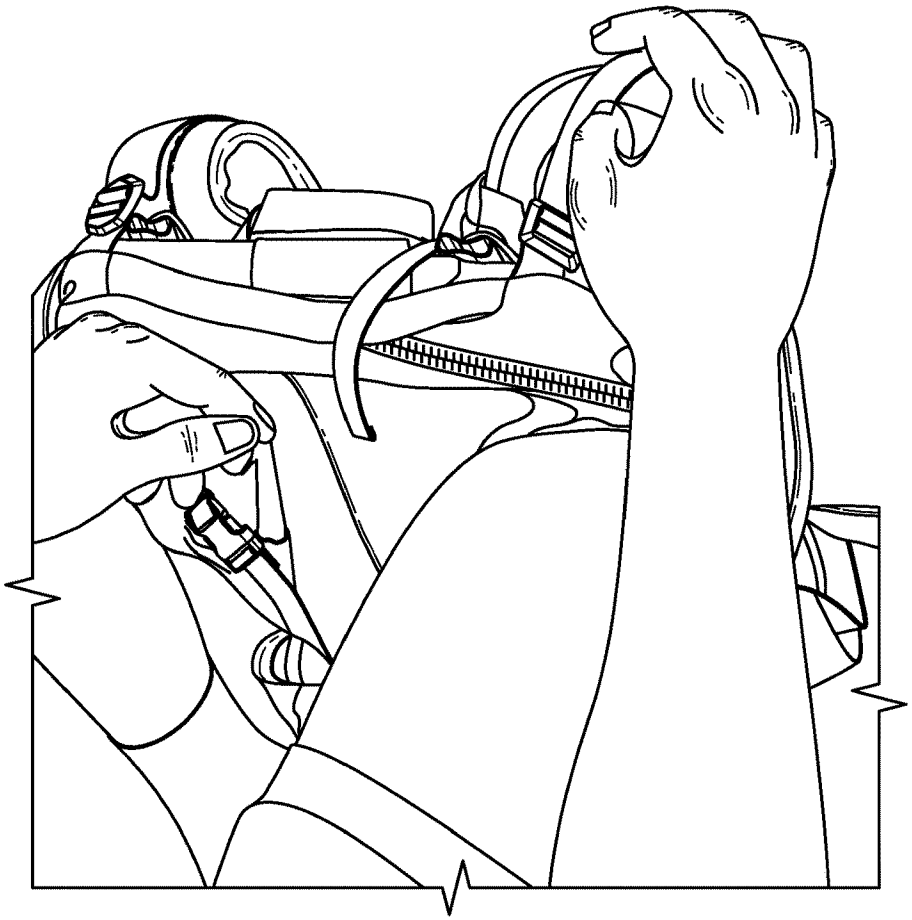
FIG. 29 representatively illustrates a step of securing the carrying assembly of FIG. 26 to a backpack.

In FIG. 28 disassembled elements of assembly 154 are shown. Top straps 168 each include a sewn loop 170, and bottom straps 172 each include a sewn loop 174. Although the backpack of FIG. 29 includes a carrying handle, one of the top straps is shown being looped around an arm strap near or at a top of the backpack, and the non-loop end threaded through the loop and pulled tight, to illustrate an example mechanism of securing the top strap to the backpack. The other top strap may be secured to the other arm strap in a similar manner, and this leaves the non-loop ends hanging loosely at a back of the backpack. Each bottom strap is secured to a portion of a waist strap proximate or at a bottom of the backpack, in a similar manner, as shown in FIG. 30. The top straps may be looped through the additional slots 166, and the bottom straps looped through the bottom slots 164, and adjusted and tightened (such as using a self-locking mechanism of the slots themselves, or by any other mechanism) to adjust the back plate to a desired position.

An optional cradle assembly 176 may be included. Cradle assembly 176 includes a cradle 178 having an upper edge 180 and a lower edge 182. A side flap 184 may be opened and closed to expose or cover the lower edge. A flap strap 186 couples with the flap (through intermediary straps) and also couples with coupler 188 (which may be a portion of a side-release buckle), such as through one or more slots of the coupler. A rear cradle strap 190 is coupled with a coupler 192 (which may be a corresponding portion of a side-release buckle), such as with one or more slots, and coupler 192 may be secured with coupler 188 to secure the cradle in the configuration in which the flap is wrapped around a back of the cradle and the lower edge is covered. In implementations this may be a more useful configuration for carrying a rifle or gun, and this is the configuration shown in FIG. 33.

Figure 34:
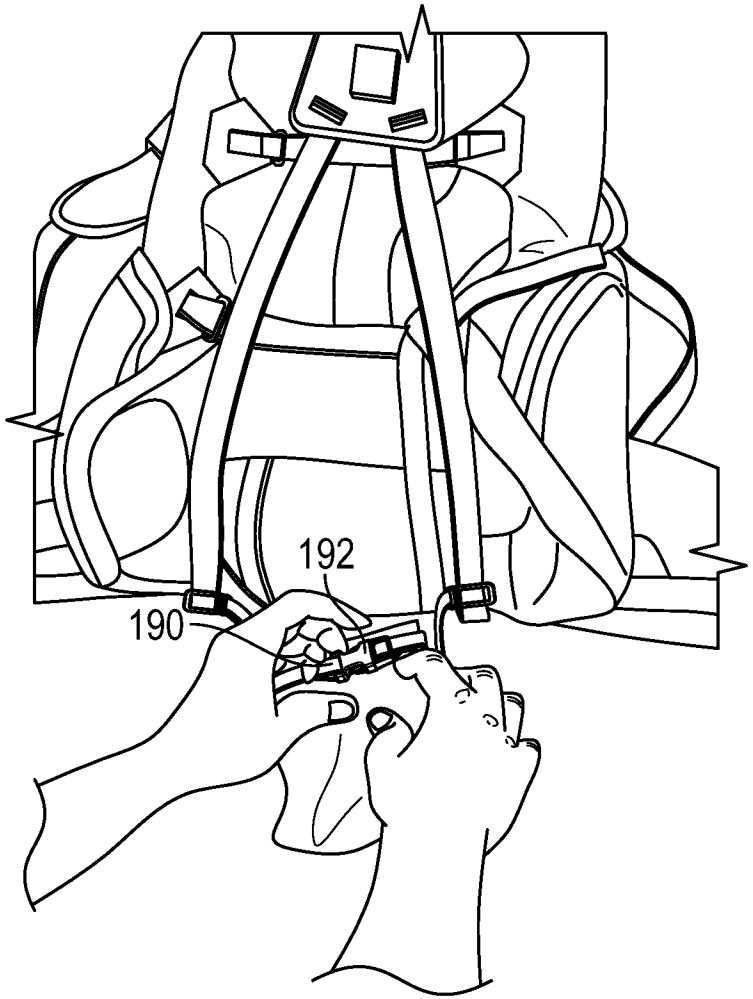
FIG. 34 representatively illustrates a step of reconfiguring a cradle assembly of the carrying assembly of FIG. 26 for carrying a bow.
Figure 33:
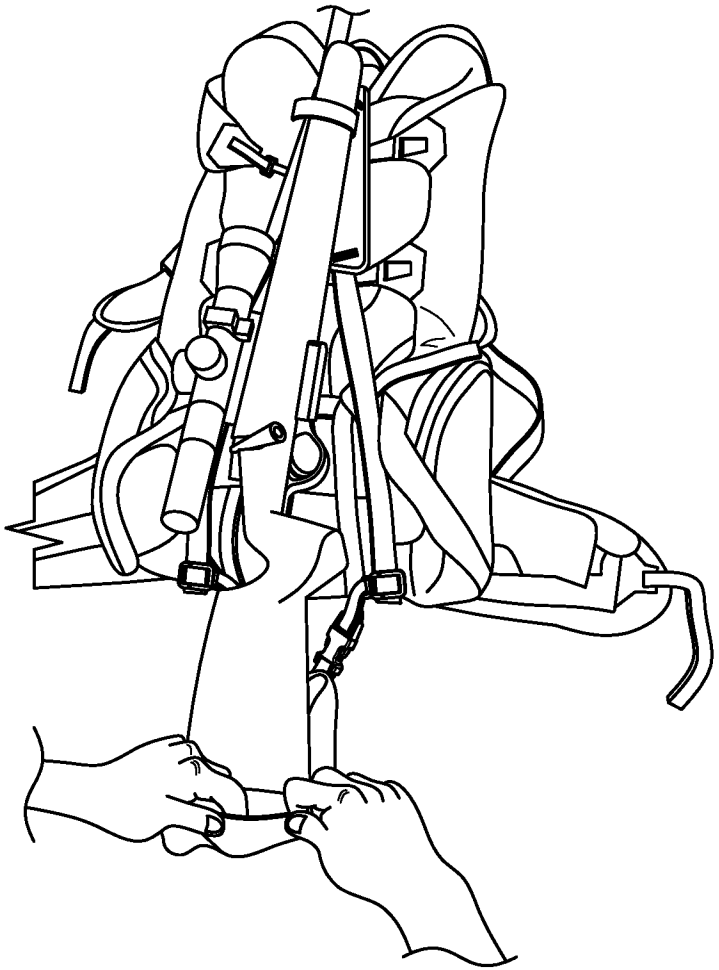
FIG. 33 representatively illustrates a step of securing a gun to the carrying assembly of FIG. 26.
Figure 36:
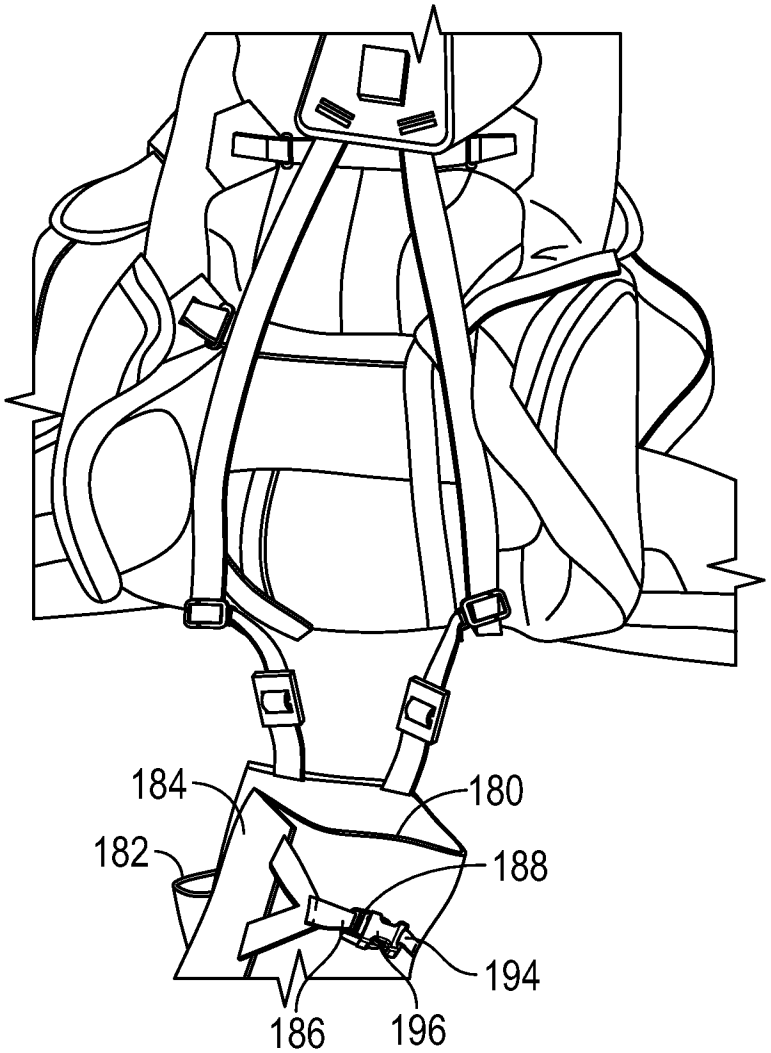
FIG. 36 representatively illustrates a step of reconfiguring a cradle assembly of the carrying assembly of FIG. 26 for carrying a bow.
Figure 35:
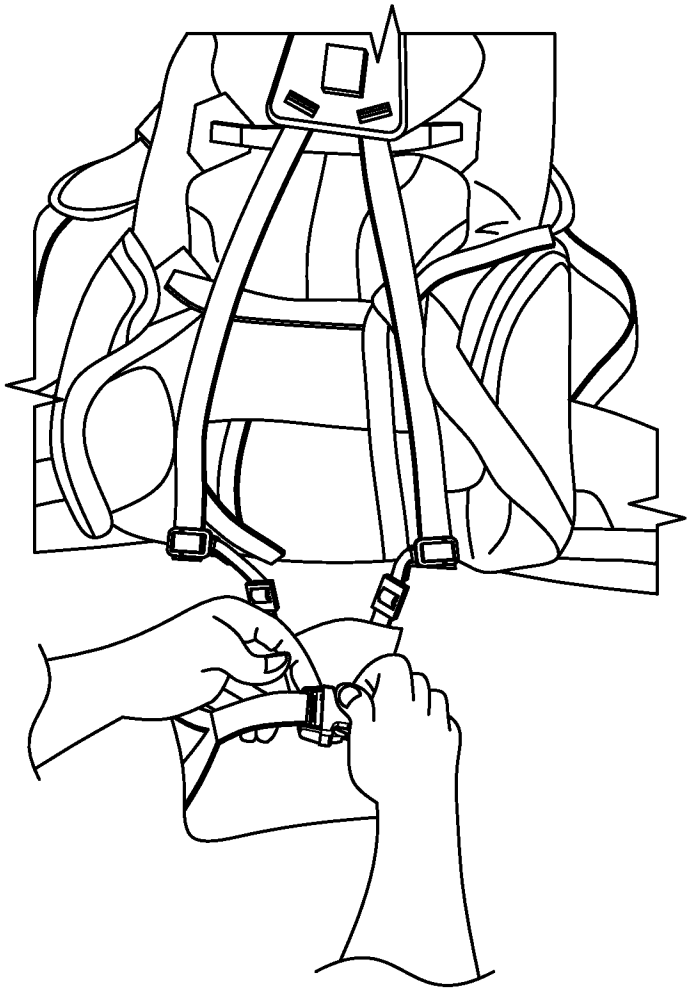
FIG. 35 representatively illustrates a step of reconfiguring a cradle assembly of the carrying assembly of FIG. 26 for carrying a bow.
Figure 38:
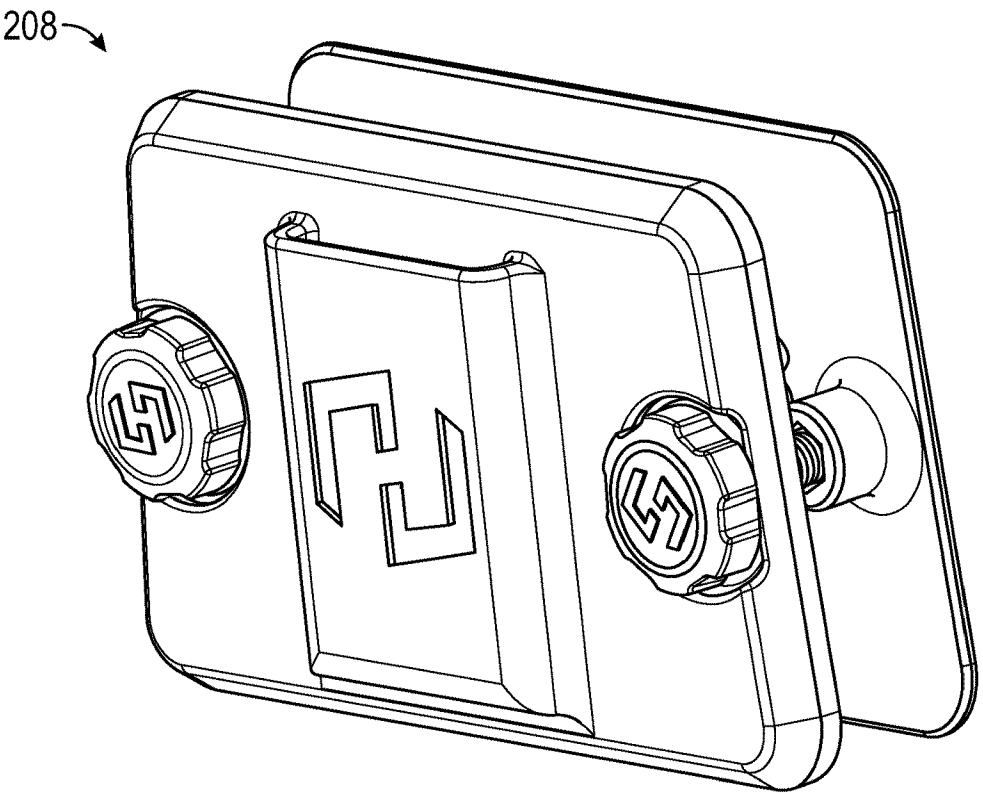
FIG. 38 is a front, top, right side view of a clip receiver assembly.
Figure 37:
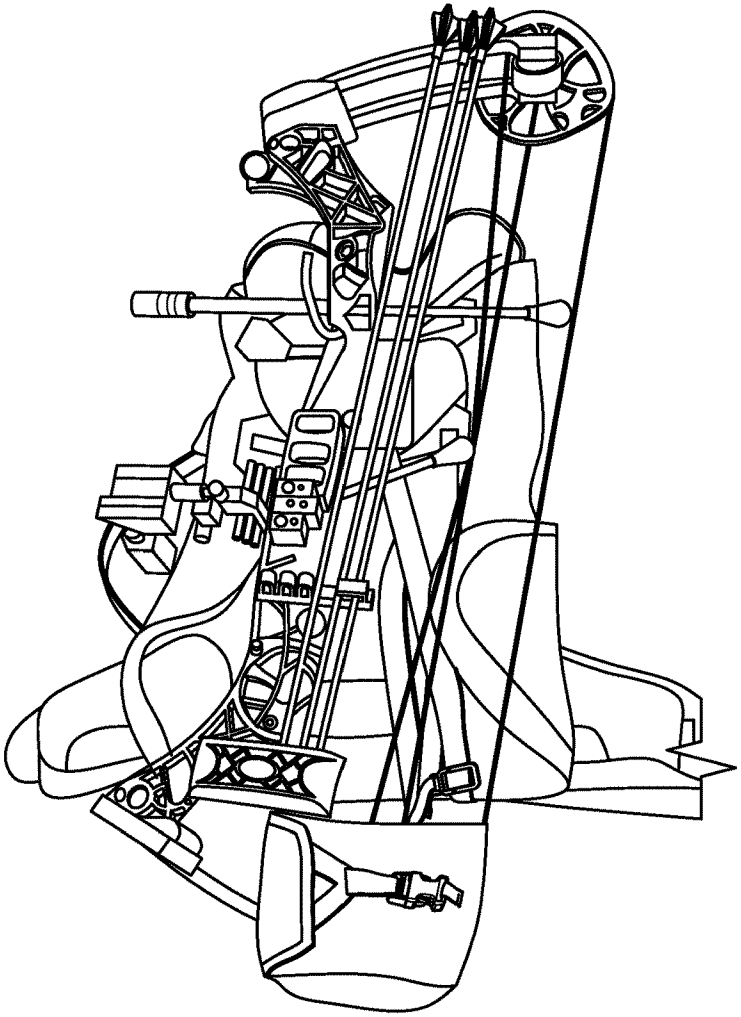
FIG. 37 representatively illustrates the carrying assembly of FIG. 26 carrying a bow.

In FIG. 34 the user has flipped the cradle around and is releasing the buckle, and in FIG. 35 the user has turned the cradle back around and wrapped the flap across the front of the cradle. The front of the cradle includes a front cradle strap 194 secured to a coupler 196 (such as using one or more slots of the coupler). In other implementations strap 194 may be excluded and coupler 196 could be directly sewn to or glued or otherwise affixed to the front of the cradle. Coupler 196 can mate with coupler 188, so that when the flap is in the configuration shown in FIG. 36 the user may secure couplers 188 and 196 together to secure the flap in this configuration. The now-exposed lower edge allows an element to extend out of the cradle through a side of the cradle (instead of only out of a top of the cradle). This is seen in FIG. 37 in which a portion of a bow (the cam or limb of the bow) extends out of the cradle through a side of the cradle, made possible by the lower edge 182. This configuration, with the flap secured open, accordingly may be more useful for carrying bows or other firearms or items which are sized/shaped in such a way that they are more easily (or better) secured with the flap open. Such an open configuration also makes it easier to deploy the bow—it being easier to deploy by allowing the cam/limb to easily slide out of the cradle when the user reaches back and pulls upward on the bow. Couplers 188 and 196 are male and female buckles, respectively, in the figures, though this configuration could be reversed and in some implementations non-buckle coupling elements could alternatively be used. It is pointed out that in some implementations strap 190 and coupler 192 could be excluded and strap 194 could be long enough or extendable enough and/or strap 186 long enough or extendable enough such that coupler 196 can wrap around to the front side of the cradle (toward the user/backpack) to be coupled with coupler 188 there to secure the cradle in the closed configuration.

Figure 26:
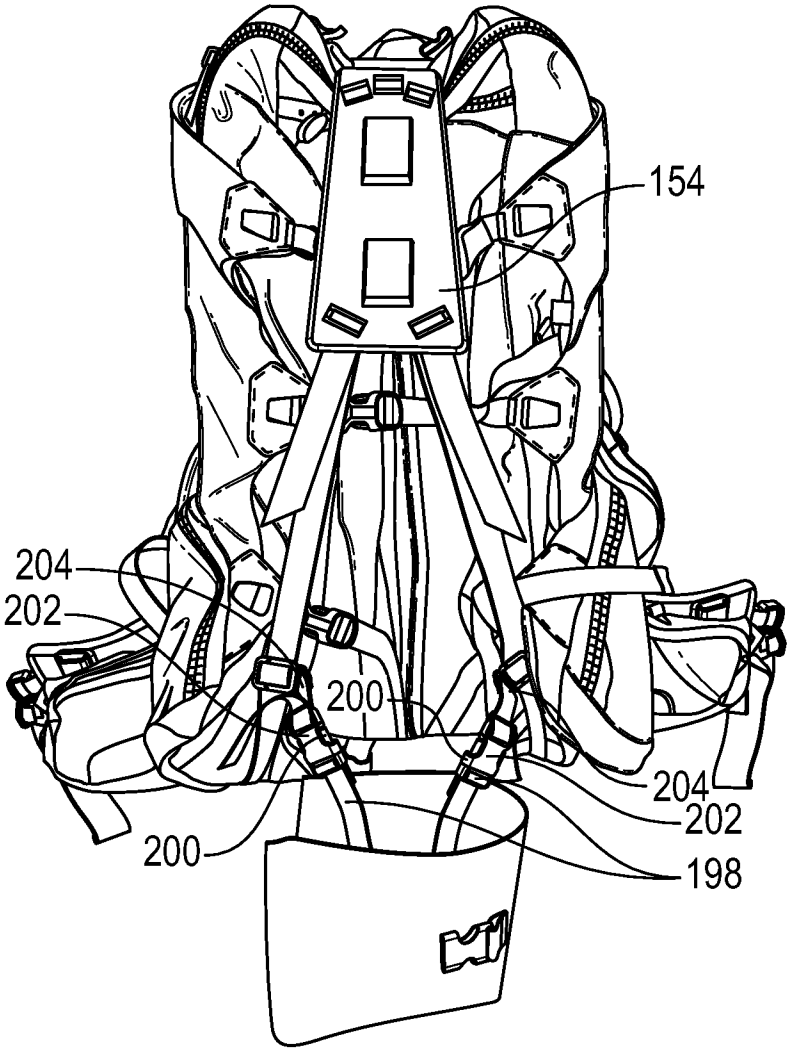
FIG. 26 representatively illustrates a carrying assembly secured to a backpack and further including a cradle assembly.
Figure 32:
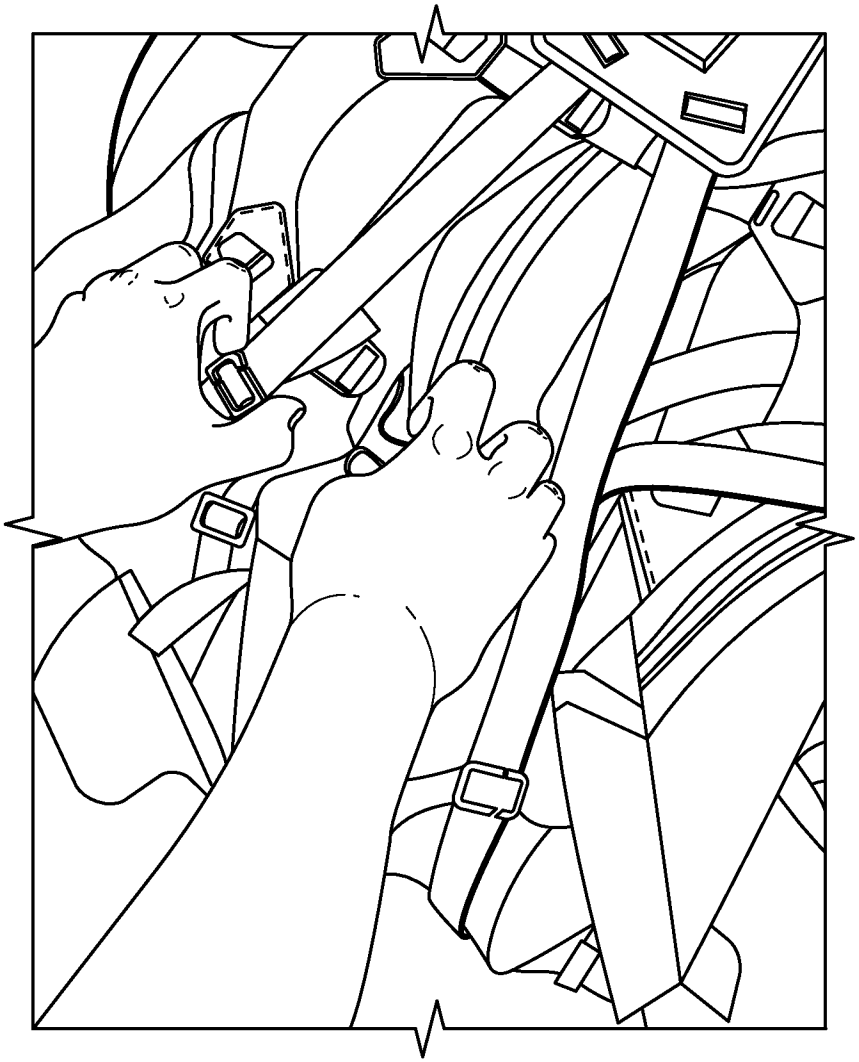
FIG. 32 representatively illustrates a step of securing the carrying assembly of FIG. 26 to a backpack.
Figure 31:
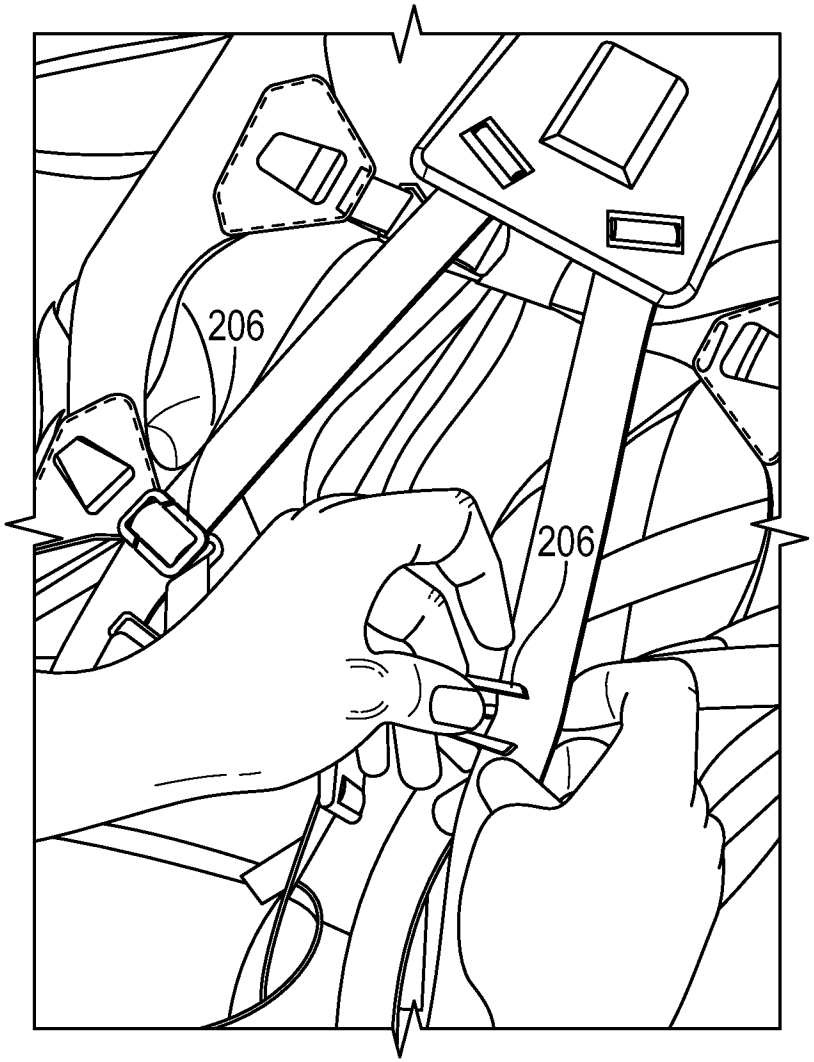
FIG. 31 representatively illustrates a step of securing the carrying assembly of FIG. 26 to a backpack.

FIG. 26 shows a few elements securing the cradle to the bottom straps 172. Lower straps 198 are secured to the cradle (such as sewn thereto) and are secured through one or more slots of couplers 200 (which in the example are portions of side-release buckles). Couplers 200 are in turn releasably coupled with couplers 202 (which in the example are complementary portions of side-release buckles). Top straps 204 are coupled through one or more slots of couplers 202 and are in turn coupled through one or more slots of clips 206. In FIG. 31 one clip 206 is shown already secured to a bottom strap 172 and another is being secured to the other bottom strap. In FIG. 32 the user has slid one of the clips to a lower position and is adjusting the other clip to a similar position (showing the adjustability of the cradle position by sliding the clips, and further adjustments may be made by adjusting the various straps relative to slots through which they are looped).

The cradle assemblies disclosed herein provide a second securing mechanism for a gun or bow or the like. This may be especially useful in situations where a user is in positions other than standing/walking or is in much motion, such as riding a bike or a motorized vehicle, climbing or scrambling or otherwise situated along a grade or cliff, etc. After a user secures the gun or bow or other element to the back plate using a clip of a firearm strap assembly, the user may put the butt of the gun or bottom of the bow or other element in the cradle and may adjust straps and clips and etc. as needed to ensure a secure configuration. Any of the cradle assemblies disclosed herein may include one or more or all details disclosed in Appendix A.

Figure 39:
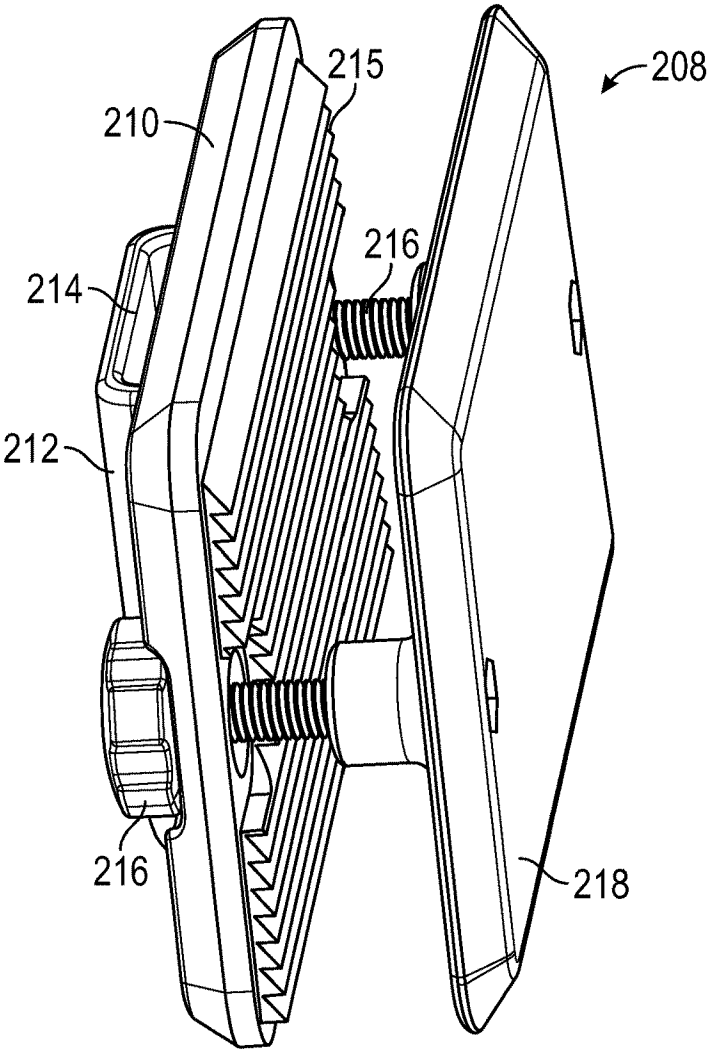
FIG. 39 is a rear, top, left side view of the clip receiver assembly of FIG. 38.

FIGS. 38-39 and 41-42 show an example clip receiver assembly 208 which includes a first member 210. The first member includes a clip receiver 212 which includes an opening 214 providing access to a cavity. The first member includes through-holes through which adjusters 216 may pass. Adjusters may be or may include bolts, screws, or any other threaded adjuster, with or without turning knobs or the like at their heads (FIG. 39 shows versions that are essentially thumbscrews with turning knobs). The adjusters may be used to tighten and loosen the first member relative to a second member 218. The second member includes through-holes and the adjusters may be secured thereto either using threads of the second member's through-holes, or using one or more nuts at a back of the second member. The first member includes ridges 215 which are useful to provide grip when the assembly 208 is secured to an item. The adjusters allow the assemblies 208 to be secured to straps/belts and other items of various thicknesses.

Figure 40:
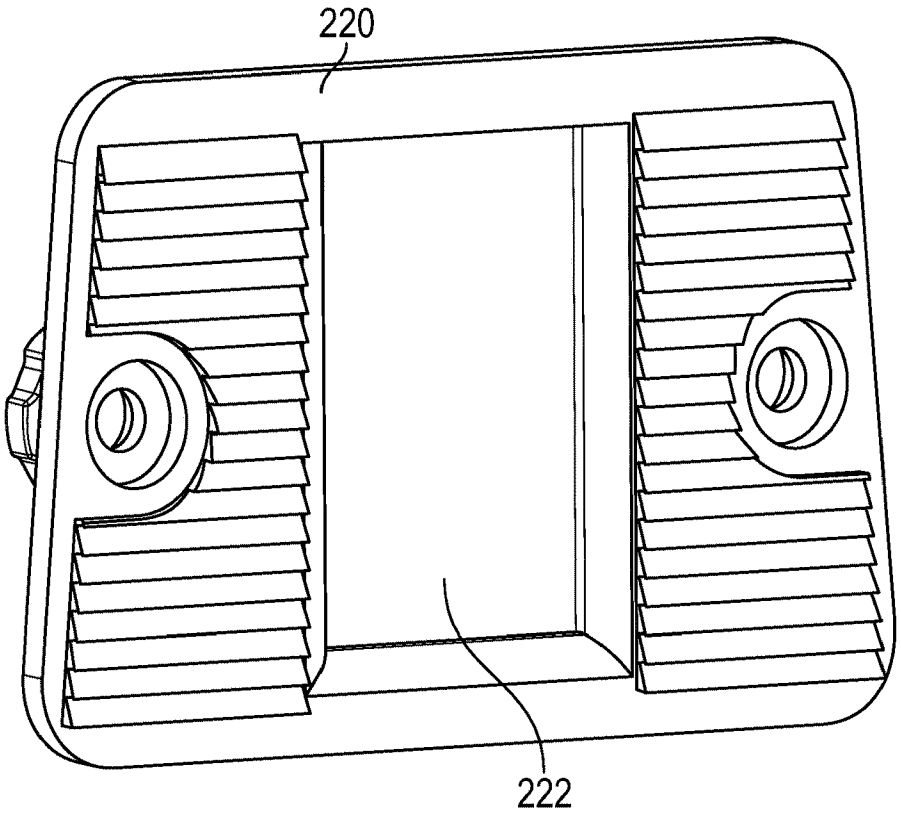
FIG. 40 is a rear, top, left side view of an alternate first member of the clip receiver assembly of FIG. 38.

FIG. 40 shows an alternative first member 220 which includes a cavity 222 which is exposed at a back of the first member. This configuration may be useful for providing a locking mechanism similar to that described below in conjunction with FIGS. 98-106.

Figure 42:
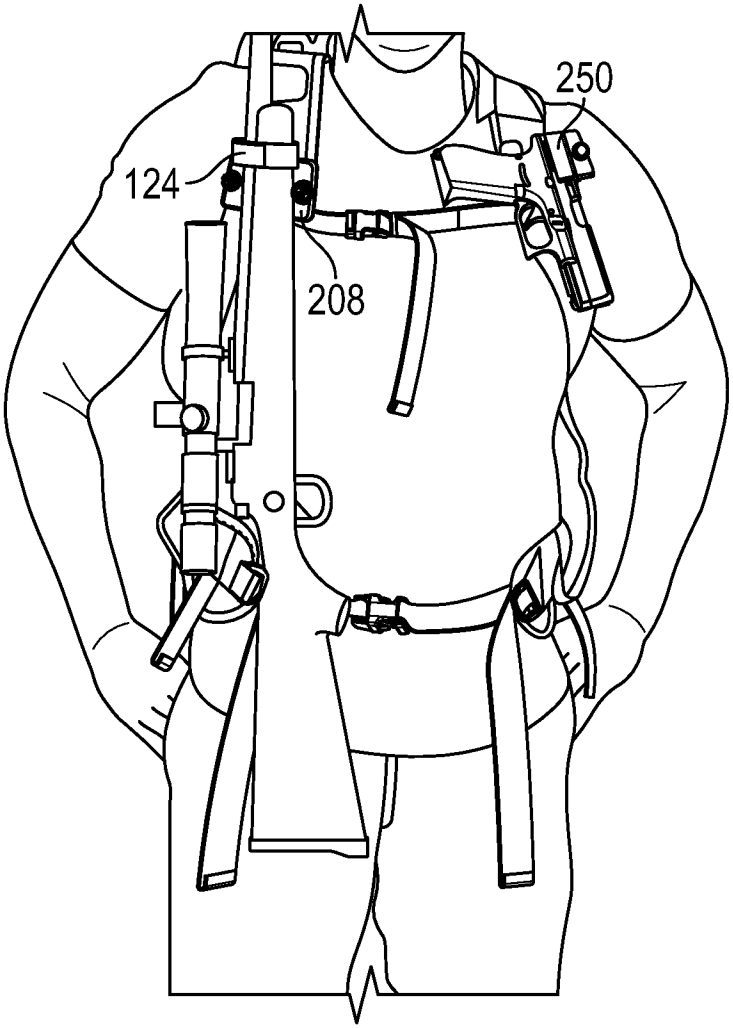
FIG. 42 representatively illustrates a rifle and a pistol secured to the clip receiver assemblies of FIG. 41.
Figure 41:
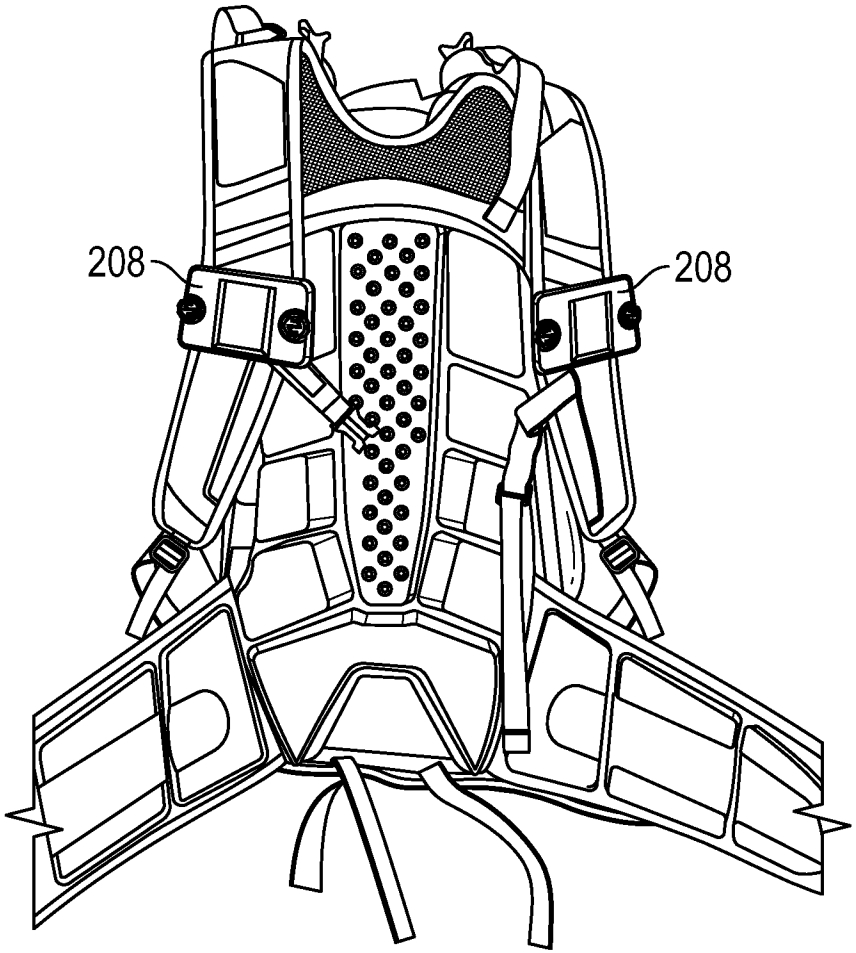
FIG. 41 representatively illustrates two clip receiver assemblies of FIG. 38 coupled with shoulder straps of a backpack.
Figure 44:
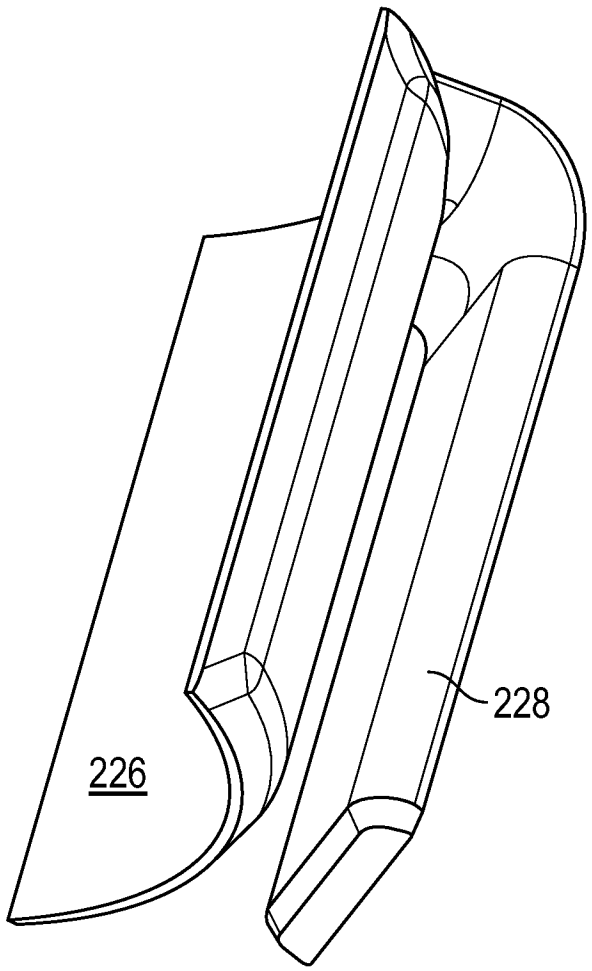
FIG. 44 is a rear, bottom, left side view of the bottle clip member of FIG. 43.
Figure 43:
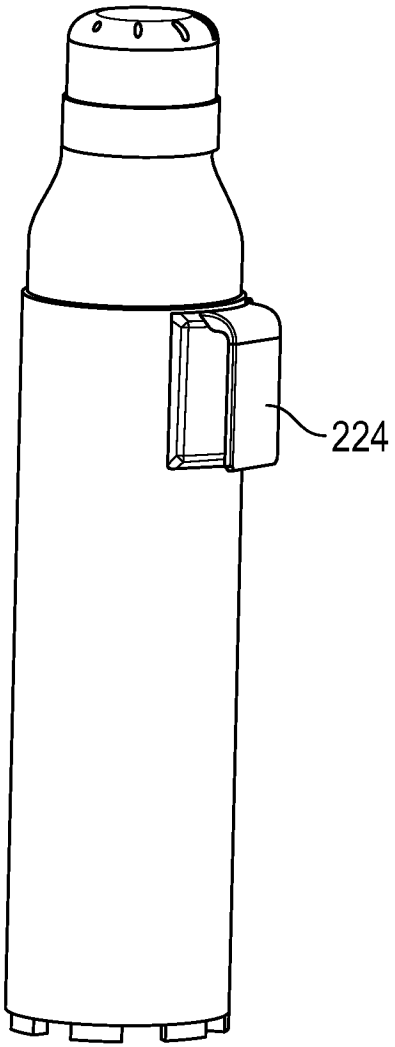
FIG. 43 is a front, top, left side view of a bottle clip member secured to a bottle.

In FIG. 41 assemblies 208 have been secured to arm straps of a backpack by tightening the adjusters. In FIG. 42 the user has coupled a rifle with one of the assemblies 208 (using above-described firearm strap assembly 124), and has coupled a handgun with the other assembly 208 (using below-described gun coupler 250). The rifle and handgun are held secured by gravity and/or a friction fit, but may easily manually be secured in such positions and removed from such positions, as desired by the user, such as for a quick aiming and shooting. Clip receiver assemblies 208 may be coupled with backpack shoulder straps, waist belts, a sling draped across the user's chest, a satchel strap, or any other flat object or strap.

Figure 46:
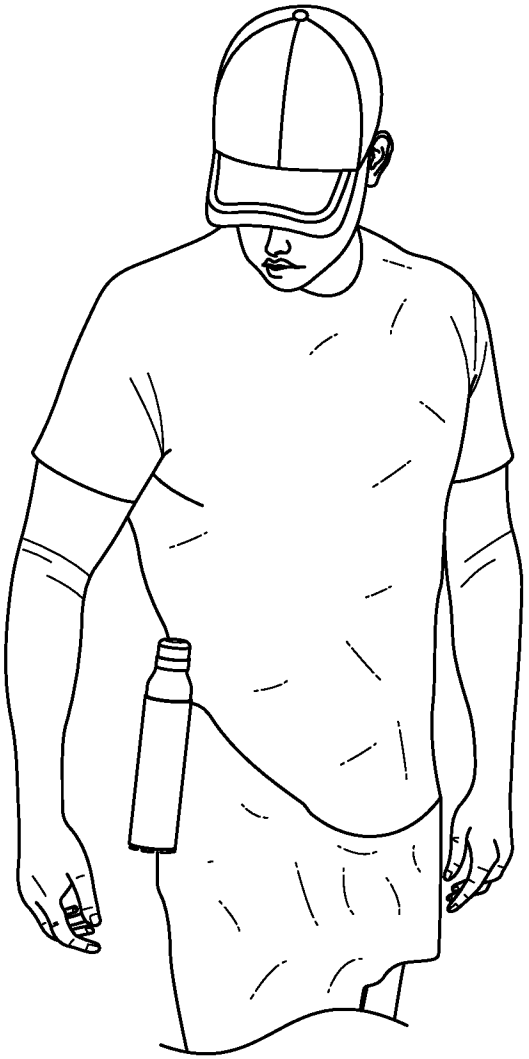
FIG. 46 representatively illustrates a bottle secured to a user's shorts using the bottle clip member of FIG. 43.
Figure 45:
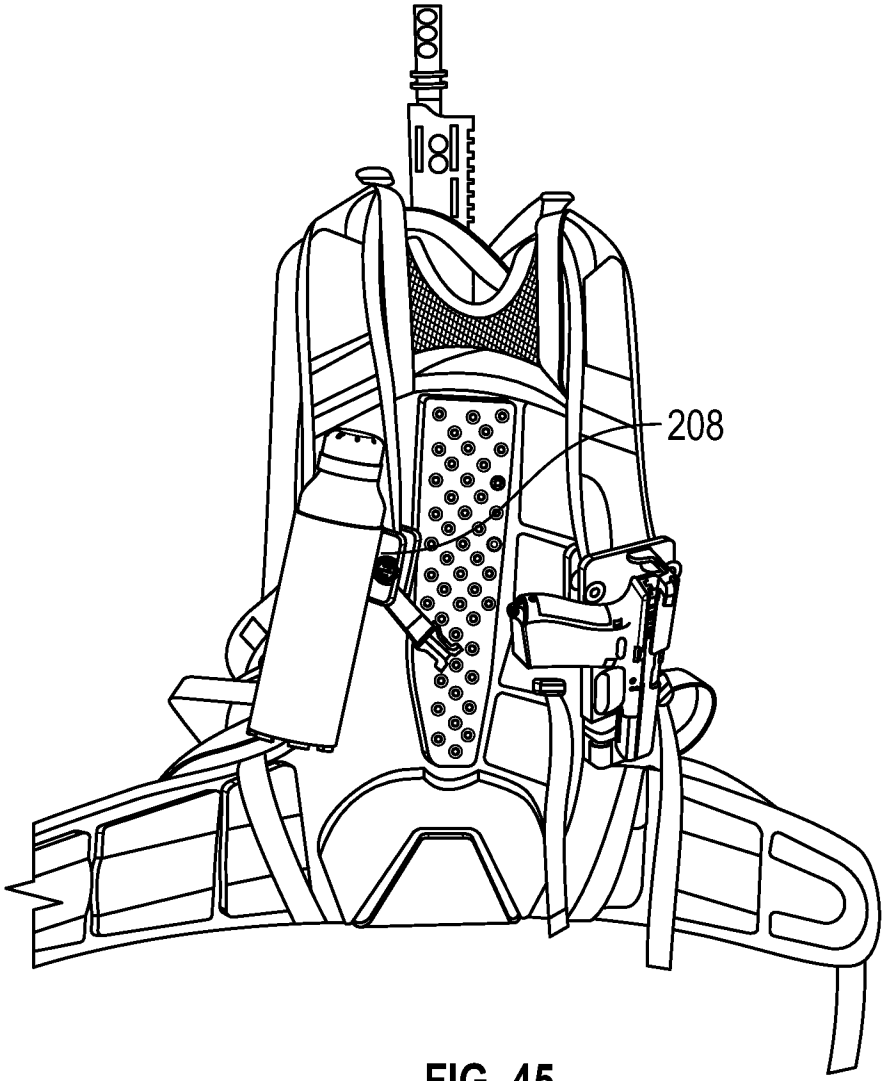
FIG. 45 representatively illustrates a bottle and a pistol secured to the clip receiver assemblies of FIG. 41.

FIGS. 43-46 show a bottle clip member 224 which includes a first surface 226 having a curvature to match a curvature of a bottle or drinking container or other curved item, and a clip 228 which may be used to secure within any clip receiver described herein (indeed, any clips of any elements described herein may be secured within any clip receiver of any element described herein). Adhesive is not shown, but an adhesive may be included at or on surface 226 and may be used to secure the bottle clip member 224 to a bottle. FIG. 45 shows a bottle secured with a clip receiver assembly 208 (which is in turn secured to a backpack shoulder strap) by a bottle clip member which is secured to the bottle. In FIG. 46 the user is using the clip of the bottle clip member to secure a bottle to a waistband of the user's shorts. The clip can alternatively be secured to the user's pocket or any other secure edge of any item. Bottle clip members may allow a water bottle to be secured to backpack shoulder straps, a back plate as disclosed herein, a waist belt, a backpack waist strap, and so forth. When coupled with a shoulder strap the bottle may be close enough to the mouth that a bottle with a straw may be used hands free or at least without dismounting the bottle.

Figure 112:
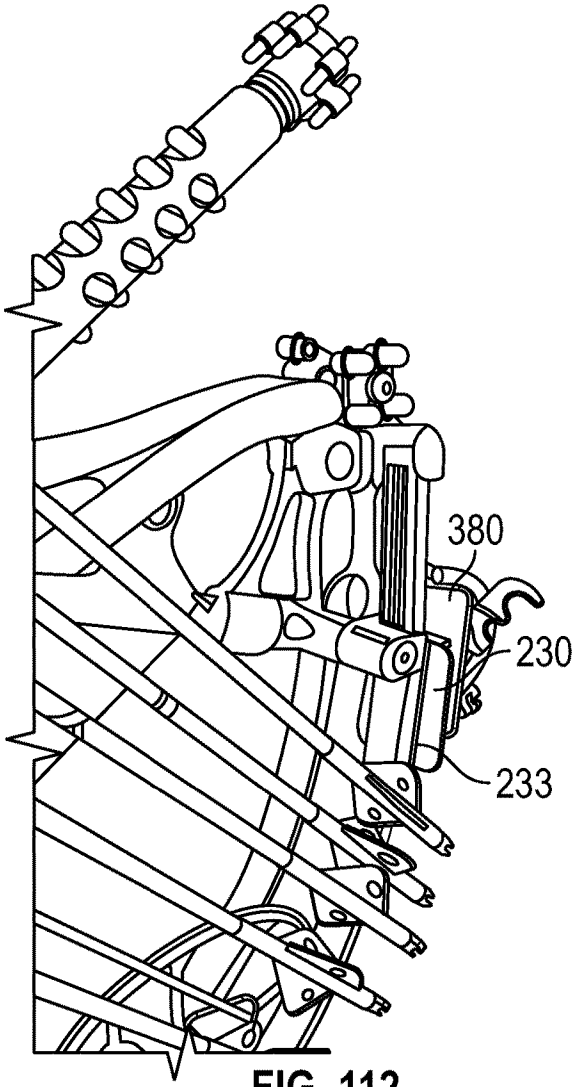
FIG. 112 is a rear, left side, top view of the carrying assembly of FIG. 107 in the closed configuration secured to a bow.

FIGS. 47-57 and FIG. 112 show an example clip receiver assembly 230 which includes a flat member 232 and an adhesive 233. One example adhesive is shown in FIG. 112 which is a narrow adhesive strip configured for coupling with a portion of a bow, but in other implementations the adhesive may cover more or all or substantially all of the back of the flat member. Assembly 230 includes a clip receiver 234 which has an opening 236 providing access to a cavity. The clip receiver may be used to receive any clips disclosed herein, for coupling any items thereto.

Figure 48:
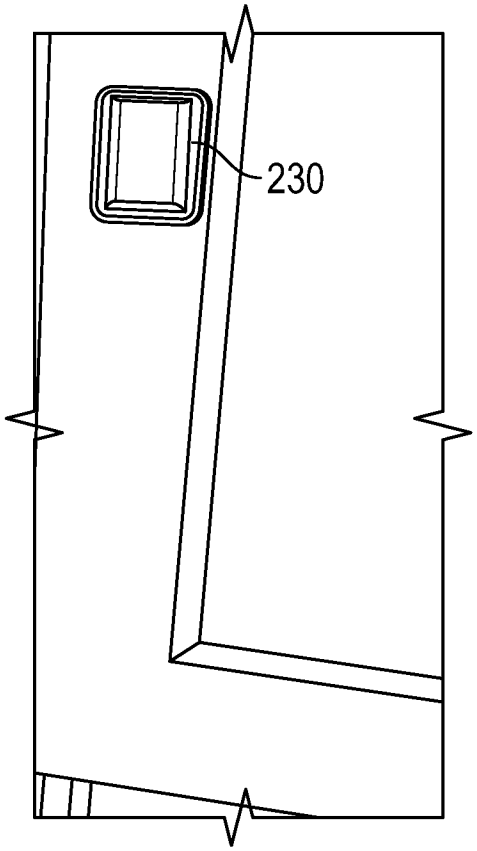
FIG. 48 is a front view of the clip receiver assembly of FIG. 47 secured to a cupboard door.
Figure 47:
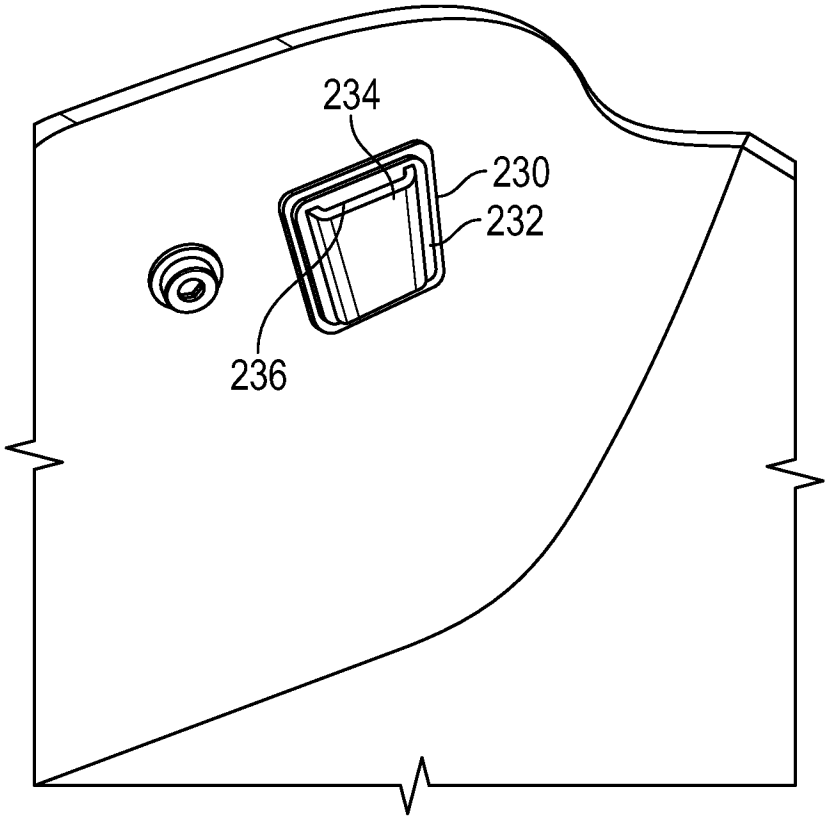
FIG. 47 is a front, top, left side view of a clip receiver assembly secured within a motorcycle storage compartment.
Figure 50:
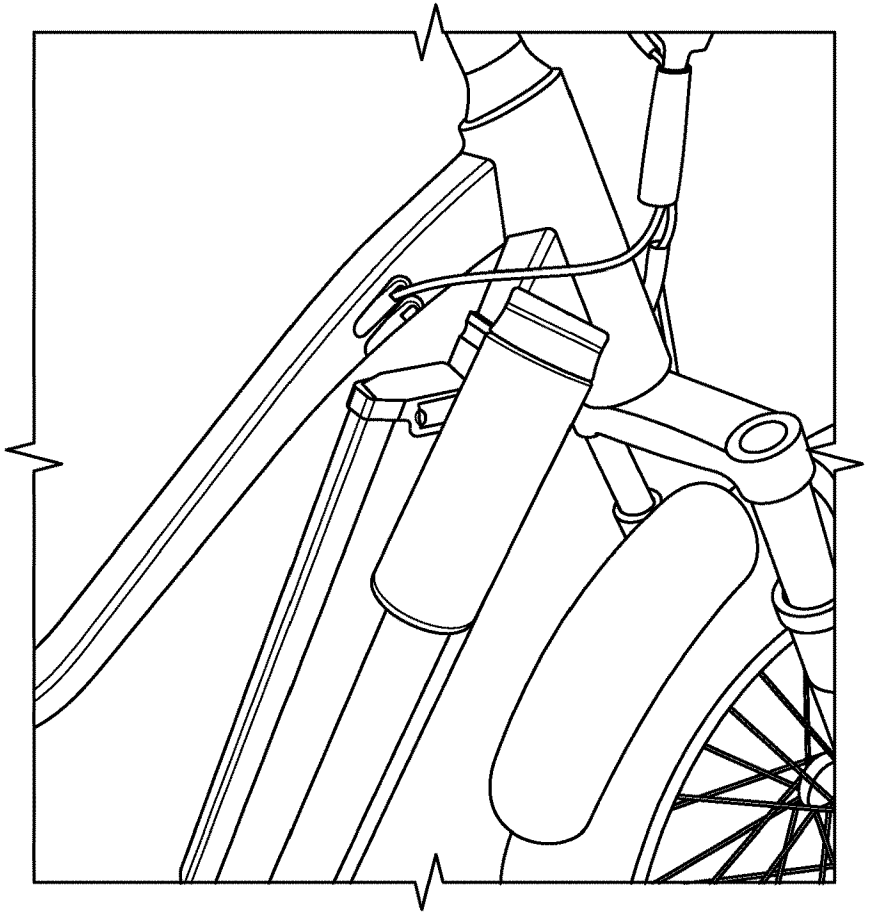
FIG. 50 representatively illustrates a water bottle secured to the bicycle of FIG. 49 using the clip receiver assembly.
Figure 49:
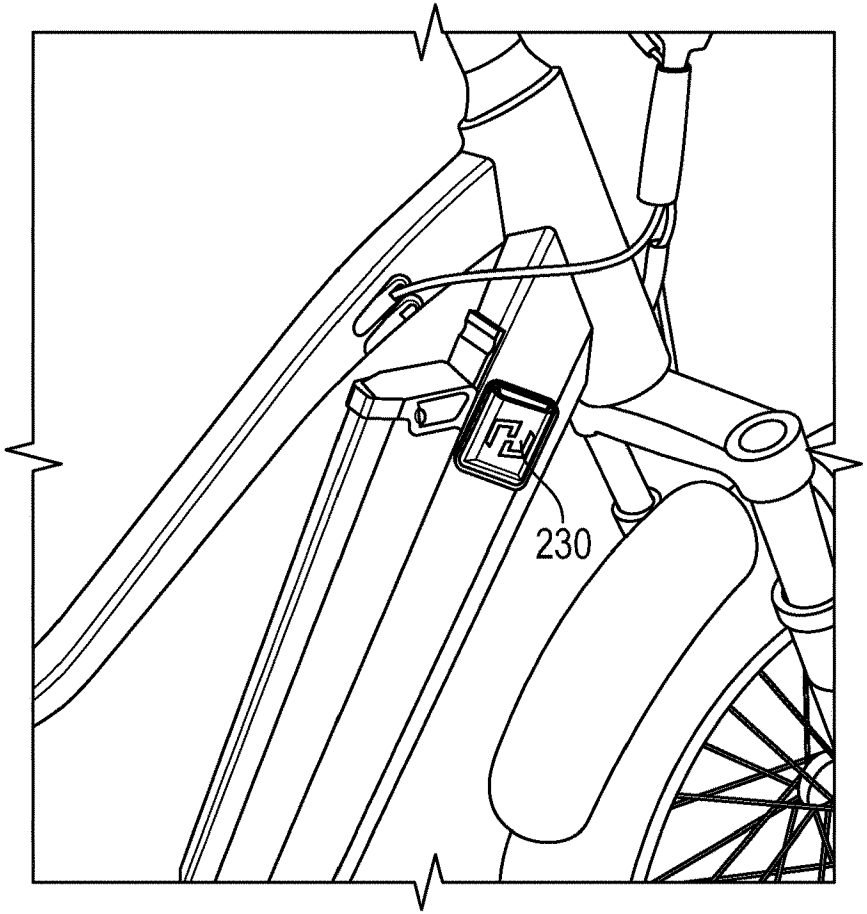
FIG. 49 representatively illustrates the clip receiver assembly of FIG. 47 secured to a bicycle.
Figure 51:
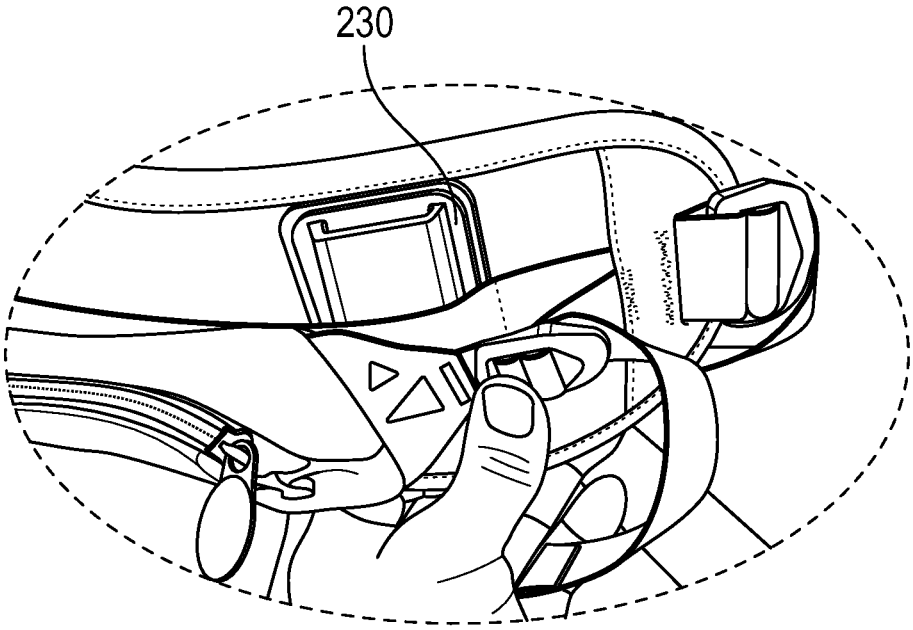
FIG. 51 representatively illustrates the clip receiver assembly of FIG. 47 secured to a waist strap of a backpack.
Figure 52:
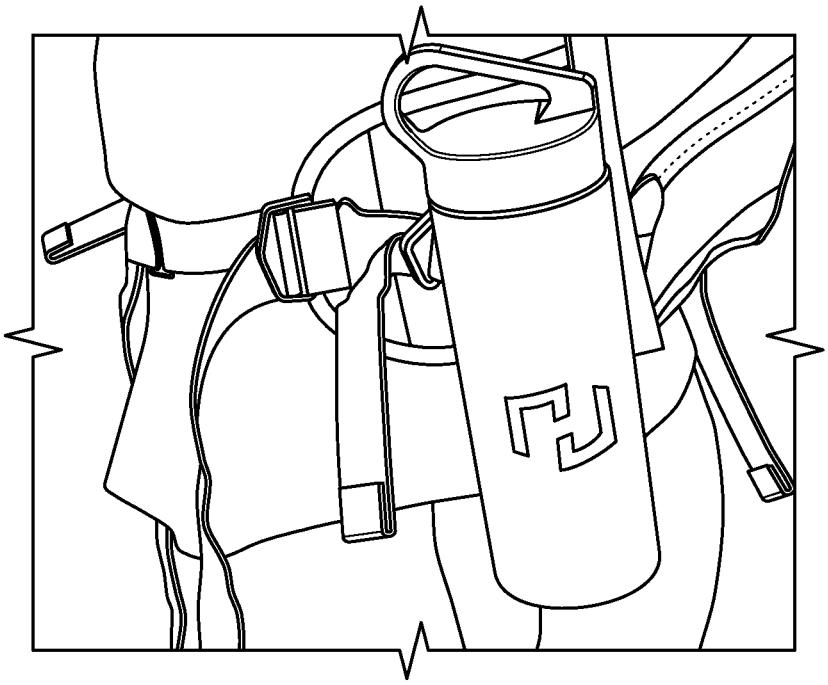
FIG. 52 representatively illustrates a water bottle secured to the waist strap of FIG. 51 using the clip receiver assembly.
Figure 54:
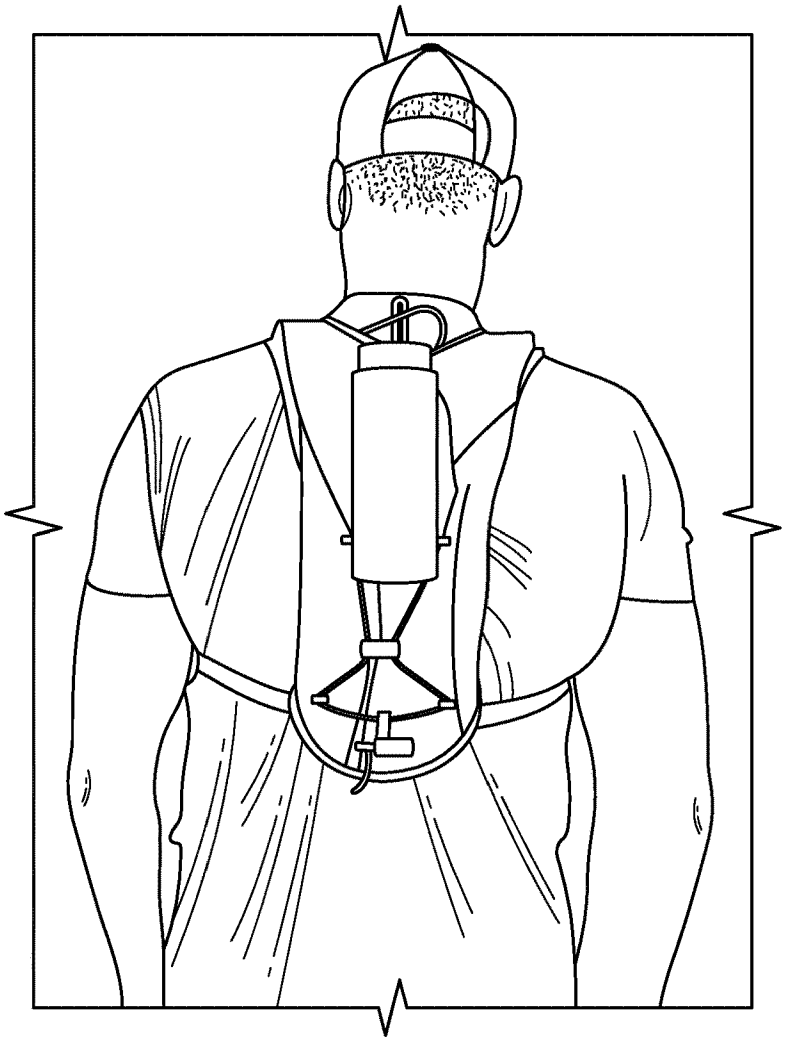
FIG. 54 representatively illustrates a water bottle secured to the hydration backpack of FIG. 53 using the clip receiver assembly.
Figure 53:
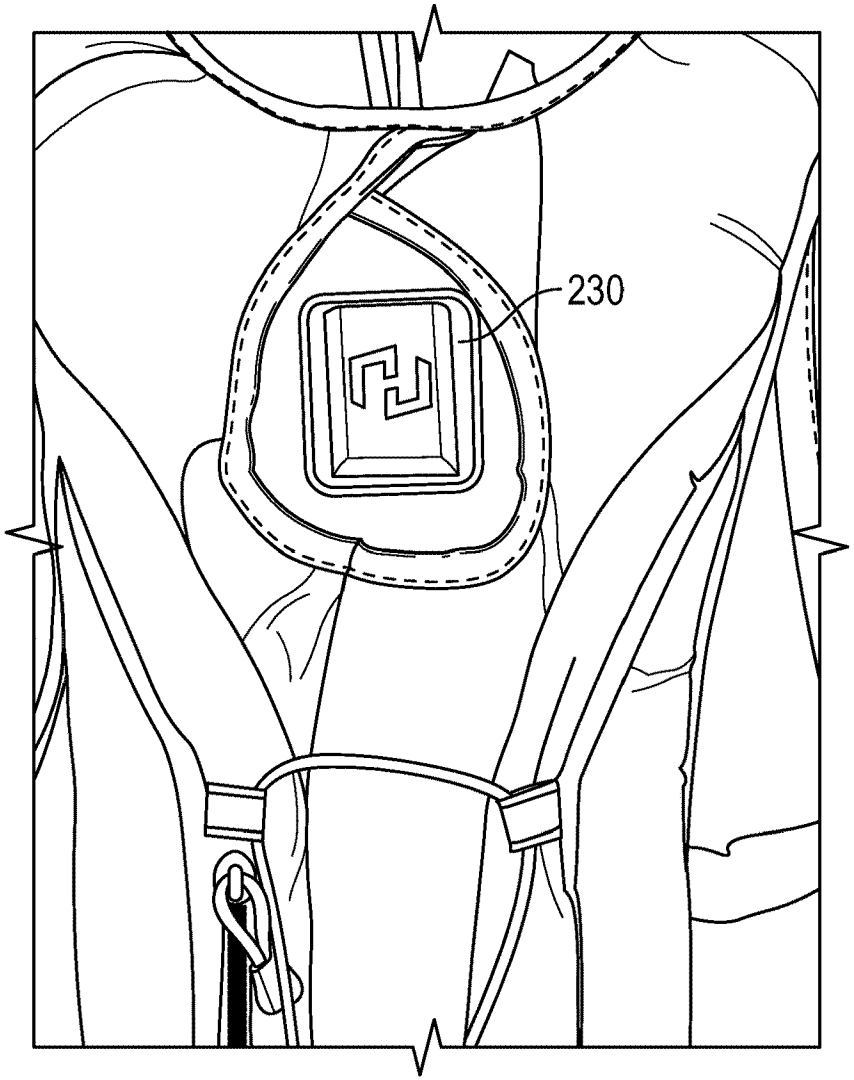
FIG. 53 representatively illustrates the clip receiver assembly of FIG. 47 secured to a hydration backpack.
Figure 56:
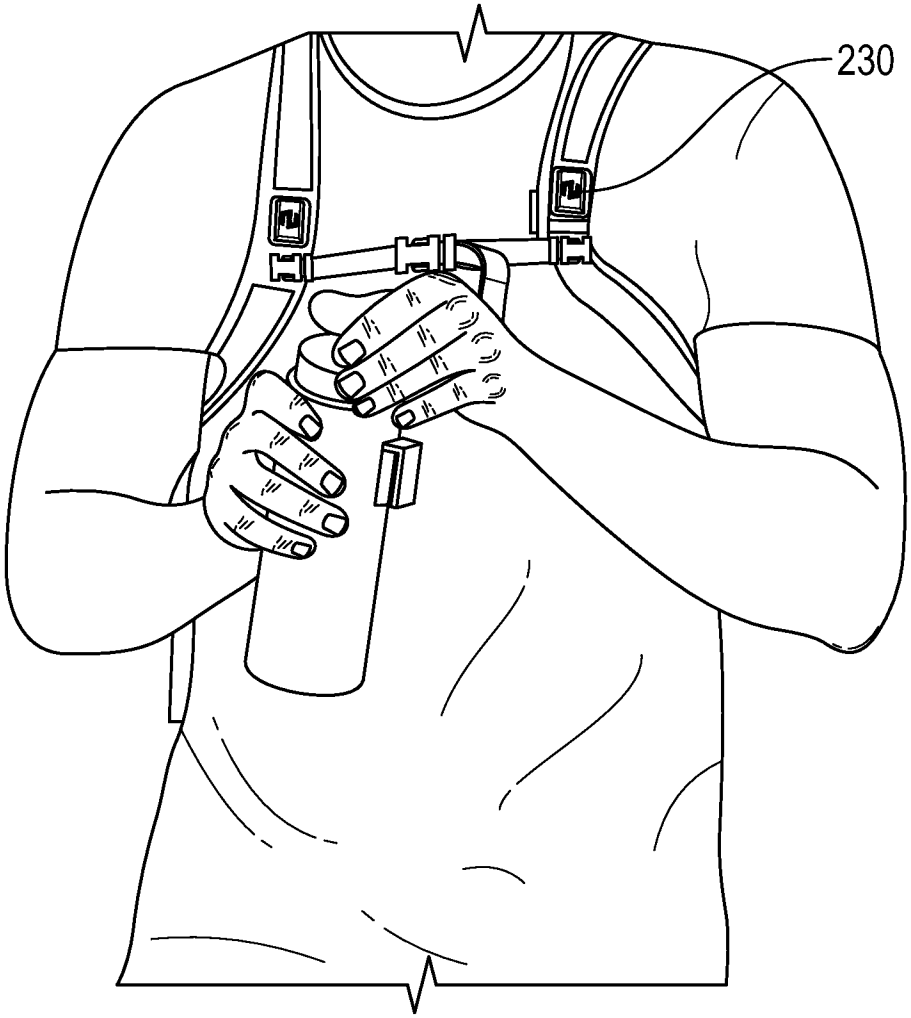
FIG. 56 representatively illustrates a user using the water bottle of FIG. 54.
Figure 55:
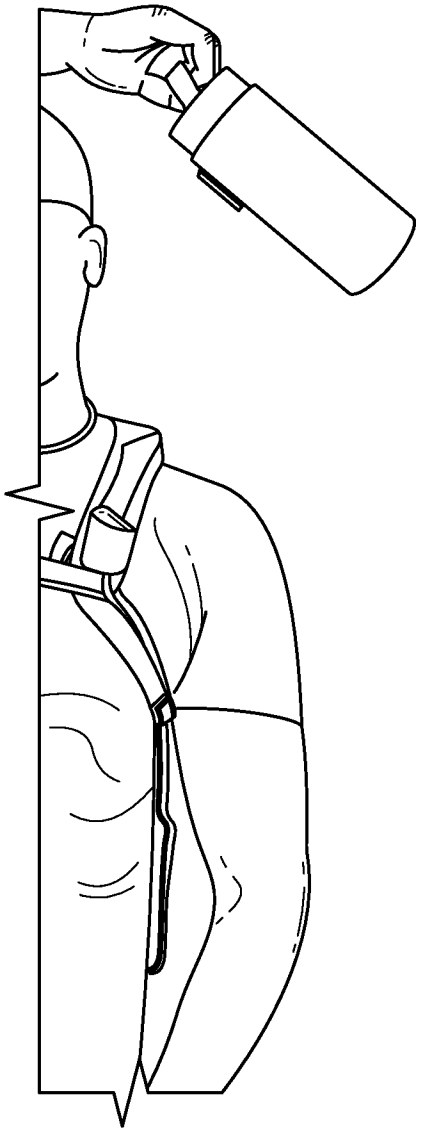
FIG. 55 representatively illustrates a user removing the water bottle of FIG. 54 from the clip receiver assembly.

In FIG. 47 the assembly 230 is coupled within a motorcycle storage compartment. In FIG. 48 clip receiver assembly 230 is adhered to the inside surface of a cabinet door. In FIG. 49 the assembly 230 is adhered to a bicycle frame, and in FIG. 50 a drinking container is secured thereto using a bottle clip member 224. In FIG. 54 assembly 230 has been secured to a waist strap of a backpack. Another assembly 230 is secured to the other waist strap, and in FIG. 52 a bottle is coupled to the assembly 230 by virtue of a bottle clip member 224. In FIG. 53 an assembly 230 is adhered to a flat portion of a hydration backpack, and in FIG. 54 the user has secured a water bottle thereto using a bottle clip member 224. When the user desires a drink the user may easily reach backwards to remove the bottle and take a drink, as in FIG. 55. FIG. 56 reveals that an assembly 230 is adhered to a shoulder strap of the hydration backpack, and in FIG. 57 the user has secured the bottle to this assembly 230 using a bottle clip member 224. Clip receiver assemblies 230 may be mounted anywhere (under a desk, inside a glove box, on the inside of a vehicle door, on a center console of a vehicle, etc.) and may be used to mount a pistol or water bottle or any other item thereon.

Figure 58:
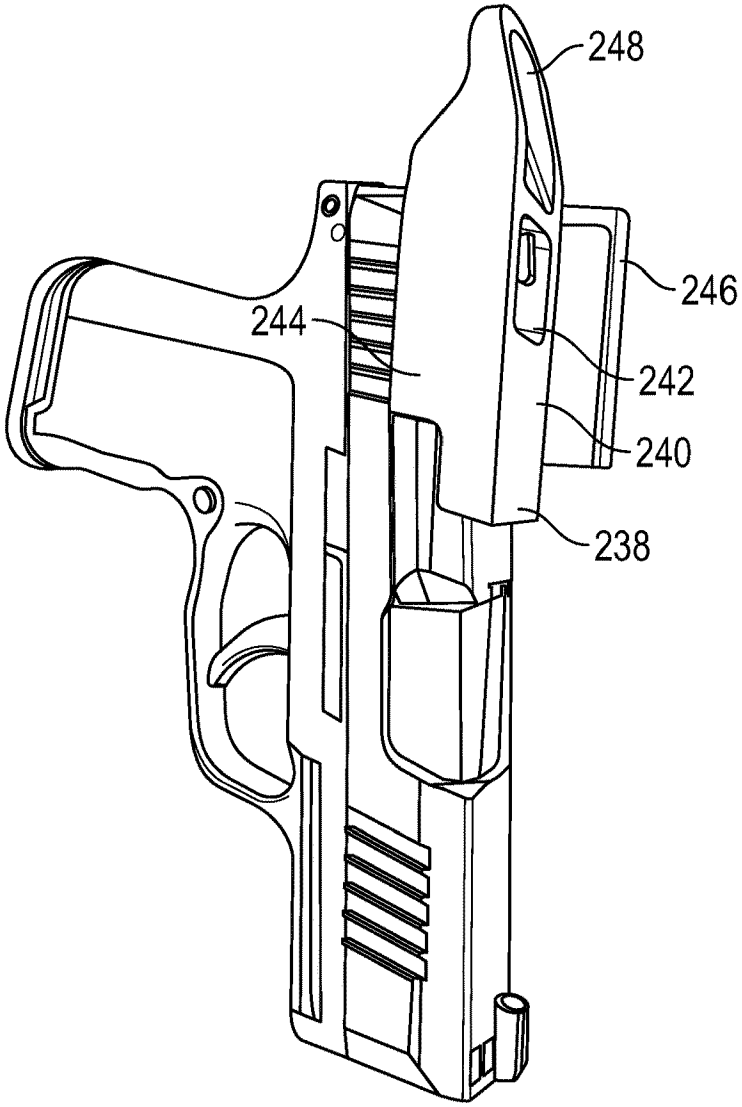
FIG. 58 is a top, right view of a gun coupler secured to a gun.
Figure 57:
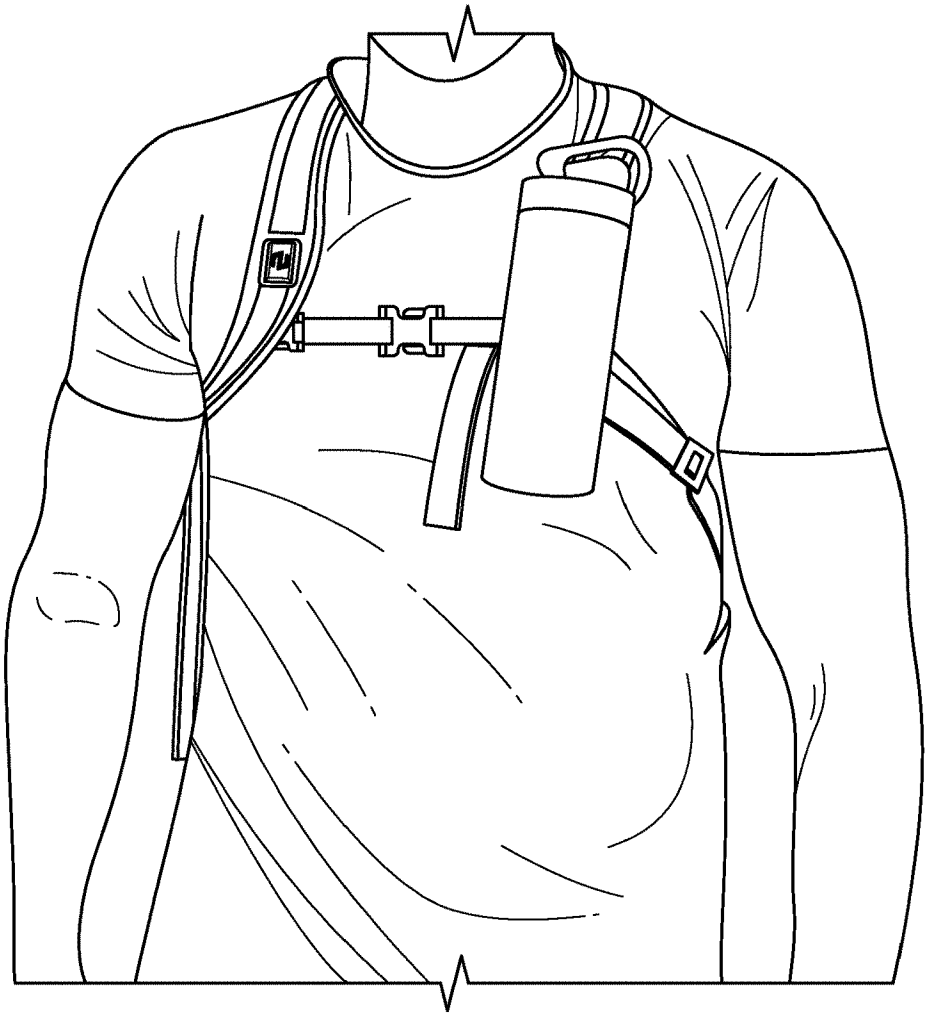
FIG. 57 representatively illustrates the water bottle of FIG. 54 secured to a clip receiver assembly of FIG. 47 in turn secured to a backpack shoulder strap.
Figure 60:
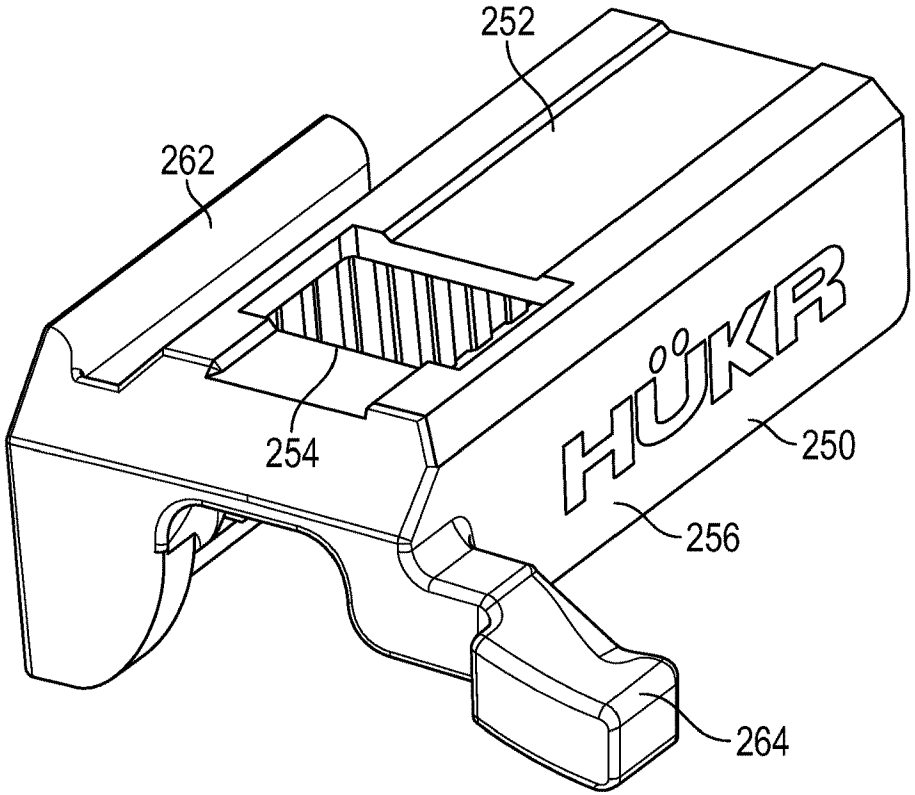
FIG. 60 is a top, rear, right view of another gun coupler.
Figure 59:
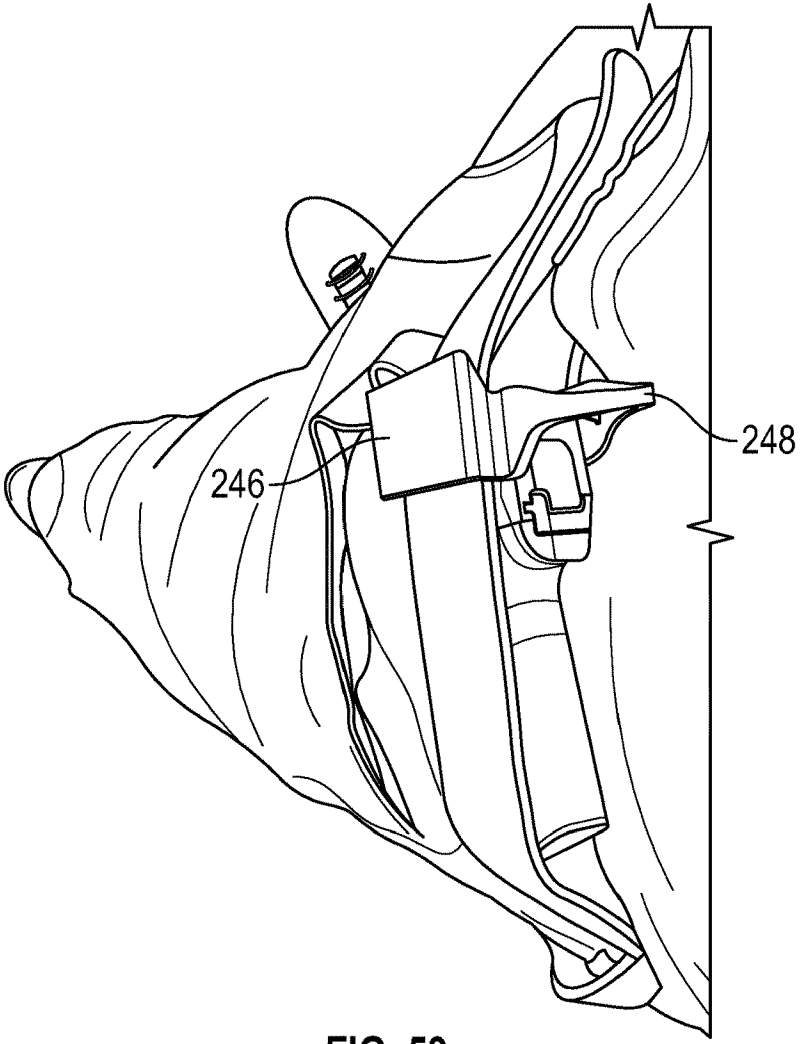
FIG. 59 is a rear, left view of the gun and gun coupler of FIG. 58 secured to a waistband of a user's pants.
Figure 62:
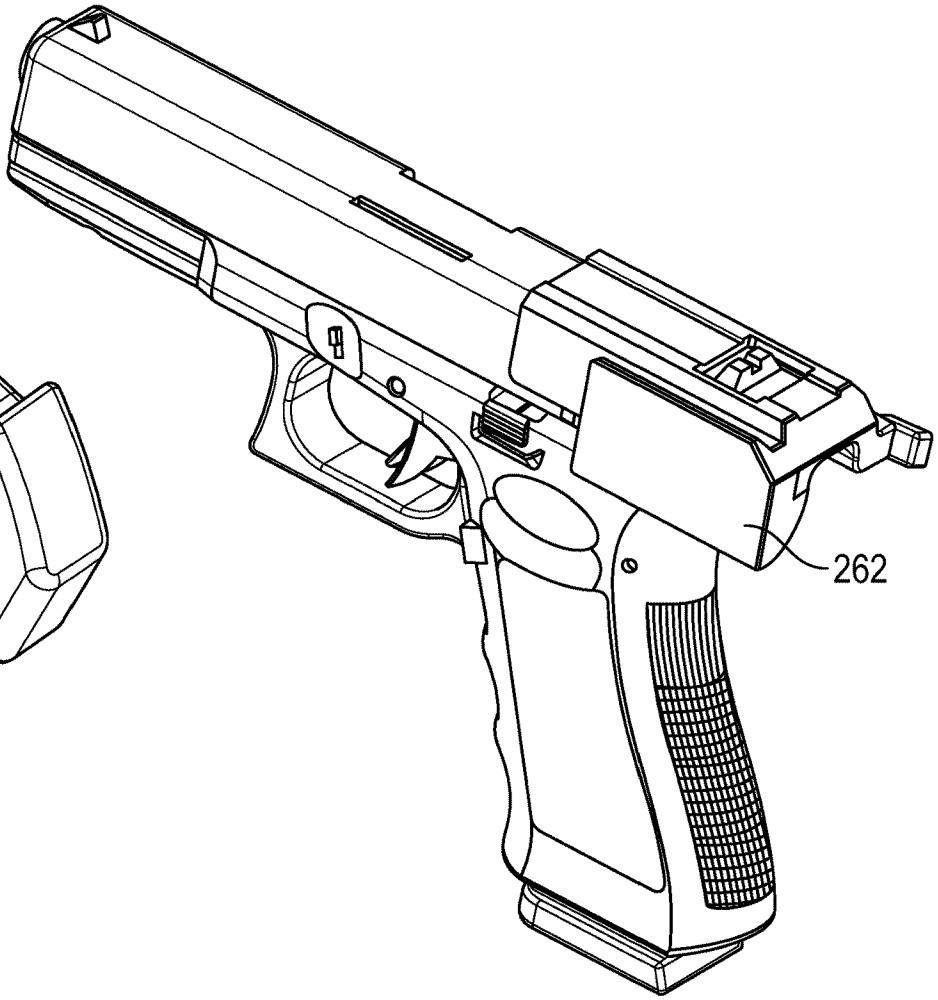
FIG. 62 is a top, rear, left view of the gun coupler of FIG. 60 secured to a gun.
Figure 61:
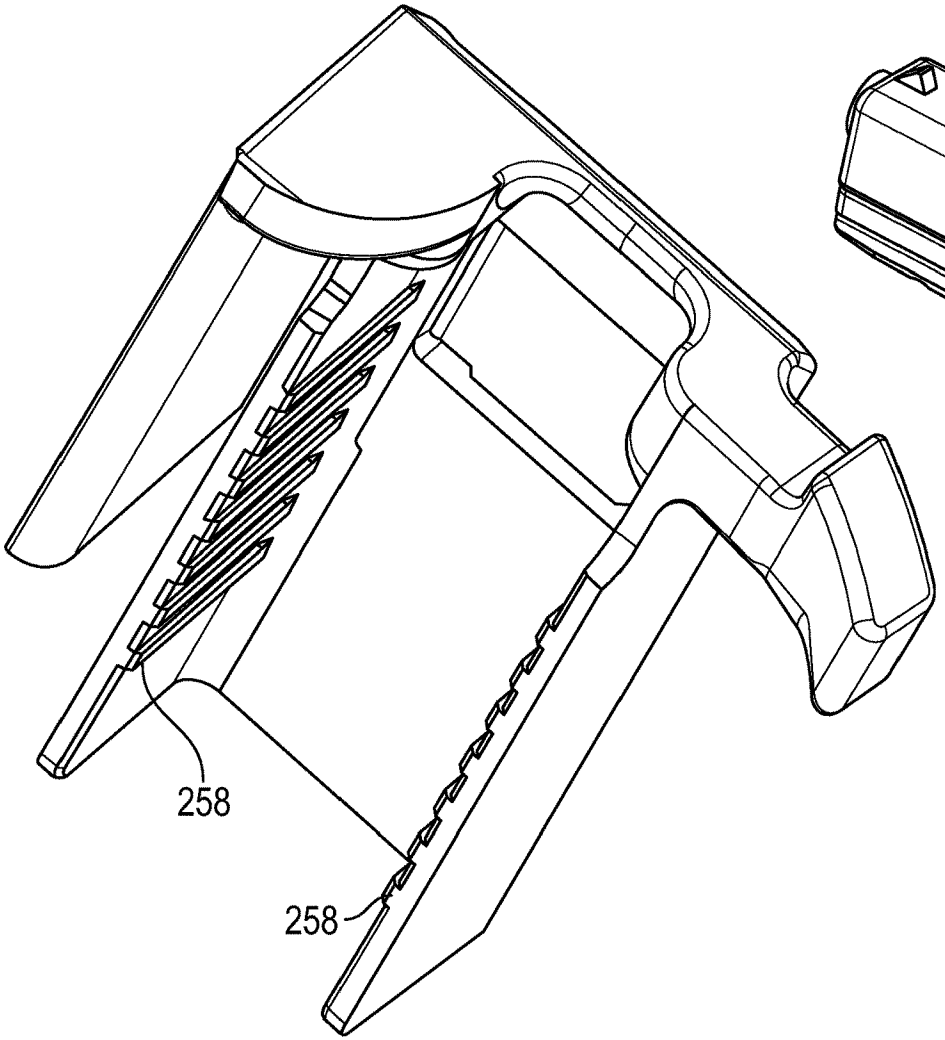
FIG. 61 is a bottom, rear, right view of the gun coupler of FIG. 60.

FIGS. 58-59 show an implementation of a gun coupler 238. The gun coupler includes a top portion 240 which at least partially covers a top of the gun but which has an opening 242 to allow a sight or other elements of the gun to be exposed therethrough, such as for aiming. Side portions 244 couple with sides of the gun and may include ridges and/or grooves to mate with grooves and/or ridges of the gun, such as for a more secure fit and coupling thereto. Specific ridges and/or grooves of the gun coupler may be configured for use with corresponding specific grooves and/or ridges of any specific gun model. A clip 246 extends from one of the side portions and may be used to secure the gun in any clip receiver disclosed herein as well as any location which may receive a clip, such as the waistband of pants as shown in FIG. 59.

As seen in FIG. 58, gun coupler 238 is secured to the slide of the handgun. The gun coupler further includes a pull member 248 which the user may use to pull the slide back, for chambering a bullet prior to firing. For example, referring to FIG. 59, as the user draws the pistol out of the stored configuration in FIG. 59 and is raising the gun using one hand, with the other hand the user can pull the pull member to chamber a bullet. The gun coupler is securely coupled to the slide using a friction fit or other securing mechanism, so that pulling on the pull member will pull the slide for this chambering action. In this manner the user may raise the gun for firing and chamber it quickly during this raising motion, allowing the user to very quickly fire the weapon at a target. The user may of course pull the pull member at any other point, without having to do it during such a gun-raising motion, and the pull member of FIG. 28 may also be used to hang the gun in any location or on any element to which the pull member can loop around, such as a nail or screw in a wall or the like.

Figure 68:
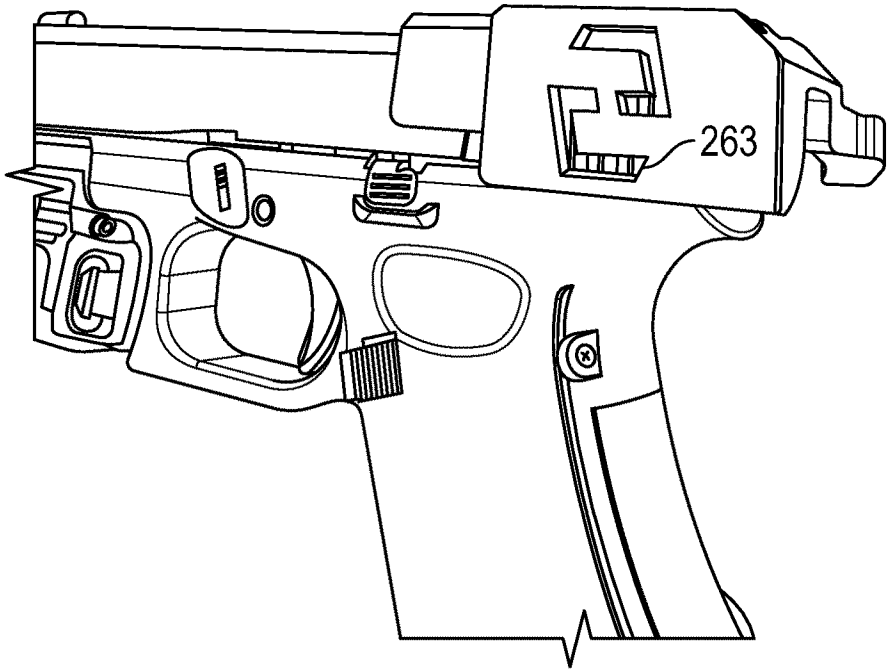
FIG. 68 is a left, rear view of an alternate version of the gun coupler and gun of FIG. 62 having openings in the gun coupler.
Figure 67:
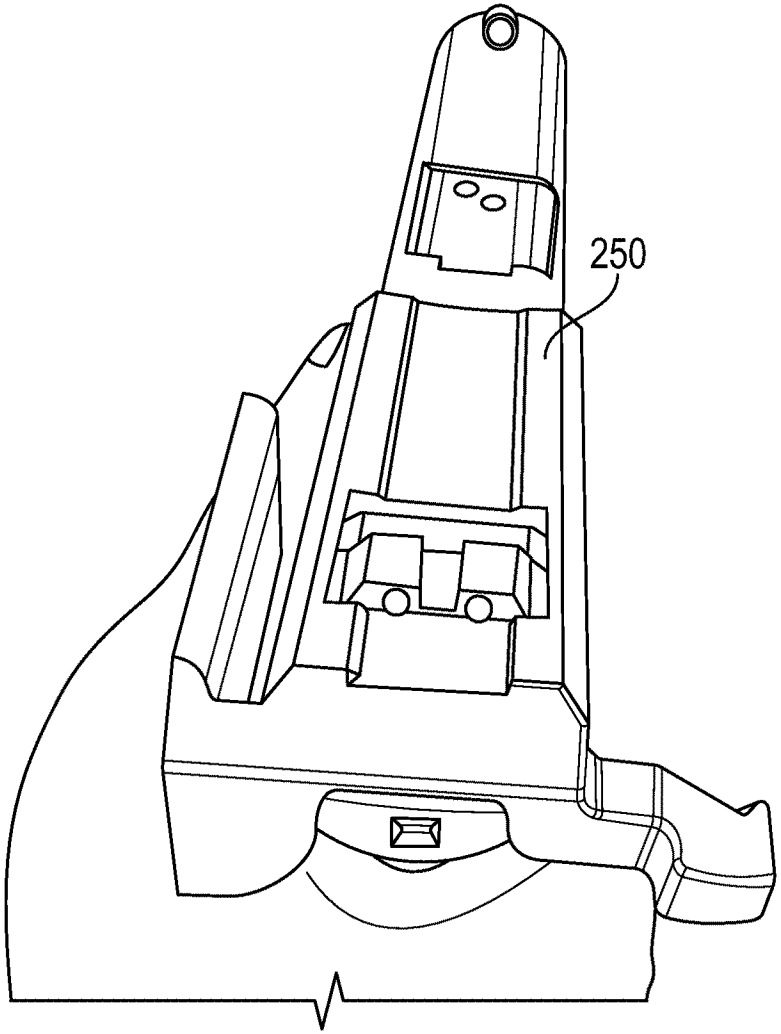
FIG. 67 is a top, rear view of the gun coupler and gun of FIG. 62 being held by a user.

FIGS. 60-69 show an implementation of a gun coupler 250 which is in some ways similar to the above-described gun coupler, having a top portion 252 with an opening 254 therein for allowing a gun sight and/or elements to be visible and/or accessible therethrough, side portions 256, ridges 258 (which form corresponding grooves therebetween and which ridges/grooves are used to couple with complementary grooves/ridges of the gun slide), and a clip 262 extending from one of the side portions. FIG. 68 shows an alternative version in which the clip has one or more openings 263 which may be used for locking/securing the clip within a clip receiver, as will be understood by the later description of FIGS. 98-106.

Figure 64:
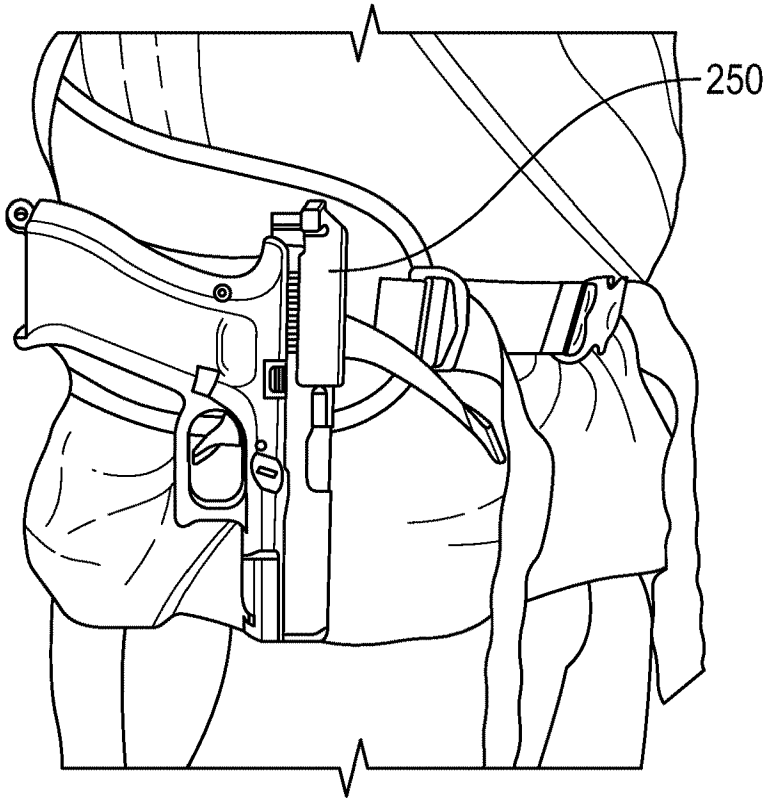
FIG. 64 is a right view of the gun coupler and gun of FIG. 62 secured to a clip receiver assembly of FIG. 47 in turn secured to a backpack waist strap.
Figure 63:
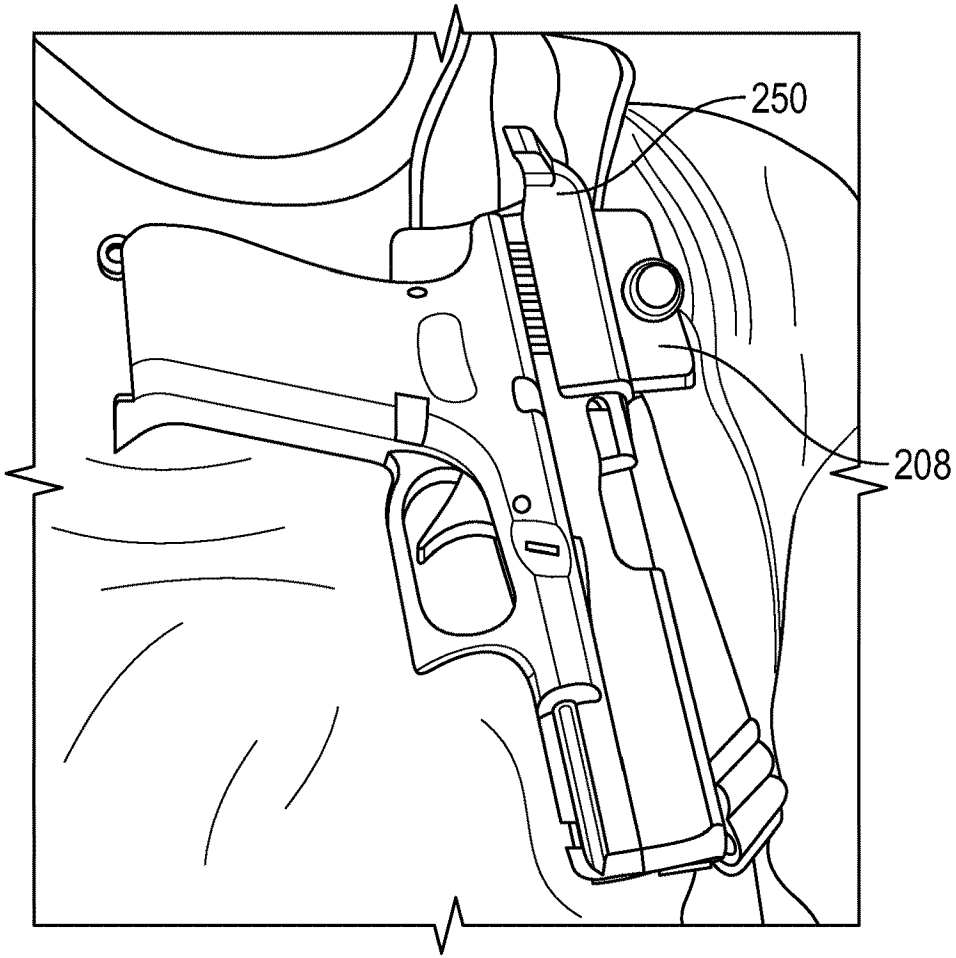
FIG. 63 is a front, right view of the gun coupler and gun of FIG. 62 secured to a clip receiver assembly of FIG. 38 in turn secured to a backpack shoulder strap.
Figure 66:
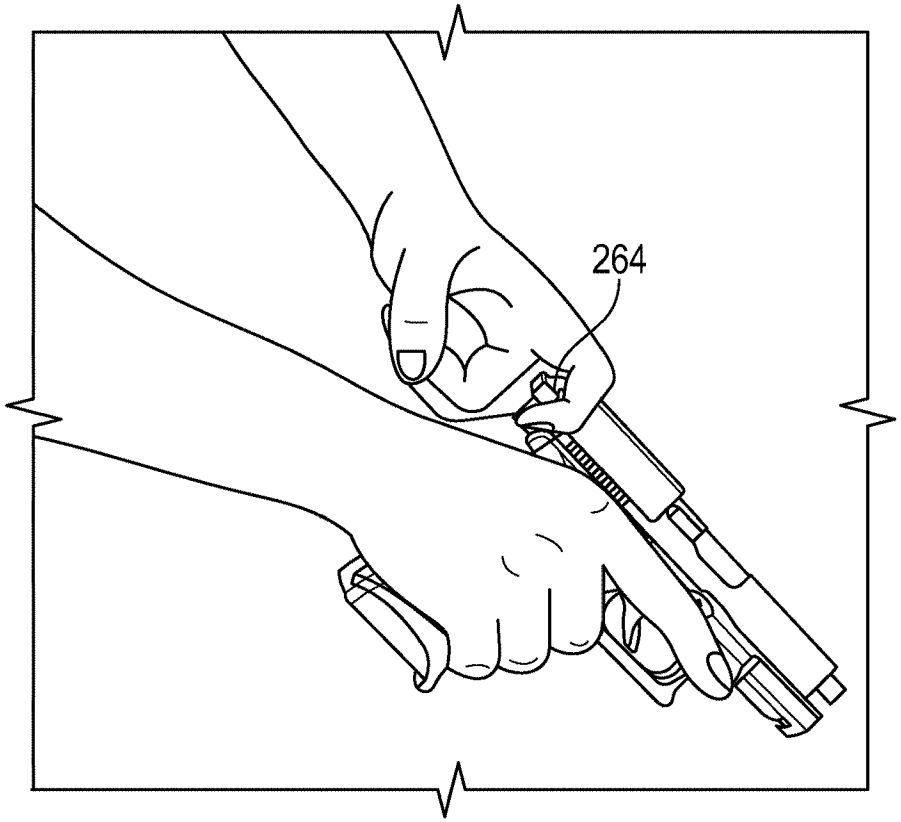
FIG. 66 representatively illustrates a user using the gun coupler of FIG. 62 to charge/cock a gun.
Figure 65:
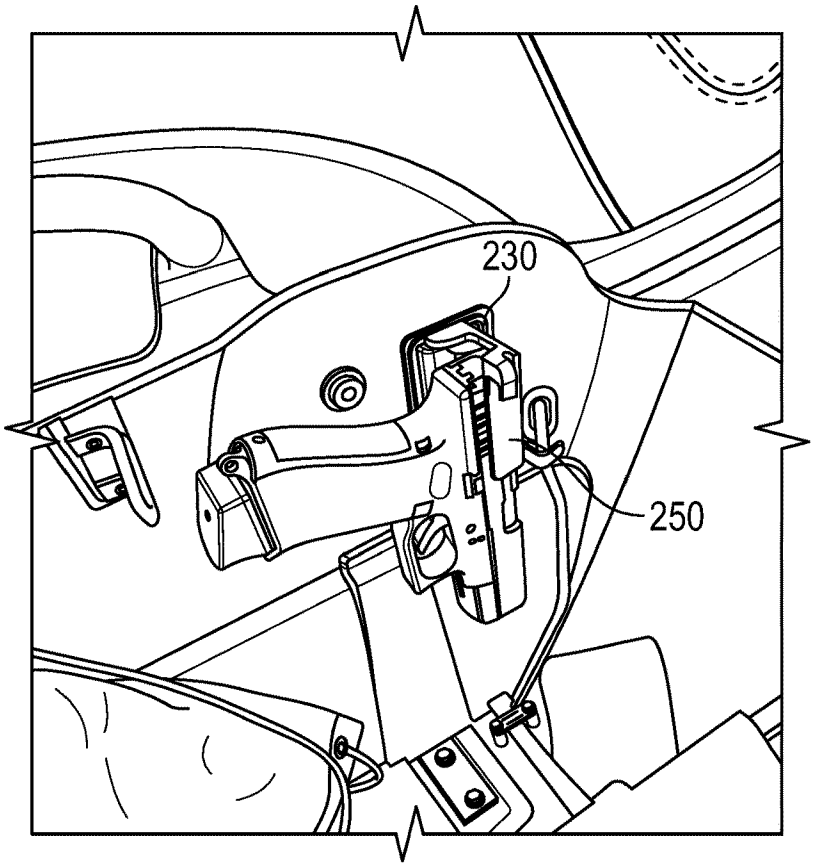
FIG. 65 is a rear, bottom, right view of the gun coupler and gun of FIG. 62 secured to a clip receiver assembly of FIG. 47 in turn secured to a motorcycle storage compartment.

The pull member 264 extends from one of the side portions and may be used for the same chambering functionality as pull member 248. In FIG. 63 the clip of coupler 250 is coupled with a clip receiver assembly 208 (which is in turn coupled with a backpack shoulder strap). In FIG. 64 the clip of coupler 250 is coupled with a clip receiver assembly 230 which is adhered to a waist strap of a backpack. In FIG. 65 the clip of coupler 250 is coupled with a clip receiver assembly 230 adhered to a motorcycle storage compartment. In FIG. 66 the user is drawing the weapon up to a firing position and is simultaneously using the pull member to pull the slide back to chamber a bullet.

Figure 69:
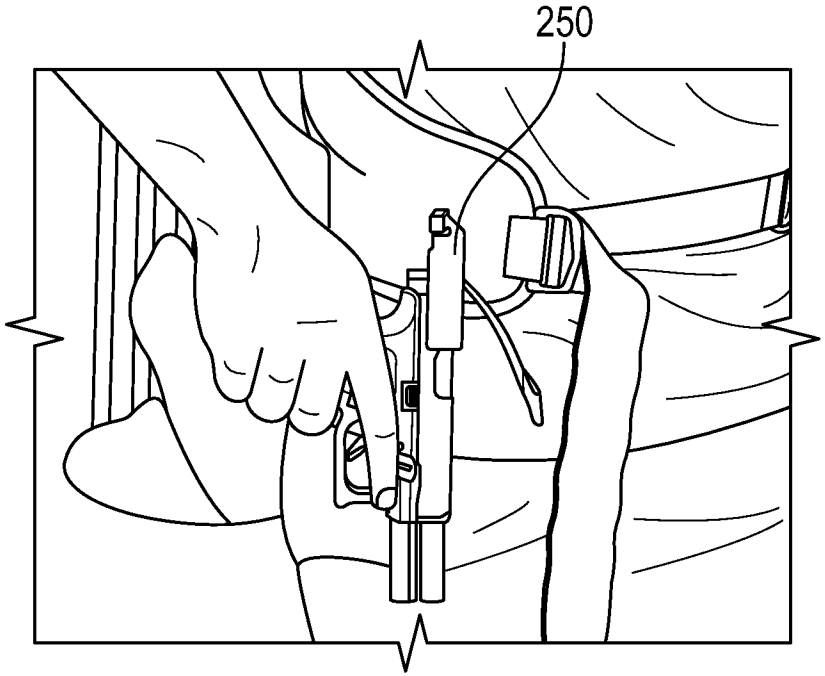
FIG. 69 representatively illustrates a user charging the gun of FIG. 62 by pressing downward on the gun while the gun coupler of FIG. 62 is secured to a clip receiver assembly of FIG. 47 in turn secured to a backpack waist strap.

In FIG. 69 the clip of coupler 250 is coupled with a clip receiver assembly 230 which is adhered to a waist strap of a backpack, and to chamber the bullet the user first grips the gun handle and pushes downward. This effectively slides the slide up relative to the rest of the gun because the slide is prevented from moving downward due to its being clipped to the clip receiver. This chambers a bullet, and then the user can pull the gun upwards out of the clipped configuration to allow firing. This allows chambering and firing using only one hand.

Figure 70:
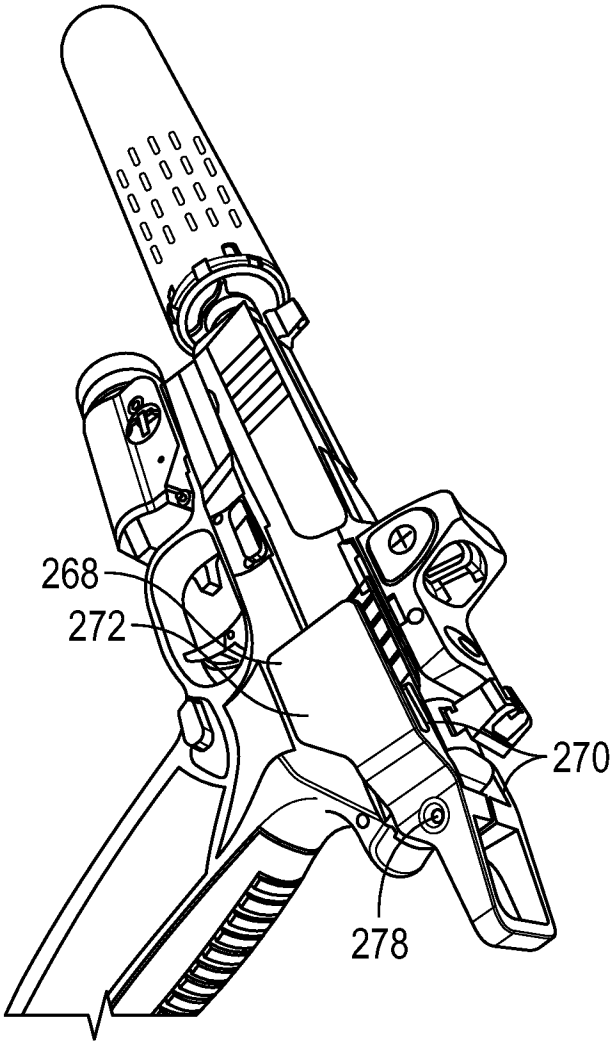
FIG. 70 is a top, left, rear view of a gun coupler and gun.
Figure 71:
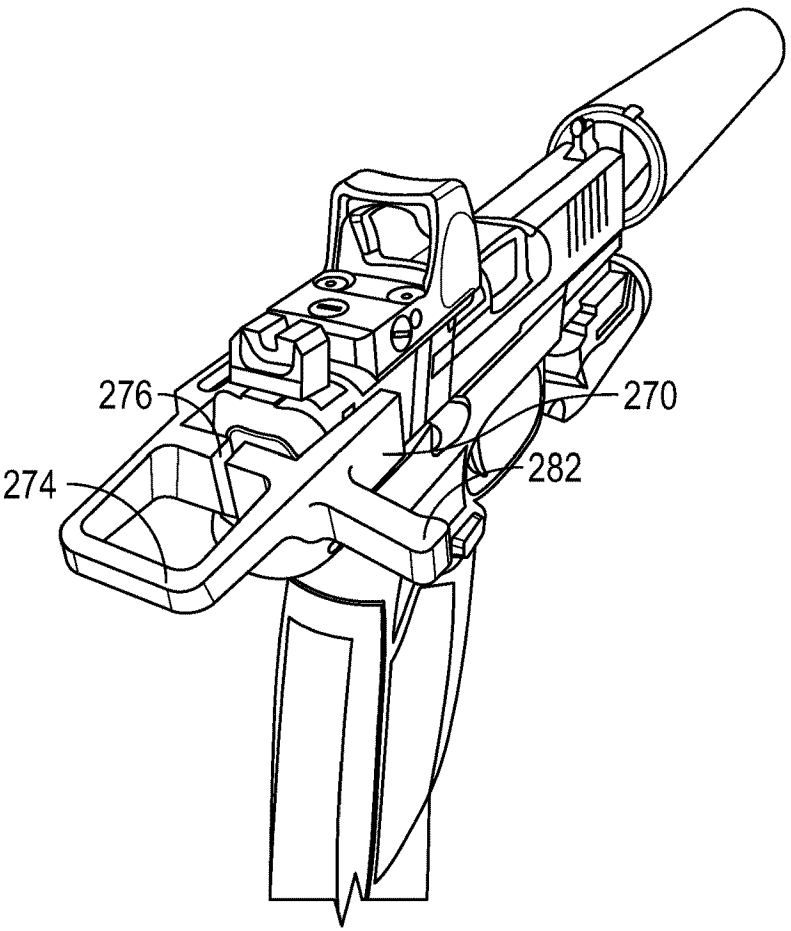
FIG. 71 is a top, right, rear view of the gun coupler and gun of FIG. 70.

FIGS. 70-71 show views of a gun coupler 268 which has some similarities with other gun couplers, having side portions 270, ridges (not visible), a clip 272, and a first pull member 274 somewhat similar to pull member 248 (but with a slightly different shape, and having similar functionality) and a second pull member 282 similar to pull member 264 (and having similar functionality). A top portion is excluded, which is useful for some guns (as seen in FIG. 70) which have elements that would interfere with a top portion. These figures also show that this gun coupler (and, similarly, other gun couplers disclosed herein) can easily be used to secure guns that have attached silencers, lights, laser pointers, and so forth (the same cannot be said for many gun holsters). The first pull member includes a separation 276 and a through-hole 278, and a tightener such as a screw or bolt (not shown) may be used to tighten the coupler proximate the first pull member so as to secure the coupler to the gun.

Figure 72:
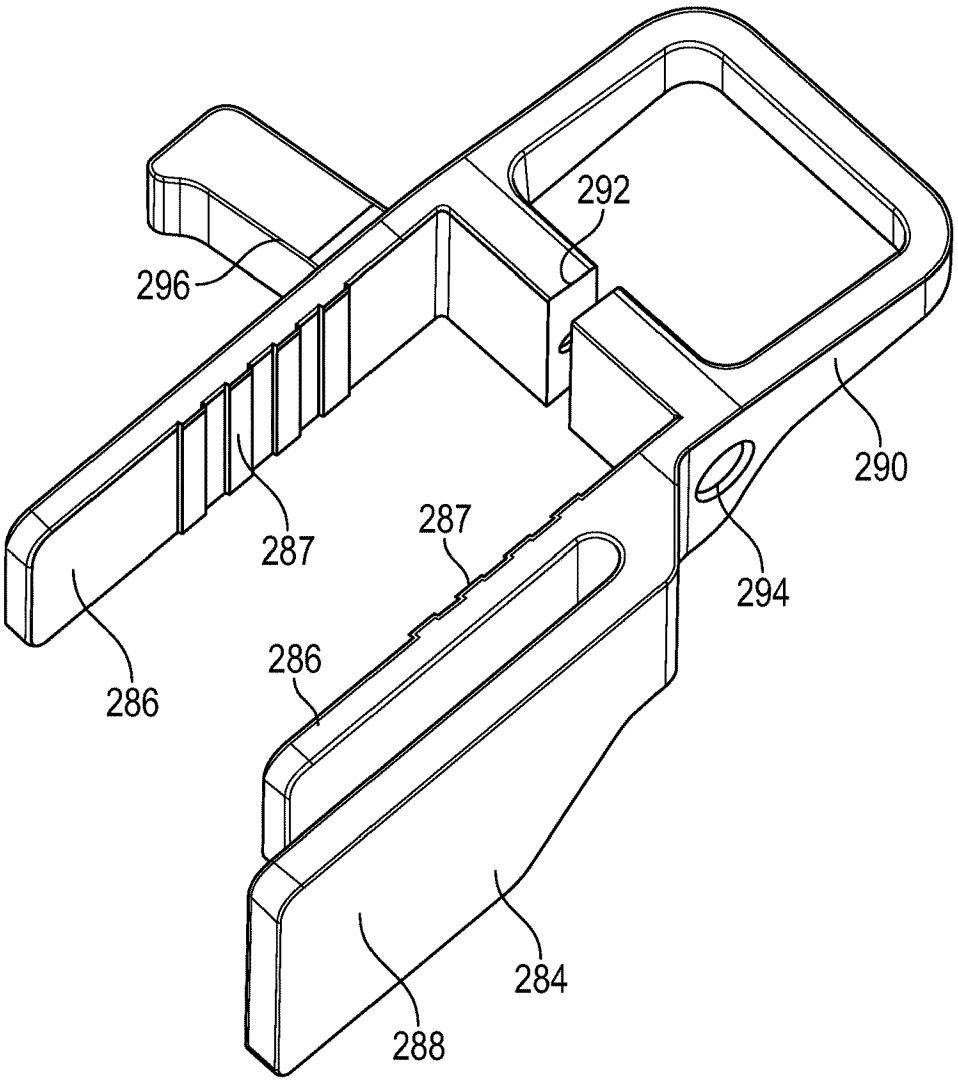
FIG. 72 is a front, left, top view of a gun coupler.
Figure 74:
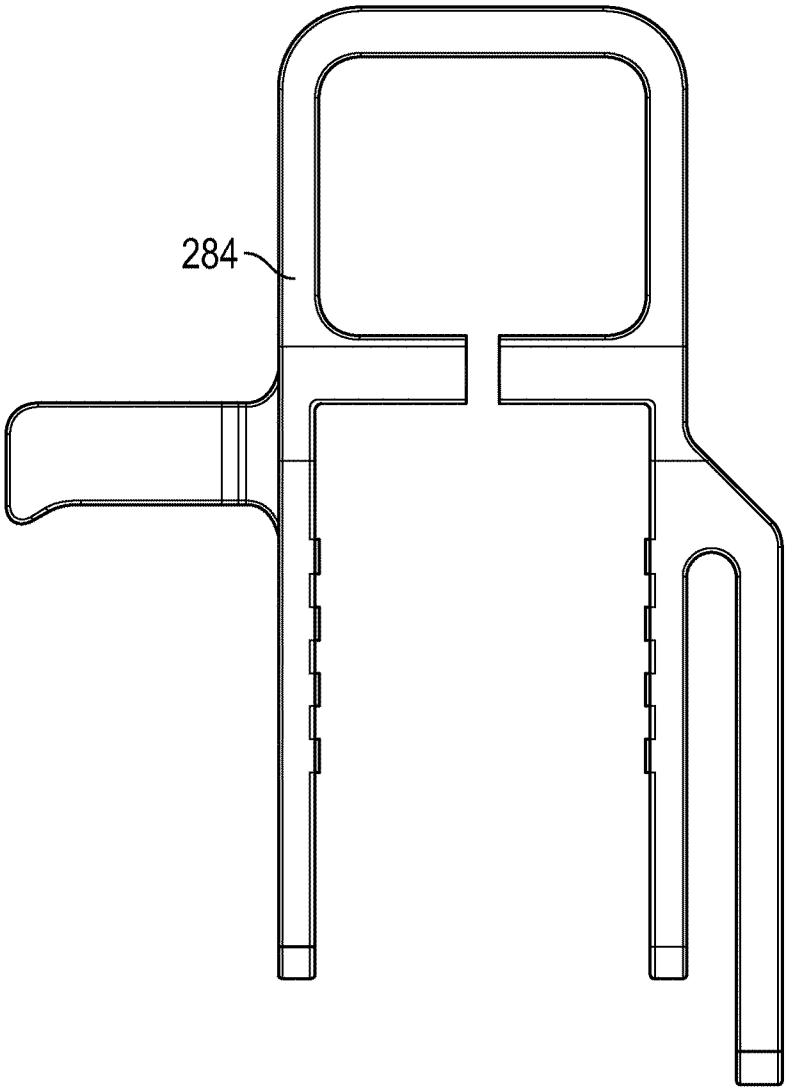
FIG. 74 is a top view of the gun coupler of FIG. 72.
Figure 73:
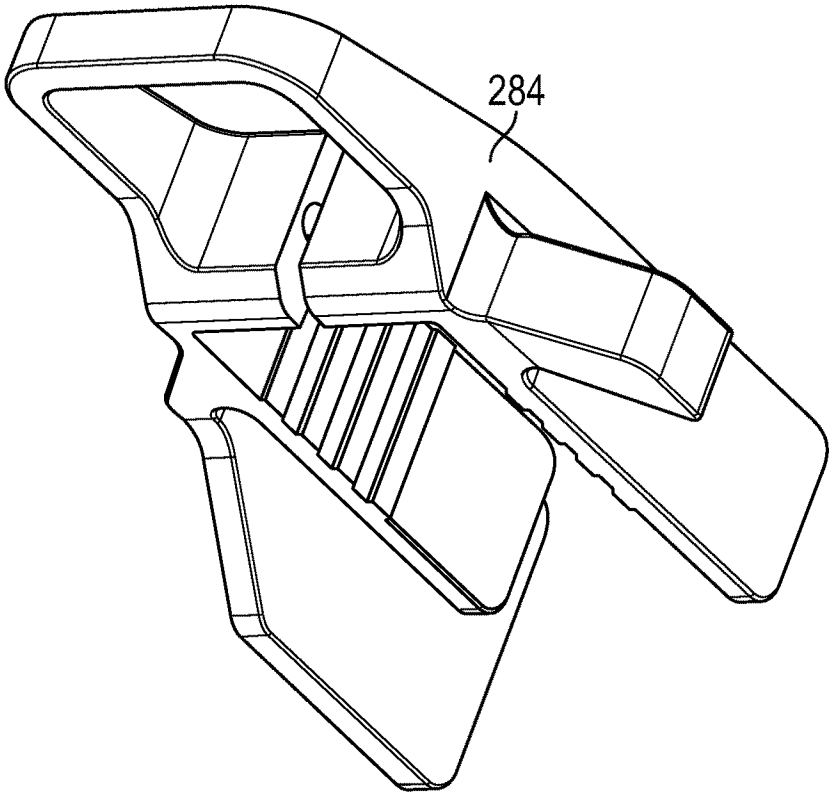
FIG. 73 is a rear, right, bottom view of the gun coupler of FIG. 72.

FIGS. 72-74 show a gun coupler 284 which is identical or similar to coupler 268—having side portions 286, ridges 287, a clip 288, a first pull member 290, a separation 292, a through-hole 294 and corresponding tightener (not shown), and a second pull member 296—except that the side portions are shorter and the second pull member is substantially perpendicular with the side portion it extends from as opposed to being slightly backward angled as the second pull member 282 of FIG. 71 is.

Figure 75:
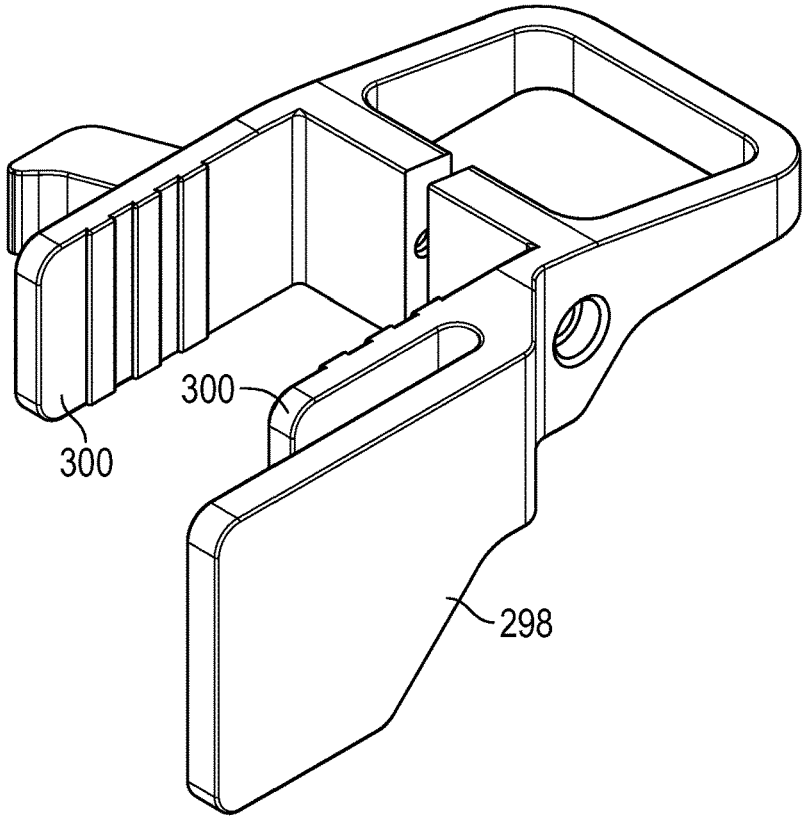
FIG. 75 is a front, left, top view of a gun coupler.
Figure 76:
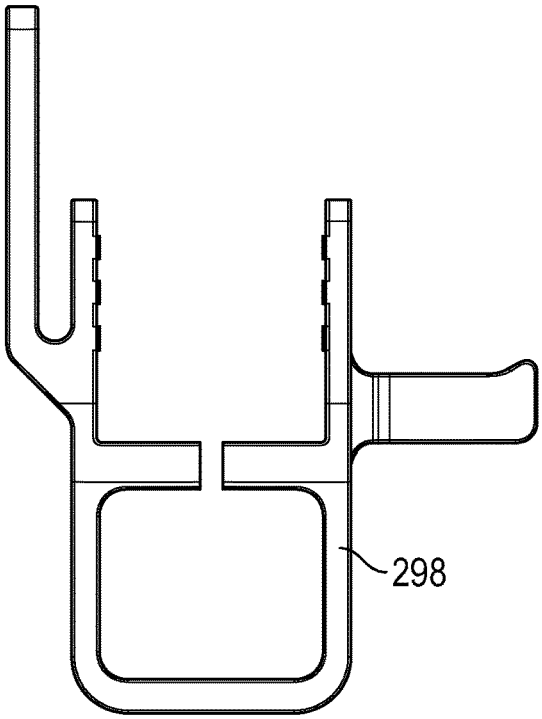
FIG. 76 is a top view of the gun coupler of FIG. 75.

FIGS. 75-76 show a gun coupler 298 that is identical or similar to coupler 284 except that the side portions 300 are shorter (similar to coupler 268).

Figure 77:
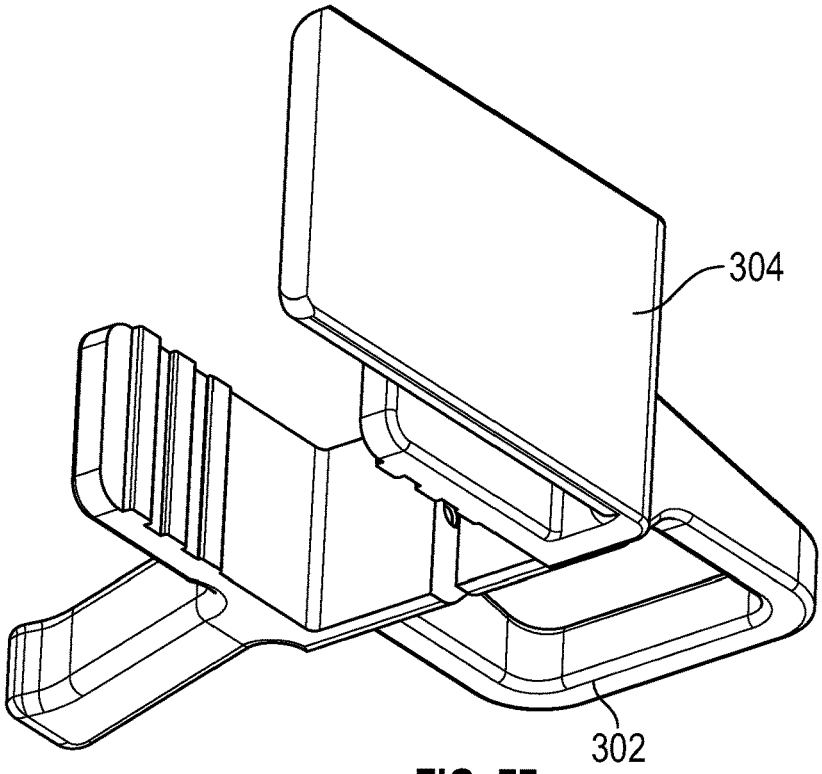
FIG. 77 is a bottom, left, front view of a gun coupler.
Figure 78:
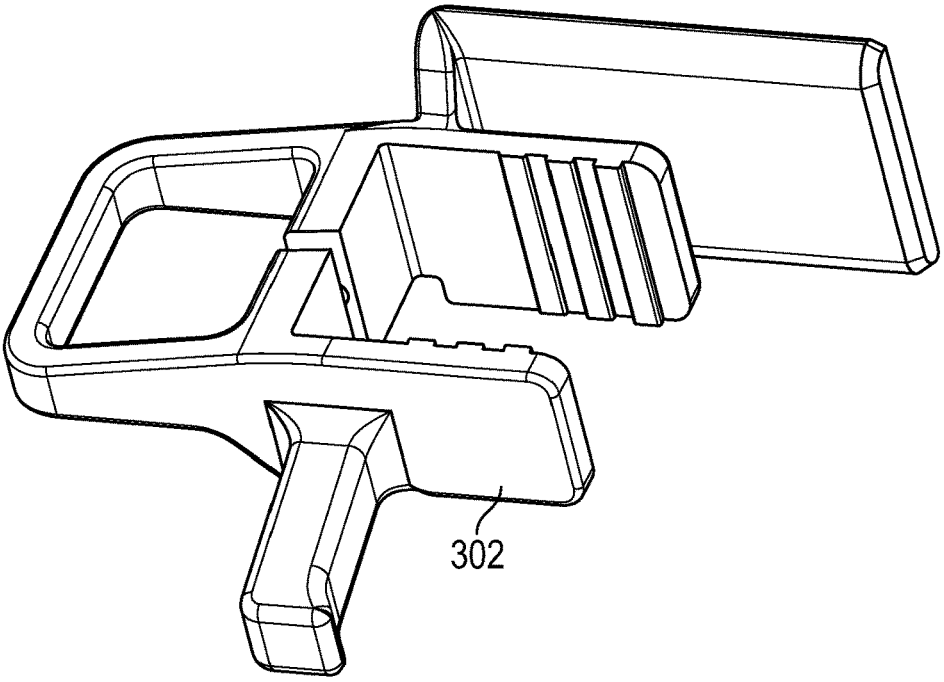
FIG. 78 is a top, right, front view of the gun coupler of FIG. 77.

FIGS. 77-78 show a gun coupler 302 that is identical or similar to coupler 298 except that the clip 304 is shaped slightly differently.

Figure 79:
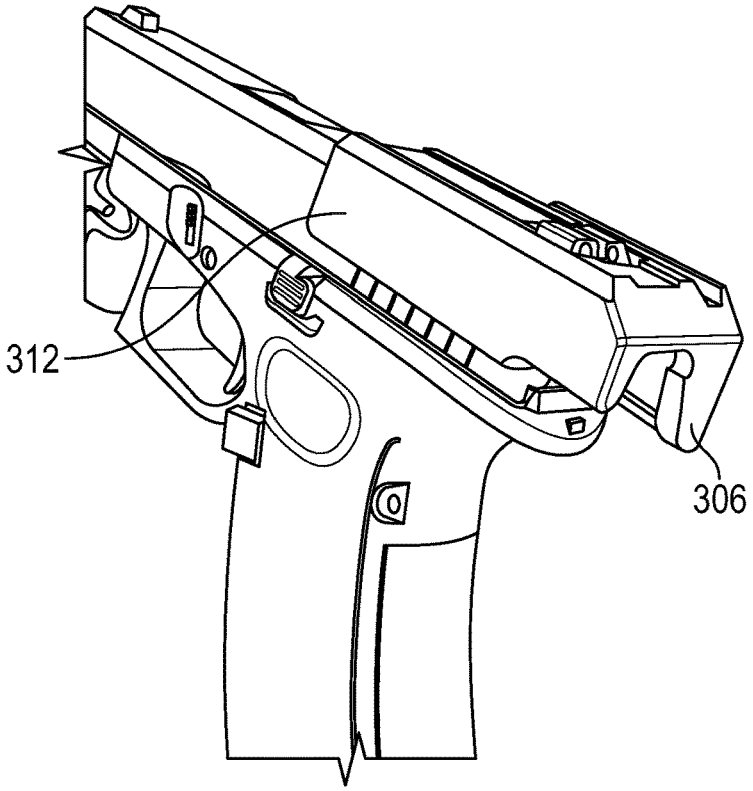
FIG. 79 is a left, rear, top view of a gun coupler coupled with a gun.
Figure 80:
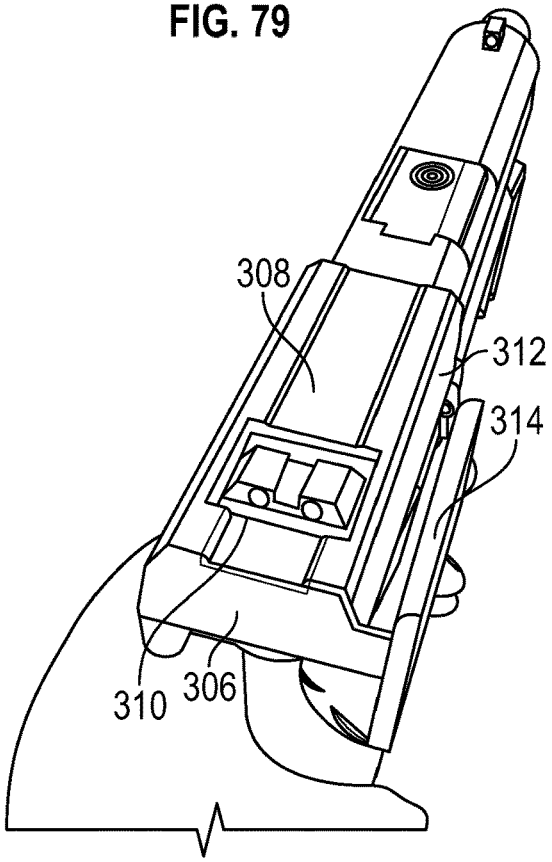
FIG. 80 is a top, right, rear view of the gun coupler and gun of FIG. 79 being held by a user.

FIGS. 79-80 show a gun coupler 306 that is in some ways similar to other gun couplers, having a top portion 308, opening 310, side portions 312, ridges (not visible), and a clip 314. There is no separate pull member with this model, though the clip can be used for loading a bullet (as with other clips) by a downward motion, as described above for another gun coupler. Additionally, for any of the gun couplers a user could grab the coupler itself and pull back to chamber a bullet.

Figure 81:
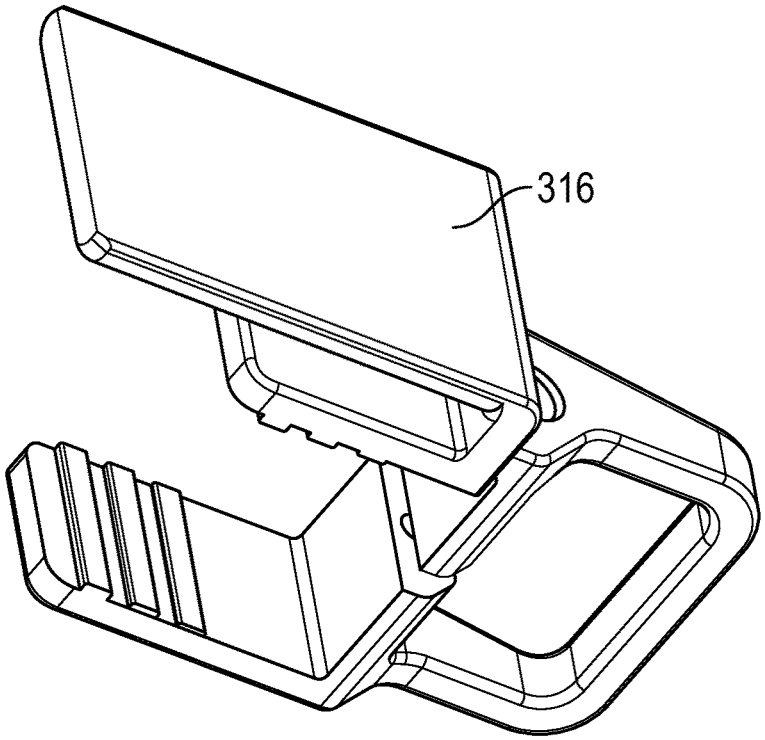
FIG. 81 is a front, left, bottom view of a gun coupler.
Figure 82:
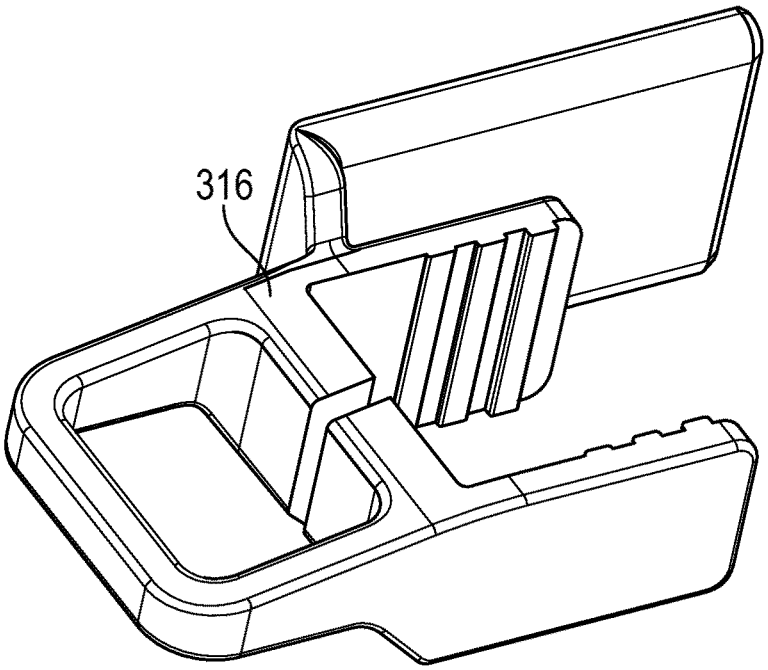
FIG. 82 is a top, right, rear view of the gun coupler of FIG. 81.

FIGS. 81-82 show a gun coupler 316 that is similar or identical to coupler 302, except excluding the second pull member.

Figure 83:
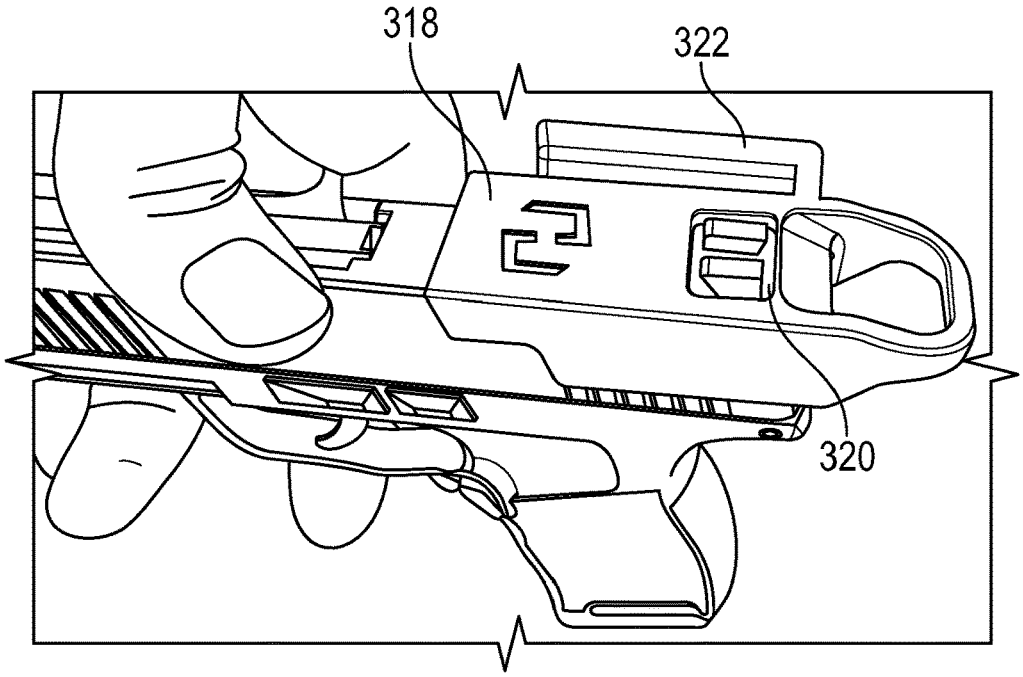
FIG. 83 is a top, left view of a gun coupler coupled with a gun being held by a user.
Figure 84:
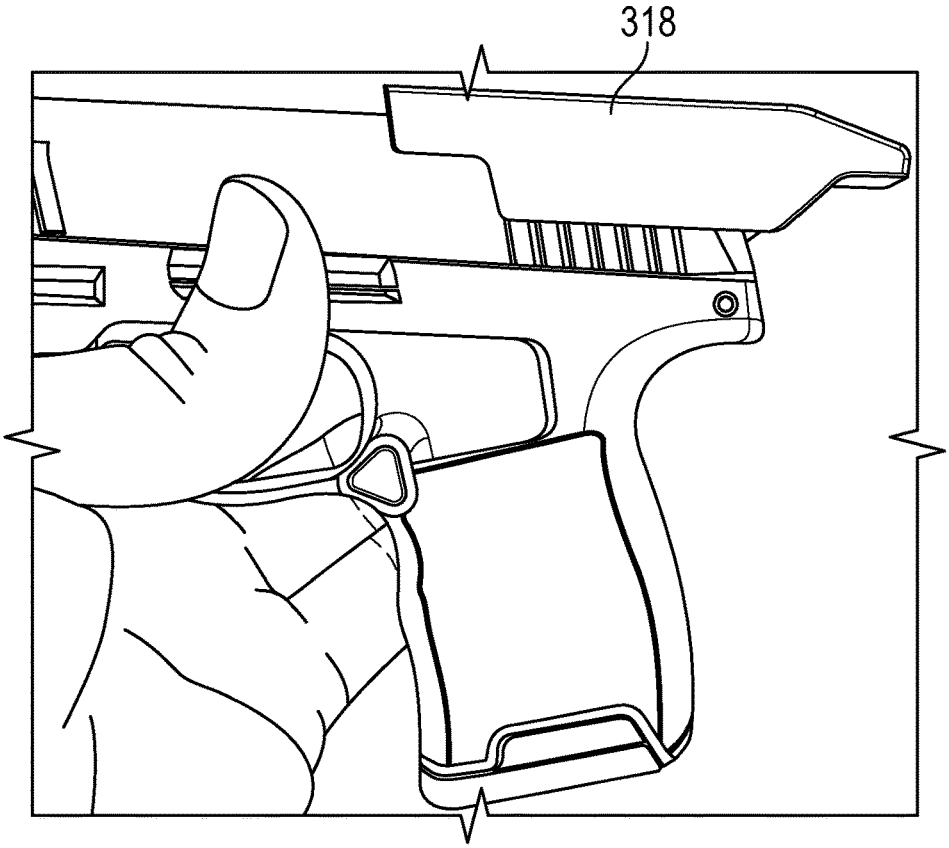
FIG. 84 is a left, bottom view of the gun coupler and gun of FIG. 83 being held by a user.
Figure 85:
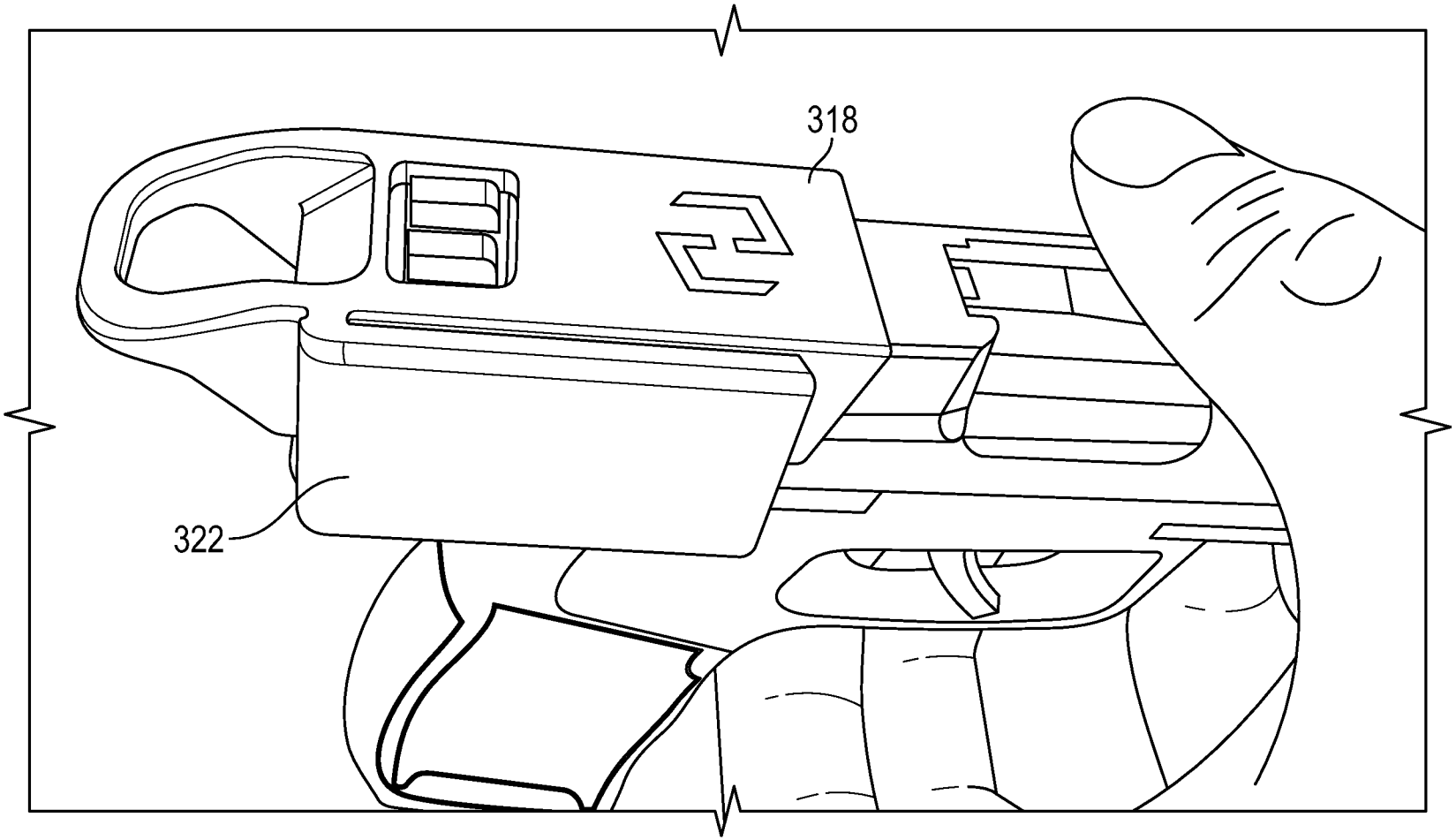
FIG. 85 is a top, right view of the gun coupler and gun of FIG. 83 being held by a user.

FIGS. 83-85 show a gun coupler 318 that is identical or similar to coupler 238, having a clip 322 with an opening 320, but the opening 320 is smaller, the clip is on the opposite side, and the top of the clip is flush or substantially flush with the top portion, as opposed to being somewhat above the top portion (as seen in FIG. 59 for coupler 238). Any of the clips of any coupler versions could be on a reverse side either due to the handedness of the user (right-handed vs. left-handed) or whether the user prefers to hold the gun outside of waist or inside of waist (as in FIG. 59). Additionally, any of the gun couplers described herein allow the user to hold/carry the gun easily without a gun holster.

Figure 86:
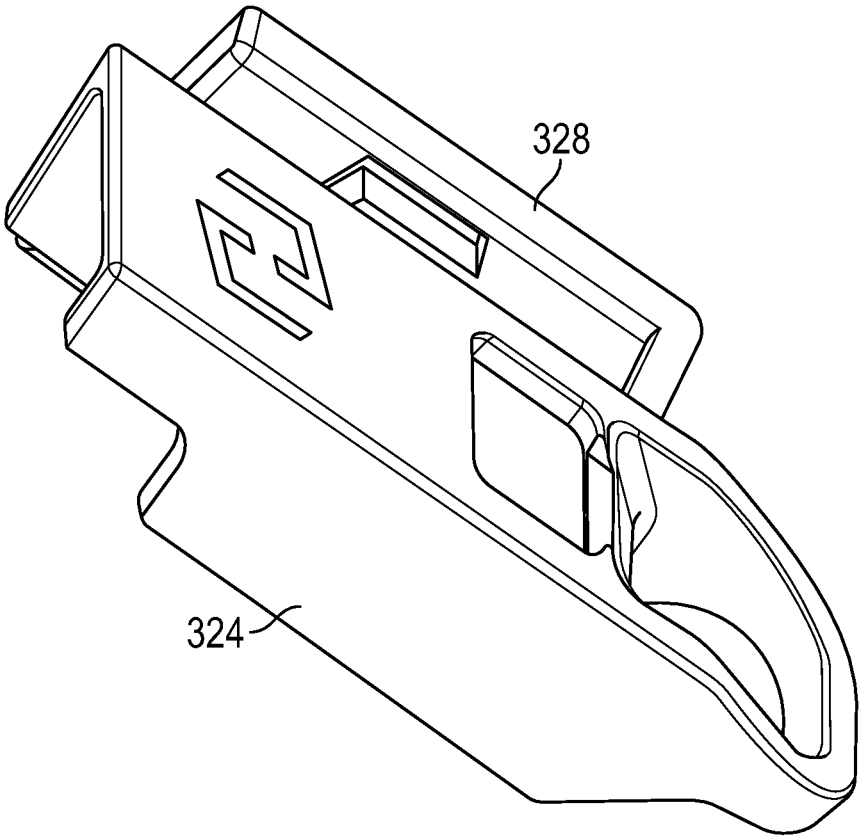
FIG. 86 is a front, top, left view of a gun coupler.
Figure 87:
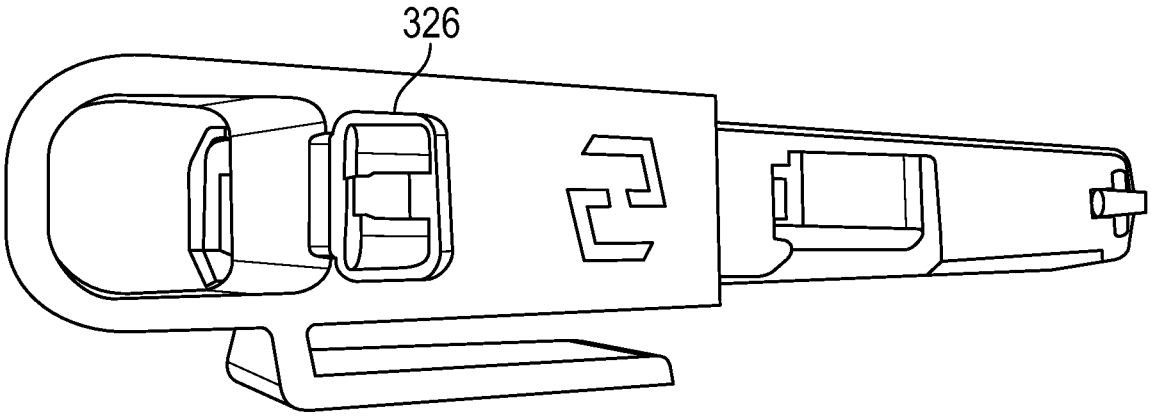
FIG. 87 is a top, rear view of the gun coupler of FIG. 86 coupled with a gun.
Figure 88:
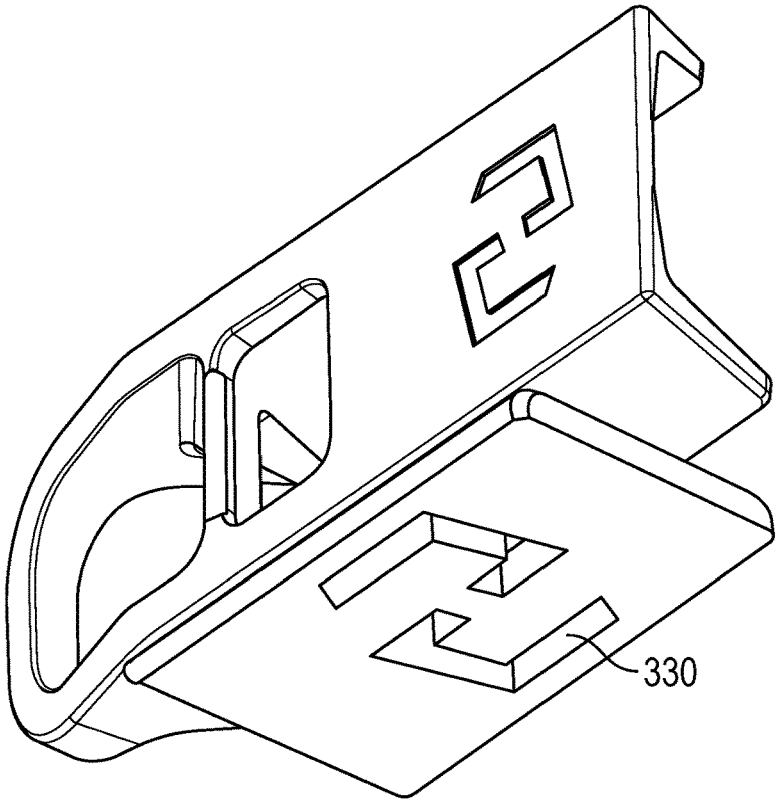
FIG. 88 is a top, front, right view of the gun coupler of FIG. 86.

FIGS. 86-88 show a gun coupler 324 that is identical or similar to coupler 238 except having a clip 328 that is lower (not as high above the top portion) and extending from the reverse side, having openings 330 in the clip which may be useful for locking mechanisms as will be described later, and having a smaller opening 326 in the top portion.

Figure 89:
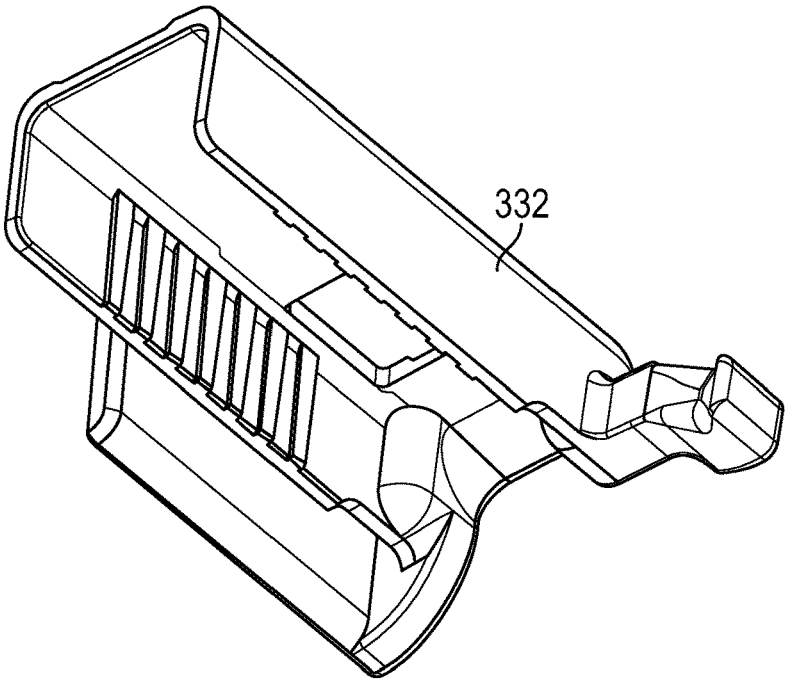
FIG. 89 is a front, bottom, left view of a gun coupler.
Figure 90:
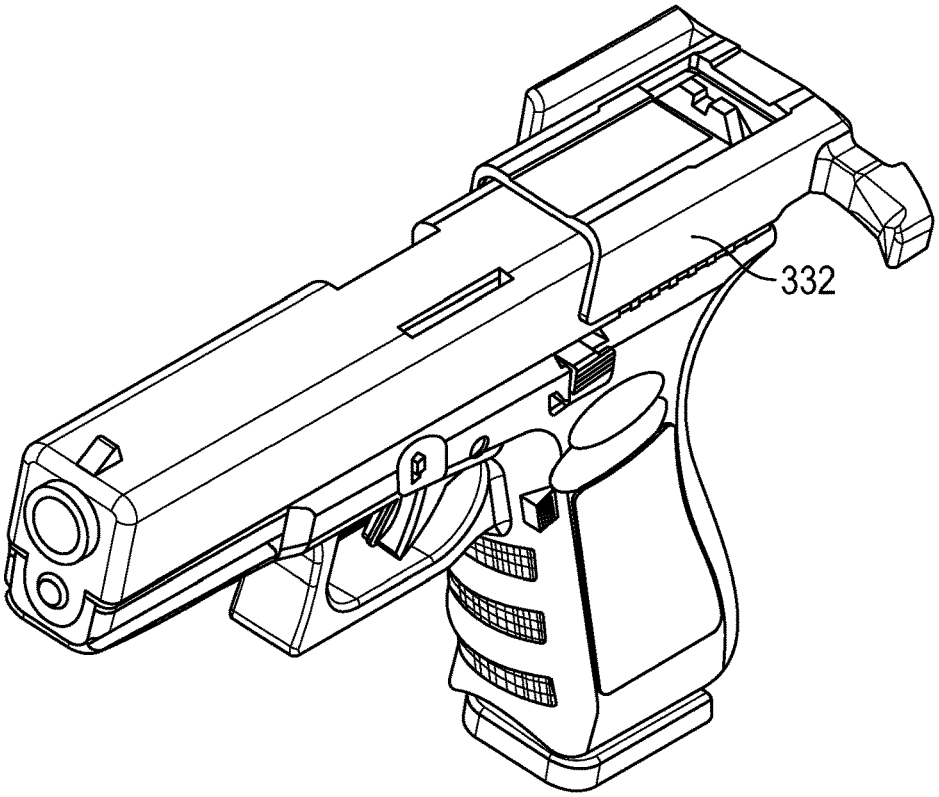
FIG. 90 is a front, left, top view of the gun coupler of FIG. 89 coupled with a gun.
Figure 91:
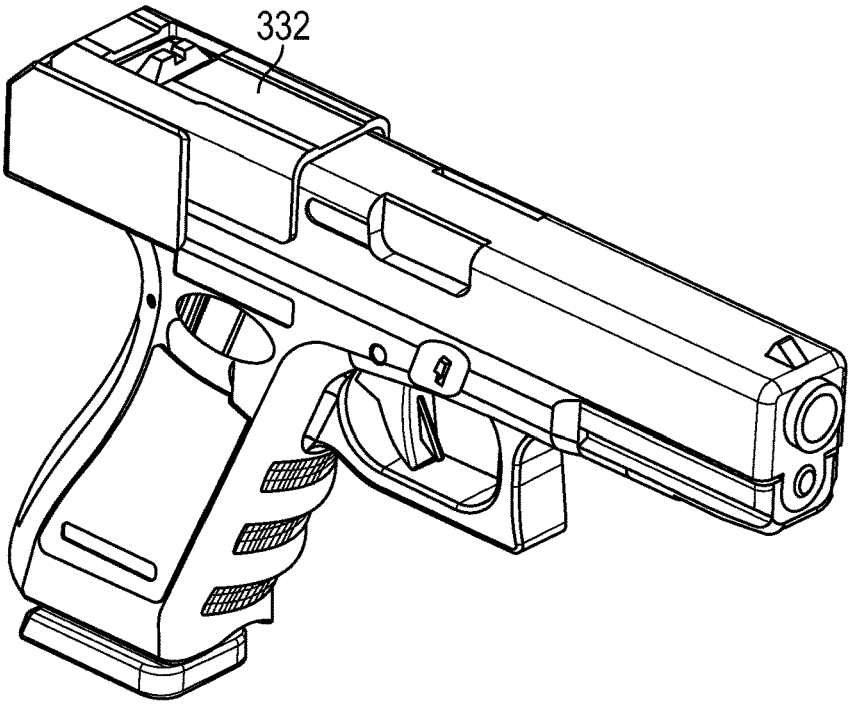
FIG. 91 is a front, top, right view of the gun coupler and gun of FIG. 90.
Figure 92:
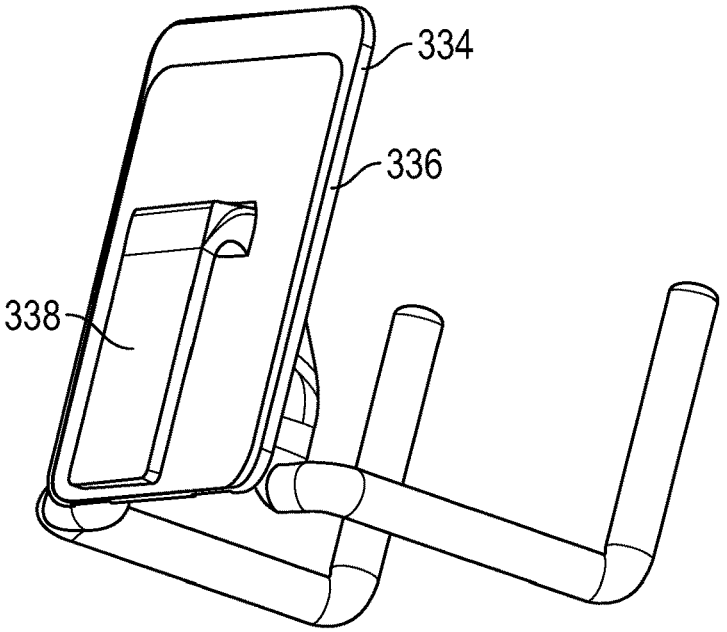
FIG. 92 is a rear, bottom, right side view of a carrying assembly in an open configuration.
Figure 93:
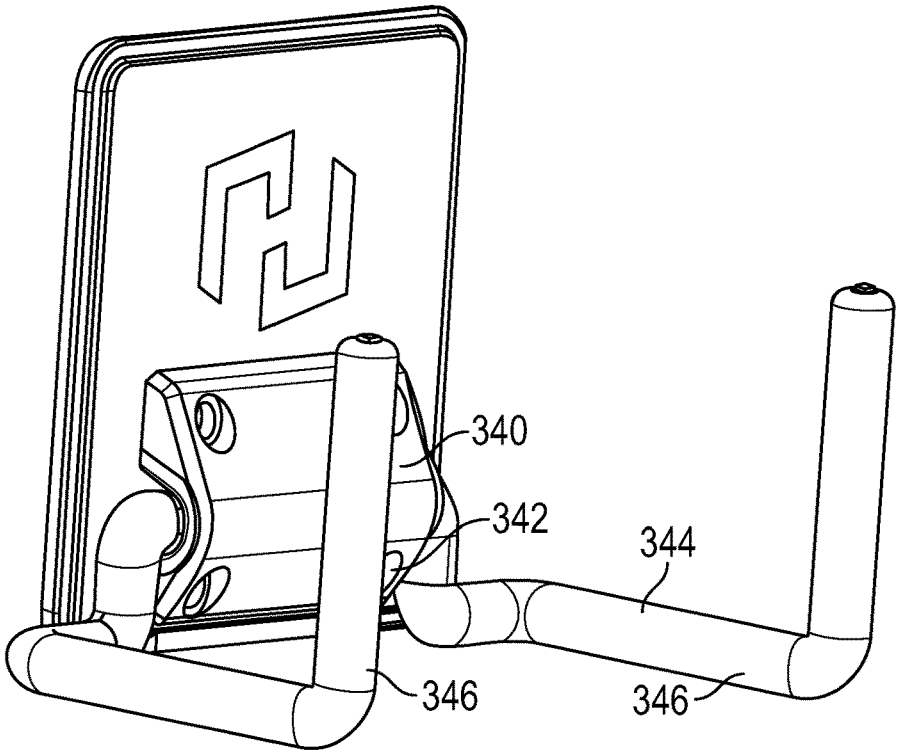
FIG. 93 is a front, top, right side view of the carrying assembly of FIG. 92 in the open configuration.

FIGS. 89-91 show a gun coupler 332 which is identical or similar to coupler 250 except having a reverse structure, such as with the clip and pull members on opposite sides than with coupler 250.

FIGS. 92-97 show a carrying assembly 334 that includes a base member 336 having a clip 338 extending therefrom, a retainer 340 having through-holes 342 and tighteners (not shown) such as bolts or screws which tighten the retainer against the base member and which secure a hang bar 344 coupled with the base member. The hang bar includes arms 346 having the shape/configuration shown in the drawings and is rotatable, via an axle-portion of the hang bar that couples with and/or within the retainer, between a down position (as in FIGS. 92-93) and an upward position (as in FIG. 94). In some cases recesses and corresponding projections (or vice versa) of the axle portion and retainer, or any other locking mechanism, allows the hang bar to be secure in either position until manually alternated to the other position. In some cases the downward position may be more useful for holding some items while the upward position is a storage position allowing for a more compact profile. In other cases the upward position may more securely hold an item fixed in some location. The clip can be secured with any clip receivers disclosed herein.

Figure 95:
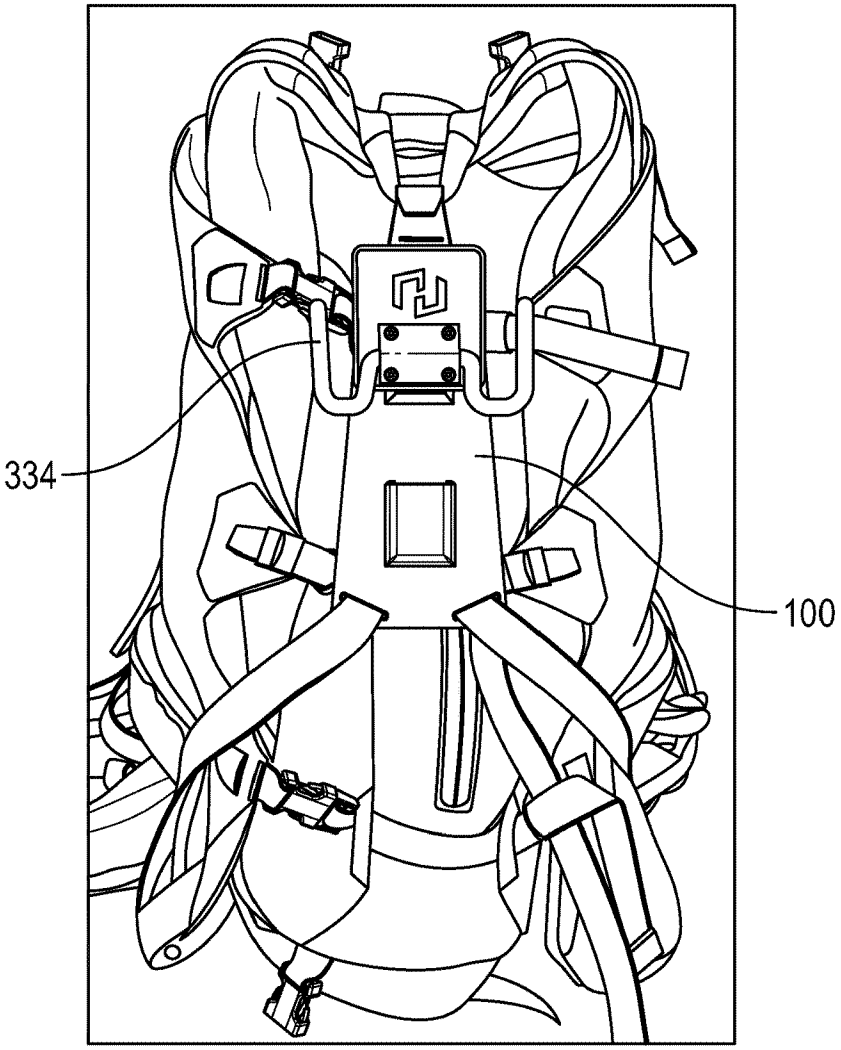
FIG. 95 is a front view of the carrying assembly of FIG. 92 secured to the carrying assembly of FIG. 4 in turn secured to a backpack.
Figure 94:
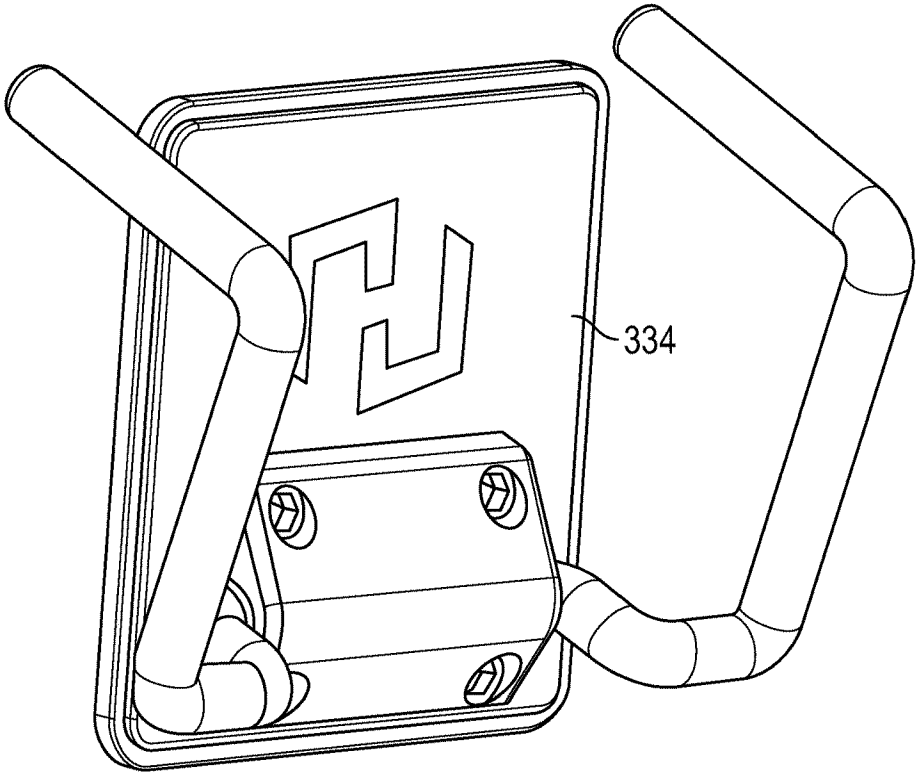
FIG. 94 is a front, top, right side view of the carrying assembly of FIG. 92 in a closed configuration.
Figure 96:
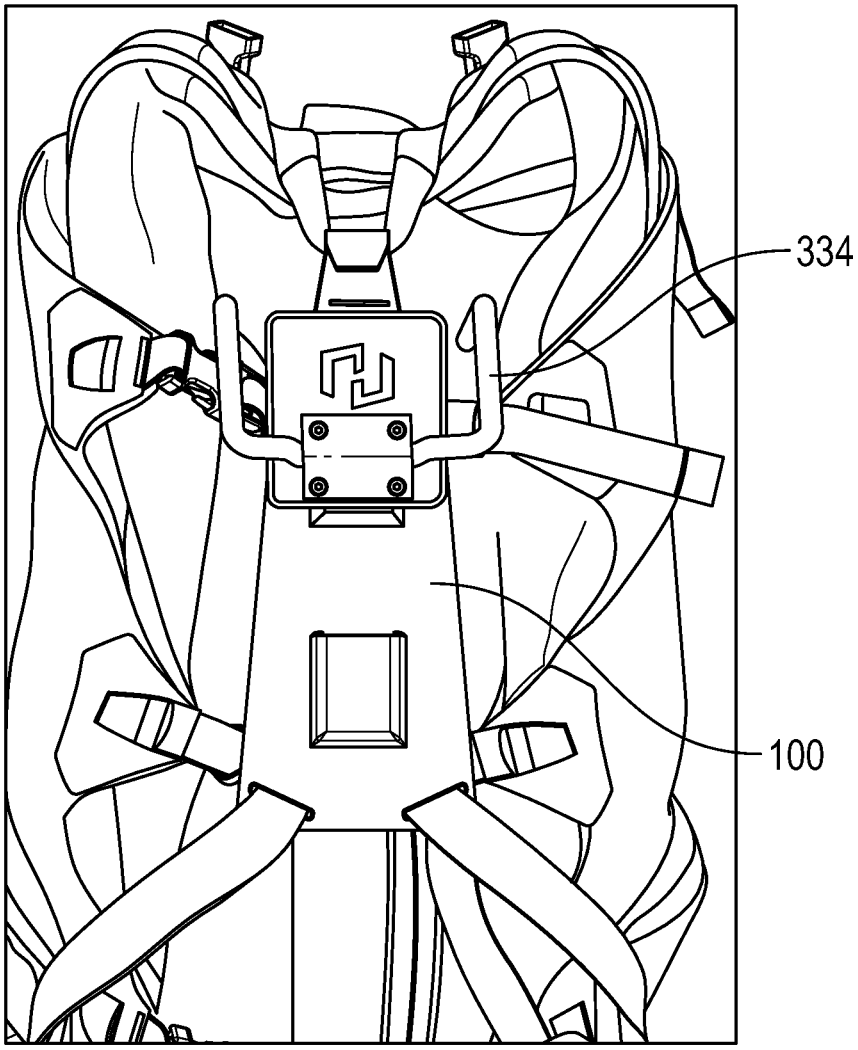
FIG. 96 is a front, left view of the carrying assembly of FIG. 92 secured to the carrying assembly of FIG. 4 in turn secured to a backpack.
Figure 97:
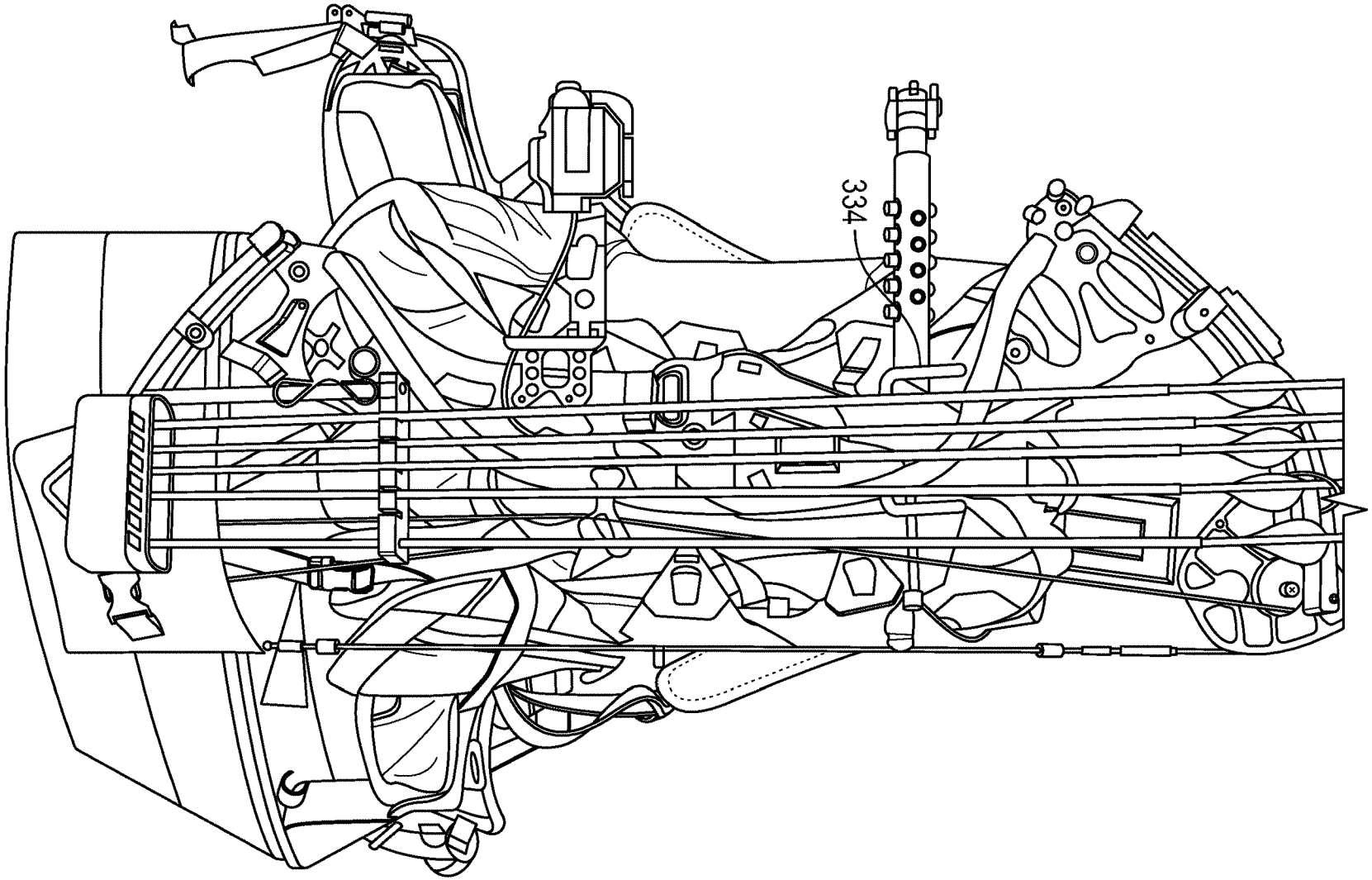
FIG. 97 is a front view of the carrying assembly of FIG. 92 secured to a backpack and holding a bow.
Figure 99:
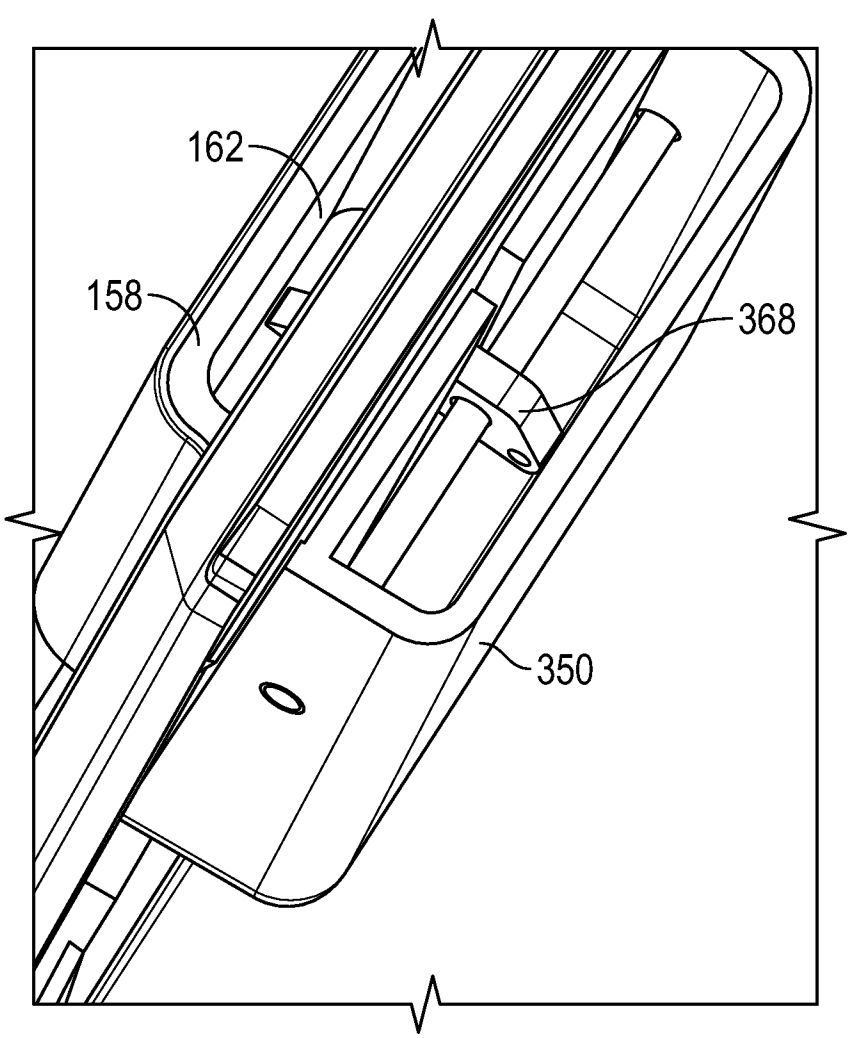
FIG. 99 is a top, left side, rear view of the elements of the lock assembly of FIG. 103.
Figure 98:
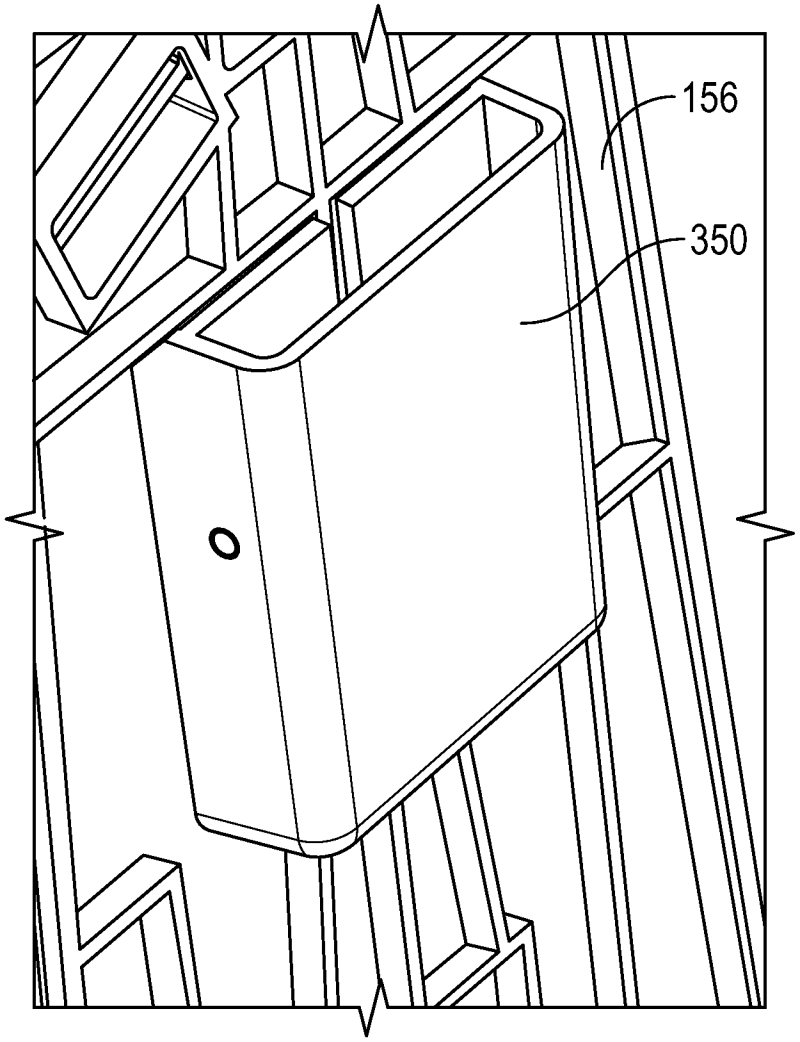
FIG. 98 is a rear, left, top view of elements of the lock assembly of FIG. 103 secured to a back plate.
Figure 101:
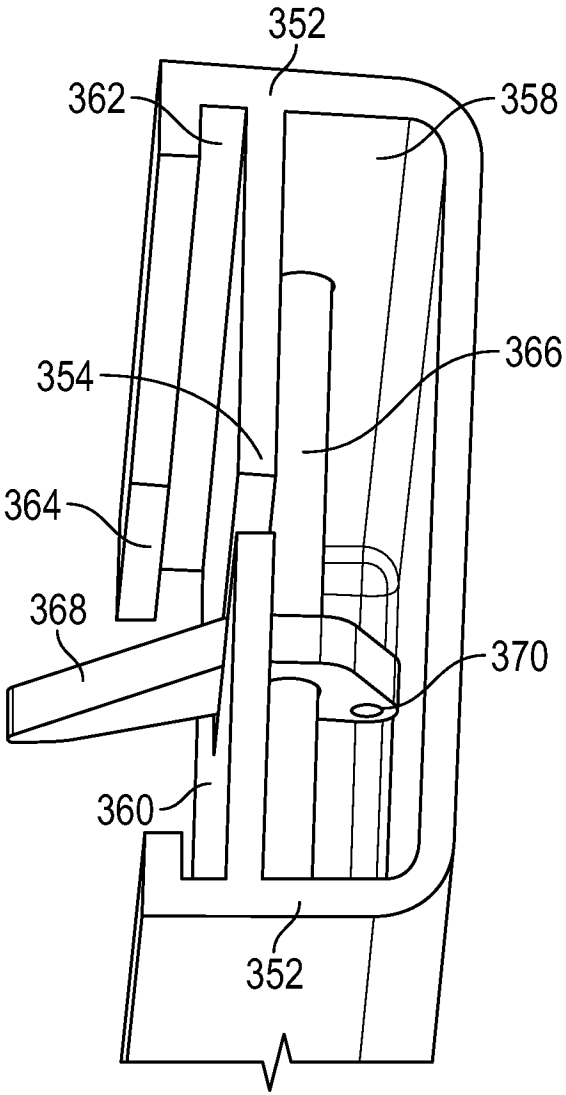
FIG. 101 is a top, left side, front view of elements of the lock assembly of FIG. 103.
Figure 100:
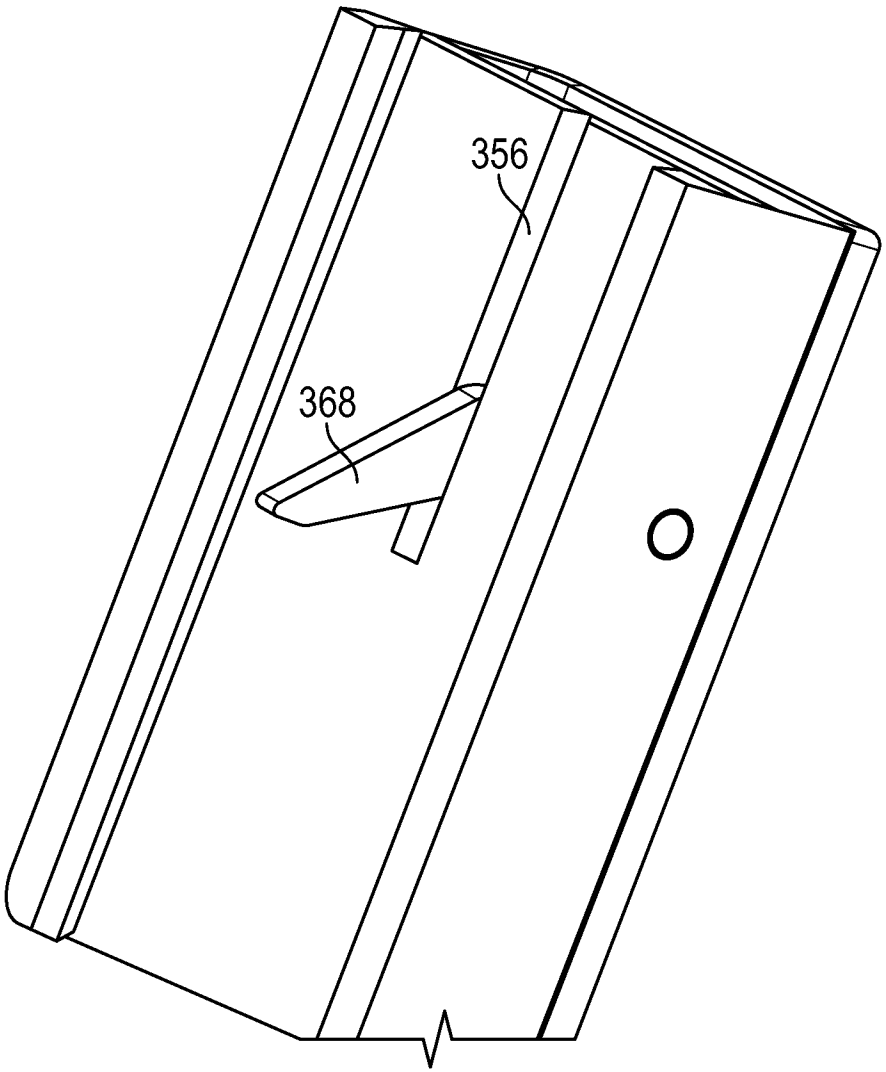
FIG. 100 is a front, left side, top view of elements of the lock assembly of FIG. 103.

FIG. 95 shows the assembly 334 coupled with a clip receiver of carrying assembly 100, the hang bar in the downward configuration. FIG. 96 is a similar view but with the hang bar in the upward configuration. In FIG. 97 the hang bar is in the downward configuration and is supporting a bow. Assembly 334 may be coupled with any clip receiver or clip receiving assembly disclosed herein to be coupled with a backpack, with any item on or attached to a user, or to any other item, and may be used to hold a bow, hat, gloves, trekking poles, etc. In implementations one or more spring biases may be included to bias the hang bar to stay in the downward configuration and/or in the upward configuration, and/or a lock to keep the hang bar in the closed and/or opened configuration, etc. In implementations anything can be hung on, or held using, any carrying assembly, firearm strap assembly, clip receiver assembly, or any other assembly, component, or subcomponent disclosed herein, such as gloves, hats, any other clothing item, hunting equipment of any type, sporting equipment of any type, camping equipment of any type, and literally any other item that is reasonably able to be carried by such assembly or component.

Figure 103:
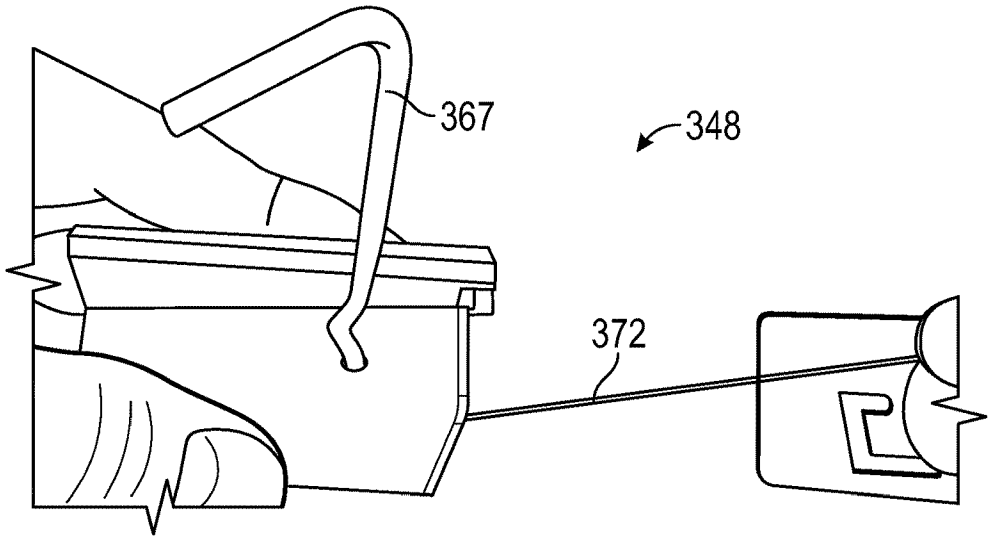
FIG. 103 representatively illustrates a lock assembly being unlatched by a user.
Figure 102:
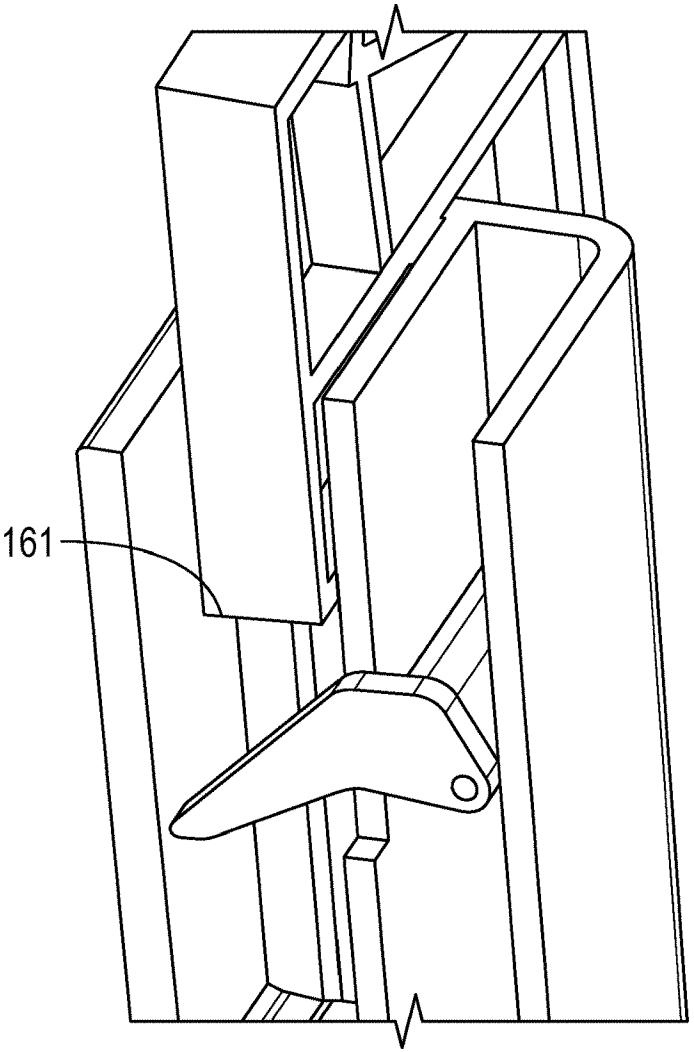
FIG. 102 is a left side, top, rear, cross-section view of elements of the lock assembly of FIG. 103.
Figure 104:
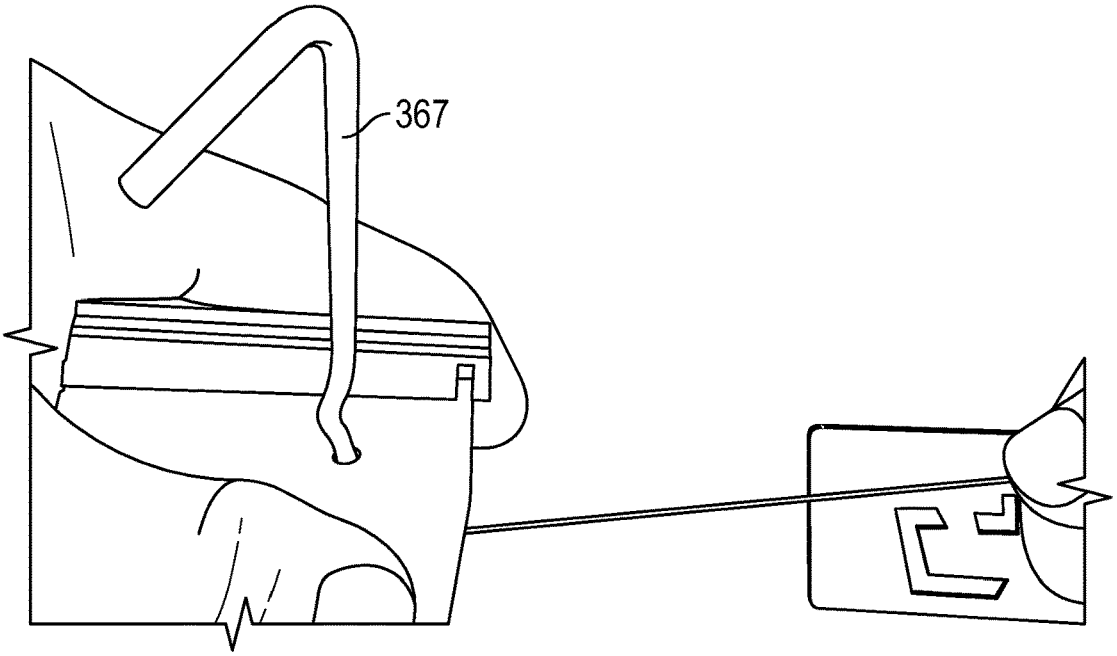
FIG. 104 representatively illustrates the lock assembly of FIG. 103 having been unlatched.

FIGS. 98-106 show an example lock assembly 348 which may be used to selectively lock a clip within a clip retainer. A housing 350 includes sidewalls 352 and a partition 354 having a slot 356 therein. The partition divides a first cavity 358 from a second cavity 360. An axle 366 rotatably coupled with the housing allows a lock 368, secured thereon, to rotate between a locked position (as in FIGS. 100-101) and an unlocked position (in which the lock would rotate upward or downward in a way that releases a secured clip). A spring bias, not shown, may be coupled with the axle such as to bias the lock toward the locked configuration. A pull member coupler 370 allows a pull member such as a string or cord or pin or the like (an example pull member 372 is shown in FIG. 103) to be manually pulled to rotate the lock to the unlocked position. The housing includes a pair of slots 362 and corresponding protruding edges 364 which may allow the housing to be secured to mating edges of a back of back plate 156 (or another back plate), and the lock in the locked position extends through opening 161 of the back plate so that the lock (at least when in the locked position) extends into the cavity 162 of the clip receiver 158. FIG. 102 shows a cross section view of the back plate and some of the lock assembly elements.

Figure 105:
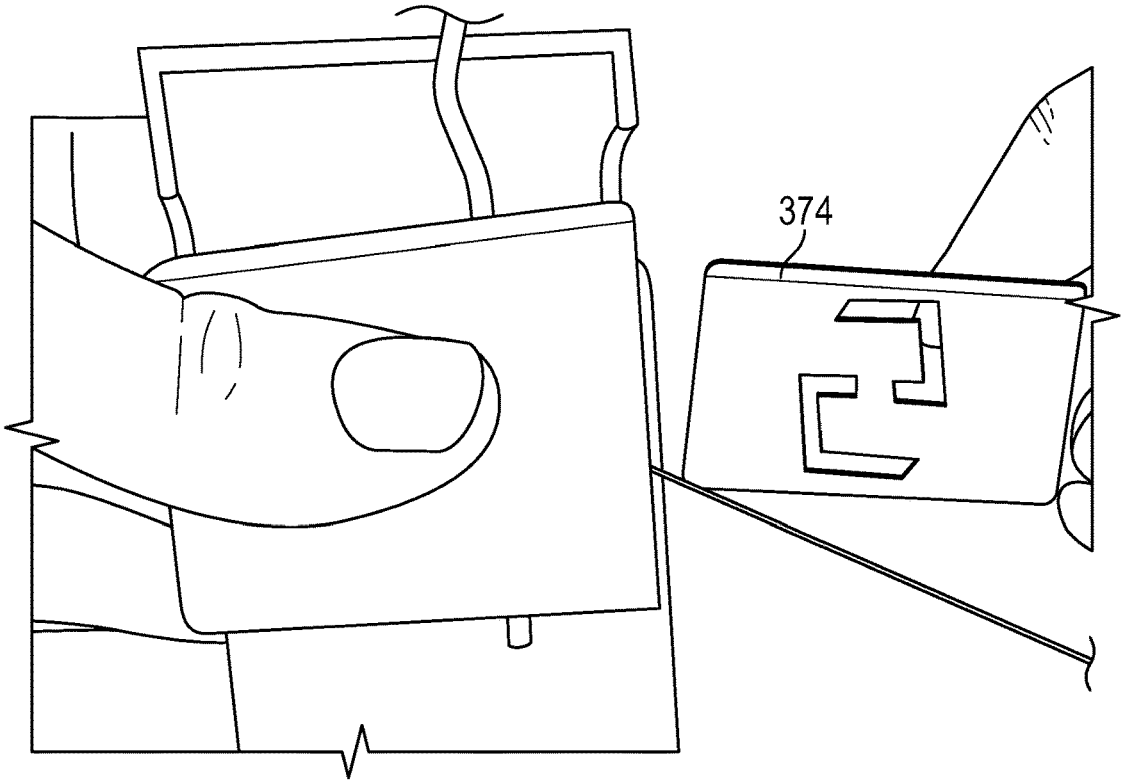
FIG. 105 representatively illustrates a user about to insert a gun clip into the lock assembly of FIG. 103.
Figure 106:
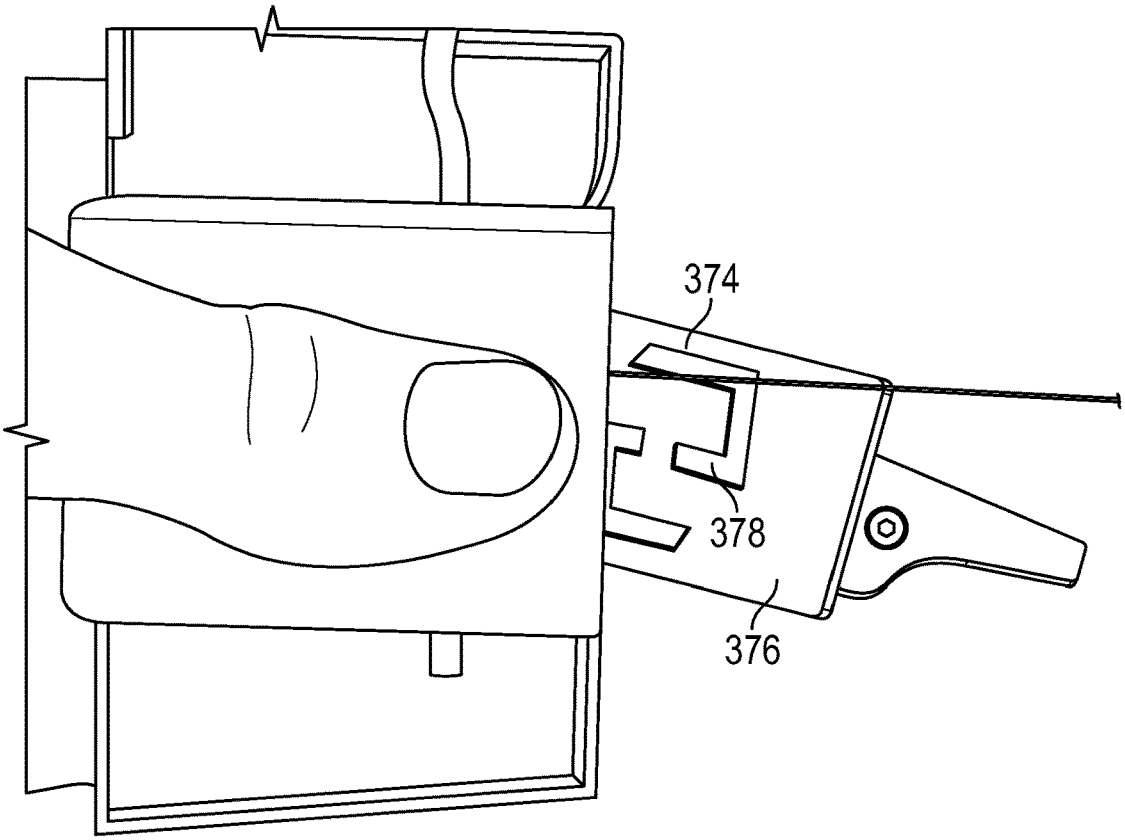
FIG. 106 representatively illustrates the gun clip of FIG. 105 at least partially inserted into the lock assembly of FIG. 103.
Figure 107:
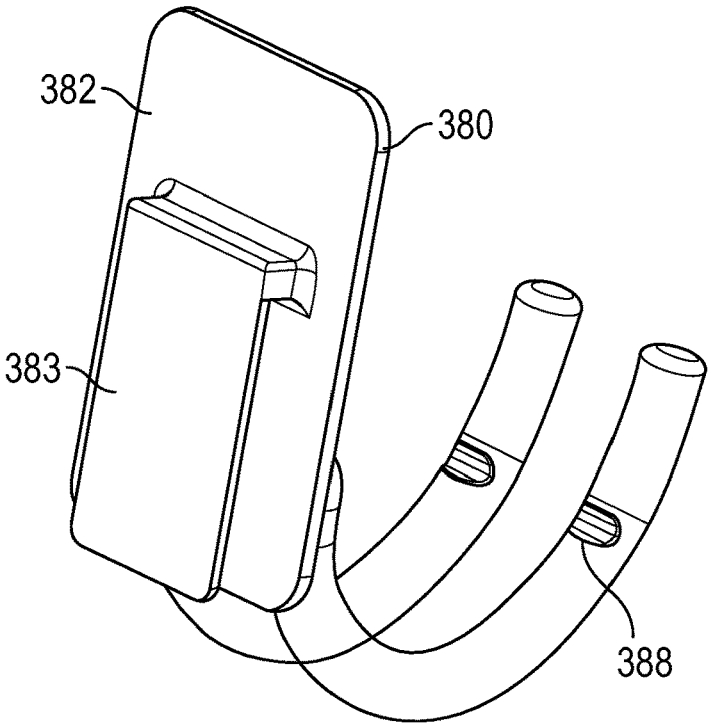
FIG. 107 is a rear, left side, top view of a carrying assembly in an open configuration.
Figure 109:
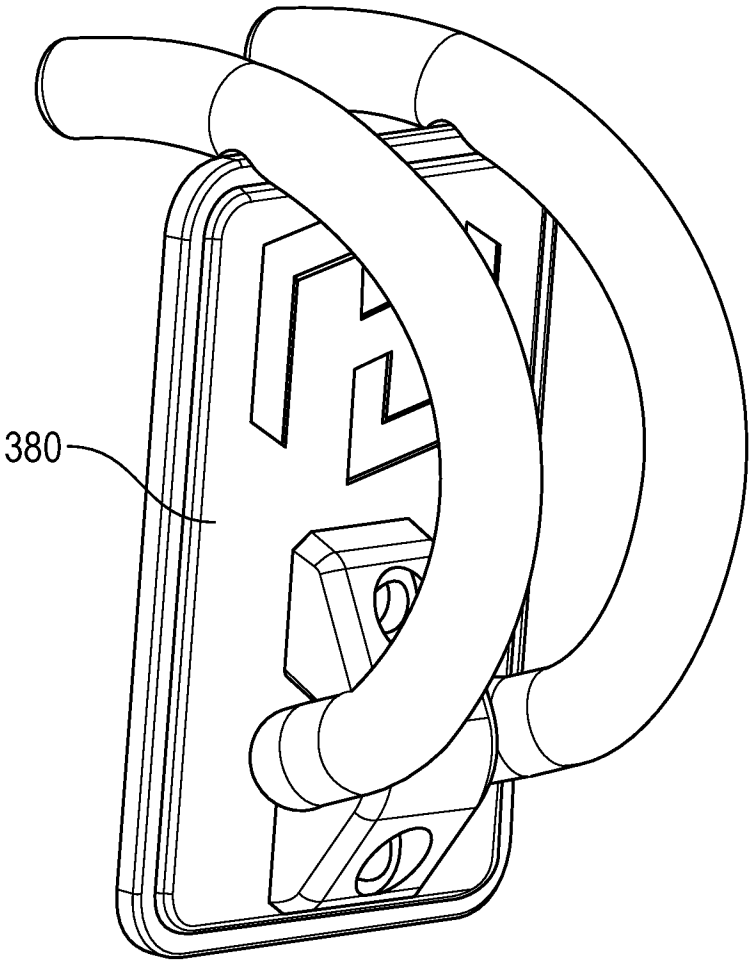
FIG. 109 is a front, left side, top view of the carrying assembly of FIG. 107 in a closed configuration.
Figure 108:
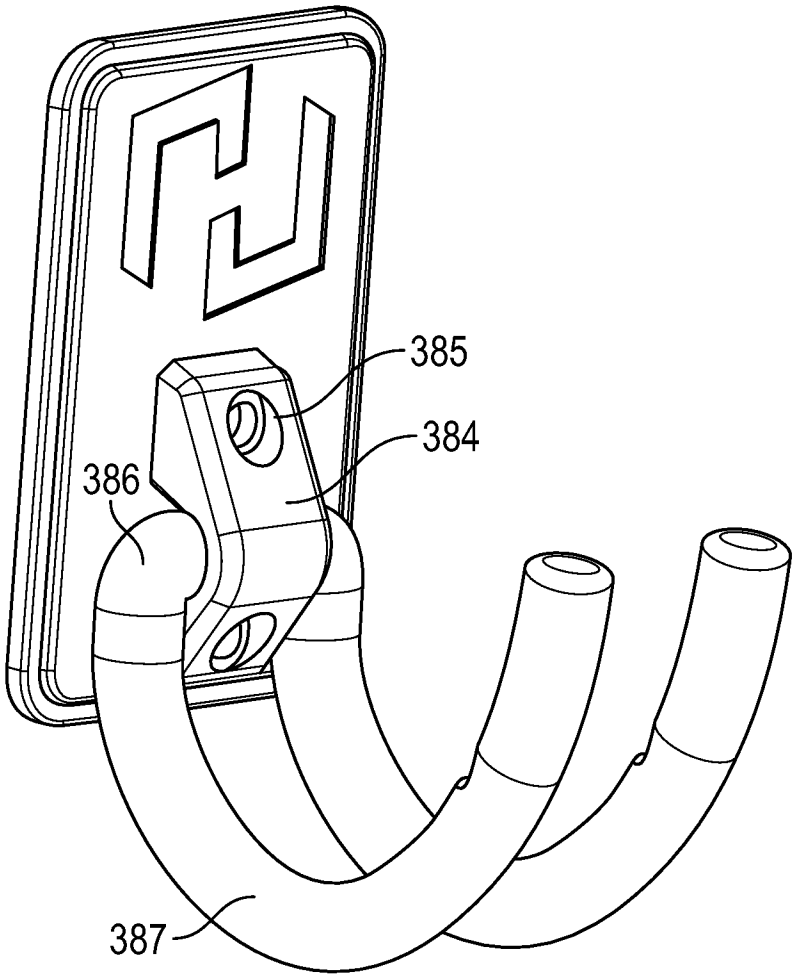
FIG. 108 is a front, left side, top view of the carrying assembly of FIG. 107 in the open configuration.

In FIG. 103 a slightly different axle 367 is used, which extends outside of the housing and can be manually turned for locking/unlocking using a bent handle of the axle (in addition or alternative to locking/unlocking by pulling on the pull member 372). In FIG. 103 the lock is in the locked position but the user is providing some tension on the pull member, while in FIG. 104 the user has pulled the pull member sufficiently to unlock the lock (and the handle is correspondingly seen as rotated relative to FIG. 103). In FIG. 105 the user is inserting a clip 376 of a gun coupler 374 into the clip receiver. This coupler is identical or similar to coupler 238 except having openings 378 in the clip. When the clip is inserted into the clip receiver the bias of the axle causes the lock to insert within one of the openings thereby locking the clip therein to prevent removal of the clip. In FIG. 106 the user has pulled the pull member sufficient for unlocking the lock, and the coupler is being removed (the clip being extracted out of the clip receiver). Any openings of any clips disclosed herein may be used for such locking/unlocking purposes, and may be useful for securing any item coupled with a clip, whether a gun or water bottle or anything else.

The lock assemblies are useful for tactical or military settings where a user is running, crawling, jumping, climbing, and so forth. The gun or rifle or other item is locked into place and with a simple pull of a loop portion or pull tab of a cable or cord (that may for instance be attached to or exit from either the left or right backpack shoulder strap) the clip securing the item may be released (by rotating the spring-tensioned lock) and then the user may pull the rifle or other item out of the back plate. Lock assemblies may be coupled with either clip receiver of a back plate, and allow the user to add locking capabilities for a rifle or assault rifle (such as an AR-15-style rifle), which may be very useful for military applications. In implementations the pull cable could for instance be identical or similar to a bicycle brake cable or shifter cable and could be disposed within a polymer sheath or the like, which sheath could be routed from proximate a back plate (close to the lock) to proximate the user's backpack shoulder strap or any other area that is convenient for a pull motion or other release motion. The cable could be looped on its end so as to provide a pull loop for the user to pull to release the lock, or any other pull member such as a tab or the like could be coupled near the end of the cable. The cable and sheath could in implementations be routed internally within the backpack, such as within the shoulder straps and/or within other parts of the backpack, and could be internally routed within the back plate and/or the housing of the lock assembly as well. Lock assemblies disclosed herein are useful in a variety of settings. For example in a military setting an enemy combatant may attempt to take a user's gun from behind but may be prevented thereby by the lock assembly, since the gun is locked to the back plate and the cable's end (or the pull member or loop of the cable) is on the front of a shoulder strap or otherwise close to the front of the user. On the other hand, when the user desires to draw a weapon or use any other item the user can simply pull the pull member or loop or other item of the cable (or item coupled with the cable) so as to quickly unlock the lock, and by reaching back may lift the gun or other item and retrieve it, such as for firing or the like. The user could pull the cable loop or tab or the like with one hand while reaching back with the other hand for retrieving the gun or other item, so that both may be done simultaneously to speed up the gun or item retrieval.

FIGS. 107-117 show a carrying assembly 380 which in some ways is similar to assembly 334 except having some different shapes and dimensions and other elements. A base member 382 includes a clip 383 extending therefrom. A retainer 384 has through-holes 385 and tighteners (not shown) such as screws or bolts or the like which secure the retainer to the base member. A hang bar 386 includes curved arms 387 which include recesses 388. An axle portion of the hang bar which at least partially couples with and/or within the retainer allows the hang bar to alternate between a downward position, as in FIG. 108, and an upward position as in FIG. 109. The recesses 388 in combination with a top edge/ridge of the base member 382 provide a bias towards keeping the arms in the upward/closed configuration when they are in this position, though manual force may overcome this. Other bias or locking mechanisms such as described above for assembly 334 may be included to bias the hang bar to stay in any given position when it is in that position.

Figure 111:
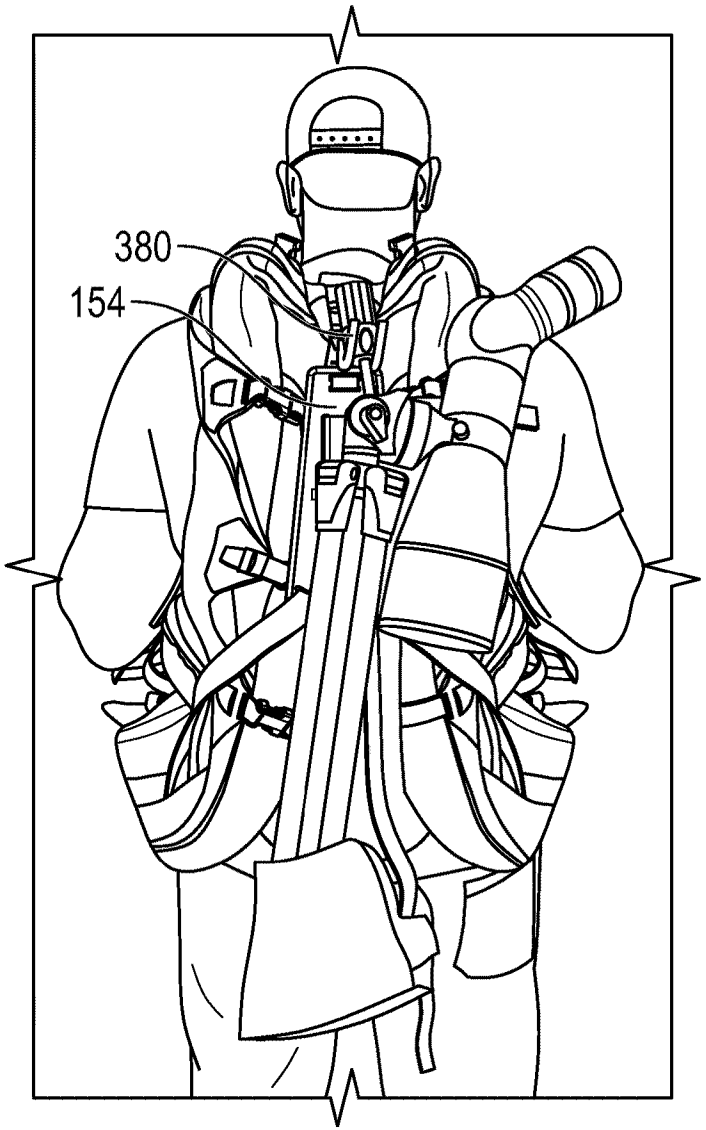
FIG. 111 representatively illustrates the carrying assembly of FIG. 107 in the open configuration secured to a back plate in turn secured to a backpack, and carrying a scope and tripod.
Figure 110:
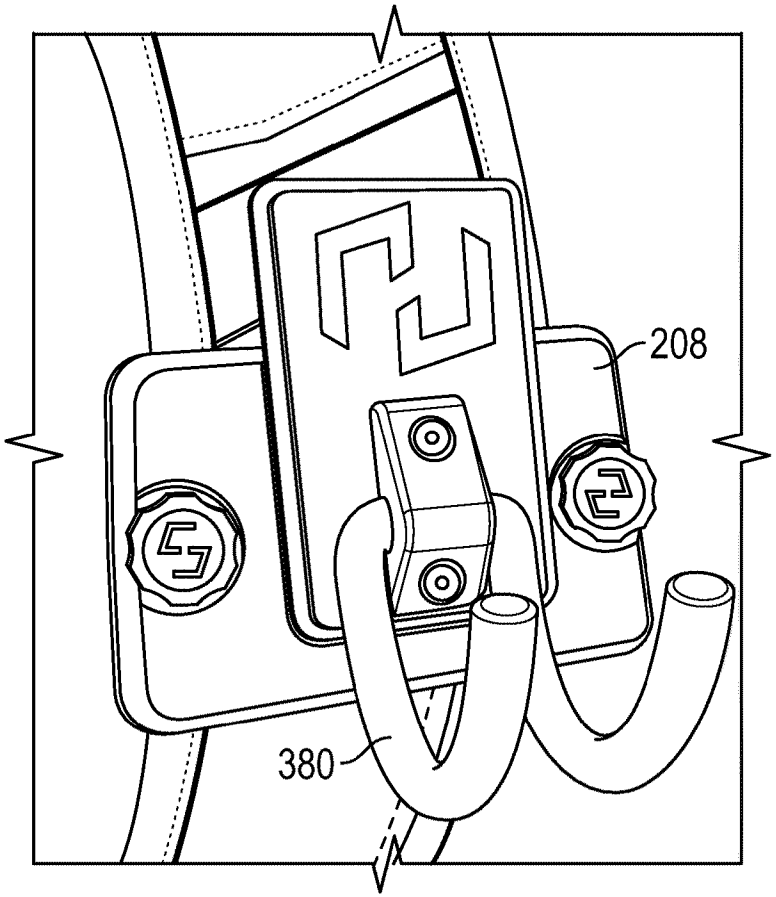
FIG. 110 representatively illustrates the carrying assembly of FIG. 107 in the open configuration and secured to the clip receiver assembly of FIG. 38 in turn secured to a backpack shoulder strap.
Figure 113:
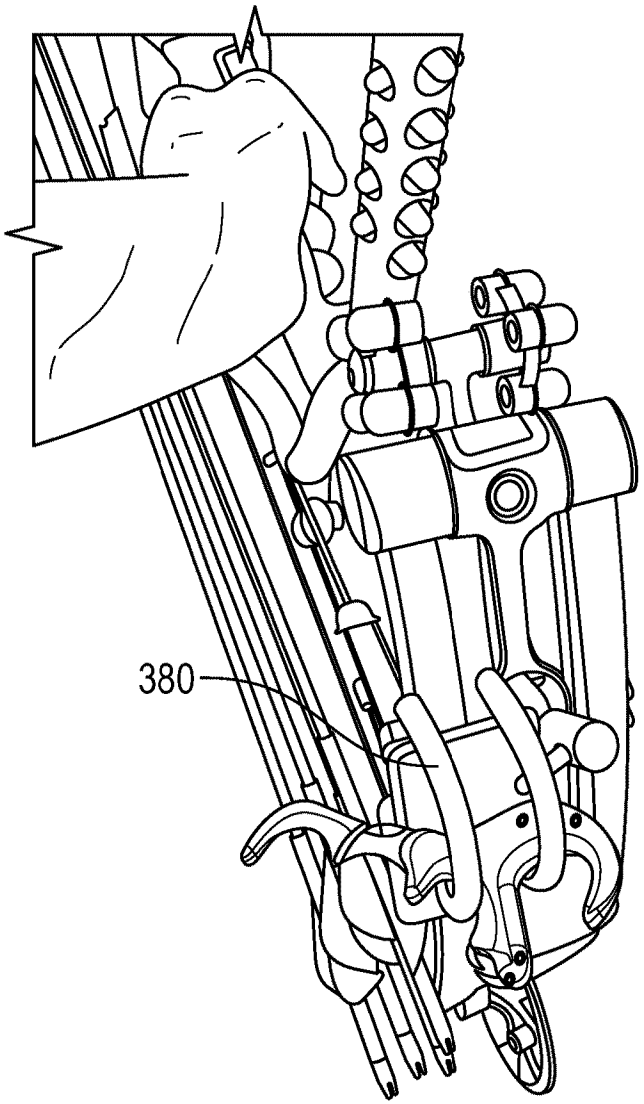
FIG. 113 is a front, left side, top view of the carrying assembly in the closed position secured to a bow.
Figure 114:
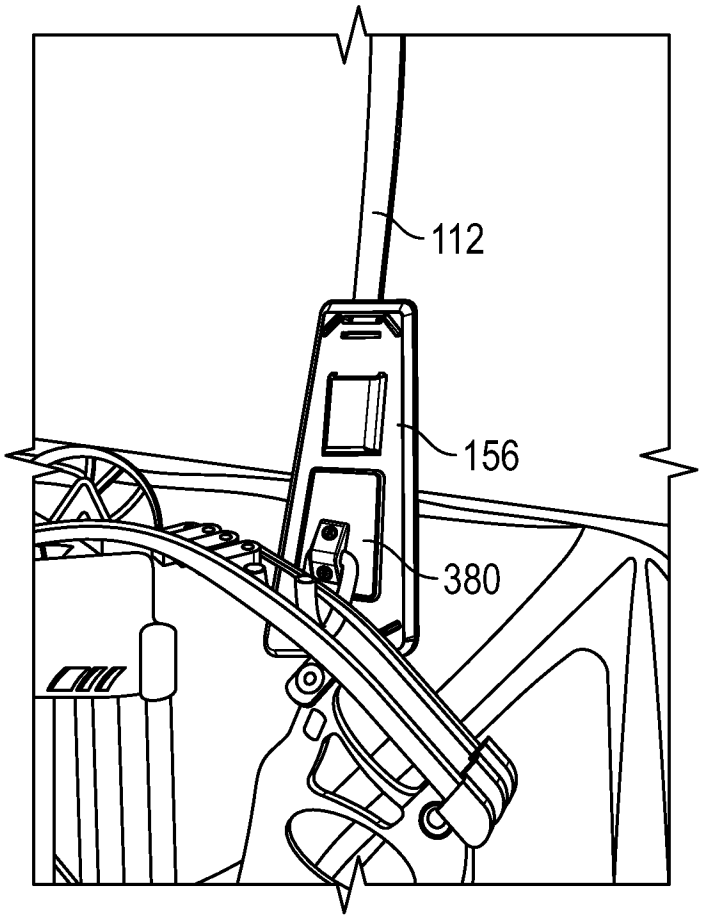
FIG. 114 representatively illustrates the carrying assembly of FIG. 107 in the open position holding a bow and secured to a back plate, in turn hanging from a canopy.
Figure 115:
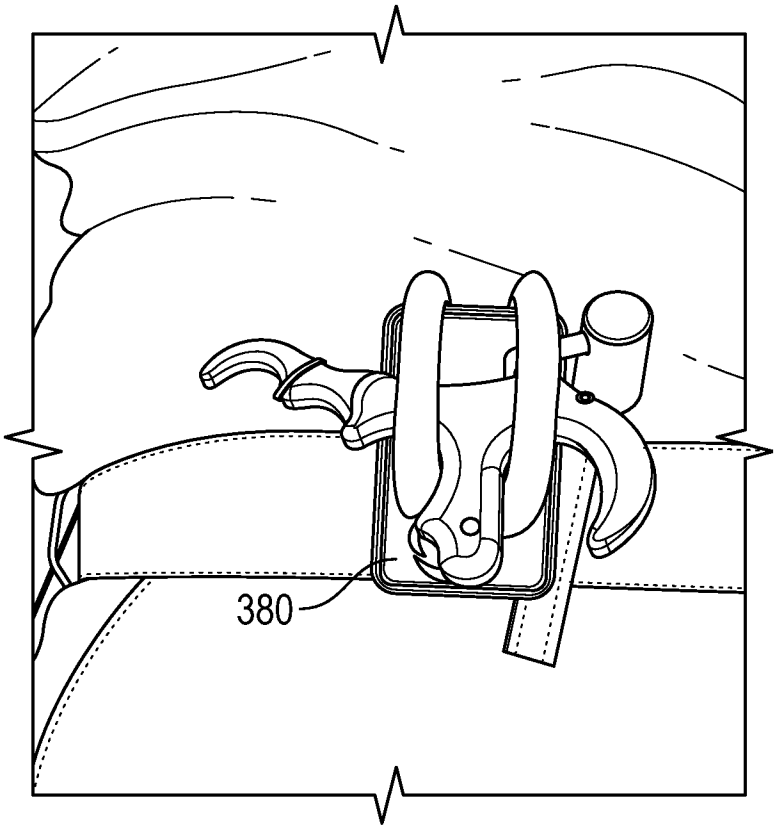
FIG. 115 representatively illustrates the carrying assembly of FIG. 107 in the closed configuration and secured to a user's waistband.
Figure 117:
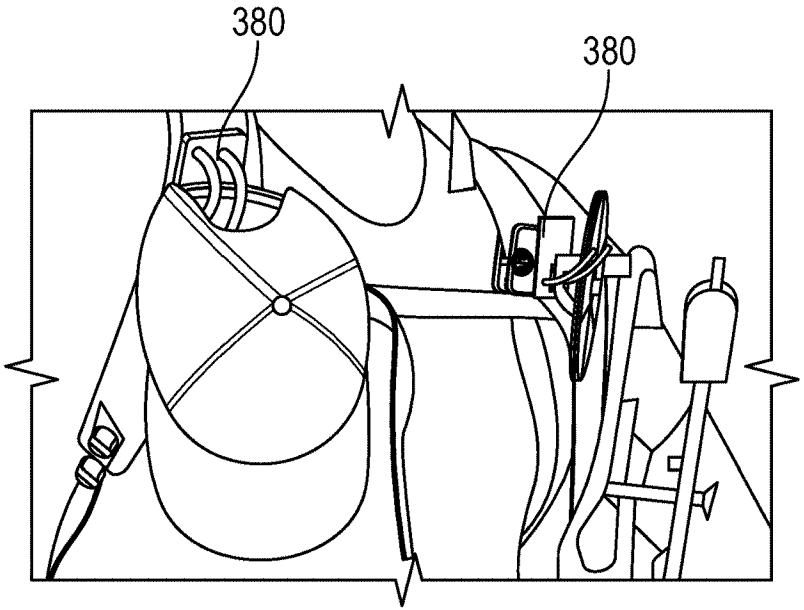
FIG. 117 representatively illustrates a first carrying assembly of FIG. 107 in the closed configuration holding a hat and secured to a clip receiver assembly of FIG. 38 in turn secured to a shoulder strap of a backpack, as well as a second carrying assembly of FIG. 107 in the open configuration holding a bow and secured to a clip receiver assembly of FIG. 38 in turn secured to another shoulder strap of the backpack.
Figure 116:
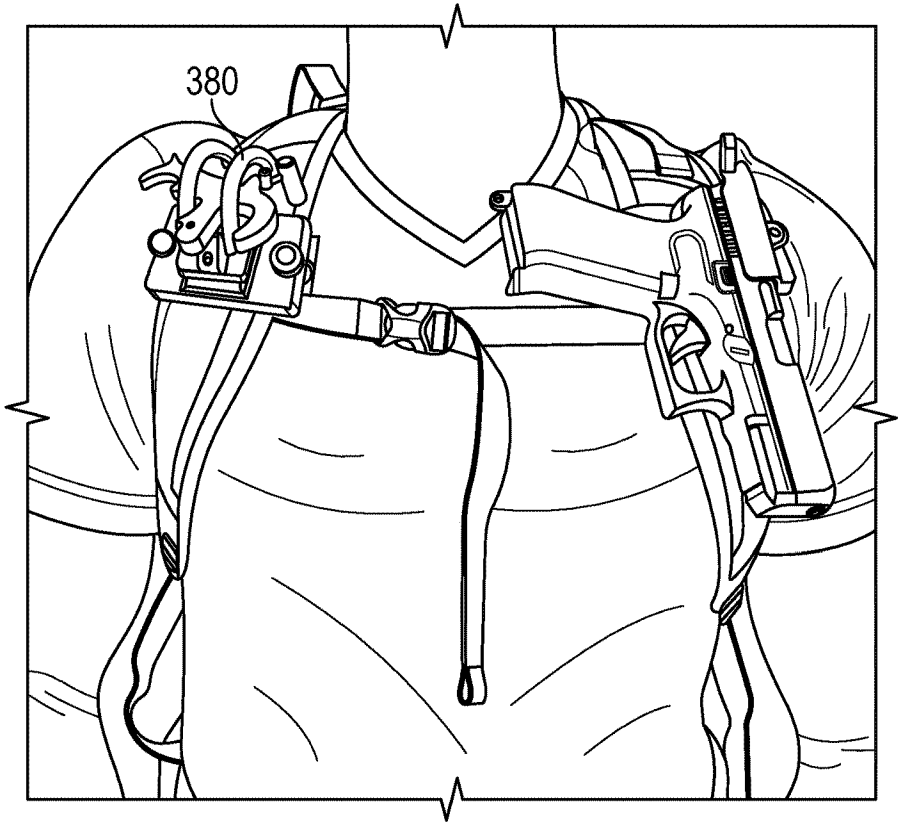
FIG. 116 representatively illustrates the carrying assembly of FIG. 107 in the closed configuration and secured to a clip receiver assembly of FIG. 38 in turn secured to a shoulder strap of a backpack.
Figure 119:
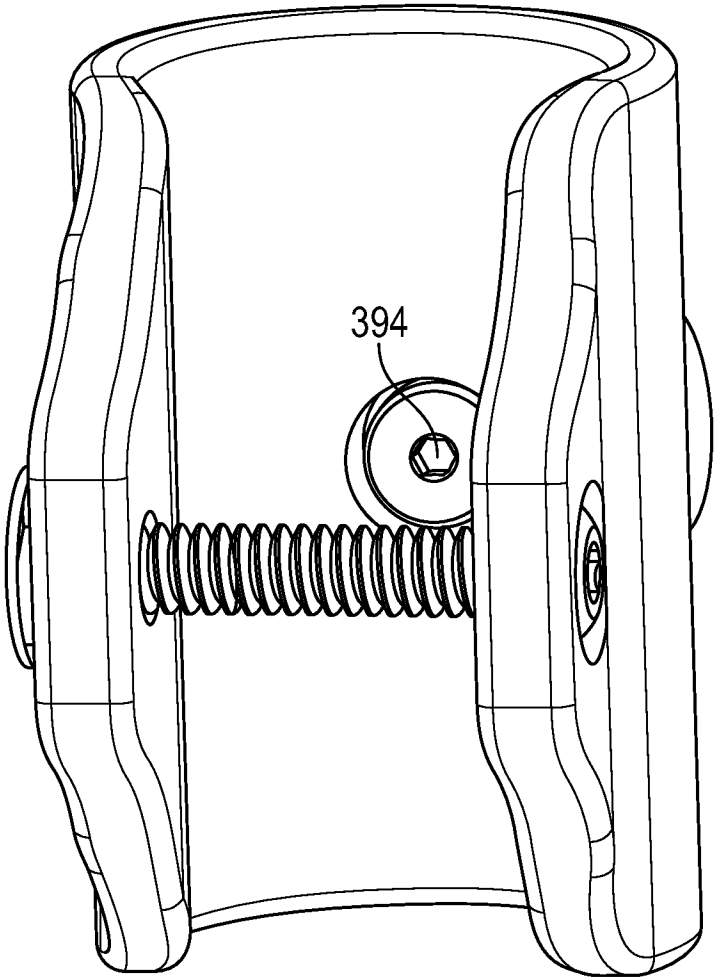
Figure 118:
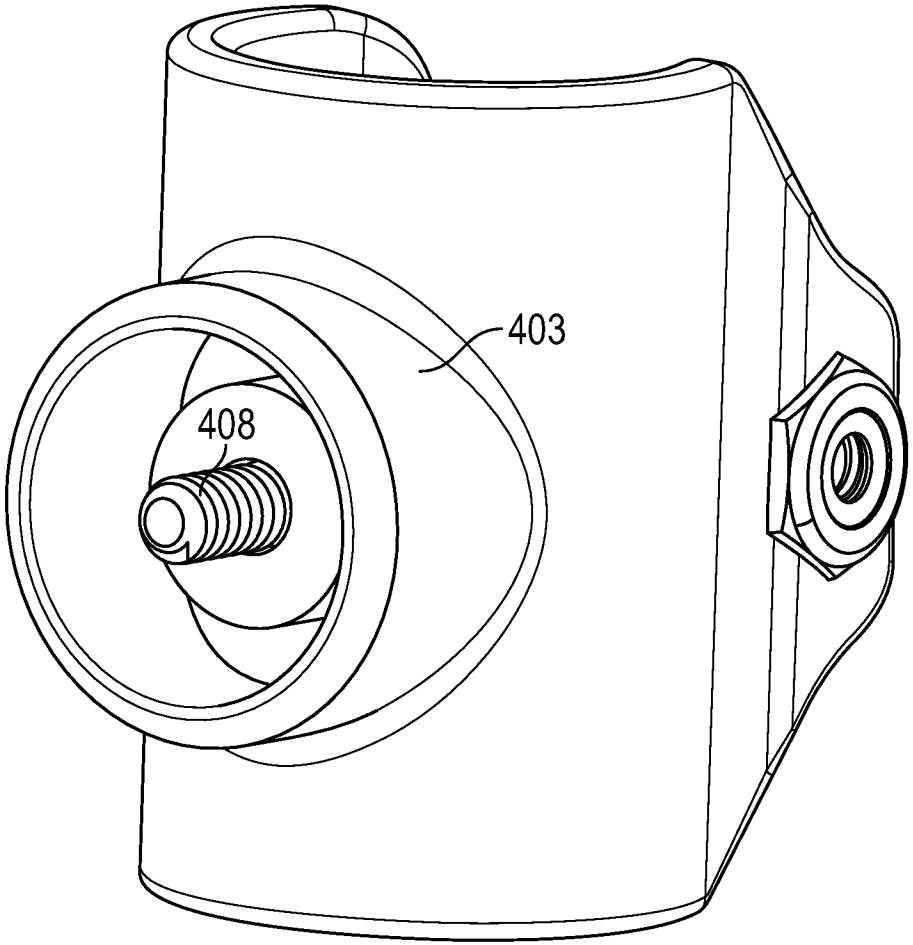
Figure 121:
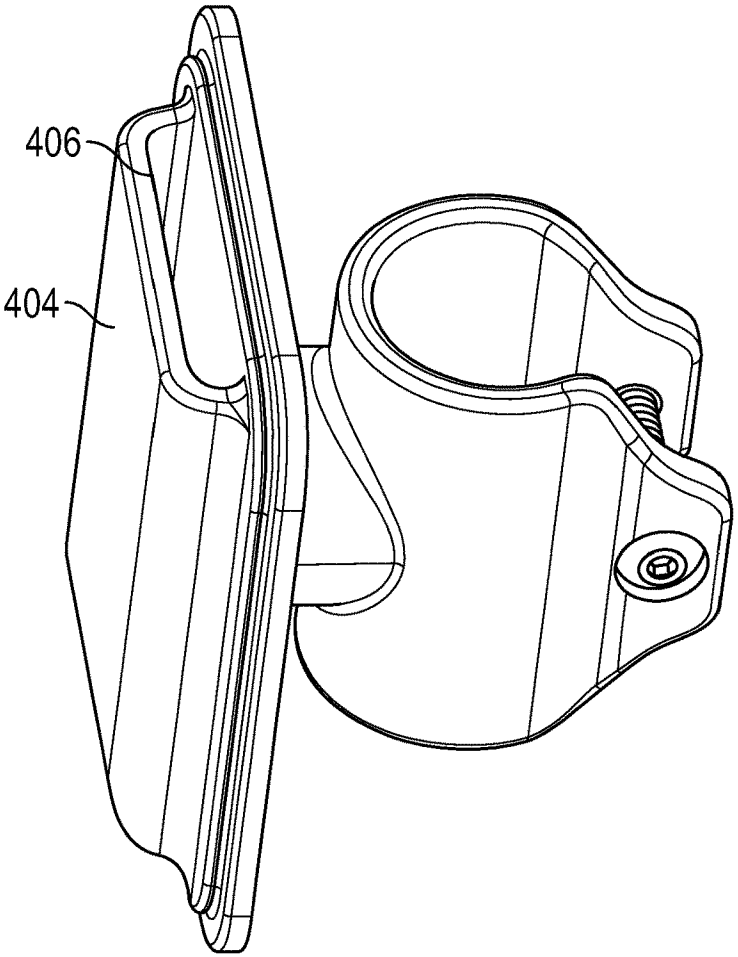
Figure 120:
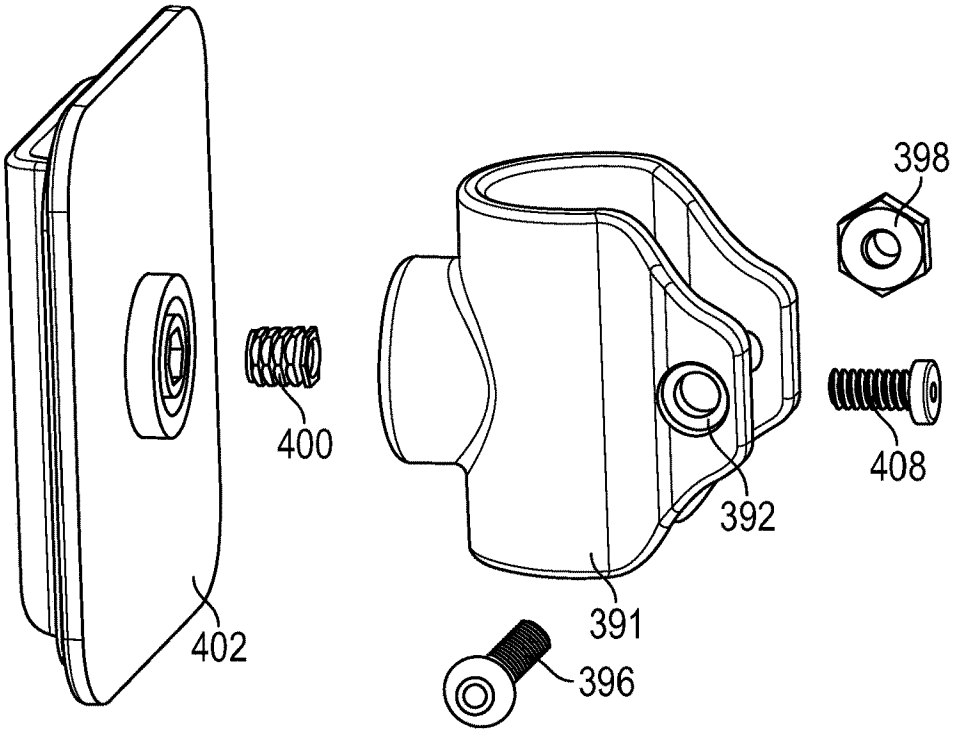
Figure 123:
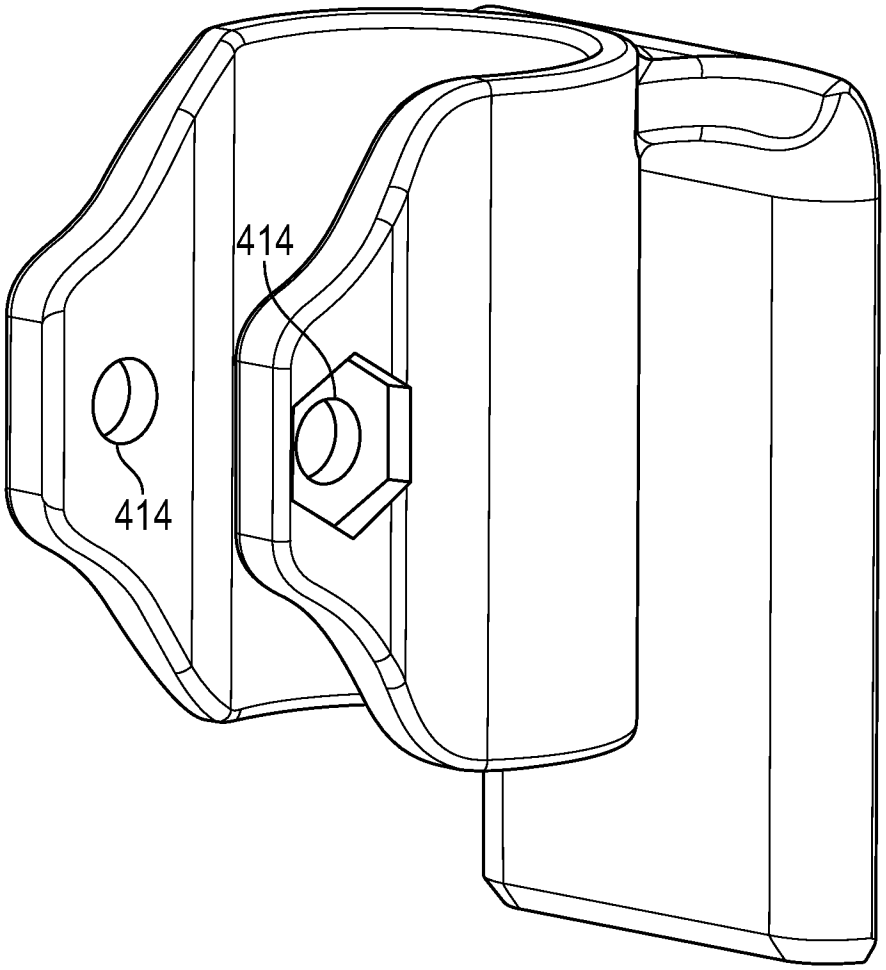
Figure 122:
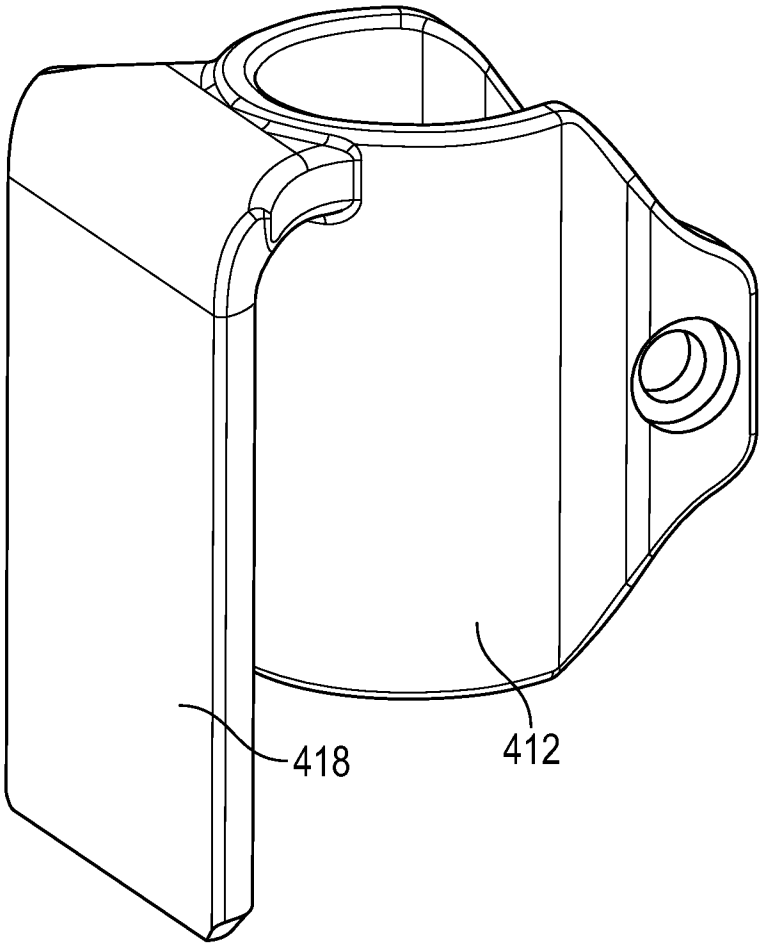

In FIG. 110 an assembly 380 is coupled with a clip receiver assembly 208, while in FIG. 111 the assembly 380 is coupled with the clip receiver of assembly 154 (and is being used to hold a scope and tripod). In FIGS. 112-113 an assembly 380 is coupled with a clip receiver assembly 230 which is adhered to a bow using adhesive 233 (the hang bar is in the closed/upward configuration and is being used to secure a bow release). In FIG. 114 back plate 156 is being used (along with a strap 112 and not-shown hook 108 to couple the back plate to the pole of a tent or awning) and assembly 380 is coupled with the lower clip receiver of the back plate and is in the open/downward position and is holding a bow. This image reveals alternative uses for the back plate and carrying elements in addition or alternative to use with a backpack. Of course a rifle with a firearm strap assembly, or a gun with a gun coupler, could be hung from a tent pole or other item in a similar manner using the clip receiver of a back plate. FIG. 115 shows assembly 380 simply clipped over a user's waistbelt and/or waistband and in the upward/closed configuration securing a bow release. FIG. 116 shows assembly 380 coupled with clip receiver assembly 208 and secured closed holding a bow release, while a handgun is secured to the other assembly 208 using one of the gun couplers. FIG. 117 shows two assemblies 380 each coupled with a clip receiver assembly 208—one in the closed configuration holding a hat and the other in an open configuration holding a bow. These images accordingly show much versatility in using the assemblies 380, alone or in conjunction with other elements, to hold various items and easily place such items in a secure configuration and/or remove them therefrom such as for easy access and use.

One or more assemblies 380 can be used to hold various items such as a camera, binoculars or another scope/lens, a tripod, hiking poles, etc. Hiking poles and other elements could be held while the assembly 380 is vertical and open (as in FIG. 108) by resting the pole handles atop the two arms with the pole passing between the two arms, or while the assembly 380 is horizontal by pressing a portion of the pole(s), such as the handle or otherwise, between the two arms and the base member.

Any of the clips disclosed herein can allow items to be coupled with a waist belt, a strap on a backpack, a back plate as disclosed herein, any carrying assembly disclosed herein, and any other clip receiver or clip receiving element disclosed herein.

FIGS. 118-132 show various elements of a pole clip system 389. A clip receiver assembly 390 includes a pole receiver 391 having a first pair of through-holes 392 for a tightener 396 (such as a bolt or screw) to pass therethrough and, with the use of a nut 398 (or threads of the through-holes themselves), allow tightening of the pole receiver to a pole, such as a hiking/trekking pole. A second through-hole 394 allows a tightener 408 (which may be a screw or bolt or the like) to pass therethrough to secure the pole receiver 391 to base member 402. The base member abuts extension 403 and is rotatable relative to the pole receiver, made more or less easy based on the tightness of tightener 408. In some cases the tightener 408 couples with the base member through an adapter 400, and in some cases the adapter itself allows the tightener 408 to secure the pole receiver and base member together while also allowing them to rotate relative to one another. For example, the adapter could be fixed to the base member but have internal elements which allow rotation of the base member relative to the pole receiver without loosening or tightening the tightener 408.

Base member 402 has a clip receiver 404 extending therefrom having an opening 406 providing access to a cavity. Any clips of any elements disclosed herein could be coupled with the clip receiver.

Clip assembly 410 of the pole clip system includes a pole receiver 412 that is identical or similar to pole receiver 391, having through-holes 414 allowing a tightener 416 (such as a screw or bolt or the like) and nut (not shown) or threads of the through-holes to tighten the pole receiver around a trekking/hiking pole or other pole. A clip 418 extends from the pole receiver and may be used to clip the clip assembly 410 with the clip receiver assembly 390 (or any other clip receiver).

In FIG. 124 two trekking poles are shown, one having the clip receiver assembly 390 secured thereto and the other having clip assembly 410 secured thereto. In FIG. 125 the poles are secured to one another by the clip of the clip assembly being secured within the clip receiver of the clip receiver assembly. This may be useful for securing the poles together for storage, for example. In FIGS. 124-125 the clip receiver is positioned upward, but in FIG. 126 it has been rotated ninety degrees to show the rotatability thereof (it can also be rotated to any other rotation). In FIG. 127 the user has been walking/hiking with the trekking pole and is lowering to a knee-down position while simultaneously positioning a bow (having a firearm strap assembly 124 thereon) towards the pole. In FIG. 128 the user has secured the clip of firearm strap assembly 124 with the clip receiver assembly 390 so that the pole can secure and steady the bow for firing. Because the clip receiver assembly has a rotatable function, after the user has secured the bow in this manner the user may still rotate the bow up or down while keeping it secured to the pole. Such a use provides increased stability for a long range shot and/or may be useful if the user has an injured shoulder or rotator cuff. In implementations securing a bow in this manner may double the user's distance with an ethical shot (which will be extremely helpful in the field).

In FIG. 129 the pole clip system is being used to secure two poles together, each staked into the ground, to form a bipod rest. The user is resting a rifle using the bipod rest to steady the rifle for aiming. Because the poles can be rotated to any angle relative to one another in the secured configuration, they could be set at ninety degrees, or thirty degrees, or at any other angle relative to one another to create any desired bipod configuration. In the figures the pole clip system is attached high up so that the gun stock rests on the trekking pole handle elements, but in other implementations they may be adjusted down to any lower portion of the trekking poles, as desired.

In FIG. 130 the user has shortened the poles (using shortening functionality of the poles themselves) to form a shorter bipod rest and is laying down and resting the rifle using the bipod rest to steady the rifle for aiming. Such setup and aiming can be done very quickly and conveniently since the user is already using the trekking poles for hiking and/or has the poles ready at hand, such as coupled with a backpack. In FIG. 131 the user is dropping down to one knee while simultaneously coupling a firearm strap assembly 124 (secured to a rifle) with a clip receiver assembly 390 (not visible), and in FIG. 132 the user has already dropped to the knee and is aiming the rifle for firing. This shows how a user can very quickly secure the rifle to the pole for steadying of the rifle, and to help with aiming, in one continuous motion while dropping to the knee. Because the rifle when secured in this manner is still rotatable relative to the pole, the user can rotate the rifle as needed for aiming, and/or may rotate the pole and rifle to zero degrees relative to one another to easily hold them both in one hand while walking/hiking for a while, without having to detach them from one another. Other methods are possible with the pole clip systems, and these are only examples, but they show the versatility with which the pole clip system may be used.

FIGS. 133-142 show a blind system 420. A receiver member 422 includes a plurality of stake receivers 424, through-holes 426 and a clip receiver 428 having an opening 430 providing access to a cavity. A clip member 432 includes a clip 438, through-holes 436, and stake receivers 424. Stakes 440 couple with the stake receivers and can be manually removed therefrom. Cords 442 pass through the through-holes and can be used for various securing functions.

In FIG. 136 the receiver member 422 and clip member 432 are secured together, and in FIG. 137, while secured together, the stakes are also coupled thereon. The cords may be wrapped around the assembly of FIG. 137 to create a very compact storage configuration. In FIG. 138 the receiver member 422 is coupled with clip 418 (which is coupled around a pole) and clip member 432 is coupled with the clip receiver of base member 402 to secure the receiver member 422 and clip member 432 with hiking/trekking poles. A different view of this configuration is seen in FIG. 139. In FIGS. 140-142 the two trekking poles have been pressed into the ground, the cords passing through the through-holes have been used to couple with the stakes to stake the poles into secure positions (tensioning the tops of the poles away from one another) and a blind 444 is coupled with the tops and/or bottoms of the poles. The blind system thus allows for hiking poles to be used to quickly and easily set up a blind such as for hunting or other purposes. In FIG. 141 the blind may be secured to only the tops of the poles or both the tops and bottoms of the poles, and the blind is in an upright position. An angled position such as in FIG. 142 may be accomplished by staking the lower corners of the blind away from the poles (and shortening the poles, if needed). Once the blind system is set up the user may adjust pole positions, pole heights, and stakes and cords to adjust the blind positioning and configuration as desired. Such systems may also be used for securing something other than a blind, such as a tarp, fly, awning, shelter, or the like.

As indicated above, the cords may be wrapped around the components of FIG. 137 for storage. When deploying the blind assembly the user may hold such a combination of elements upright and allow the cords to unravel by gravity, which allows for quick deployment. It has been found that the blind system may very quickly be set up, using the poles, in under sixty seconds. In implementations (as in FIG. 141) the bottoms of the trekking poles are not pressed into the ground, but have rubber or polymer boots thereon, and the bottom corners of the blind are held secure by the boots pressing down on the corners to hold them tightly down. In implementations the existing holes/openings in the blind that are present throughout the blind (so that the user has visibility through the blind) are used for coupling the blind with the top of the hiking pole, by passing the hiking pole through one or more of such holes. Any discussion of trekking poles herein (or any implementations of systems or elements that work together with trekking poles) may alternatively be used with shooting sticks/supports or monopods. The blind itself could also include a variety of patterns or designs such as camouflage, decoy animal patterns (such as images of deer or elk), etc., to help conceal a user and/or to attract (or not frighten) animals being hunted, or for other reasons.

In implementations the slots of back plates disclosed herein may be configured so that, when the back plate is against a hiking or hunting or any other type of backpack, the straps pull to adjust tighter but don't slide back (towards a looser configuration) without positioning the back plate away from the backpack.

Any of the elements disclosed herein that are or can be used with a backpack (such as back plates, clip receivers, and any other disclosed element herein) may, in implementations, be integrally formed within or on the backpack itself. Accordingly, implementations of hunting and carrying devices, assemblies, systems, and related methods may themselves include a backpack with such elements integrally formed therewith.

Any clips disclosed herein may include openings for allowing a locking mechanism. Any of the gun couplers may have elements (clips, pull members, etc.) reversed or placed on opposite sides as those shown in the drawings according to the desired use and storage position/configuration. Additionally, any gun coupler type may be modified to securely fit well with any gun type and model.

Any element or sub-element disclosed herein may be modified in number, shape, size, etc. without departing from the scope of this invention. For example a back plate could include three or four clip receivers, or only one, and of various sizes, a clip receiver assembly for coupling with a backpack shoulder strap could include two clip receivers, of various sizes, and so forth.

Any item shown in the drawings as mounted using a clip receiver assembly or with a carrying assembly of any type in one location may similarly be mounted with that same type of element in another location. For example the scope mounted to carrying assembly 154 using carrying assembly 380 at a back of the backpack may alternatively be mounted to a carrying assembly 208 using carrying assembly 380 at the shoulder strap of the backpack, or in any other location where carrying assembly 380 may be located. Some guns have openings at the butt end that allow them to be carried, butt end up, by hanging on the arms of carrying assembly 380 or 334. Additionally, the methods disclosed herein include carrying any item, using any of the carrying elements disclosed herein, in any feasible or reasonable configuration or combination.

The ease with which a user may retrieve a rifle or bow from a backpack, while reaching over the back, also allows a user on a bike or motorized vehicle who is actively riding to briefly stop, retrieve the gun or bow by reaching back and pulling upwards, and aim and fire without dismounting from the bike or vehicle.

Referring now to FIGS. 143-147, a back plate 502 is representatively illustrated. In some ways it is similar to other back plates described herein, having clip receivers 504 each having an opening 506 providing access to a cavity 508. A plurality of slots 510 allow the back plate to be secured to a backpack, such as using the same straps 168/172 described above secured around the arm and waist straps of a backpack, with the free ends (opposite loops 170/174) threaded through the double-slot elements at each of the four corners of the back plate. The straps may be pulled tight through the double-slot elements (and held secure due to friction from the separator 512, located between each slot pair, on the corresponding strap). One advantage of having the tightening mechanism built into the back plate (instead of having separate tightening mechanisms coupled with the straps) is that manual force may be used by the user to loosen all straps at the same time by simply pulling the back plate away from the back of the backpack (each strap sliding through its corresponding double-slot to allow this pulling motion) such that the user can easily back the back plate away and have easy access to the backpack itself, such as for removing items therefrom and/or placing items therein/thereon. The top middle double-slot could be used for a strap secured to a hook such as hook 108, either alternative or additional to the top corner straps, for use with backpacks having a grab bar/handle or the like. The same pulling motion for separating the back plate from the backpack operates if the top strap is used for a hook.

From the perspective of FIG. 145 it may be seen that a pair of overhangs 516 at least partially define recesses 514, and that these correspond with the topmost clip receiver. This allows functionality for coupling a lock assembly, such as lock assembly 530 of FIG. 149 (which may also be called a locking assembly herein), with the back plate to provide a locking function (similar to the locking function of other locking assemblies discussed herein). From the perspective of FIG. 146 it may be seen that a protrusion 518 extends from each recess 514. These protrusions are sized and shaped to sit within corresponding recesses of a lock assembly, such as recesses 536 of FIGS. 148/150, to bias the locking assembly to the back plate or to otherwise keep it secured thereon until a user manually removes it. A lock assembly may have a protruding portion, such as back portions 534 of FIGS. 148/150, which are sized and shaped to slide upward into (and downward out of) recesses 514 for securing the lock assembly to the back plate.

FIG. 147 is a close up view of a top portion of the back plate of FIG. 143, showing example configurations of some of the double slot elements each formed by two slots 510 separated by a separator 512. Each of the double slot elements in the example back plate is identical except for relative position and rotation.

FIGS. 148-153 show various views of a lock assembly 530 and/or portions thereof. In FIG. 149 it is seen that the overall assembly includes a first housing 532 and a second housing 568 coupled together using a tube 564. Tube 564 is flexible (as is cable 566 therein) such that, while the first housing is secured to the back of a back plate behind a user's back (when the backpack is being worn), the second housing can be secured to a shoulder strap or other element at a front of the user for easy access. This allows the user easy access to operate a pull member 574 to pull the cable and release the lock 556, such as to unlock a clip locked into the corresponding clip receiver, the clip secured to a firearm or other element by a terminal end 558 of the lock, similar to other lock assemblies disclosed herein, but quickly retrievable once the lock is disengaged.

FIGS. 148 and 150 show that the first housing includes a pair of back portions 534 each having a recess 536 and operating as described above for securing to a back plate. A bottom portion 538 secures to the first housing (such as with a friction fit, an adhesive, by virtue of axle 546, or otherwise) and includes a through-hole 540 for receiving the cable (or tube and cable). A pair of projections 542 are present on the bottom portion and each includes a through-hole 544 for receiving and securing to the axle. Projections 548 are present on the first housing and each includes a through-hole 550 for receiving and securing to the axle. First housing includes sidewalls 552 each of which includes a through-hole 554 for receiving and securing to the axle. Lock 556 includes a terminal end 558 configured to provide a locking function and also includes a through-hole 560 for receiving and securing to the axle. The lock further includes a slot 562 which is configured to receive a terminal end (not shown) of the cable (for example a knot in the cable or an element attached to the terminal end of the cable having a larger diameter than the cable can reside above the slot so that pulling down on the cable rotates the lock on the axle to an unlocked configuration. A bias member may be provided, such as a flat/leaf spring between the first housing and the lock or a coil spring wound around the axle, to bias the lock to the locked configuration, though one is not shown in the figures. The axle could be secured with a friction fit, adhesive, threads, or some other mechanism to the first housing and bottom portion and in implementations may not rotate relative to either of these elements, so long as the lock may rotate relative to the axle. In implementations the locking function is achieved not only by the terminal end but also by other portion(s) of the lock.

The second housing 568 and various elements coupled thereto are shown in detail in FIGS. 151-153. A through-hole 570 allows the cable (or the cable and tube) to pass through to an interior of the second housing, and through-hole 576 of the pull member 574 allows the cable to further pass within a cavity of the pull member, where a loop (as in the drawings) or a terminal end of the cable 566 may be secured to the pull member so that when the pull member is pulled using its bottom handle, the cable is pulled downward. Means for securing the cable to the pull member are not explicitly shown in the drawings, but the cable loop could be secured around a simple projection of the pull member, or screwed thereto, or a knot or larger-diameter element could be sized to not be passable through the through-hole 576 for securing the cable thereto, or any other securing mechanism may be used.

The pull member is sized and shaped to sit at least partially within the second housing, such that slots at a bottom of the second housing (not numbered) slidably receive corresponding portions of the handle of the pull member (not numbered). The second housing has an extension 571 which at least partially defines a threaded receiver 572, and opening 578 of the pull member is oblong to allow room for the extension 571 to move up and down therein during the pull motions. The pull member includes spring receivers 580 each of which receives the top of a spring 582, and the bottom of each spring rests against a bottom of the second housing (next to the aforementioned second housing slots) so that the pull member is biased upward.

A clip member 584 includes a through-hole 586 through which a screw 592 may pass and then secure to the threaded receiver 572 to secure the clip member to the second housing with the pull member sandwiched therebetween (but still slidable relative to each). Projections 591 mate with corresponding recesses 581 and slot 573 for alignment and further securing the portions together. The clip member includes a clip portion 588 which may be secured to a backpack shoulder/arm strap (left or right) or a user's pocket or some other element, as described above, so that the pull member is easily accessible to disengage the lock. A recess 590 in the clip portion allows easy access to through-hole 586 for securing and removing the screw 592. Other configurations for the lock assembly are possible, and those shown in the drawings are only examples.

FIGS. 154-156 show various views of a partial assembly 598 of a firearm strap assembly similar in some ways to firearm strap assembly 124. A first member (similar to first member 126 with a clip, backing, and slots to secure the strap 606) is not shown, for ease of viewing other elements, but would be present to form the full firearm strap assembly. A second member 600 is shown, having slots 602. One end of strap 606 is secured to one of the slots, such as by being looped through the slot and stitched to itself. The strap includes a first portion 608 and second portion 610 having corresponding hook members and loop members, respectively (or vice versa) to form a hook-and-loop fastening mechanism. The free end of the strap is accordingly looped through the free slot 602, doubled back upon itself, and secured to itself using the hook-and-loop members.

A through-hole 604 is present in second member 600 having the same functionality as through-hole 136 described above. When the strap is not secured to a rifle or firearm having a corresponding projection 144, however, the anti-slip members 612 are especially useful to keep the strap secured to the firearm. The anti-slip members may be formed of a flexible polymer that has high friction against many materials, such as a silicone that is laid down in the wavy configuration (or any other configuration) in a liquid state and then solidified or cured to stay adhered to the strap. The anti-slip members may keep the strap from moving relative to a shotgun, bow, crossbow, camera tripod, or some other firearm or other element when strapped thereto, even when the element does not have a projection such as projection 144.

Although only the top clip receiver of back plate 502 has corresponding features at the back side of the back plate for locking, such could be integrated into the bottom clip receiver as well. In some cases items that need more securing or support, such as meat, antlers, some other portion of a captured animal, or any other heavy or bulky item, may be secured to a back plate using a larger strap or other element which integrally includes two clips, one for securing to the top clip receiver and the other for the bottom clip receiver, so that both clip and clip receiver pairs support the heavy or bulky item.

Hunting and carrying devices, assemblies, systems, and related methods may include any combinations of the above-described elements. Any of the elements and components herein may be formed of any materials, including polymers, metals, ceramics, composites, and so forth. Some gun coupler implementations disclosed herein may be formed of KYDEX brand polymer. Some gun coupler implementations could also include their own dots or other indicators to be used as sights for aiming, either alone or in conjunction with sights integral to a gun.

In implementations the carrying assemblies disclosed herein could be integrally formed on/in a backpack, for example having a back plate sewn/stitched permanently to a backpack and/or having the straps and/or strap couplers sewn into/onto the backpack permanently with the back plate and/or straps removable.

The various devices and/or assemblies disclosed herein and their elements, sub-elements, sub-assemblies, and so forth may be formed from any materials that will feasibly allow, facilitate, and/or otherwise not hinder their respective functions as described herein. For example, any of the devices, elements, or sub-elements may, wherever possible, be formed of metals, polymers, composites, ceramic materials, fabrics, and so forth.

Furthermore, there are a variety of ways in which the various elements may be directly or indirectly coupled together. Notwithstanding the specific ways in which elements are depicted as being coupled together herein, these same elements could, wherever feasible, be joined together in any of the following ways: manually removably coupled together such as using a friction fit, hook and loop fasteners, snaps, buttons and corresponding holes/slits, zippers, a reusable adhesive, manually removable bolts and nuts or screws or other threaded fasteners, and any other type of manually removable coupling mechanism; or fixedly/permanently coupled together such as using a permanent adhesive, rivets, welding, melt joining or heat bonding, sewn elements, stitching, seams, and any other type of permanent coupling mechanism that is not manually removable. Manually removable, as defined herein, refers to the ability to remove a coupling using manual force either using hands alone or using non-powered hand tools.

The above-described elements may in implementations be configured or arranged in a variety of arrangements, each arrangement with its own advantages as will be understood by the practitioner of ordinary skill in the art, notwithstanding the specific example arrangements which are discussed above and representatively illustrated in the drawings.

Furthermore, while each individual above-described element may be configured as shown in the drawings and/or as discussed above, these are only representative examples and other configurations are possible for any individual element, with various advantages and tradeoffs as will be understood by the practitioner of ordinary skill in the art.

In places where the phrase "one of A and B" is used herein, including in the claims, wherein A and B are elements, the phrase shall have the meaning "A and/or B." This shall be extrapolated to as many elements as are recited in this manner, for example the phrase "one of A, B, and C" shall mean "A, B, and/or C," and so forth. To further clarify, the phrase "one of A, B, and C" would include implementations having: A only; B only; C only; A and B but not C; A and C but not B; B and C but not A; and A and B and C.

In places where the description above refers to specific implementations of hunting and carrying devices, assemblies, systems, and related methods, one or more or many modifications may be made without departing from the spirit and scope thereof. Details of any specific implementation/embodiment described herein may, wherever possible, be applied to any other specific implementation/embodiment described herein. The appended claims are to encompass within their scope all such changes and modifications as are within the true spirit and scope of this disclosure.

Furthermore, in the claims, if a specific number of an element is intended, such will be explicitly recited, and in the absence of such explicit recitation no such limitation exists. For example, the claims may include phrases such as "at least one" and "one or more" to introduce claim elements. The use of such phrases should not be construed to imply that the introduction of any other claim element by the indefinite article "a" or "an" limits that claim to only one such element, and the same holds true for the use in the claims of definite articles.

Additionally, in places where a claim below uses the term "first" as applied to an element, this does not imply that the claim requires a second (or more) of that element-if the claim does not explicitly recite a "second" of that element, the claim does not require a "second" of that element. Furthermore, in some cases a claim may recite a "second" or "third" or "fourth" (or so on) of an element, and this does not necessarily imply that the claim requires a first (or so on) of that element-if the claim does not explicitly recite a "first" (or so on) of that element (or an element with the same name, such as "a widget" and "a second widget"), then the claim does not require a "first" (or so on) of that element.

Method steps disclosed anywhere herein, including in the claims, may be performed in any feasible/possible order. Recitation of method steps in any given order in the claims or elsewhere does not imply that the steps must be performed in that order-such claims and descriptions are intended to cover the steps performed in any order except any orders which are technically impossible or not feasible. However, in some implementations method steps may be performed in the order(s) in which the steps are presented herein, including any order(s) presented in the claims.

What is claimed is:

1. A carrying assembly, comprising:

a back plate comprising:
one or more clip receivers, and;
a plurality of slots;

a plurality of straps, each strap configured to pass through one of the slots and configured to releasably secure the back plate to a backpack, wherein the one or more clip receivers are configured to receive a clip to releasably secure a firearm to the back plate; and a cradle assembly comprising a cradle and at least one cradle strap configured to releasably secure the cradle to the back plate or at least one of the plurality of straps, wherein the cradle is configured to receive a butt of a gun and is further configured to receive a bottom portion of a hunting bow;

wherein the cradle comprises an upper edge and a side flap which, when alternated from a first position to a second position, exposes a lower edge, and wherein the exposed lower edge is configured to allow the bottom portion of the hunting bow to partially extend out of a side of the cradle instead of only out of a top of the cradle, wherein the cradle assembly comprises one or more couplers configured to releasably secure the flap alternately between the first position and the second position.

2. A method of use of a carrying assembly, comprising:

providing a back plate comprising:
one or more clip receivers, and;
a plurality of slots;

securing a plurality of straps to the back plate by passing each strap through one of the slots;

using the straps, securing the back plate to a backpack;

securing a clip into one of the one or more clip receivers; and securing a firearm to the back plate using the clip.

3. The method of claim 2, further comprising coupling a cradle assembly with the back plate or at least one of the plurality of straps, the cradle assembly comprising a cradle, and inserting a butt of a gun or a bottom portion of a hunting bow into the cradle.

* * * * *